US007676044B2

(12) United States Patent
Sasaki et al.

(10) Patent No.: US 7,676,044 B2
(45) **Date of Patent: *Mar. 9, 2010**

(54) MULTI-SPEAKER AUDIO SYSTEM AND AUTOMATIC CONTROL METHOD

(75) Inventors: Toru Sasaki, Tokyo (JP); Tetsunori Itabashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 1488 days.

This patent is subject to a terminal disclaimer.

(21) Appl. No.: 11/009,955

(22) Filed: Dec. 10, 2004

(65) Prior Publication Data

US 2005/0152557 A1 Jul. 14, 2005

(30) Foreign Application Priority Data

Dec. 10, 2003 (JP) ..... 2003-411326
Oct. 4, 2004 (JP) ..... 2004-291000

(51) Int. Cl.
*H04R 29/00* (2006.01)
*H04R 5/02* (2006.01)

(52) U.S. Cl. ..... 381/59; 381/58; 381/303; 381/304

(58) Field of Classification Search ..... 381/58, 381/59, 56, 77, 84, 300, 303, 85, 304
See application file for complete search history.

(56) References Cited

U.S. PATENT DOCUMENTS

2005/0207598 A1 9/2005 Fuke
2005/0254662 A1 * 11/2005 Blank et al. ..... 381/58

* cited by examiner

*Primary Examiner*—Vivian Chin
*Assistant Examiner*—George C Monikang
(74) *Attorney, Agent, or Firm*—Wolf, Greenfield & Sacks, P.C.

(57) ABSTRACT

A sound produced at the location of a listener is captured by a microphone in each of a plurality of speaker devices. A sever apparatus receives an audio signal of the captured sound from all speaker devices, and calculates a distance difference between the distance of the location of the listener to the speaker device closest to the listener and the distance of the listener to each of the plurality of speaker devices. When one of the speaker devices emits a sound, the server apparatus receives an audio signal of the sound captured by and transmitted from each of the other speaker devices. The server apparatus calculates a speaker-to-speaker distance between the speaker device that has emitted the sound and each of the other speaker devices. The server apparatus calculates a layout configuration of the plurality of speaker devices based on the distance difference and the speaker-to-speaker distance.

89 Claims, 60 Drawing Sheets

FIG. 18

| | LISTENER L | SPEAKER DEVICE 1 | SPEAKER DEVICE 2 | ..... | SPEAKER DEVICE n |
|---|---|---|---|---|---|
| LISTENER L | | DL1 | DL2 | | DLn |
| SPEAKER DEVICE 1 | D1L | | D12 | | D1n |
| SPEAKER DEVICE 2 | D2L | D21 | | | D2n |
| ⋮ | | | | | |
| SPEAKER DEVICE n | DnL | Dn1 | Dn2 | | |

(Djk=Dkj)

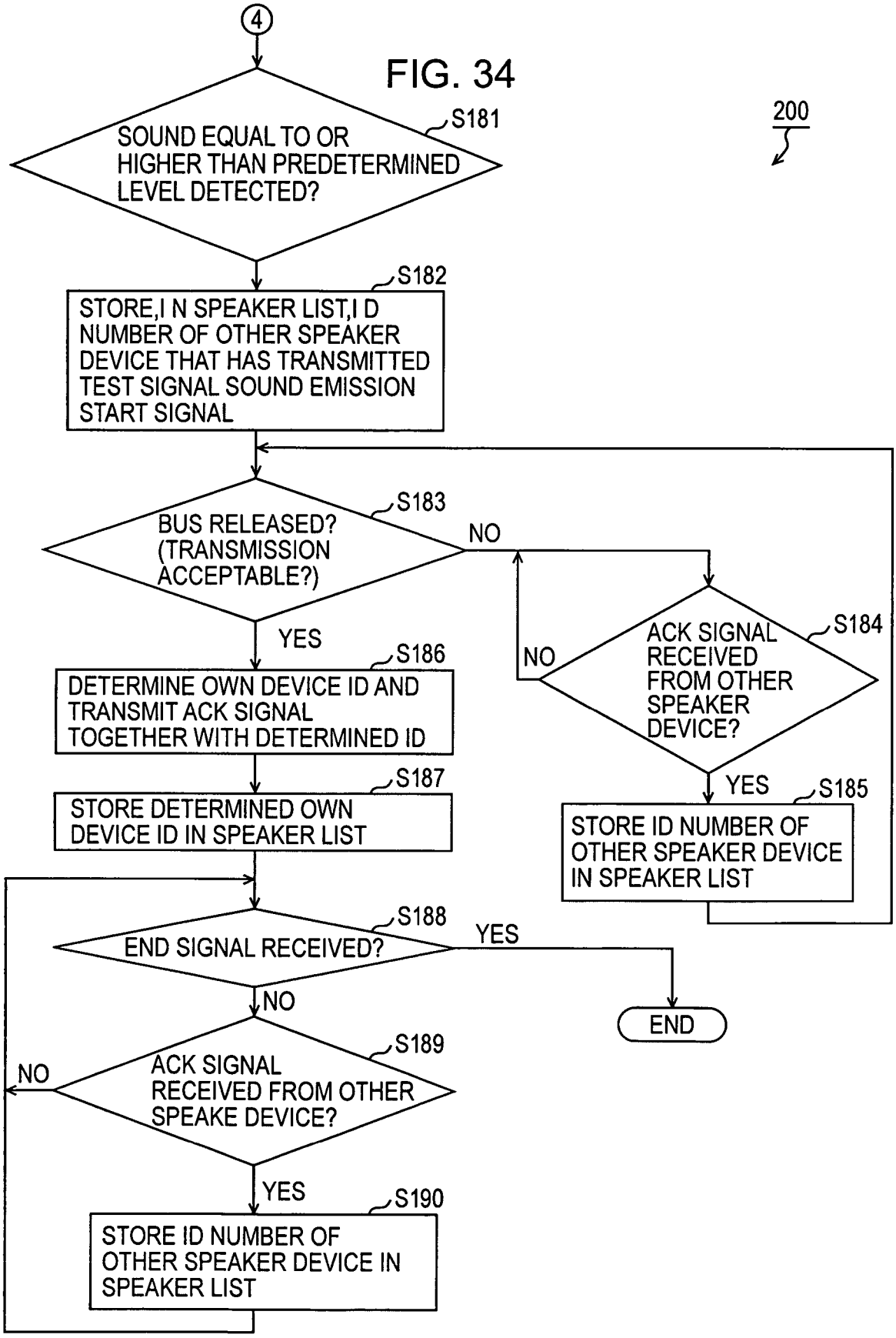
4
FIG. 34
200
S181
SOUND EQUAL TO OR HIGHER THAN PREDETERMINED LEVEL DETECTED?
S182
STORE,I N SPEAKER LIST,I D NUMBER OF OTHER SPEAKER DEVICE THAT HAS TRANSMITTED TEST SIGNAL SOUND EMISSION START SIGNAL
S183
BUS RELEASED? (TRANSMISSION ACCEPTABLE?)
NO
YES
S184
ACK SIGNAL RECEIVED FROM OTHER SPEAKER DEVICE?
NO
YES
S185
STORE ID NUMBER OF OTHER SPEAKER DEVICE IN SPEAKER LIST
S186
DETERMINE OWN DEVICE ID AND TRANSMIT ACK SIGNAL TOGETHER WITH DETERMINED ID
S187
STORE DETERMINED OWN DEVICE ID IN SPEAKER LIST
S188
END SIGNAL RECEIVED?
YES
END
NO
S189
ACK SIGNAL RECEIVED FROM OTHER SPEAKE DEVICE?
NO
YES
S190
STORE ID NUMBER OF OTHER SPEAKER DEVICE IN SPEAKER LIST FIG. 46A
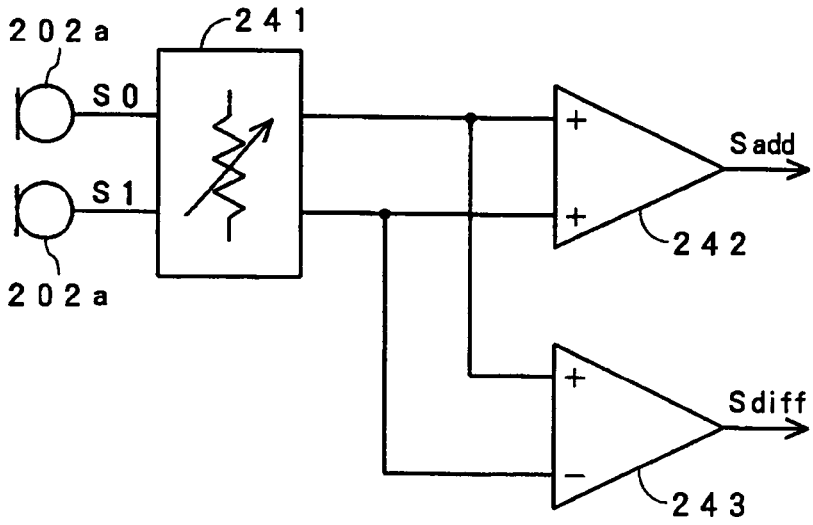
FIG. 46B
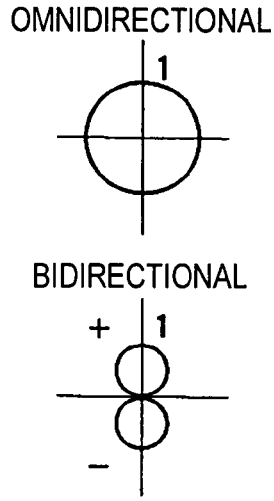
FIG. 46C
FIG. 47
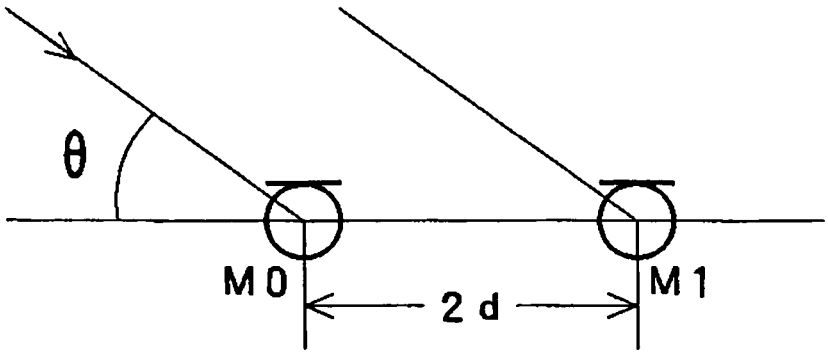

FIG. 48

$$S1 = S0 \cdot \varepsilon^{-jk2d\cos\theta} \quad \cdots \text{(Eq. 1)}$$

WAVE CONSTANT: $k=\omega/c$, $\omega$: ANGULAR FREQUENCY, c: SPEED OF SOUND $$Sdiff = S0 \cdot (1 - \varepsilon^{-jk2d\cos\theta}) \approx S0 \cdot jk2d\cos\theta \quad \cdots \text{(Eq. 2)}$$

$$Sadd = S0 \cdot (1 + \varepsilon^{-jk2d\cos\theta}) \approx 2S0 \quad \cdots \text{(Eq. 3)}$$

$$S(t) = \frac{S0(t) + S1(t)}{2} \quad \cdots \text{(Eq. 4)}$$

$$V(t) = \frac{-1}{\rho 2d} \int (S1(t) - S0(t)) \quad \cdots \text{(Eq. 5)}$$

$\rho$ : AIR DENSITY

FIG. 49

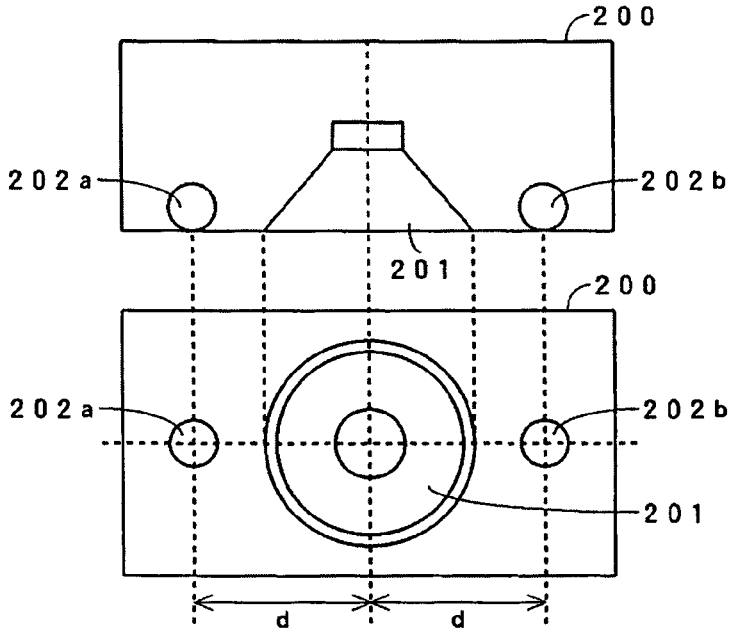

200A
202a
202b
201
200D
202a
202b
201
200B
201
202a
202b
200C
202b
202a
201

500

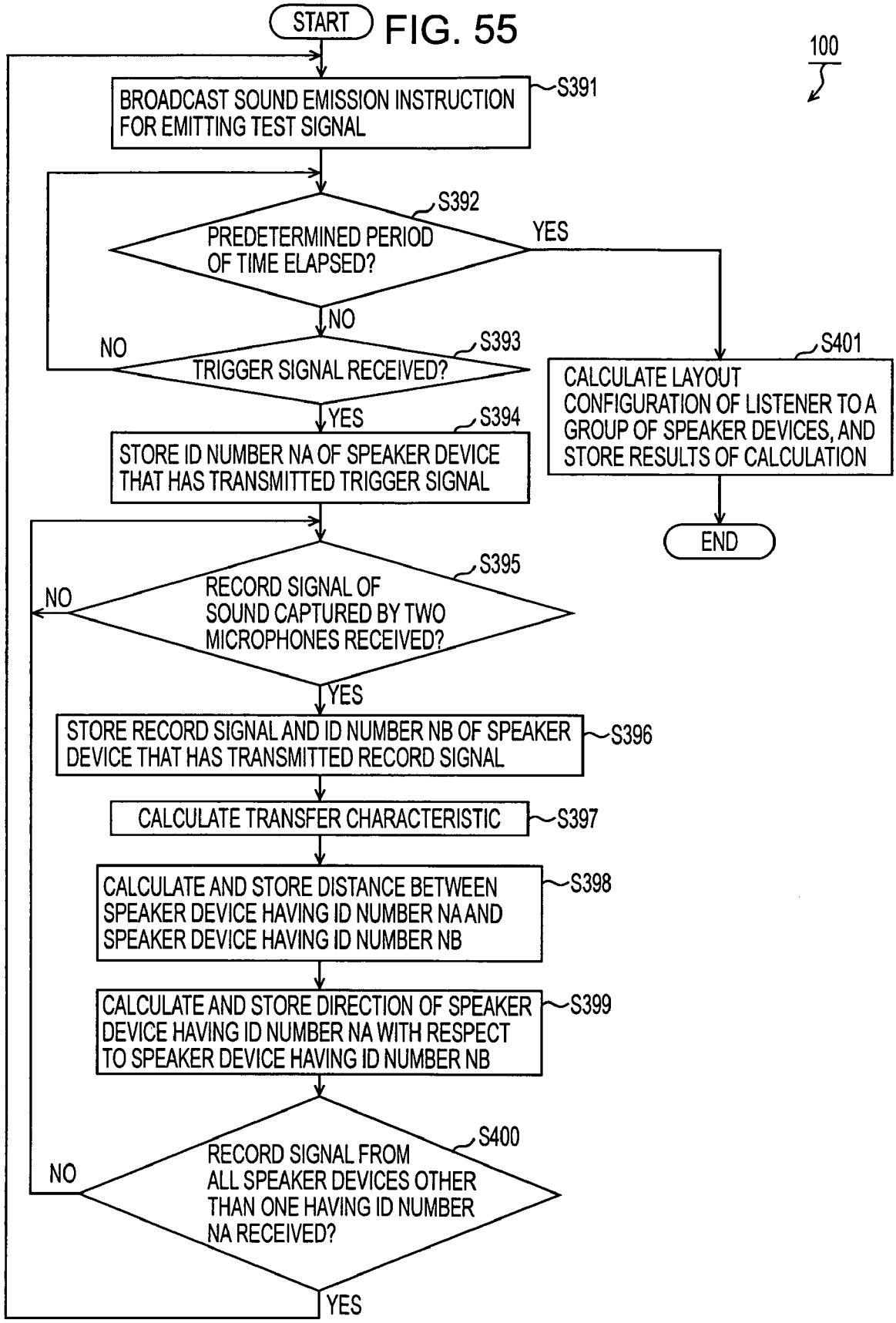
FIG. 55
100
START
BROADCAST SOUND EMISSION INSTRUCTION FOR EMITTING TEST SIGNAL
S391
PREDETERMINED PERIOD OF TIME ELAPSED?
S392
YES
NO
TRIGGER SIGNAL RECEIVED?
S393
NO
YES
CALCULATE LAYOUT CONFIGURATION OF LISTENER TO A GROUP OF SPEAKER DEVICES, AND STORE RESULTS OF CALCULATION
S401
END
STORE ID NUMBER NA OF SPEAKER DEVICE THAT HAS TRANSMITTED TRIGGER SIGNAL
S394
RECORD SIGNAL OF SOUND CAPTURED BY TWO MICROPHONES RECEIVED?
S395
NO
YES
STORE RECORD SIGNAL AND ID NUMBER NB OF SPEAKER DEVICE THAT HAS TRANSMITTED RECORD SIGNAL
S396
CALCULATE TRANSFER CHARACTERISTIC
S397
CALCULATE AND STORE DISTANCE BETWEEN SPEAKER DEVICE HAVING ID NUMBER NA AND SPEAKER DEVICE HAVING ID NUMBER NB
S398
CALCULATE AND STORE DIRECTION OF SPEAKER DEVICE HAVING ID NUMBER NA WITH RESPECT TO SPEAKER DEVICE HAVING ID NUMBER NB
S399
RECORD SIGNAL FROM ALL SPEAKER DEVICES OTHER THAN ONE HAVING ID NUMBER NA RECEIVED?
S400
NO
YES

FIG. 56

| | LISTENER L | SPEAKER DEVICE 1 | SPEAKER DEVICE 2 | ..... | SPEAKER DEVICE n |
|---|---|---|---|---|---|
| LISTENER L | | DL1, θL1 | DL2, θL2 | | DLn, θLn |
| SPEAKER DEVICE 1 | DL1, θL1 | | D12, θ12 | | D1n, θ1n |
| SPEAKER DEVICE 2 | DL2, θL2 | D21, θ21 | | | D2n, θ2n |
| ⋮ | | | | | |
| SPEAKER DEVICE n | DLn, θLn | D1n, θ1n | D2n, θ2n | | |

(Djk=Dkj)

FIG. 58A
FIG. 58B
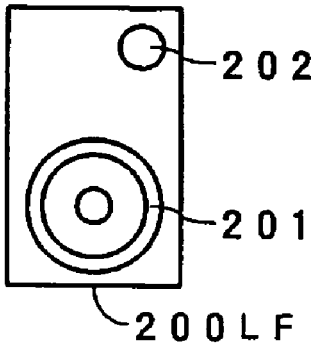
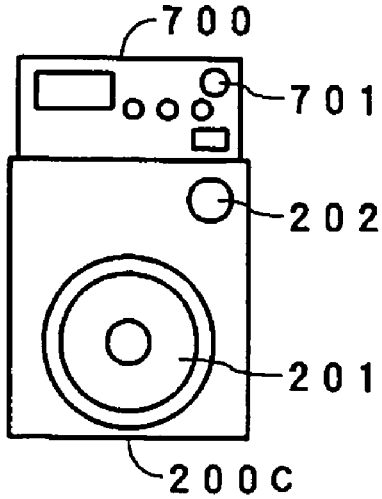
FIG. 58C
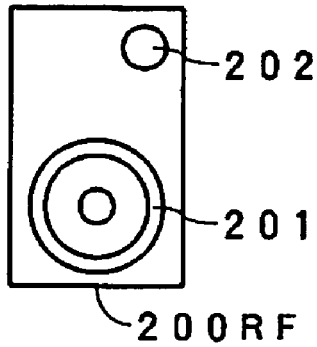
FIG. 58D
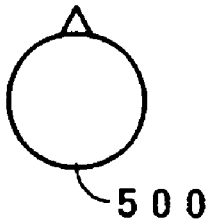
FIG. 58E
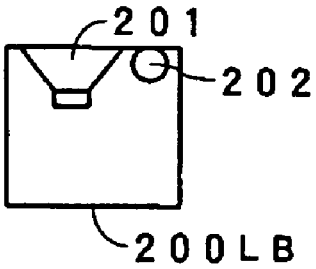
FIG. 58F
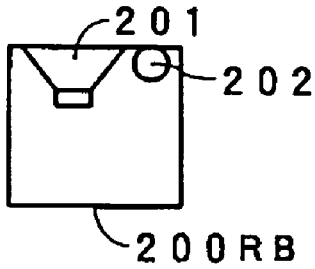

MULTI-SPEAKER AUDIO SYSTEM AND AUTOMATIC CONTROL METHOD

BACKGROUND OF THE INVENTION

1. Field of the Invention

The present invention relates to a server apparatus, a speaker device and a multi-speaker audio system. The present invention also relates to a layout configuration detection method of the speaker devices in the multi-speaker audio system.

2. Description of the Related Art

FIG. 61 shows a typical audio system in which a multi-channel acoustic field of a multi-channel signal such as 5.1-channel surround signal is produced using a plurality of speaker devices.

The audio system includes a multi-channel amplifier 1 and a plurality of speaker devices 2 of the number equal to the number of channels. The 5.1-channel surround signals include signals of a left (L) channel, a right (R) channel, a center channel, a left-surround (LS) channel, a right-surround (RS) channel, and a low-frequency effect (LFE) channel. If all channels are used for playing, six speakers are required. The six speakers are arranged with respect to the forward direction of a listener so that the sound images of sounds emitted from respective channels are localized at respective intended locations.

A multi-channel amplifier 1 includes a channel decoder 3, and a plurality of audio amplifiers 4 of the number equal to the number of channels. The output terminals of the audio amplifiers 4 are connected to respective output terminals (speaker connection terminals) 5 of the number equal to the number of channels.

The 5.1-channel surround signal input to the input terminal 6 is decomposed into the audio channel signals by the channel decoder 3. The audio channel signals from the channel decoder 3 are supplied to the speakers 2 via the audio amplifiers 4 and then the output terminals 5. Each channel sound is thus emitted from the respective speaker device 2. Volume control and audio effect process are not shown in FIG. 6.

To listen to a two-channel source in the 5.1-channel surround audio system of FIG. 61, only both a left channel and a right channel are used, with the remaining four channels unused.

To listen to a multi-channel source such as a 6.1-channel source or a 7.1-channel source, the system reduces the number of output channels to the 5.1-channel surround signal using a down-mix process. The number of speaker connection terminals is smaller than the number of channels, even if the channel decoder 3 has a capability to extract required audio signals from the multi channels. The down-mix process is performed to work as the 5.1-channel surround signal.

FIG. 62 illustrates a speaker device that is designed to be connected to a personal computer. The speaker device is commercially available in a pair of an L-channel module 7L and a R-channel module 7R.

As shown in FIG. 62, the L-channel module 7L includes a channel decoder 8, an audio amplifier 9L, an L-channel speaker 10L, and an input terminal 11 to be connected to a universal serial bus (USB) terminal of the personal computer. The R-channel module 7R includes an audio amplifier 9R that is connected to an R-channel audio signal output terminal of the channel decoder 8 in the L-channel module 7L via a connection cable 12, and an R-channel speaker 10R.

An audio signal in a format containing L/R channel signals is output from the USB terminal of the personal computer and then input to the channel decoder 8 in the L-channel module 7L via the input terminal 11. The channel decoder 8 outputs an L-channel audio signal and an R-channel audio signal in response to the input signal.

The L-channel audio signal from the channel decoder 8 is supplied to the L-channel speaker 10L via the audio amplifier 9L for playing. The R-channel audio signal from the channel decoder 8 is supplied to the audio amplifier 9R in the R-channel module 7R via the connection cable 12. The R-channel audio signal is then supplied to the R-channel speaker 10R via the audio amplifier 9R.

Japanese Unexamined Patent Application Publication No. 2002-199500 discloses a virtual sound image localization processor in a 5.1-channel surround audio system. The virtual sound image localization processor modifies a virtual sound image location to a modified sound image location when a user instructs the processor to modify a sound image. In other words, the disclosed audio system performs sound playing corresponding to a "multi-angle function" that is one of features of DVD video disks.

The multi-angle function allows a user to switch a camera angle to a maximum of nine angles up to the user's preference. Pictures of movie scene, sporting events, live events, etc. are taken at a plurality of camera angles and stored on a video disk, and the user is free to select any one of the cameral angles.

Each of the plurality of speaker devices is provided with a multi-channel audio signal that is appropriately channel synthesized. In response to an angle mode selected by a user, a channel synthesis ratio is updated and controlled so that each sound image is properly localized. In accordance with the disclosed technique, the user achieves sound playing at a sound image localized in accordance with the selected angle mode.

The audio system of FIG. 62 is an L/R two channel system. To work with a multi-channel source, a new audio system must be newly purchased.

In the known arts of FIGS. 61 and 62, the channel decoders 3 and 8 work with a fixed multi-channel input signal and fixed decomposed output channels as stated in the specifications thereof. This arrangement inconveniences the user, because the user can neither increase the number of speakers, nor rearrange the layout of the speaker device to any desired one.

In view of this point, the disclosed virtual sound image location process technique can provide an audio system that permits a desired sound image localization even when speakers of any number is arranged at any desired locations.

More specifically, the number of speakers is entered and the information of the speaker layout is entered in the audio system, and the layout configuration of the speakers of the audio system with respect to a listener is identified. If the speaker layout configuration is identified, a channel synthesis ratio of the audio signal to be supplied to each speaker is calculated. The audio system thus achieves a desired sound localization even if speakers of any number are arranged at any locations.

The disclosed technique is not limited to the channel synthesis of multi-channel audio signals. For example, the audio system generates signals to be supplied to a plurality of speakers more than the number of channels of a sound source, from the source sound, such as a monophonic audio signal or a sound source having a smaller number of channels, by setting a channel synthesis ratio. The audio system thus generates a pseudo-plural channel sound image.

If the number of speakers and the layout configuration of the speakers are identified in the audio system, a desired sound image is produced in the audio system by setting a channel coding radio and a channel decoding ratio in accordance with a speaker layout configuration.

However, it is difficult for a listener to enter accurate speaker layout information in the audio system. When the speaker layout is modified, new speaker layout information must be entered. This inconveniences the user. The speaker layout configuration is preferably entered in an automatic fashion.

SUMMARY OF THE INVENTION

Accordingly, the object of the present invention is to provide an audio system including a plurality of speaker devices for automatically detecting a layout configuration of a speaker device placed at any location.

The present invention in a first aspect relates to a method for detecting a speaker layout configuration in an audio system including a plurality of speaker devices and a server apparatus that generates, from an input audio signal, a speaker signal to be supplied to each of the plurality of speaker devices in accordance with locations of the plurality of speaker devices. The method includes a first step for capturing a sound emitted at a location of a listener with a pickup unit mounted in each of the plurality of speaker devices and transmitting an audio signal of the captured sound from each of the speaker devices to the server apparatus, a second step for analyzing the audio signal transmitted from each of the plurality of speaker devices in the first step and calculating a distance difference between a distance of the location of the listener to the speaker device closest to the listener and the distance of the location of the listener to each of the plurality of speaker devices, a third step for emitting a predetermined sound from one of the speaker devices in response to a command signal from the server apparatus, a fourth step for capturing the predetermined sound, emitted in the third step, with the pickup units of the speaker devices other than the speaker device that has emitted the predetermined sound and transmitting the audio signal of the sounds to the server apparatus, a fifth step for analyzing the audio signals transmitted in the fourth step from the speaker devices other than the speaker device that has emitted the predetermined sound and calculating a speaker-to-speaker distance between each of the speaker devices that have transmitted the audio signals and the speaker device that has emitted the predetermined sound, a sixth step for repeating the third step through the fifth step until all speaker-to-speaker distances of the plurality of speaker devices are obtained, and a seventh step for calculating the layout configuration of the plurality of speaker devices based on the distance difference of each of the plurality of speaker devices obtained in the second step, and the speaker-to-speaker distances of the plurality of speaker devices obtained in the fifth step.

In the audio system of the present invention, the pickup unit captures the sound generated at the location of the listener. The pickup units of the plurality of speaker devices capture the sound and supplies the audio signal of the sound to the server apparatus.

The server apparatus analyzes the audio signal received from the plurality of speaker devices, thereby calculating the distance difference between the distance of the location of the listener to the speaker device closest to the location of the listener and the distance of each of the plurality of speaker devices to the listener location.

The server apparatus transmits a command signal to each of the speaker devices on a device-by-device basis to emit a predetermined sound therefrom. In response, each speaker device emits the predetermined sound. The sound is captured by the speaker devices and the audio signal of the sound is transmitted to the server apparatus. The server apparatus calculates the speaker-to-speaker distance between the speaker device that has emitted the sound, and each of the other speaker devices. The server apparatus causes speaker devices to emit the predetermined sound until the speaker-to-speaker distance between any two speaker devices is determined, thereby calculating the speaker-to-speaker distances of all speaker devices.

The present invention in a second aspect relates to a method for detecting a speaker layout configuration in an audio system including a plurality of speaker devices and a system controller connected to the plurality of speaker devices, an input audio signal being supplied to each of the plurality of speaker devices via a common transmission line, and each of the plurality of speaker devices generating a speaker signal to emit a sound therefrom in response to the input audio signal. The method includes a first step for capturing a sound produced at a location of a listener with a pickup unit mounted in each of the plurality of speaker devices and transmitting an audio signal of the captured sound from each of the speaker devices to the system controller, a second step for analyzing the audio signal transmitted in the first step from each of the plurality of speaker devices with the system controller and calculating a distance difference between the distance of the location of the listener to the speaker device closest to the listener and the distance of the location of the listener to each of the plurality of speaker devices, a third step for emitting a predetermined sound from one of the speaker devices in response to a command signal from the system controller, a fourth step for capturing the predetermined sound, emitted in the third step, with the pickup units of the speaker devices other than the speaker device that has emitted the predetermined sound and transmitting the audio signal of the captured sounds to the system controller, a fifth step for analyzing the audio signals transmitted in the fourth step from the speaker devices other than the speaker device that has emitted the predetermined sound and calculating a speaker-to-speaker distance between each of the speaker devices that have transmitted the audio signals and the speaker device that has emitted the predetermined sound, a sixth step for repeating the third step through the fifth step until all speaker-to-speaker distances of the plurality of speaker devices are obtained, and a seventh step for calculating the layout configuration of the plurality of speaker devices based on the distance difference of each of the plurality of speaker devices obtained in the second step, and the speaker-to-speaker distances of the plurality of speaker devices obtained in the fifth step.

The plurality of speaker devices are supplied with a common audio input signal via the common transmission line rather than being supplied with respective speaker signals. In response to the audio input signal, each speaker device generates a speaker signal thereof using a speaker factor in a speaker factor memory thereof.

In the speaker layout configuration detection method of the audio system, the sound generated at the location of the listener, captured by the pickup units of the plurality of speaker devices, is transmitted to the system controller.

The system controller analyzes the audio signal received from the plurality of speaker devices, thereby calculating the location of the listener, and the distance difference between the distance of the location of the listener to the speaker device closest to the location of the listener and the distance of each of the plurality of speaker devices to the listener location.

The system controller transmits, to each of the speaker devices, a command signal to cause the speaker device to emit the predetermined sound. In response to the command signal, each speaker device emits the predetermined sound. The sound emitted is then captured by the other speaker devices and the audio signal of the sound is then transmitted to the system controller. The system controller calculates the distance between the speaker device that has emitted the sound and each of the other speaker devices. The system controller causes each of the speaker devices to emit the predetermined sound until at least any one speaker-to-speaker distance is determined. The speaker-to-speaker distances of the speaker devices are thus determined.

The system controller calculates the layout configuration of the plurality of speaker devices based on the distance difference and the speaker-to-speaker distance.

The present invention in a third aspect relates to a method for detecting a speaker layout configuration in an audio system including a plurality of speaker devices, an input audio signal being supplied to each of the plurality of speaker devices via a common transmission line, and each of the plurality of speaker devices generating a speaker signal to emit a sound therefrom in response to the input audio signal. The method includes a first step for supplying a first trigger signal from one of the speaker devices that has detected first a sound generated at a location of a listener to the other speaker devices via the common transmission line, a second step for recording, in response to the first trigger signal as a start point, the sound generated at the location of the listener and captured by a pickup unit of each of the plurality of speaker devices that have received the first trigger signal, a third step for analyzing the audio signal of the sound recorded in the second step, and calculating a distance difference between the distance of the location of the listener to the speaker device that has supplied the first trigger signal and is closest to the listener location and the distance between each of the speaker devices and the listener location, a fourth step for transmitting information of the distance difference calculated in the third step from each of the speaker devices to the other speaker devices via the common transmission line, a fifth step for transmitting a second trigger signal from one of the plurality of speaker devices to the other speaker devices via the common transmission line and for emitting a predetermined sound from the one of the plurality of speaker devices, a sixth step for recording, in response to the time of reception of the second trigger signal as a start point, the predetermined sound, emitted in the fifth step and captured by the pickup unit, with each of speaker devices other than the speaker device that has emitted the predetermined sound, a seventh step for analyzing the audio signal recorded in the sixth step with each of the speaker devices other than the speaker device that has emitted the predetermined sound, and calculating a speaker-to-speaker distance between the speaker device that has emitted the predetermined sound and each of the speaker devices that have transmitted the audio signal, an eighth step for repeating the fifth step through the seventh step until all speaker-to-speaker distances of the plurality of speaker devices are obtained, and a ninth step for calculating the layout configuration of the plurality of speaker devices based on the distance differences of the plurality of speaker devices obtained in the third step and the speaker-to-speaker distances of the plurality of speaker devices obtained in the repeatedly performed seventh steps.

Each of the plurality of speaker devices calculates the distance difference and the speaker-to-speaker distance, and mutually exchanges information of the distance difference and speaker-to-speaker distance with the other speaker devices.

Each of the plurality of speaker devices calculates the layout configuration of the plurality of speaker devices from the distance difference and the speaker-to-speaker distance.

In accordance with embodiments of the present invention, the layout configuration of the plurality of speaker devices is automatically calculated. Since the speaker signal is generated from the layout configuration, the listener can construct the audio system by simply placing speaker devices of any number.

Even if speaker devices are added or the layout of the speaker devices is modified, no troublesome setup is required.

BRIEF DESCRIPTION OF THE DRAWINGS

FIG. 18 is a table listing information concerning a determined layout of the speaker devices in accordance with the first embodiment of the present invention;

FIG. 34 is a flowchart illustrating the operation of the speaker device that performs the first process for assigning an ID number to each of the plurality of speaker devices connected to the bus in accordance with the third embodiment of the present invention;

FIGS. 46A-46C illustrate a method for producing a sum output and a difference output of two microphones, and directivity patterns thereof in accordance with the fourth embodiment of the present invention;

FIG. 47 illustrates the directivity of the sum output and the difference output of the two microphones in accordance with the fourth embodiment of the present invention;

FIG. 48 illustrates the directivity of the sum output and the difference output of the two microphones in accordance with the fourth embodiment of the present invention;

FIG. 49 illustrates another layout of microphones in the speaker device in accordance with the fourth embodiment of the present invention;

FIG. 55 illustrates a method for determining the distance between the speaker devices in accordance with the fourth embodiment of the present invention;

FIG. 56 is a table listing information of the determined layout of the speaker devices in accordance with the fourth embodiment of the present invention;

FIGS. 58A-58F illustrate an audio system in accordance with a seventh embodiment of the present invention;

FIGS. 60A-60G illustrate another audio system in accordance with the seventh embodiment of the present invention;

DESCRIPTION OF THE EMBODIMENTS

Figure 1:
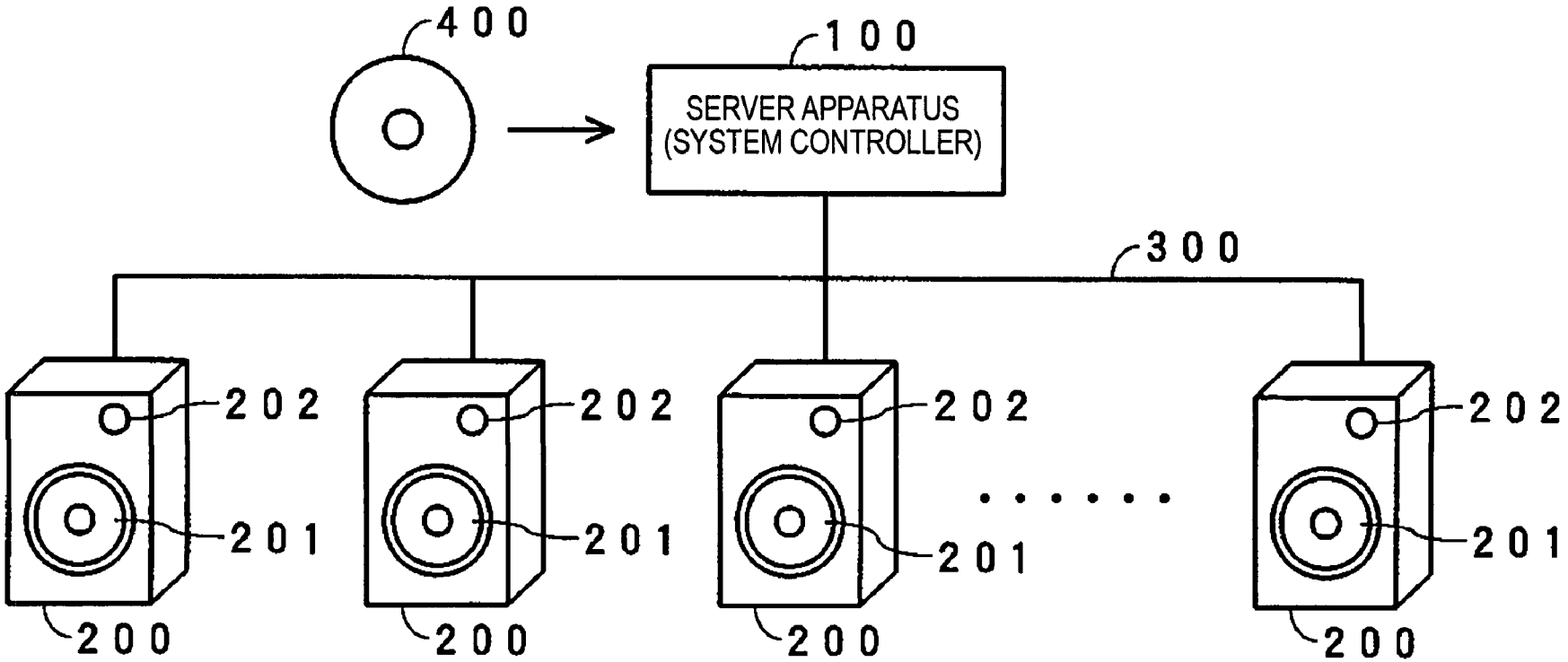
FIG. 1 is a configuration diagram illustrating a system configuration of an audio system of a first embodiment of the present invention.

The embodiments of the audio system of the present invention are described below with reference to the drawings. In each of the embodiments of the audio system, a sound source is a multi-channel audio signal. Even if signal specifications, such as the number of channels of multi-channel sound and music source, are changed, an appropriate sound playing and listening environment is provided in response to speaker devices connected to the system.

Although the audio system of the embodiments of the present invention works with a single channel source, namely, a monophonic source, the discussion that follows assumes a multi-channel source. A speaker signal is generated by channel coding multi-channel audio signals, and a speaker signal factor is a channel coding factor. If the number of channels of the sound source is small, a channel decoding rather than a channel coding is performed, and the speaker signal is a channel decoding factor.

The audio system of the embodiments permits any number of speaker devices arranged in any layout configuration. In accordance with the embodiments of the present invention, any number of speaker devices arranged in any layout configuration provides a listening environment that produces an appropriate sound image.

For example, six speaker devices are arranged in a layout configuration of an L-channel, an R-channel, a center channel, an LS channel, an RS channel, and an LFE-channel with respect to the location of a user as recommended in the 5.1-channel surround specification. The speaker devices thus arranged emit respective sounds of the audio signals of the L-channel, the R-channel, the center channel, the LS channel, the RS channel, and the LFE-channel.

In the audio system having an arbitrary number of speaker devices arranged in an arbitrary layout configuration, however, the sounds (hereinafter referred to as speaker signals) emitted from the speaker devices are produced so that the sound images corresponding to the L-channel, the R-channel, the center channel, the LS channel, the RS channel, and the LFE-channel are properly localized with reference to a listener.

In one method for producing a sound image by channel coding the multi-channel audio signals, a signal is assigned depending on the direction of two speaker devices wherein two speaker devices subtend an angle within which a position of localization of a channel signal is present. Depending on the layout of the speaker devices, a delayed channel signal may be supplied to adjacent speaker devices to provide the sense of sound localization in the direction of depth.

Using the previously discussed virtual sound image localization technique, a sound image may be localized in a direction in which the localization of the channel signal is desired. In that case, the number of speakers per channel is any number equal to or larger than two. To widen appropriate listening range, speakers as many as possible are used, and sound image and acoustic field control is performed using multiple-input/output inverse-filtering theorem (MINT).

The above-mentioned method is used in the embodiments. The speaker signal is thus produced by channel coding the multi-channel audio signals.

In the 5.1-channel surround signals, the L-channel signal, the R-channel signal, the center channel signal, the LS channel signal, the RS channel signal, and the LFE-channel signal are referred to as SL, SR, SC, SLS, SRS, and SLE, respectively, and channel synthesis factors of the L-channel signal, the R-channel signal, the center channel signal, the LS channel signal, the RS channel signal, and the LFE-channel signal are referred to as wL, wR, wC, wLS, wRS, and wLEF, respectively. A speaker signal SPi of a speaker having an identification (ID) number "i" at any given position is represented as follows:

$$SPi=wLi\cdot SL+wRi\cdot SR+wCi\cdot SC+wLSi\cdot SLS+wRSi\cdot SRS+wLFEi\cdot SLFE$$

where wLi, wRi, wCi, wLSi, wRSi, and wLEFi represent channel synthesis factors of the speaker having the ID number i.

The channel synthesis factor typically accounts for delay time and frequency characteristics. For simplicity of explanation, the channel synthesis factor is simply regarded as weighting coefficients, and falls within a range as follows:

$$0 \leqq wI, wR, wC, wLS, wRS, wLEF \leqq 1$$

The audio system includes a plurality of loudspeaker devices and a server apparatus for supplying the plurality of speaker devices with an audio signal from a music and sound source. The speaker signal may be generated by the server apparatus or each of the speaker devices.

When the server apparatus generates the speaker signal, the server apparatus holds channel synthesis factors of all speaker devices forming the audio system. Using the held channel synthesis factors, the server apparatus performs a system control function, thereby generating all channel synthesis factors through channel coding.

As will be discussed later, the server apparatus communicates with all speaker devices through the system control function thereof, thereby performing a verification and correction process on the channel synthesis factors of all speaker devices.

When each speaker generates the speaker signal, the speaker holds the channel synthesis factor thereof, while the server apparatus supplies each speaker with the multi-channel audio signal of all channels. Each speaker channel codes the received multi-channel audio signal into the speaker signal thereof using the channel synthesis factor thereof.

Each speaker performs the verification and correction process on the channel synthesis factor thereof by communicating with each of the other speakers.

The audio systems of the embodiments of the present invention permits any number of speakers to be arranged in any layout configuration. The audio system automatically detects and recognizes the number of speakers, identification information of each speaker, and layout information of the plurality of speaker devices, and performs setting in accordance with the detected result. The exemplary embodiments are described below.

First Embodiment

FIG. 1 is a system configuration of an audio system in accordance with a first embodiment of the present invention. The audio system of the first embodiment includes a server apparatus 100, a plurality of speaker devices 200 connected thereto via a common transmission line, such as a serial bus 300. In the discussion that follows, an identification (ID) number is used to identify each speaker device.

The bus 300 can be one of a universal serial bus (USB) connection, an IEEE (Institute Electrical and Electronics Engineers) 1394 Standard connection, an MID (musical instrument digital interface) connection, or equivalent connection.

The server apparatus 100 replays, from the 5.1-channel surround signals recorded in the disk 400, the multi-channel audio signals of the L-channel, the R-channel, the center channel, the LS channel, the RS channel, and the LFE-channel are properly localized with reference to a listener.

The server apparatus 100 of the first embodiment having a system control function unit generates speaker signals to be supplied to the speaker devices 200 from the multi-channel audio signals, and supplies the speaker devices 200 with the speaker signals via the bus 300, respectively.

Separate lines can be used to supply the speaker devices 200 with the speaker signals from the server apparatus 100. In the first embodiment, the bus 300 as a common transmission line is used to transmit the speaker signals to the plurality of speaker devices 200.

Figure 2A:
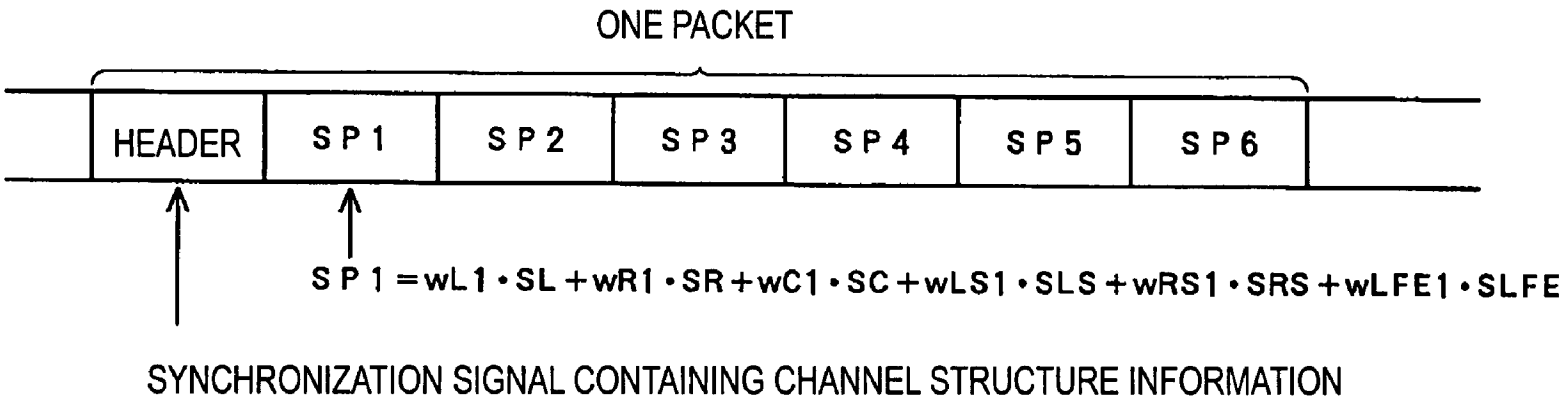
FIGS. 2A and 2B illustrate signals supplied from a server apparatus to each of speaker devices in accordance with the first embodiment of the present invention.

FIG. 2A illustrates a format of each of the speaker signals to be transmitted to the plurality of speaker devices 200 from the server apparatus 100.

The audio signal supplied to the speaker devices 200 from the server apparatus 100 is a packetized digital audio signal. One packet includes audio data for the speaker devices of the number connected to the bus 300. As shown in FIG. 2A, six speaker devices 200 are connected to the bus 300. SP1-SP6 represent speaker signals of respective speaker devices. All speaker signals of the plurality of speaker devices 200 connected to the bus 300 are contained in the single packet.

The audio data SP1 is a speaker signal of the speaker device having an ID number 1, the audio data SP2 is a speaker signal of the speaker device having an ID number 2, . . . , and audio data SP6 is a speaker signal of the speaker device having an ID number 6. The audio data SP1-SP6 is generated by channel coding the multi-channel audio signals, each lasting a predetermined unit time. The audio data SP1-SP6 is compressed data. If the bus 300 has a high-speed data rate, there is no need for compressing the audio data SP1-SP6. The use of a high-speed data is sufficient.

The packet has on the leading portion thereof a packet header containing a synchronization signal and channel structure information. The synchronization signal is used to synchronize timing of the sound emission of the speaker devices 200. The channel structure information contains information concerning the number of speaker signals contained in one packet.

Each of the speaker devices 200 recognizes audio data (speaker signal) thereof by counting the order of the audio data starting from the header. The speaker device 200 extracts the audio data thereof from the packet data transmitted via the bus 300, and buffers the audio data thereof in a random-access memory (RAM) thereof.

Each speaker device 200 reads the speaker signal thereof from the RAM at the same timing as the synchronization signal of the packet header, and emits a sound from a speaker 201. The plurality of speaker devices 200 connected to the bus 300 emit the sound at the same timing of the synchronization signal.

If the number of speaker devices 200 connected to the bus 300 changes, the number of speaker signals contained in one packet changes accordingly. Each speaker signal may be constant or variable in length. In the case of a variable speaker signal, the number of bytes of speaker signal is written in the heater.

Figure 2B:
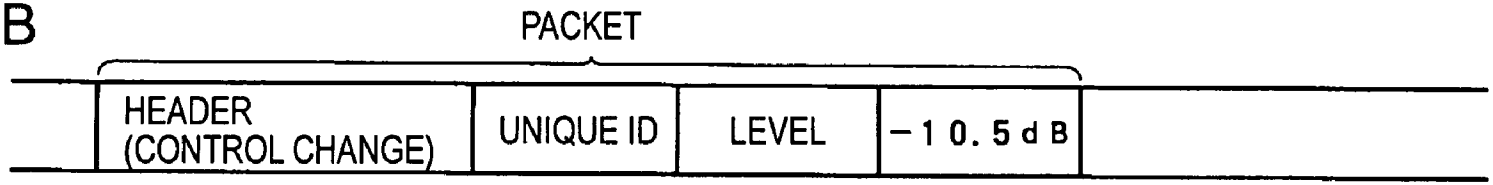

The header of the packet may contain control change information. As shown in FIG. 2B, for example, if the statement of a control change is contained in the packet header, control is performed to a speaker device having an ID number represented by "unique ID" information that follows the header. As shown in FIG. 2B, the server apparatus 100 issues a control command to that speaker device 200 identified by the unique ID to set a sound emission level (volume) of "−10.5 dB". A plurality of pieces of control information can be contained in one packet. The control change can cause all speaker devices 200 to be muted.

As already discussed, the server apparatus 100 having the system control function unit generates the speaker signals to be supplied to the plurality of speaker devices 200 respectively, through the previously discussed channel coding process.

The server apparatus 100 detects the number of speaker devices 200 connected to the bus 300, and assigns an ID number to each speaker device 200 so that each speaker device 200 is identified in the system.

The server apparatus 100 detects the layout configuration of the plurality of speaker devices 200 arranged and connected to the bus 300 using a technique to be discussed later. Also using the technique, the forward direction of a listener is set as a reference direction in the detected layout configuration of the plurality of speaker devices 200. Based on the speaker layout configuration with respect to the detected forward direction of the listener as the reference direction, the server apparatus 100 calculates the channel synthesis factor of each speaker device 200 to produce the speaker signal of that speaker device 200 and stores the calculated channel synthesis factor.

As will be discussed later, the system control function unit of the server apparatus 100 verifies that the stored channel synthesis factor is optimum for each speaker device 200 in view of the actual layout configuration, and performs a correction process on the channel synthesis factor on a per speaker device basis as necessary.

The speaker device 200 includes a microphone 202 and a signal processor (not shown in FIG. 1) in addition to the speaker 201. The microphone 202 captures a sound emitted by own speaker device 200, a sound produced by the listener, and a sound emitted by another speaker device 200. The sound captured by the microphone 202 is converted into an electrical audio signal. Hereinafter the electrical audio signal is simply referred to as an audio signal captured by the microphone 202. The audio system uses an audio signal in the detection process of the number of speaker devices 200, an ID number assignment process for each speaker device 200, a layout configuration detection process of the plurality of speaker devices 200, a detection process of the forward direction of the listener, and a sound image localization verification and correction process.

Figure 3:
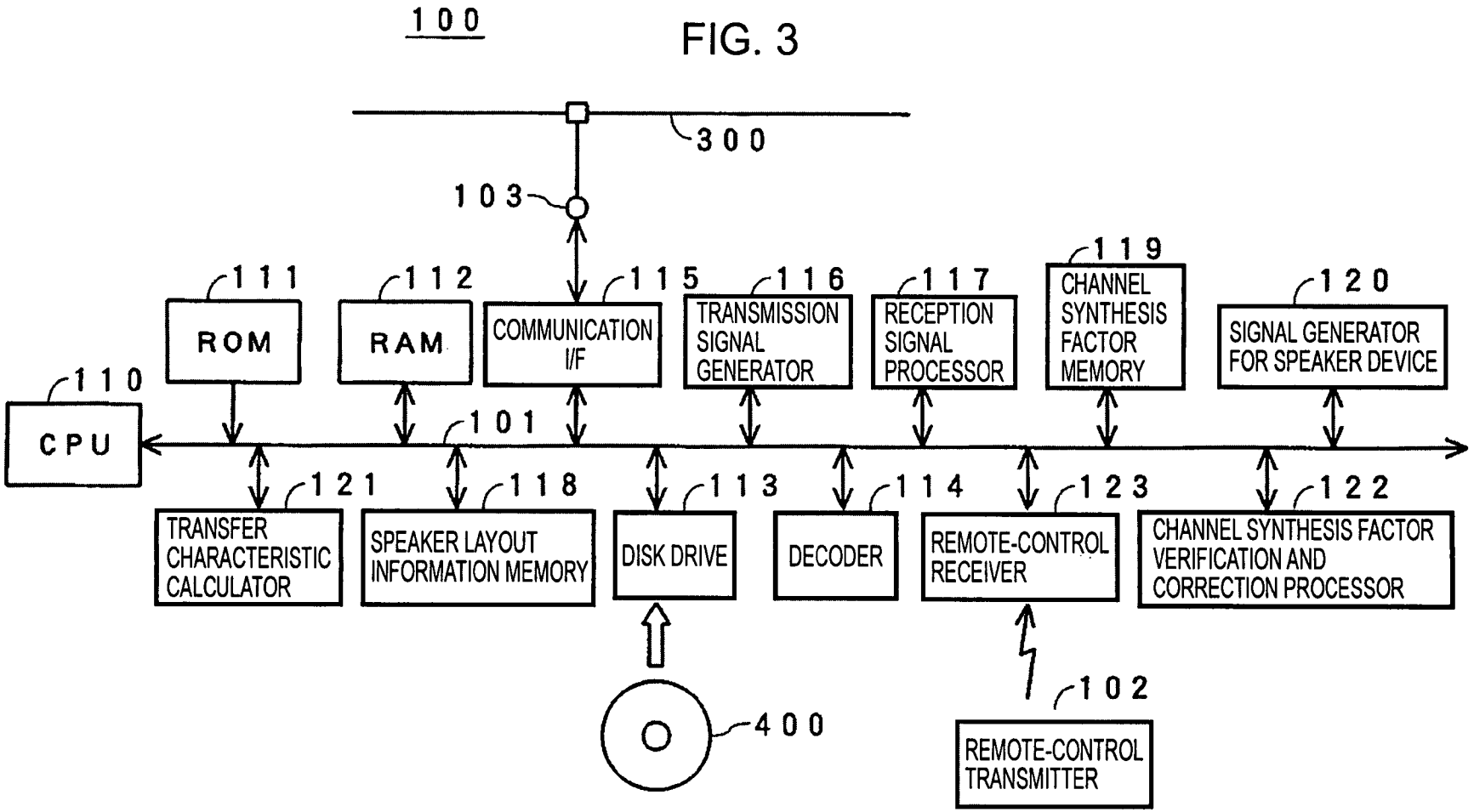
FIG. 3 is a block diagram illustrating the hardware structure of the server apparatus in accordance with the first embodiment of the present invention.

FIG. 3 illustrates the hardware structure of the server apparatus 100 in accordance with the first embodiment of the present invention. The server apparatus 100 includes a microcomputer.

The server apparatus 100 includes a central processing unit (CPU) 110, a read-only memory (ROM) 111, a random-access memory (RAM) 112, a disk drive 113, a decoder 114, a communication interface (I/F) 115, a transmission signal generator 116, a reception signal processor 117, a speaker layout information memory 118, a channel synthesis factor memory 119, a speaker signal generator 120, a transfer characteristic calculator 121, a channel synthesis factor verification and correction processor 122, and a remote-control receiver 123, all connected to each other via a system bus 101.

The ROM 111 stores programs for the detection process of the number of speaker devices 200, the ID number assignment process for each speaker device 200, the layout configuration detection process of the plurality of speaker devices 200, the detection process of the forward direction of the listener, and the sound image localization verification and correction process. The CPU 110 executes the processes using the RAM 112 as a work area.

The disk drive 113 reads audio information recorded on the disk 400, and transfers the audio information to the decoder 114. The decoder 114 decodes the read audio information, thereby generating a multi-channel audio signal such as the 5.1-channel surround signal.

The communication I/F 115, connected to the bus 300 via a connector terminal 103, communicates with each speaker device 200 via the bus 300.

The transmission signal generator 116, including a transmission buffer, generates a signal to be transmitted to the speaker device 200 via the communication interface 115 and the bus 300. As already discussed, the transmission signal is a packetized digital signal. The transmission signal may contain not only the speaker signal but also a command signal to the speaker device 200.

The reception signal processor 117, including a reception buffer, receives packetized data from the speaker device 200 via the communication I/F 115. The reception signal processor 117 decomposes the received packetized data into packets, and transfers the packets to the transfer characteristic calculator 121 in response to a command from the CPU 110.

The speaker layout information memory 118 stores the ID number assigned to each speaker device 200 connected to the bus 300 while also storing speaker layout information, obtained in the detection process of the speaker layout configuration with the assigned ID number associated therewith.

The channel synthesis factor memory 119 stores the channel synthesis factor, generated from the speaker layout information, with the respective ID number associated therewith. The channel synthesis factor is used to generate the speaker signal of each speaker device 200.

The speaker signal generator 120 generates the speaker signal SP1 for each speaker from the multi-channel audio signal, decoded by the decoder 114, in accordance with the channel synthesis factor of each speaker device 200 in the channel synthesis factor memory 119.

The transfer characteristic calculator 121 calculates transfer characteristic of the audio signal captured by and received from the microphone of the speaker device 200. The calculation result of the transfer characteristic calculator 121 is used in the detection process of the speaker layout, and the verification and correction process of the channel synthesis factor.

The channel synthesis factor verification and correction processor 122 performs the channel synthesis factor verification and correction process.

The remote-control receiver 123 receives an infrared remote control signal, for example, from a remote-control transmitter 102. The remote-control transmitter 102 issues a play command of the disk 400. In addition, the remote-control transmitter 102 is used for the listener to indicate the listener's forward direction.

The process program of the decoder 114, the speaker signal generator 120, the transfer characteristic calculator 121 and the channel synthesis factor verification and correction processor 122 is stored in the ROM 111. By allowing the CPU 110 to execute the process program, the functions of these elements are thus performed in software.

Figure 4:
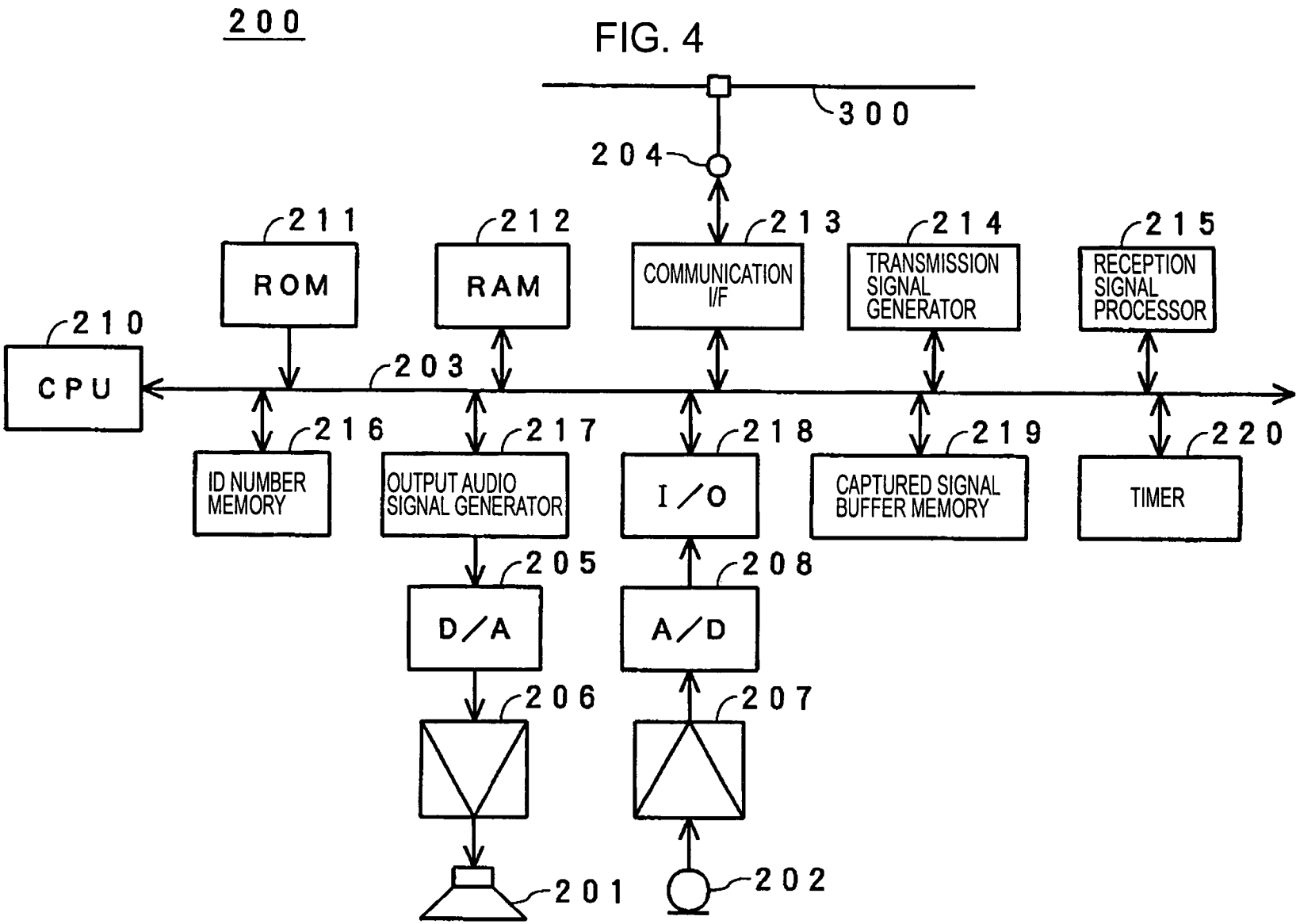
FIG. 4 is a block diagram illustrating the hardware structure of the server apparatus in accordance with the first embodiment of the present invention.

FIG. 4 illustrates the hardware structure of the speaker device 200 of the first embodiment. The speaker device 200 includes an information processor having a microcomputer therewithin.

The speaker device 200 includes a CPU 210, an ROM 211, an RAM 212, a communication I/F 213, a transmission signal generator 214, a reception signal processor 215, an ID number memory 216, an output audio signal generator 217, an I/O port 218, a captured signal buffer memory 219, and a timer 220, all connected to each other via a system bus 203.

The ROM 211 stores programs for the detection process of the number of speaker devices 200, the ID number assignment process for each speaker device 200, the layout configuration detection process of the plurality of speaker devices 200, the detection process of the forward direction of the listener, and the sound image localization verification and correction process. The CPU 1 performs the processes using the RAM 212 as a work area.

The communication I/F 213, connected to the bus 300 via a connector terminal 204, communicates with the server apparatus 100 and the other speaker devices via the bus 300.

The transmission signal generator 214, including a transmission buffer, transmits a signal to the server apparatus 100 and the other speaker devices via the communication I/F 213 and the bus 300. As already discussed, the transmission signal is a packetized digital signal. The transmission signal contains a response signal (hereinafter referred to as an ACK signal) in response to an enquiry signal from the server apparatus 100, and a digital signal of the audio sound captured by the microphone 202.

The reception signal processor 215, including a reception buffer, receives packetized data from the server apparatus 100 and the other speaker devices via the communication I/F 213. The reception signal processor 215 decomposes the received packetized data into packets, and transfers the received data to the ID number memory 216 and the output audio signal generator 217 in response to a command from the CPU 210.

The ID number memory 216 stores the ID number transmitted from the server apparatus 100 as an ID number thereof.

The output audio signal generator 217 extracts a speaker signal SPi of own device from the packetized data received by the reception signal processor 215, generates a continuous audio signal (digital signal) for a speaker 201 from the extracted speaker signal SPi, and stores the continuous audio signal in an output buffer memory thereof. The audio signal is read from the output buffer memory in synchronization with the synchronization signal contained in the header of the packetized data and output to the speaker 201.

If the speaker signal transmitted in packet is compressed, the output audio signal generator 217 decodes (decompresses) the compressed data, and outputs the decoded audio signal via the output buffer memory in synchronization with the synchronization signal.

If the bus 300 works at a high-speed data rate, the data is time-compressed with a transfer clock frequency set to be higher than a sampling clock frequency of the audio data, instead of being data compressed, before transmission. In such a case, the output audio signal generator 217 sets the data rate of the received audio stat back to the original data rate in a time-decompression process.

The digital audio signal output from the output audio signal generator 217 is converted to an analog audio signal by a digital-to-analog (D/A) converter 205, before being supplied to the speaker 201 via an output amplifier 206. A sound is thus emitted from the speaker 201.

The I/O port 218 captures the audio signal captured by the microphone 202. The audio signal, captured by the microphone 202, is supplied to an A/D converter 208 via an amplifier 207 for analog-to-digital conversion. The digital signal is then transferred to the system bus 203 via the I/O port 218 and then stored in the captured signal buffer memory 219.

The captured signal buffer memory 219 is a ring buffer memory having a predetermined memory capacity.

The timer 220 is used to measure time in the variety of above-referenced processes.

The amplifications of the output amplifier 206 and the amplifier 207 can be modified in response to a command from the CPU 210.

The detection process of the number of speaker devices 200, the ID number assignment process for each speaker device 200, the layout configuration detection process of the plurality of speaker devices 200, the detection process of the forward direction of the listener, and the sound image localization verification and correction process are described below.

A user can set and register the number of the speaker devices 200 connected to the bus 300 and the ID numbers of the speaker devices 200 connected to the bus 300 not only in the server apparatus 100 but also in each speaker device 200. In the first embodiment, the process of detecting the number of the speaker devices 200 and assigning the ID number to each speaker device 200 is automatically performed with the server apparatus 100 and each speaker device 200 functioning in cooperation as discussed below.

The ID number can be set in each speaker device 200 using a method conforming to the general purpose interface bus (GPIB) standard or the small computer system interface (SCSI) standard. For example, a bit switch is mounted on each speaker device 200 and the user sets the bit switches so that no ID numbers are unduplicated among the speaker devices 200.

Figure 5:
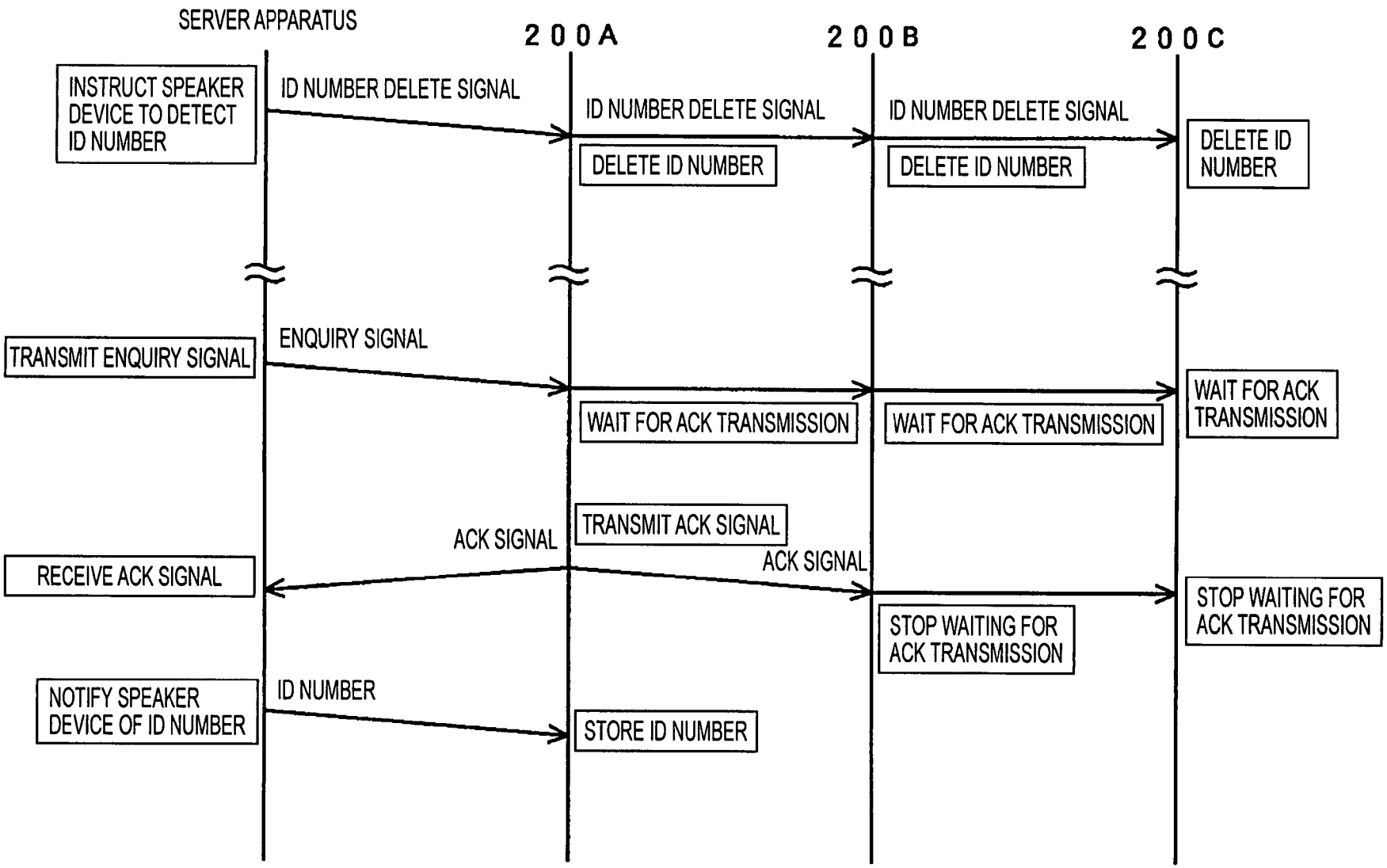
FIG. 5 is a sequence chart of a first sequence of an operation of assigning an identification (ID) number to each of the plurality of speaker devices connected to a bus in accordance with the first embodiment of the present invention.
Figure 6:
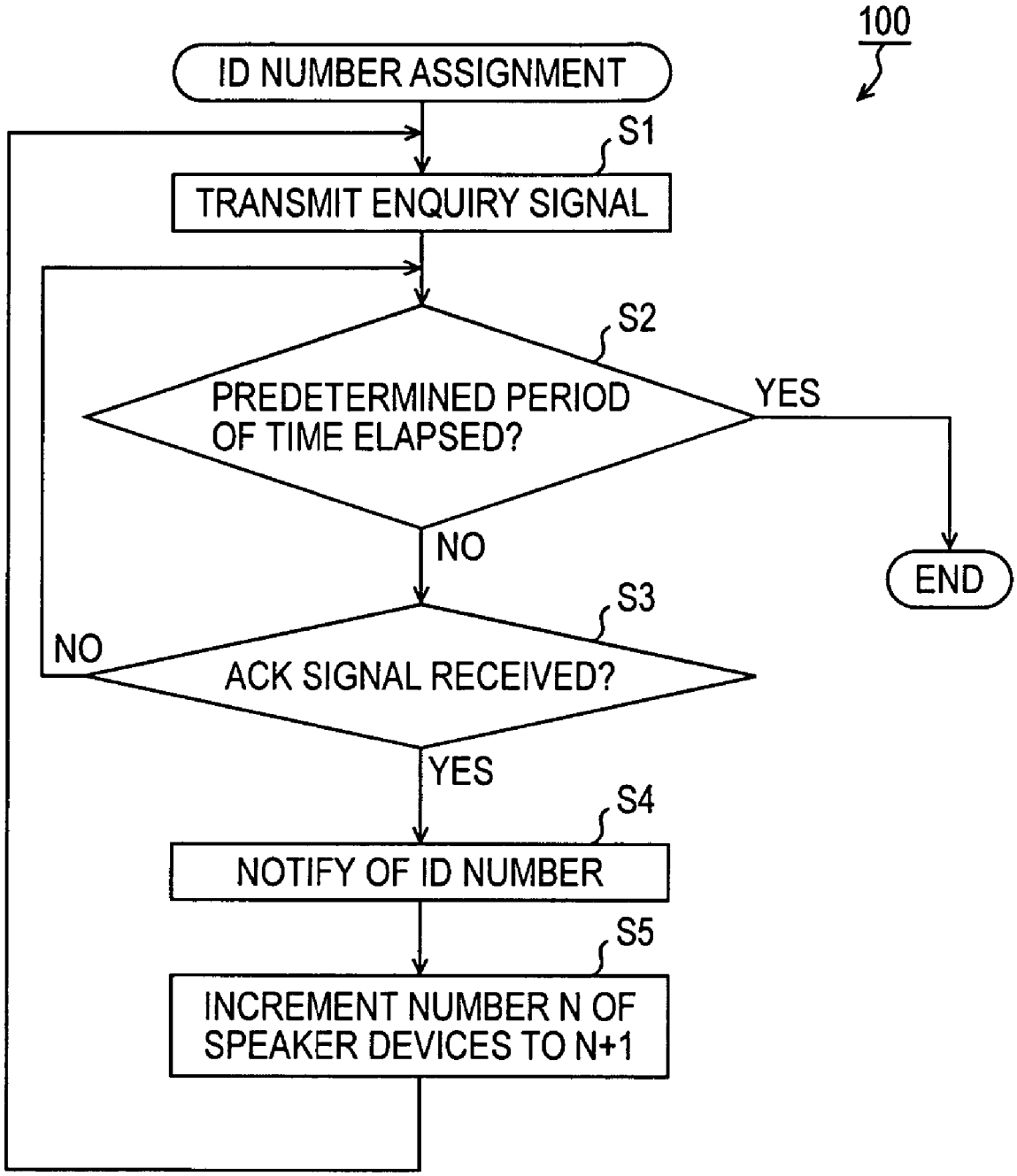
FIG. 6 is a flowchart illustrating the operation of the server apparatus that assigns the ID number to each of the plurality of speaker devices connected to the bus in accordance with the first embodiment of the present invention.
Figure 7:
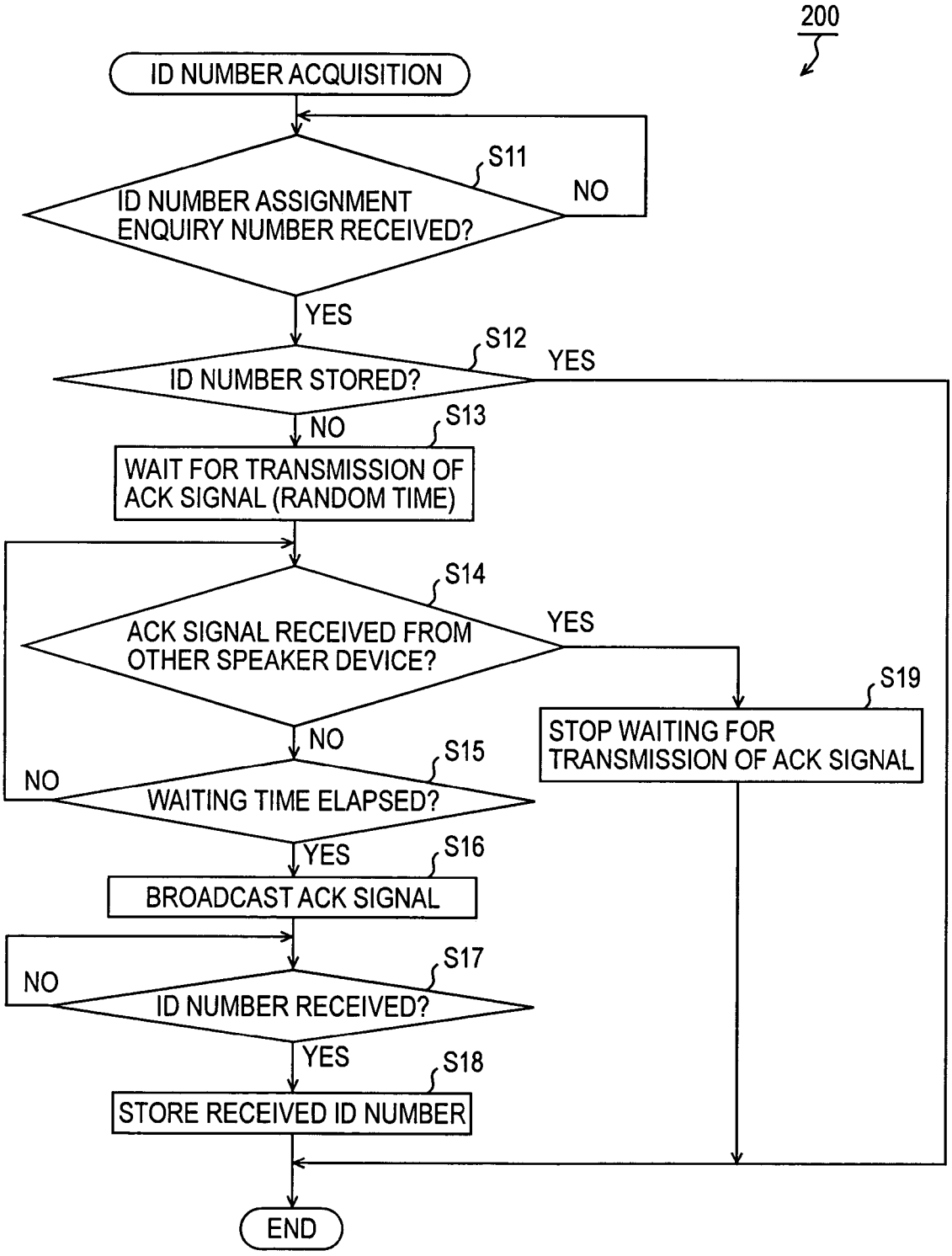
FIG. 7 is a flowchart illustrating the operation of the server apparatus that assigns the ID number to each of the plurality of speaker devices connected to the bus in accordance with the first embodiment of the present invention.

FIG. 5 illustrates a first sequence of a process for detecting the number of the speaker devices 200 connected to the bus 300 and for assigning the ID number to each speaker device 200. FIG. 6 is a flowchart of the process mainly performed by the CPU 110 in the server apparatus 100. FIG. 7 is a flowchart of the process mainly performed by the CPU 210 in the speaker device 200.

In the following discussion, audio signals are transmitted via the bus 300 to all speaker devices 200 connected to the bus 300 without specifying any particular destination in a broadcasting method, and audio signals are transmitted via the bus 300 to particularly specified speaker devices 200 in a unicasting method.

As shown in a sequence chart of FIG. 5, the server apparatus 100 broadcasts an ID number delete signal to all speaker devices 200 connected to the bus 300, prior to the start of the process, based on the ID number delete command operation issued by the user through the remote-control transmitter 102, or when an addition or reduction in the number of speaker devices 200 is detected. Upon receiving the ID number delete signal, each speaker device 200 deletes the ID number stored in the ID number memory 216.

The server apparatus 100 waits until all speaker devices 200 completes the delete process of the ID number. The CPU 110 then initiates a process routine described in the flowchart of FIG. 6 to assign the ID number. The CPU 110 in the server apparatus 100 broadcasts an enquiry signal for ID number assignment to all speaker devices 200 via the bus 300 in step S1 of FIG. 6.

The CPU 110 determines in step S2 whether a predetermined period of time, within which an ACK signal is expected to be received from a predetermined speaker device 200, has elapsed. If it is determined that the predetermined period of time has not yet elapsed, the CPU 110 waits for the arrival of the ACK signal from any of the speaker devices 200 step S3.

In step S11 of FIG. 7, the CPU 210 in each speaker device 200 monitors the arrival of the ID number assignment enquiry signal subsequent to the deletion of the ID number. After acknowledging the arrival of the ID number assignment enquiry signal, the CPU 210 determines in step S12 of FIG. 7 whether the ID number is stored in the ID number memory 216. If the CPU 210 determines that the ID number is stored in the ID number memory 216, in other words, the ID number is assigned, the CPU 210 ends the process routine of FIG. 7 without transmitting the ACK signal.

If the CPU 210 in each speaker device 200 determines in step S12 that the ID number is not stored, the CPU 210 sets the timer 220 so that the transmission of the ACK signal is performed after a predetermined period of time later. The CPU 210 then waits on standby (step S13). The predetermined period of time set in the timer 220 for waiting on standby for the transmission of the ACK signal is not constant but random from speaker to speaker.

The CPU 210 in each speaker device 200 determines in step S14 whether the ACK signal broadcast by the other speaker device 200 has been received via the bus 300. If the ACK signal has been received, the CPU 210 stops the waiting state for the ACK signal (step S19), and ends the process routine.

If it is determined in step S14 that no ACK signal has been received, the CPU 210 determines in step S15 whether the predetermined period of time set in step S13 has elapsed.

If it is determined in step S15 that the predetermined period of time has elapsed, the CPU 210 broadcasts the ACK signal via the bus 300 in step S16. Out of the speaker devices 200 having no ID assigned thereto and thus no ID number thereof stored in the ID number memory 216, a speaker device 200 in which the predetermined period of time has elapsed first from the reception of the enquiry signal from the server apparatus 100 issues the ACK signal.

In the sequence chart of FIG. 5, a speaker device 200A transmits the ACK signal, and speaker devices 200B and 200C having no ID numbers assigned thereto receive the ACK signal, stops the emission waiting state, and wait on standby for a next enquiry signal.

Upon recognizing the arrival of the ACK signal from any speaker device 200 in step S3, the CPU 110 in the server apparatus 100 broadcasts the ID numbers of all speaker device 200, including the speaker device 200A that has transmitted the ACK signal (step S4 of FIG. 6). In other words, the ID numbers are assigned. The CPU 110 increments a variable N, or the number of the speaker devices 200, by 1 (step S5).

The CPU 110 returns to step S1 where the process is repeated again from the emission of the enquiry signal. If it is determined in step S3 that no ACK signal is received even after the predetermined period of time, within which the predetermined ACK signal is expected to arrive, has elapsed in step S2, the CPU 110 determines that the ID number assignment to all speaker devices 200 connected to the bus 300 is complete. The CPU 110 also determines that the audio system is in a state that none of the speaker device 200 issues the ACK signal, and ends the process routine.

The speaker device 200 that has transmitted the ACK signal receives the ID number from the server apparatus 100 as previously discussed. The CPU 210 waits for the arrival of the ID number in step S17. Upon receiving the ID number, the CPU 210 stores the ID number in the ID number memory 216 in step S18. Although the ID numbers are sent to the other speaker devices 200, only the speaker device 200 having transmitted the ACK signal in step S16 performs the process in step S17. Duplicate ID numbers are not assigned. The CPU 210 ends the process routine.

Each speaker device 200 performs the process routine of FIG. 7 each time the enquiry signal of the ID number arrives. If the speaker device 200 having the ID number assigned thereto confirms the assignment of the ID number in step S12, the CPU 210 ends the process routine. Only the speaker device 200 having no ID number assigned thereto performs the process in step S13 and subsequent steps until respective ID numbers are assigned to all speaker devices 200.

When the ID number assignment is complete, the server apparatus 100 detects the variable N incremented in step S5 as the number of the speaker devices 200 connected to the speaker device 200 in the audio system. The server apparatus 100 stores the assigned ID numbers in the speaker layout information memory 118.

In the first sequence, the server apparatus 100 counts the number of speaker devices 200 connected to the bus 300 by exchanging the signals via the bus 300, while assigning the ID numbers to the respective speaker devices 200 at the same time. In a second sequence described below, the server apparatus 100 causes the speaker 201 of each of the speaker devices 200 to emit a test signal. Using the sound captured by the microphone 202, the server apparatus 100 counts the number of speaker devices 200 connected to the bus 300 while assigning the ID numbers to each speaker device 200.

In accordance with the second sequence, the server apparatus 100 can check whether a sound output system including the speaker 201 and the output amplifier 206 and an sound input system including the microphone 202 and the amplifier 207 normally function.

Figure 8:
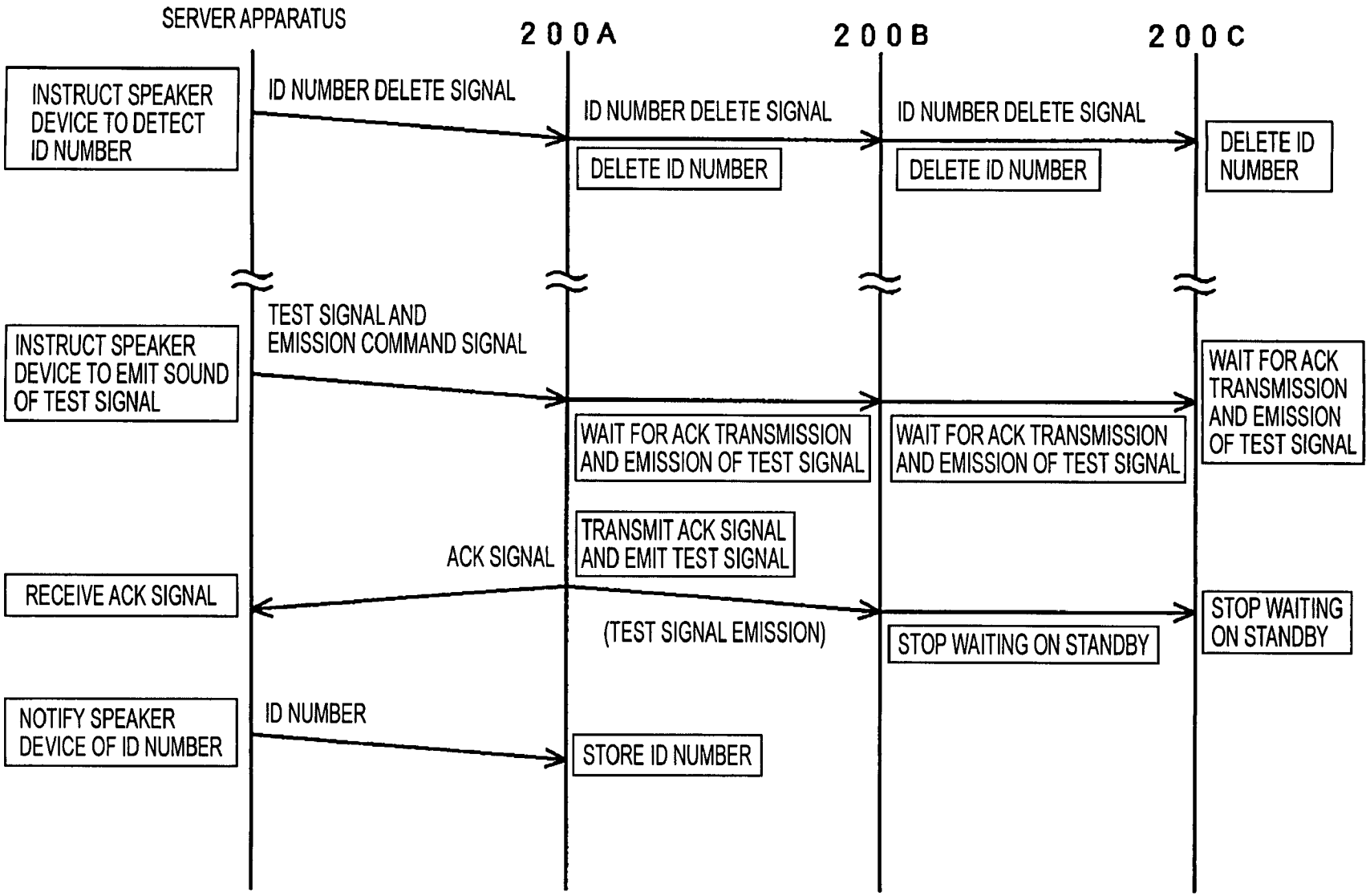
FIG. 8 is a sequence chart of a second sequence of an operation of assigning an ID number to each of the plurality of speaker devices connected to the bus in accordance with the first embodiment of the present invention.
Figure 9:
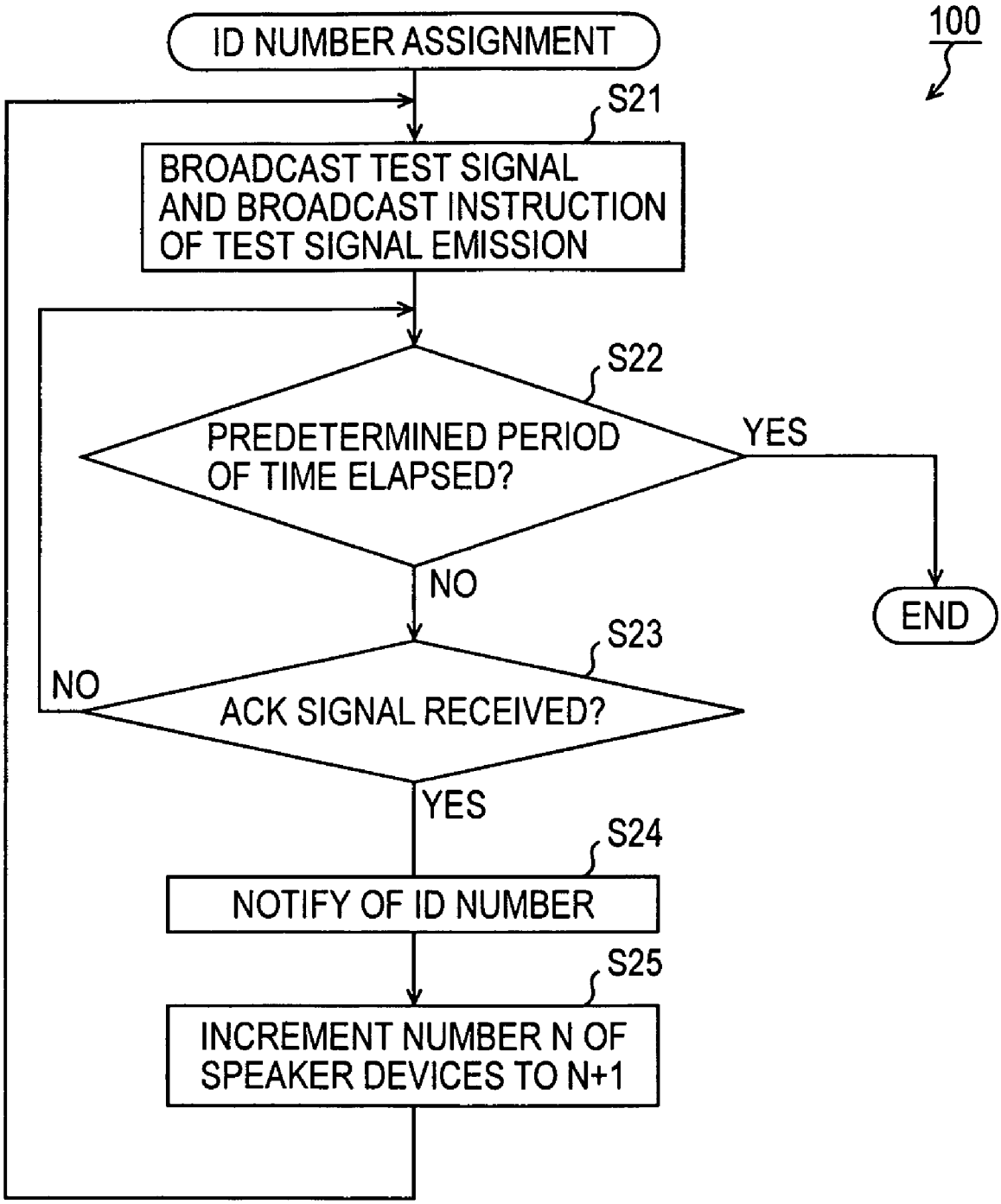
FIG. 9 is a flowchart illustrating the operation of the server apparatus that assigns the ID number to each of the plurality of speaker devices connected to the bus in accordance with the first embodiment of the present invention.
Figure 10:
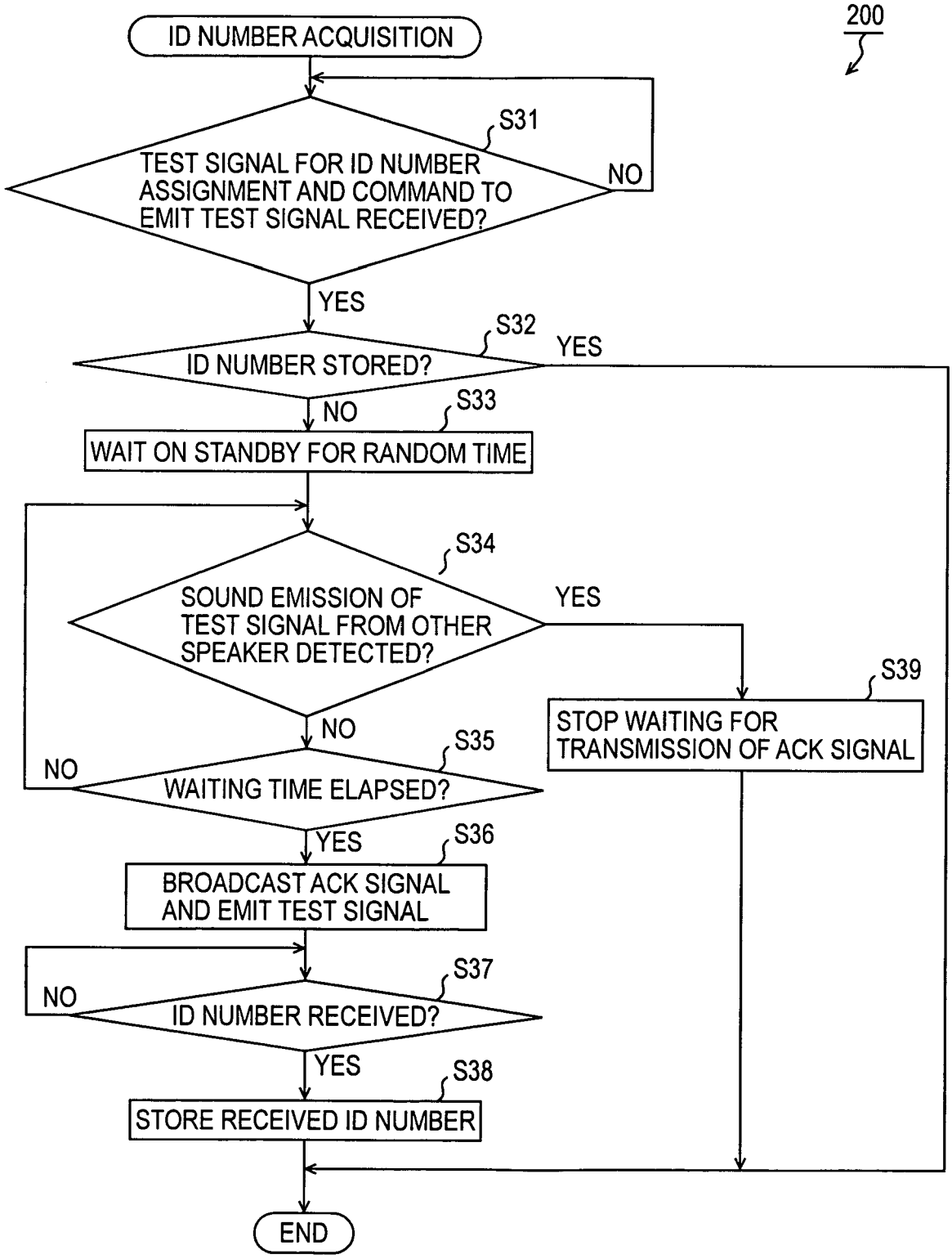
FIG. 10 is a flowchart illustrating the operation of the server apparatus that assigns the ID number to each of the plurality of speaker devices connected to the bus in accordance with the first embodiment of the present invention.

FIG. 8 is a sequence chart illustrating the second sequence of a process for detecting the number of speaker devices 200 and assigning the ID number to each of the speaker devices 200. FIG. 9 is a flowchart of the process mainly performed by the CPU 110 in the server apparatus 100 in the second sequence. FIG. 10 is a flowchart of the process mainly performed by the CPU 210 in speaker device 200 in the second sequence.

As shown in the sequence chart of FIG. 8, as in the first sequence, the server apparatus 100 broadcasts an ID number delete signal to all speaker devices 200 connected to the bus 300, prior to the start of the process, based on the ID number delete command operation issued by the user through the remote-control transmitter 102, or when an addition or reduction in the number of speaker devices 200 is detected. Upon receiving the ID number delete signal, each speaker device 200 deletes the ID number stored in the ID number memory 216.

The server apparatus 100 waits until all speaker devices 200 complete the delete process of the ID number. The CPU 110 then initiates a process routine described in the flowchart of FIG. 9 to assign the ID number. The CPU 110 in the server apparatus 100 broadcasts a test signal for ID number assignment and a sound emission command signal to all speaker devices 200 via the bus 300 (step S21 of FIG. 9). The sound emission command signal is similar to the previously described enquiry signal in function.

The CPU 110 determines whether a predetermined period of time, within which an ACK signal is expected to arrive from a predetermined speaker device 200, has elapsed (step S22). If it is determined that the predetermined period of time has not yet elapsed, the CPU 110 waits for the arrival of the ACK signal from any of the speaker devices 200 (step S23).

The CPU 210 in each speaker device 200 monitors the arrival of the ID number assignment test signal and the sound emission command signal subsequent to the deletion of the ID number (step S31 of FIG. 10). After acknowledging the reception of the ID number assignment test signal and the sound emission command signal, the CPU 210 determines in step S32 whether the ID number is stored in the ID number memory 216. If the CPU 210 determines that the ID number is stored in the ID number memory 216, in other words, the ID number is assigned, the CPU 210 ends the process routine of FIG. 10.

If the CPU 210 in each speaker device 200 determines in step S32 that the ID number is not stored, the CPU 210 sets the timer 220 so that the transmission of the ACK signal and the sound emission of the test signal are performed after a predetermined period of time later. The CPU 210 then waits on standby (step S33). The predetermined period of time set in the timer 220 is not constant but random from speaker to speaker.

The CPU 210 in each speaker device 200 determines in step S34 whether the sound of the test signal emitted from the other speaker devices 200 is detected. The detection of the emitted sound is performed depending on whether the audio signal captured by the microphone 202 is equal to or higher than a predetermined level. If it is determined in step S34 that the sound of the test signal emitted from the other speaker device 200 is detected, the CPU 210 stops the waiting time set in step S33 (step S39), and ends the process routine.

If it is determined in step S34 that the sound of the test signal emitted from the other speaker device 200 is not detected, the CPU 210 determines in step S35 whether the predetermined period of time set in step S33 has elapsed.

If it is determined in step S35 that the predetermined period of time has elapsed, the CPU 210 broadcasts the ACK signal via the bus 300 while emitting the test signal (step S36). Out of the speaker devices 200 having no ID assigned thereto and thus no ID number thereof stored in the ID number memory 216, a speaker device 200 in which the predetermined period of time has elapsed first from the reception of the test signal and the sound emission command signal from the server apparatus 100 issues the ACK signal. The speaker device 200 also emits the test signal from the speaker 201.

In the sequence chart of FIG. 8, a speaker device 200A transmits the ACK signal while emitting the test signal at the same time. The microphone 202 of the speaker device 200 having no ID number assigned thereto detects the sound of the test signal, the CPU 210 stops the time waiting state, and waits on standby for a next test signal and a next sound emission command signal.

Upon recognizing the arrival of the ACK signal from any speaker device 200 in step S23, the CPU 110 in the server apparatus 100 broadcasts the ID numbers of all speaker devices 200, including the speaker device 200A that have transmitted the ACK signal (step S24 of FIG. 9). In other words, the ID numbers are assigned. The CPU 110 increments a variable N, or the number of the speaker devices 200, by 1 (step S25).

The CPU 110 returns to step S21 where the process is repeated again from the emission of the test signal and the sound emission command signal. If it is determined in step S23 that no ACK signal is received even after the predetermined period of time, within which the predetermined ACK signal is expected to arrive, has elapsed in step S22, the CPU 110 determines that the ID number assignment to all speaker devices 200 connected to the bus 300 is complete. The CPU 110 also determines that the audio system is in a state that none of the speaker device 200 issues the ACK signal, and ends the process routine.

The speaker device 200 that has transmitted the ACK signal receives the ID number from the server apparatus 100 as previously discussed. The CPU 210 waits for the reception of the ID number in step S37. Upon receiving the ID number, the CPU 210 stores the ID number in the ID number memory 216 in step S38. Although the ID numbers are sent to the other speaker devices 200, only the speaker device 200 having transmitted the ACK signal in step S36 performs the process in step S37. Duplicate ID numbers are not assigned. The CPU 210 ends the process routine.

Each speaker device 200 performs the process routine of FIG. 10 each time the test signal and the sound emission command signal arrive. If the speaker device 200 having the ID number assigned thereto confirms the assignment of the ID number in step S32, the CPU 210 ends the process routine. Only the speaker device 200 having no ID number assigned thereto performs the process in step S33 and subsequent steps until respective ID numbers are assigned to all speaker devices 200.

When the ID number assignment is complete, the server apparatus 100 detects the variable N, incremented in step S25, as the number of the speaker devices 200 connected to the speaker device 200 in the audio system. The server apparatus 100 stores the assigned ID numbers in the speaker layout information memory 118.

In the first and second sequences, the server apparatus 100 causes each speaker device 200 to delete the ID number before the counting of the number of speaker devices 200 and the ID number assignment process. It is sufficient to delete the ID number at the initial setting of the audio system. When a speaker device 200 added to or removed from the bus 300, the deletion of the ID number is not required.

The test signal is transmitted from the server apparatus 100 to the speaker devices 200 as described above. Alternatively, the test signal may be generated in the speaker device 200. For example, a signal having a waveform stored in the ROM 211 in the speaker device 200 or noise may be used as a test signal. In such a case, the server apparatus 100 simply sends a sound emission command of the test signal to each speaker device 200.

Rather than transmitting the sound emission command of the test signal from the server apparatus 100, the user can produce a voice or clap hands to give a signal to start the ID assignment process. The speaker device 200 detects the sound with the microphone 202, and then starts the above-described process.

The detection process of the layout configuration of the speaker devices 200 is automatically performed with the server apparatus 100 and the speaker devices 200 functioning in cooperation with each other.

Prior to the detection process of the layout configuration of the speaker devices 200, the number of speaker devices 200 forming the audio system must be identified and the ID numbers must be respectively assigned to the speaker devices 200. This process is preferably automatically performed. Alternatively, the listener can register the number of speaker devices 200 in the server apparatus 100, assign the ID numbers to the speaker devices 200, respectively, and register the assigned ID numbers in the speaker devices 200.

In the first embodiment, the layout configuration of the speaker devices 200 with respect to the listener is detected first. The microphone 202 of the speaker device 200 captures the voice produced by the listener. The speaker device 200 calculates the transfer characteristic of the audio signal captured by the microphone 202, and determines a distance between the speaker device 200 and the listener from a propagation delay time.

The listener may use a sound generator, such as a buzzer, to generate a sound. The voice produced by the listener is here used because the voice is produced within a close range to the ears without the need for preparing any particular devices.

Although ultrasonic wave or light may be used to measure distance, measurement using acoustic wave is appropriate to determine acoustic propagation path length. The use of the acoustic wave provides a correct distance measurement if an object is interposed between the speaker device 200 and the listener. The distance measurement method using the acoustic wave is used herein.

The server apparatus 100 broadcasts a listener-to-speaker distance measurement process start signal to all speaker devices 200 via the bus 300.

Upon receiving the start signal, each speaker device 200 shifts into a waiting mode for capturing the sound to be produced by the listener. The speaker device 200 stops emitting sound from the speaker 201 (mutes an audio output), while starting recording the audio signal captured by the microphone 202 in the captured signal buffer memory (ring buffer memory) 219.

Figure 11:
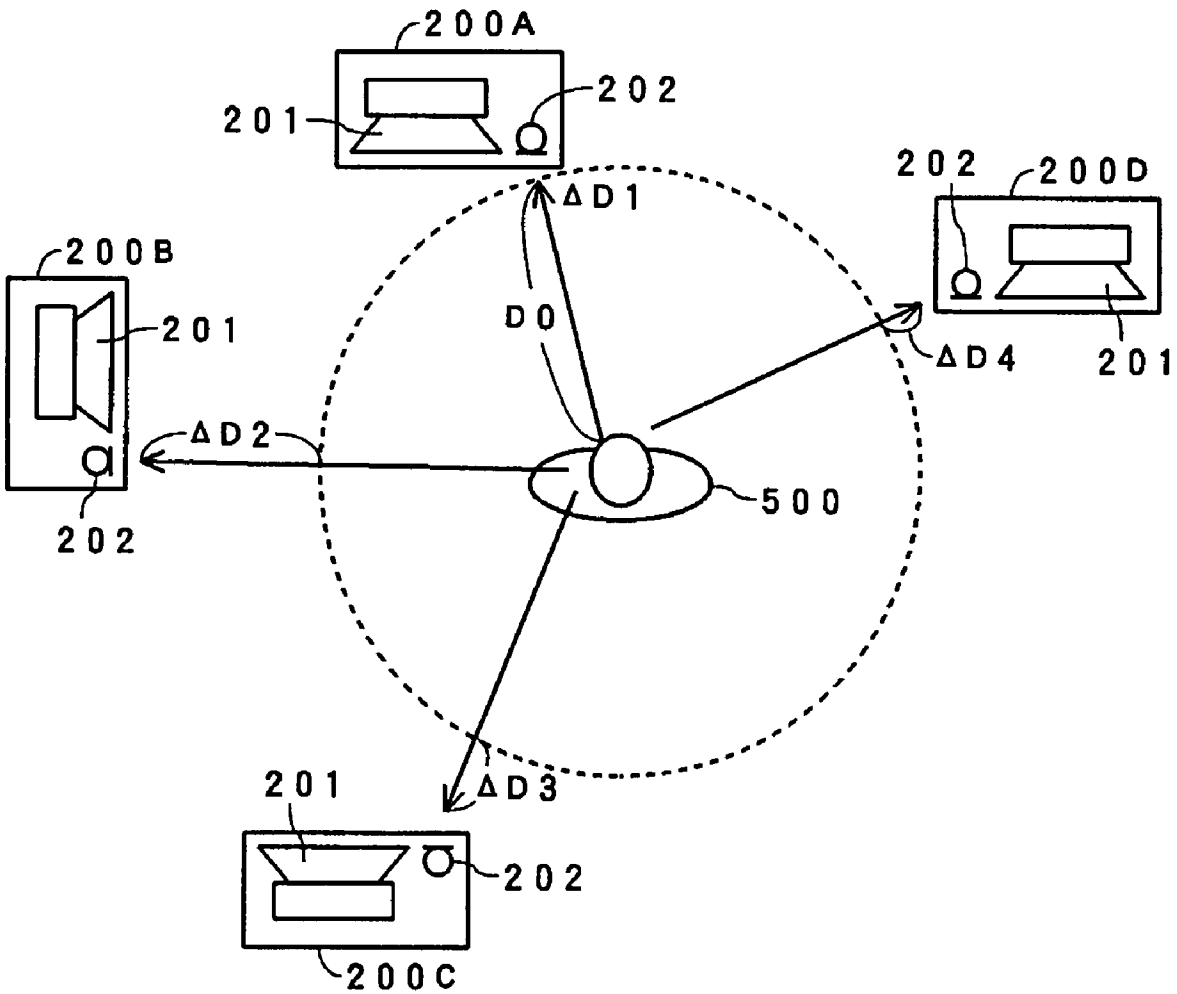
FIG. 11 illustrates a method for obtaining information concerning a distance between a listener and a location of the speaker device in accordance with the first embodiment of the present invention.

As shown in FIG. 11, for example, a listener 500 produces a voice to a plurality of speaker devices 200 arranged at arbitrary locations.

The microphone 202 in the speaker device 200 captures the voice produced by the listener 500. Any speaker device 200 that has captured first the voice equal to or higher than a predetermined level transmits a trigger signal to all other speaker devices 200. The speaker device 200 that has captured first the voice equal to or higher than the predetermined level is the one closest to the listener 500 in distance.

All speaker devices 200 starts recording the audio signal from the microphone 202 in response to the trigger signal as a reference timing, and continues to record the audio signal for a constant duration of time. When the recording of the captured audio signal during the constant duration of time is complete, each speaker device 200 transmits, to the server apparatus 100, the recorded audio signal with the ID number thereof attached thereto.

The server apparatus 100 calculates the transfer characteristic of the audio signal received from the speaker device 200, thereby determining the propagation delay time for each speaker device 200. The propagation delay time determined for each speaker device 200 is a delay from the timing of the trigger signal, and the propagation delay time of the speaker device 200 that has generated the trigger signal is zero.

The server apparatus 100 collects information relating to the distance between the listener 500 and each of the speaker devices 200 from the propagation delay times of the speaker devices 200. The distance between the listener 500 and the speaker device 200 is not directly determined. Let Do represent the distance between the listener 500 and the speaker device 200 that has generated the trigger signal, and Di represent the distance between the listener 500 and each speaker device 200 having the ID number i, and a distance difference ΔDi between a distance D0 and a distance Di is determined herein.

As shown in FIG. 11, the speaker device 200A is located closest to the listener 500. The distance between the listener 500 and the speaker device 200A is represented by Do, and the server apparatus 100 calculates the distance difference Δi between the distance Do and the distance of each of speaker devices 200A, 200B, 200C, and 200D to the listener 500.

The speaker devices 200A, 200B, 200C, and 200D have "1", "2", "3", and "4" as ID numbers i, respectively, and ΔD1, ΔD2, Δ3, and Δ4 as distance differences, respectively. Here, ΔD1 is zero.

Figure 12:
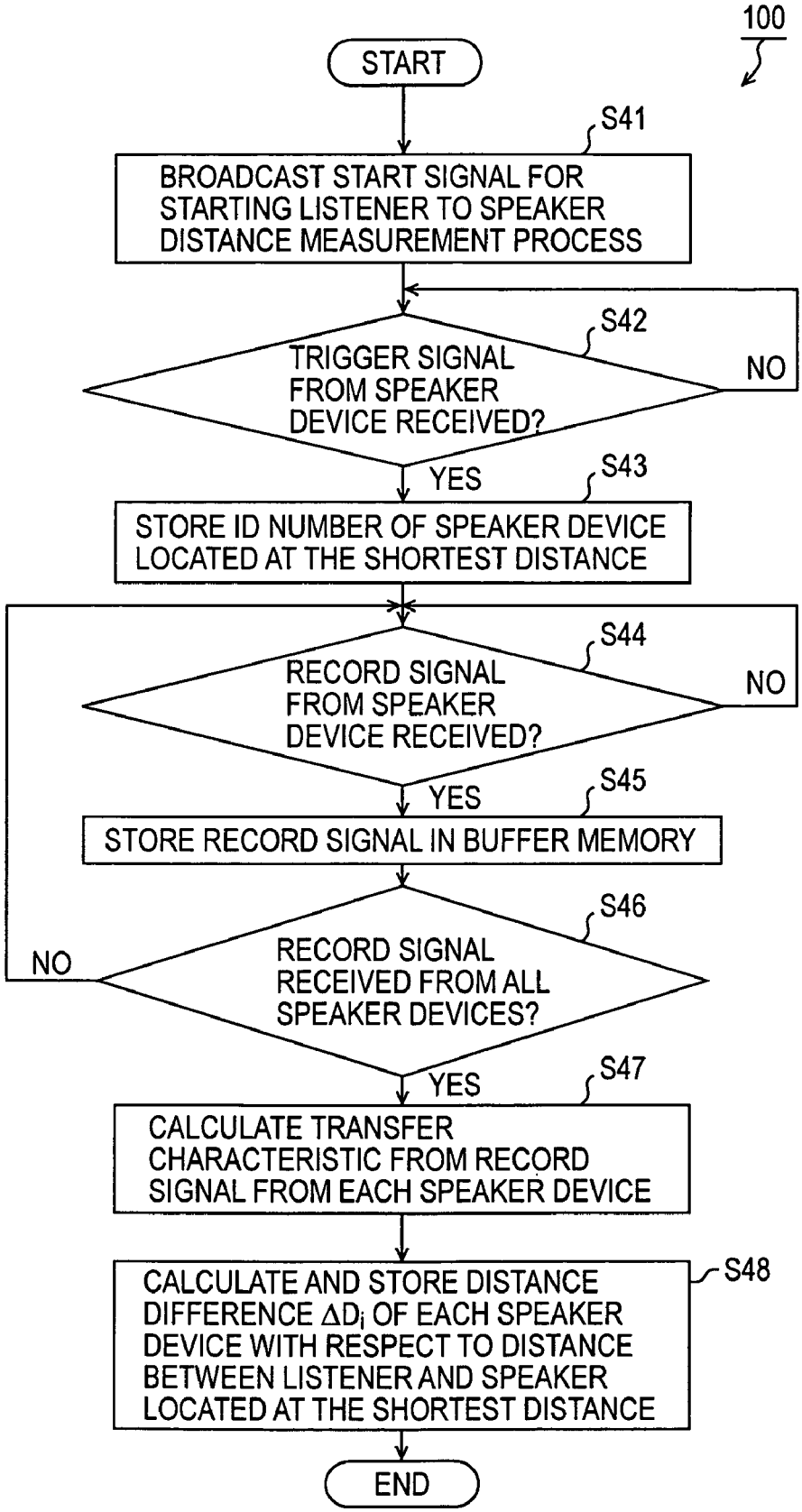
FIG. 12 is a flowchart illustrating the operation of the server apparatus that collects information concerning the distance between the listener and the speaker device in accordance with the first embodiment of the present invention.

The listener-to-speaker distance measurement process performed by the server apparatus 100 is described below with reference to a flowchart of FIG. 12.

The CPU 110 broadcasts the listener-to-speaker distance measurement process start signal to all speaker devices 200 via the bus 300 in step S41. The CPU 110 waits for the arrival of the trigger signal from any of the speaker devices 200 in step S42.

Upon recognizing the arrival of the trigger signal from any of the speaker devices 200 in step S42, the CPU 110 stores, in the RAM 112 or the speaker layout information memory 118, the ID number of the speaker device 200 having transmitted the trigger signal as a speaker device 200 located closest to the listener 500 in step S43.

The CPU 110 waits for the arrival of a record signal from each speaker device 200 in step S44. Upon confirming the reception of the ID number and the record signal from the speaker device 200, the CPU 110 stores the record signal in the RAM 112 in step S45. The CPU 110 determines in step S46 whether the record signals have been received from all speaker devices 200 connected to the bus 300. If it is determined that the record signals have not been received from all speaker devices 200, the CPU 110 returns to step S44 where the reception process of the record signal is repeated until the record signals are received from all speaker devices 200.

If it is determined in step S46 that the record signals have been received from all speaker devices 200, the CPU 110 controls the transfer characteristic calculator 121 to calculate the transfer characteristics of the record signals of the speaker devices 200 in step S47. The CPU 110 calculates the propagation delay time of each of the speaker device 200 from the calculated transfer characteristic of the speaker device 200, calculates the distance difference ΔDi of each of the speaker devices 200 relative to the distance Do between the speaker located closest to the listener 500 and the listener 500, and stores, in the RAM 112 or the speaker layout information memory 118, the distance difference ΔDi with the ID number of the speaker device 200 associated thereto in step S48.

The listener-to-speaker distance measurement process performed by the speaker device 200 is described below with reference to a flowchart of FIG. 13.

Figure 13:
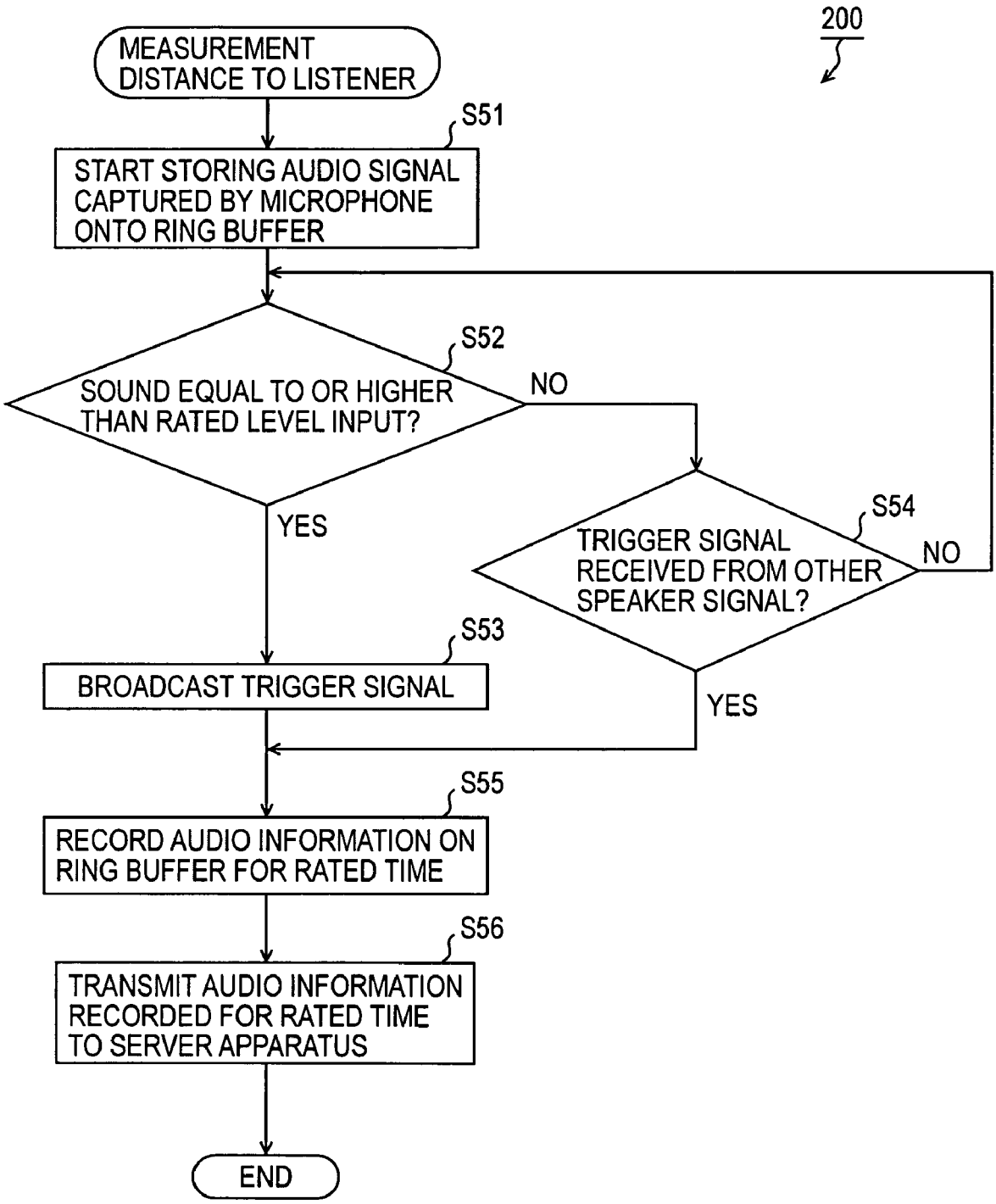
FIG. 13 is a flowchart illustrating the operation of the server apparatus that collects the information concerning the distance between the listener and the speaker device in accordance with the first embodiment of the present invention.

Upon receiving the listener-to-speaker distance measurement process start signal from the server apparatus 100 via the bus 300, the CPU 210 in each speaker device 200 initiates the process of the flowchart of FIG. 13. The CPU 210 starts writing the sound captured by the microphone 202 in the captured signal buffer memory (ring buffer memory) 219 in step S51.

The CPU 210 monitors the level of the audio signal from the microphone 202. The CPU 210 determines in step S52 whether the listener 500 has produced a voice by determining whether the level of the audio signal is equal to or higher than a predetermined threshold level. The determination of whether the audio signal is equal to or higher than the predetermined threshold level is performed to prevent the speaker device 200 from erroneously detect noise as a voice produced by the listener 500.

If it is determined in step S52 that the audio signal equal to or higher than the predetermined threshold level is detected, the CPU 210 broadcasts the trigger signal to the server apparatus 100 and the other speaker devices 200 via the bus 300 in step S53.

If it is determined in step S52 that the audio signal equal to or higher than the predetermined threshold level is not detected, the CPU 210 determines in step S54 whether the trigger signal has been received from the other speaker device 200 via the bus 300. If it is determined that no trigger signal has been received, the CPU 210 returns to step S52.

If it is determined in step S54 that the trigger signal has been received from the other speaker device 200, or if the trigger signal is broadcast via the bus 300 in step S53, the CPU 210 records the audio signal, captured by the microphone 202, in the captured signal buffer memory 219 in step S55 for a rated period of time from the timing of the reception of the trigger signal or the timing of the transmission of the trigger signal.

The CPU 210 transmits the audio signal recorded for the rated period of time together with the ID number of own device 200 to the server apparatus 100 via the bus 300 in step S56.

In the first embodiment, the propagation delay time is determined by calculating the transfer characteristic in step S47. Alternatively, a cross correlation calculation may be performed on the record signal from the closest speaker and the record signals from the other speaker devices 200, and the propagation delay time is determined from the result of cross correlation calculation.

The distance difference ΔDi alone as the information relating to the distance between the listener 500 and the speaker device 200 is not sufficient to determine the layout configuration of the plurality of speaker devices 200. In accordance with the first embodiment, the distance between the speaker devices 200 is measured, and the layout configuration is determined from the speaker-to-speaker distance and the distance difference ΔDi.

Figure 14:
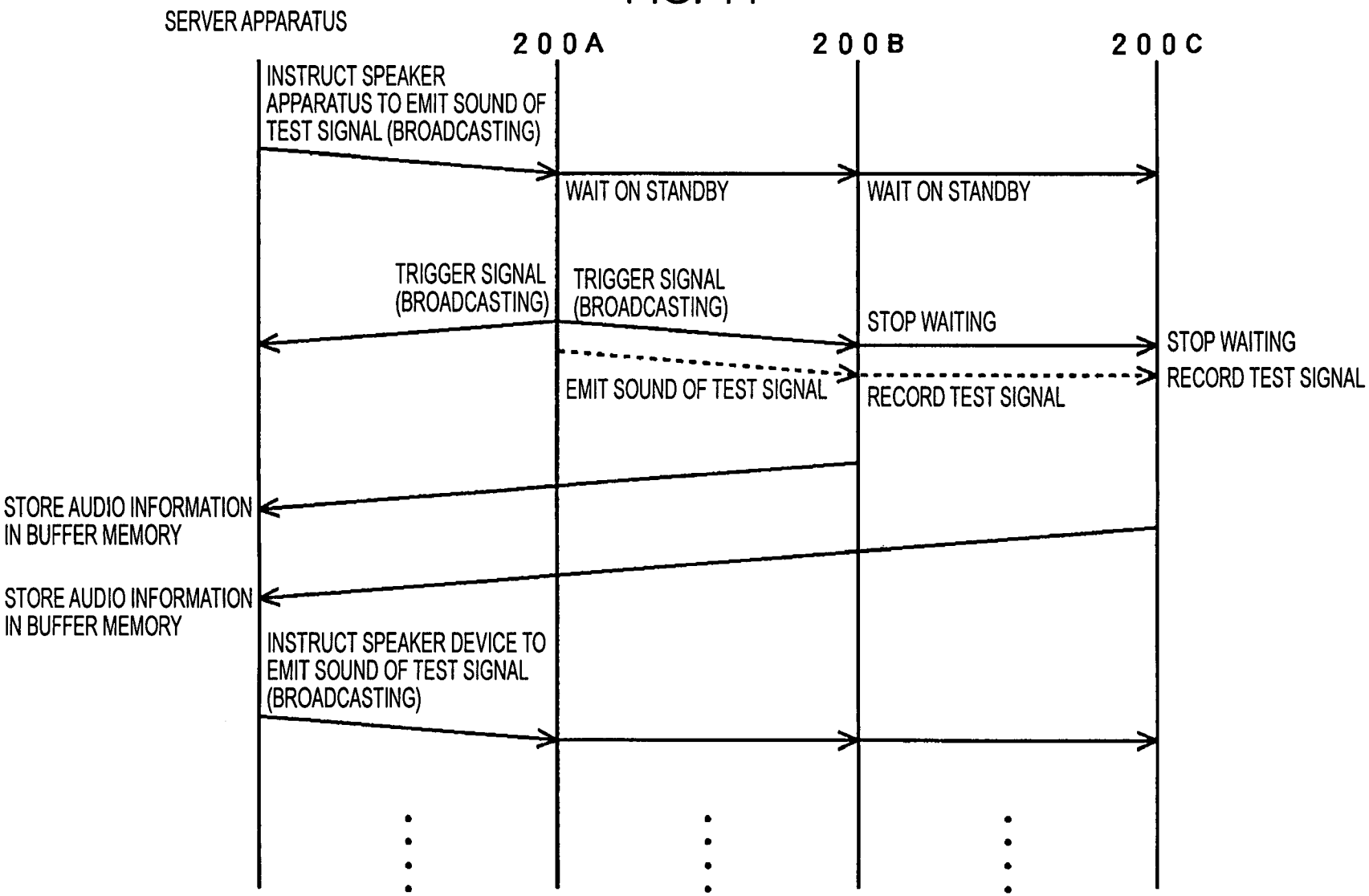
FIG. 14 is a sequence chart of a method for calculating a speaker-to-speaker distance in accordance with the first embodiment of the present invention.
Figures 15A, 15B:
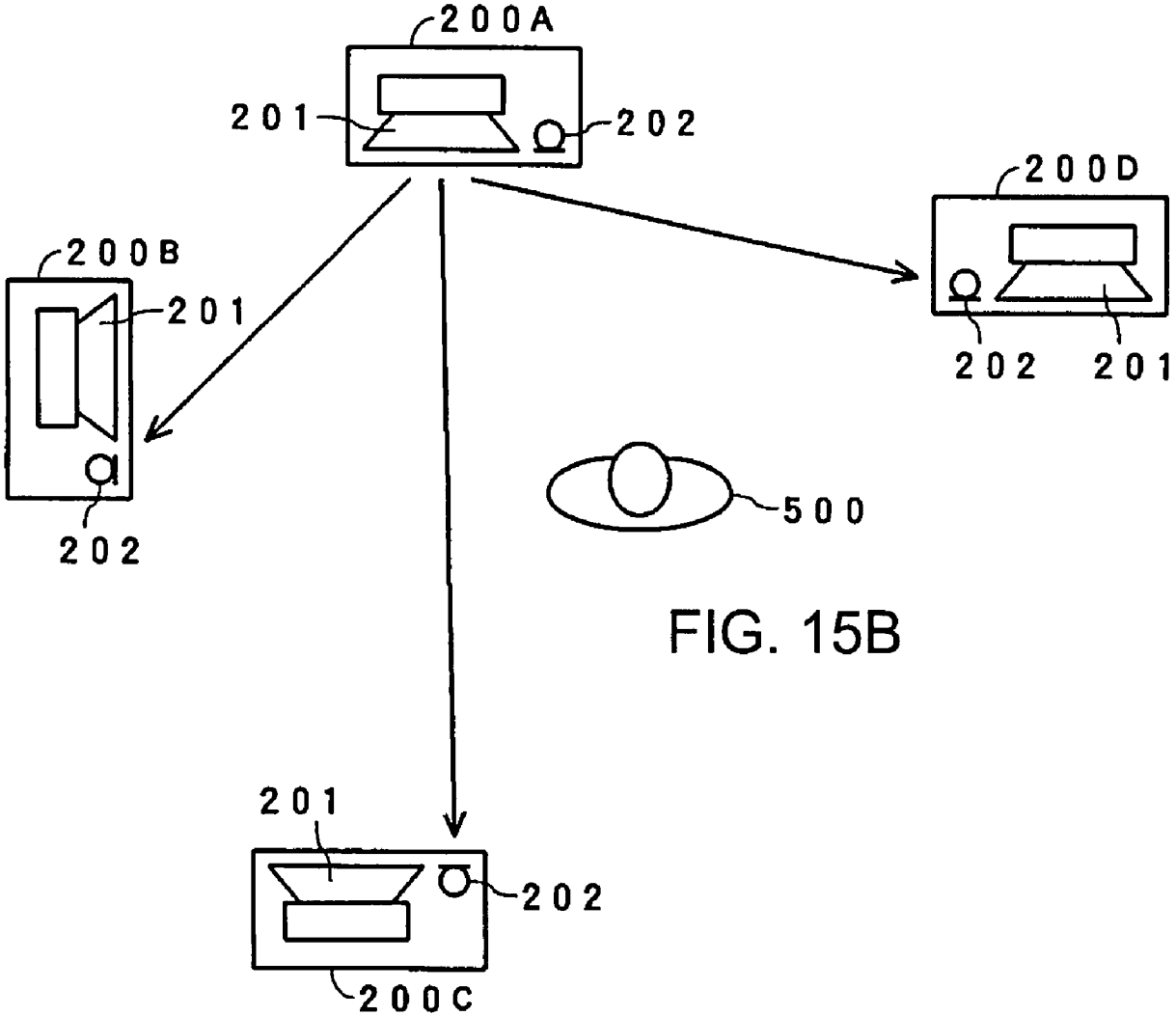
FIGS. 15A and 15B illustrates a method for determining the speaker-to-speaker distance in accordance with the first embodiment of the present invention.

FIG. 14 is a sequence chart illustrating the distance measurement process for measuring the distances between the speaker devices 200. FIG. 15 illustrates a setup for measuring the speaker-to-speaker distance.

The server apparatus 100 broadcasts a sound emission command signal of a test signal to all speaker devices 200. Upon receiving the sound emission command signal of the test signal, each speaker device 200 shifts into a random-time waiting state.

The speaker device 200 in which the waiting time thereof has elapsed first broadcasts a trigger signal via the bus 300 while emitting the test signal at the same time. A packet of the trigger signal transmitted via the bus 300 is accompanied by the ID number of the speaker device 200. The other speaker devices 200 having received the trigger signal stop the time waiting state thereof, and capture and record the sound of the test signal with the microphones 202 thereof.

The speaker device 200 generates the trigger signal in the detection process of the number of speaker devices 200, the ID number assignment process, and several other processes to be discussed later. The same trigger signal may be used in these processes, or the trigger signal may be different from process to process.

As shown in FIG. 15, the speaker device 200A transmits the trigger signal via the bus 300, while emitting the test signal from the speaker 201 thereof at the same time. The other speaker devices 200B, 200C, and 200D capture the sound, emitted by the speaker device 200A, with the microphones 202 thereof.

The speaker devices 200B, 200C, and 200D having captured the emitted sound of the test signal transmit, to the server apparatus 100, record signals for a rated duration of time starting with the timing of the trigger signal. The server apparatus 100 stores the record signals in the buffer memory thereof. The packets of the record signals transmitted to the server apparatus 100 are accompanied by the respective ID numbers of the speaker devices 200B, 200C, and 200D.

The server apparatus 100 detects the speaker device 200 that has emitted the test signal from the ID number attached to the packet of the trigger signal. Based on the ID numbers attached to the packets of the record signals, the server apparatus 100 detect the record signals of the speaker device 200 that has captured and recorded the test signal from the speaker device 200 having generated the trigger signal.

The server apparatus 100 calculates the transfer characteristic of the received record signals, and calculates, from the propagation delay time, the distance between the speaker device 200 having the ID number attached to the received record signal and the speaker device 200 that have generated the trigger signal. The server apparatus 100 then stores the calculated distance in the speaker layout information memory 118, for example.

The server apparatus 100 repeats the above-described process by transmitting the test signal emission command signal until all speaker devices 200 connected to the bus 300 emit the test signal. In this way, the speaker-to-speaker distances of all speaker devices 200 are calculated. The distance between the same speaker devices 200 is repeatedly measured, and the average of the measured distances is adopted. The distance measurement can be performed once for each combination of speaker devices 200 to avoid measurement duplication. To enhance measurement accuracy level, measurement is preferably duplicated.

The speaker-to-speaker distance measurement process performed by the speaker device 200 is described below with reference to a flowchart of FIG. 16.

Figure 16:
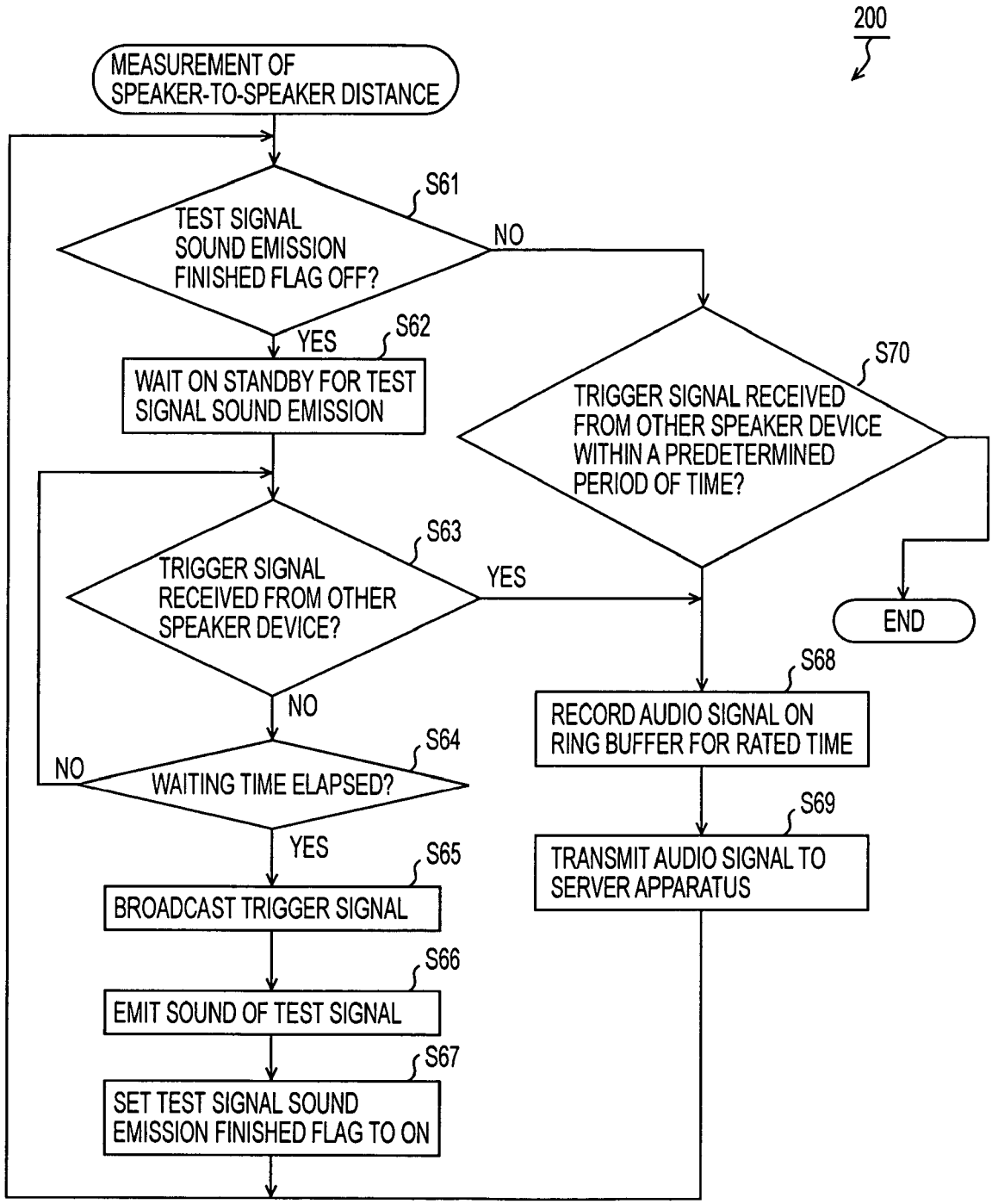
FIG. 16 is a flowchart illustrating the operation of the speaker device that determines the speaker-to-speaker distance in accordance with the first embodiment of the present invention.

Upon receiving the test signal emission command signal from the server apparatus 100 via the bus 300, the CPU 210 in each speaker device 200 initiates the process of the flowchart of FIG. 16. The CPU 210 determines in step S61 whether or not a test signal emitted flag is off. If it is determined that that the test signal emitted flag is off, the CPU 210 determines that the test signal is not emitted yet and waits for a test signal emission for a random time in step S62.

The CPU 210 determines in step S63 whether a trigger signal has been received from another speaker device 200. If it is determined that no trigger signal has been received, the CPU 210 determines in step S64 whether the waiting time set in step S62 has elapsed. If it is determined that the waiting time has not elapsed yet, the CPU 210 returns to step S63 to monitor the arrival of a trigger signal from another speaker device 200.

If it is determined in step S64 that the waiting time has elapsed without receiving a trigger signal from another speaker device 200, the CPU 210 packetizes the trigger signal with the ID number thereof attached thereto, and broadcasts the trigger signal via the bus 300 in step S65. The CPU 210 emits the test signal from the speaker 201 thereof in synchronization with the timing of the transmitted trigger signal in step S66. The CPU 210 sets the test signal emitted flag to on in step S67. The CPU 210 then returns to step S61.

If it is determined in step S63 that a trigger signal is received from another speaker device 200 during the waiting time for the test signal emission, the audio signal captured by the microphone 202 is recorded for the rated duration of time from the timing of the trigger signal in step S68. In step S69, the CPU 210 packetizes the audio signal recorded during the rated duration of time and attaches the ID number to the packet before transmitting the audio signal to the server apparatus 100 via the bus 300. The CPU 210 returns to step S61.

If it is determined in step S61 that the test signal is emitted with the test signal emitted flag on, the CPU 210 determines in step S70 whether a trigger signal is received from another speaker device 200 within the predetermined period of time. If it is determined that a trigger signal is received, the CPU 210 records the test signal, captured by the microphone 202, for the rated duration of time from the timing of the received trigger signal in step S68. The CPU 210 packetizes the audio signal recorded during the rated duration of time, and attaches the ID number to the packet before transmitting the packet to the server apparatus 100 via the bus 300 in step S69.

If it is determined in step S70 that no trigger signal is received from another speaker device 200 within the predetermined period of time, the CPU 210 determines that all speaker devices 200 have completed the emission of the test signal, and ends the process routine.

Figure 17:
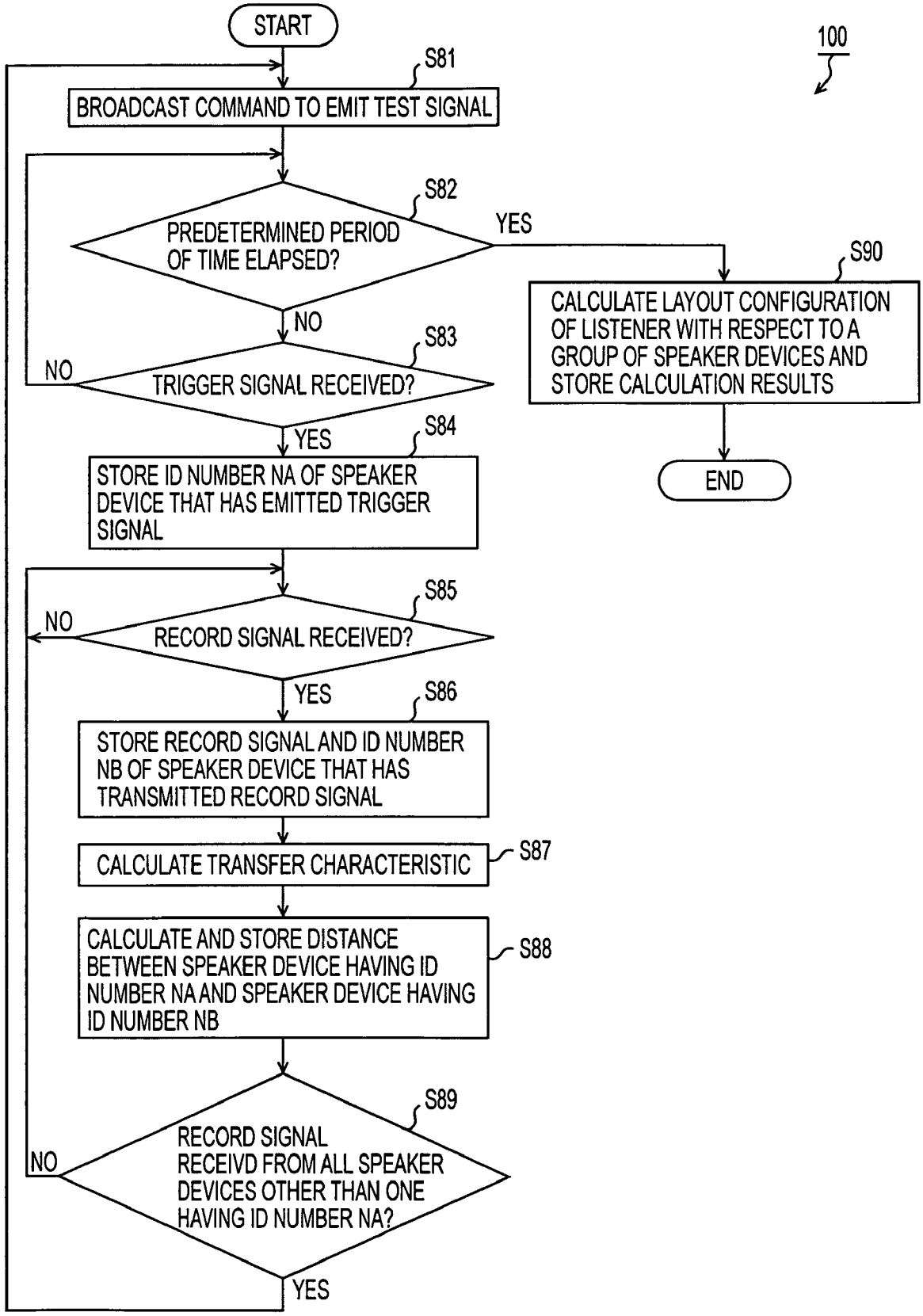
FIG. 17 is a flowchart illustrating the operation of the server apparatus that determines the speaker-to-speaker distance in accordance with the first embodiment of the present invention.

The speaker-to-speaker distance measurement process performed by the server apparatus 100 is described below with reference to a flowchart of FIG. 17.

In step S81, the CPU 110 in the server apparatus 100 broadcasts the sound emission start signal for the test signal to all speaker devices 200 via the bus 300. The server apparatus 100 determines in step S82 whether a predetermined period of time, determined taking into consideration a waiting time for the sound emission of the test signal in the speaker device 200, has elapsed.

If it is determined in step S82 that the predetermined period of time has not elapsed, the CPU 110 determines in step S83 whether a trigger signal has been received from any speaker device 200. If it is determined that no trigger signal has been received, the CPU 110 returns to step S82 to monitor whether the predetermined period of time has elapsed.

If it is determined in step S83 that a trigger signal has been received, the CPU 110 discriminates in step S84 an ID number NA of the speaker device 200 having emitted the trigger signal from the ID numbers attached to the packet of the trigger signals.

The CPU 110 waits for the record signal from the speaker device 200 in step S85. Upon receiving the record signal, the CPU 110 discriminates an ID number NB of the speaker device 200 having transmitted the record signal from the ID numbers attached to the packet of the record signals, and stores the record signal corresponding to the ID number NB in the buffer memory thereof in step S86.

The CPU 110 calculates the transfer characteristic of the record signal stored in the buffer memory in step S87, thereby determining a propagation delay time from the generation timing of the trigger signal. The CPU 110 calculates a distance Djk between the speaker device 200 of the ID number NA that has emitted the test signal and the speaker device 200 of the ID number NB that has transmitted the record signal (namely, a distance between the speaker having an ID number j and the speaker having an ID number k), and stores the distance Djk in the speaker layout information memory 118 in step S88.

The server apparatus 100 again determines the propagation delay time by calculating the transfer characteristic in step S87. Alternatively, a cross correlation calculation may be performed on the test signal and the record signals from the speaker devices 200, and the propagation delay time is determined from the result of cross correlation calculation.

The CPU 110 determines in step S89 whether the record signal has been received from all speaker devices 200 connected to the bus 300 other than the speaker device 200 of the ID number NA having emitted the test signal. If it is determined that the reception of the record signals from all speaker devices 200 is not complete, the CPU 110 returns to step S85.

It is determined in step S89 that the record signal has been received from all speaker devices 200 connected to the bus 300 other than the speaker device 200 of the ID number NA having emitted the test signal, the CPU 110 returns to step S81. The CPU 110 again broadcasts the sound emission command signal for the test signal to the speaker devices 200 via the bus 300.

If it is determined in step S82 that the predetermined period of time has elapsed without receiving a trigger signal from any of the speaker devices 200, the CPU 110 determines that the sound emission of the test signal from all speaker devices 200 is complete, and that the speaker-to-speaker distance measurement is complete. The CPU 110 calculates the layout configuration of the plurality of speaker devices 200 connected to the bus 300, and stores the information of the calculated layout configuration in the speaker layout information memory 118 in step S90.

The server apparatus 100 determines the layout configuration of the speaker devices 200 based on not only the speaker-to-speaker distance Djk determined in this process routine but also the distance difference ΔDi relating to the distance of the speaker device 200 relative to the listener 500 determined in the preceding process routine.

The layout configuration of the speaker devices 200 is determined by calculating the speaker-to-speaker distance Djk and the distance difference ΔDi of the speaker device 200 relative to the listener 500. Thus, the location of the listener satisfying the layout configuration is determined. The location of the listener is determined geometrically or using simultaneous equations. Since the distance measurement and the distance difference measurement are subject to some degree of errors, the layout configuration is determined using the least squares method or the like to minimize the errors.

FIG. 18 is a table listing distance data obtained, including distances between the speaker devices 200 and a listener L and the speaker-to-speaker distances of the speaker devices 200. The speaker layout information memory 118 stores at least the information listed in the table of FIG. 18.

In the distance measurement process of the speaker-to-speaker distances of the speaker devices 200, the distance measurement process ends if no trigger signal is received from any of the speaker devices 200 within the predetermined period of time after the server apparatus 100 broadcasts the sound emission command signal for the test signal to the speaker devices 200.

As previously described, the server apparatus 100 stores and knows the number of speaker devices 200 connected to the bus 300 and the ID numbers thereof. The server apparatus 100 determines that all speaker devices 200 have emitted the test signals when the trigger signals are received from all speaker devices 200 connected to the bus 300. The server apparatus 100 transmits a distance measurement end signal to the bus 300 when the record signal for the rated duration of time responsive to the emitted test signal is received from the other speaker devices 200. The distance measurement process of the speaker-to-speaker distances of the speaker devices 200 is thus complete.

In the above discussion, the test signal and the sound emission command signal are broadcast via the bus 300. Since the server apparatus 100 knows the number of speaker devices 200 connected to the bus 300 and the ID numbers thereof, the server apparatus 100 can unicast the test signal and the sound emission command signal successively to the speaker devices 200 corresponding to the stored ID numbers. The server apparatus 100 then repeats, for each of the speaker devices 200, the process of receiving the record signal responsive to the emitted sound of the test signal from the other speaker devices 200.

This process is described below with reference to a sequence chart of FIG. 19.

Figure 19:
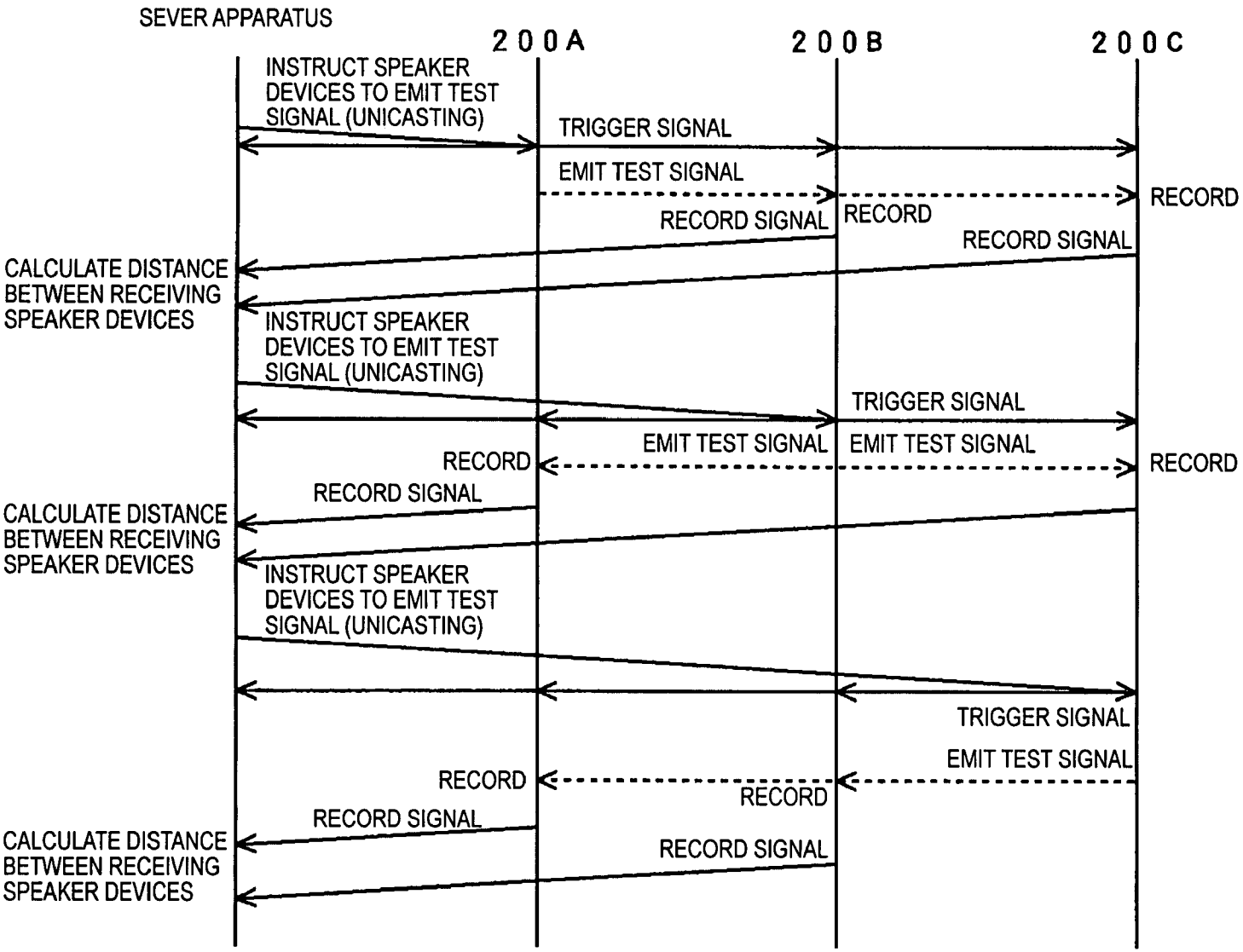
FIG. 19 is a sequence diagram of illustrating another method for determining the speaker-to-speaker distance in accordance with the first embodiment of the present invention.

The server apparatus 100 unicasts the test signal and the sound emission command signal to a first speaker device 200, i.e., a speaker device 200A in FIG. 19. In response, the speaker device 200A broadcasts the trigger signal via the bus 300 while emitting the test signal at the same time.

The other speaker devices 200B and 200C record the emitted sound of the test signal with the microphone 202 for the rated duration of time from the timing of the trigger signal transmitted vie the bus 300, and transmit the record signals to the server apparatus 100. Upon receiving the record signals, the server apparatus 100 calculates the transfer characteristic and then calculates, from the propagation delay time measured from the timing of the trigger signal, the distance between the speaker device 200A having emitted the test signal and each of the speaker devices 200A and 200B.

When the distance of each of the speaker devices 200C and 200B with respect to the speaker device 200A is calculated, the server apparatus 100 transmits the test signal and the sound emission command signal to the next speaker device 200B, and the same process is repeated to the speaker device 200B.

In this way, the server apparatus 100 transmits the test signal and the sound emission command signal to all speaker devices 200, receives the record signals from the speaker devices 200 other than the speaker device 200 that has emitted the test signal, calculates the propagation delay time from the transfer characteristic, and calculates the distance between the speaker device 200 that has emitted the test signal and each of the other speaker devices 200. The server apparatus 100 thus ends the speaker-to-speaker distance measurement process.

The test signal is supplied from the server apparatus 100 in the above discussion. Since the ROM 211 in the speaker device 200 typically contains a signal generator for generating a sinusoidal wave signal or the like, a signal generated by the signal generator in the speaker device 200 can be used as the test signal. For the distance calculation process, a time stretched pulse (TSP) is used.

The information of the layout configuration of the listener 500 and the plurality of speaker devices 200 does not account for a direction toward which the listener 500 looks. In other words, this layout configuration is unable to localize the sound image with respect to the audio signals of the left, right, center, left surround, and right surround channels that are fixed with respect to the forward direction of the listener 500.

In the first embodiment, several techniques are used to specify the forward direction of the listener 500 as a reference direction to cause the server apparatus 100 of the audio system to recognize the forward direction of the listener 500.

Figure 20:
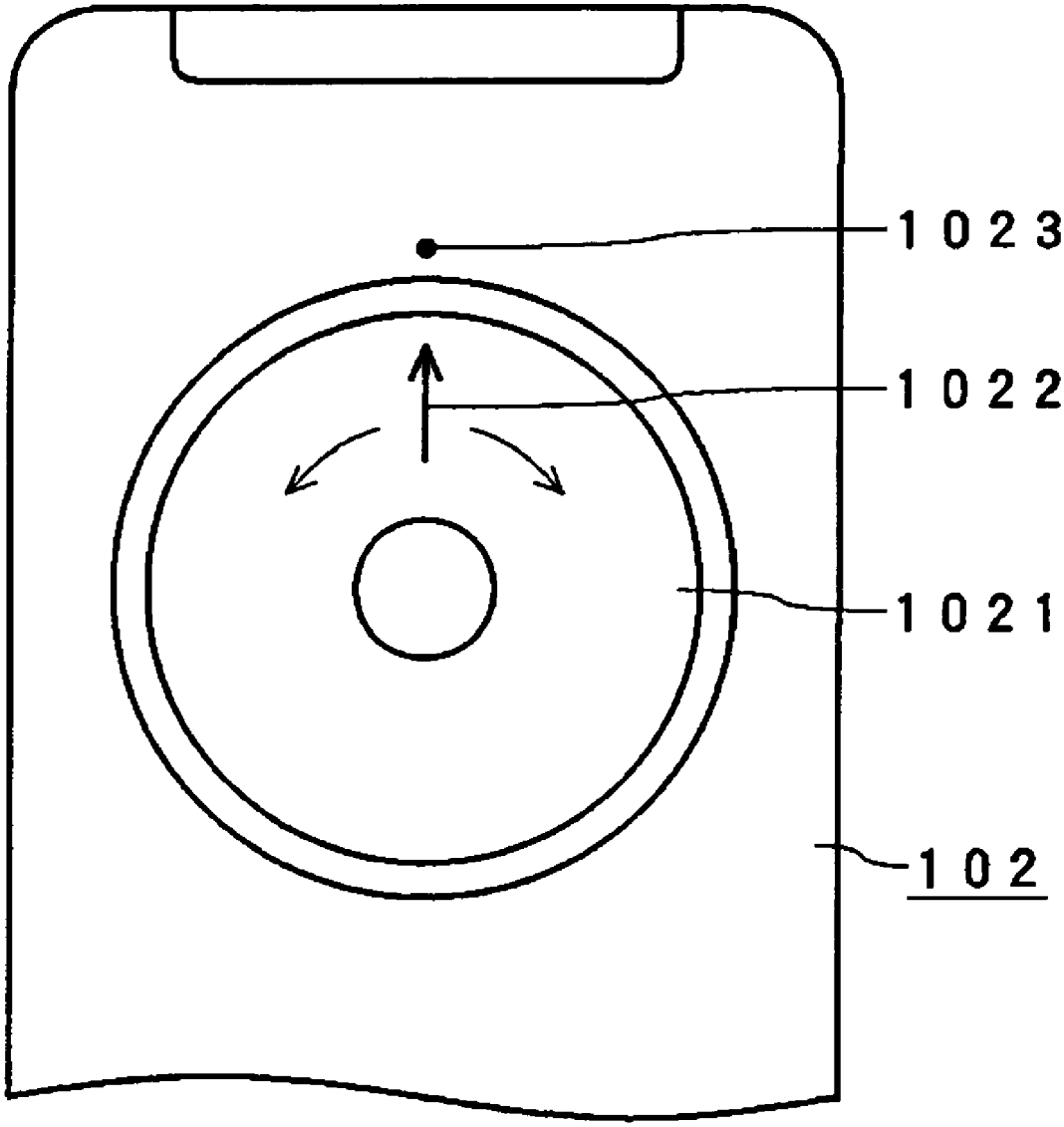
FIG. 20 illustrates a major portion of a remote controller for pointing to the forward direction of the listener in accordance with the first embodiment of the present invention.

In a first technique, the server apparatus 100 receives, via the remote-control receiver 123, a command the listener 500 inputs to the remote-control transmitter 102 to specify the forward direction of the listener 500. The remote-control transmitter 102 includes a direction indicator 1021 as shown in FIG. 20. The disk-like shaped direction indicator 1021 is rotatable around the center axis thereof, and can be pressed against onto the body of the remote-control transmitter 102.

The direction indicator 1021 is at a home position with an arrow mark 1022 pointing to a reference position mark 1023. The direction indicator 1021 is rotated by the listener 500 by an angle of rotation from the home position thereof, and is pressed by the listener 500 at that angle. The remote-control transmitter 102 then transmits, to the remote-control receiver 123, a signal representing the angle of rotation from the home position that is aligned with the forward direction of the listener 500.

When the listener 500 rotates and presses the direction indicator 1021 with the remote-control transmitter 102 aligned with the forward direction of the listener 500, the angle of rotation with reference to the forward direction of the listener 500 is indicated to the server apparatus 100. Using the direction indicator 1021, the forward direction of the listener 500 as the reference direction is determined in the layout of the plurality of speaker devices 200 forming the audio system.

Figure 21:
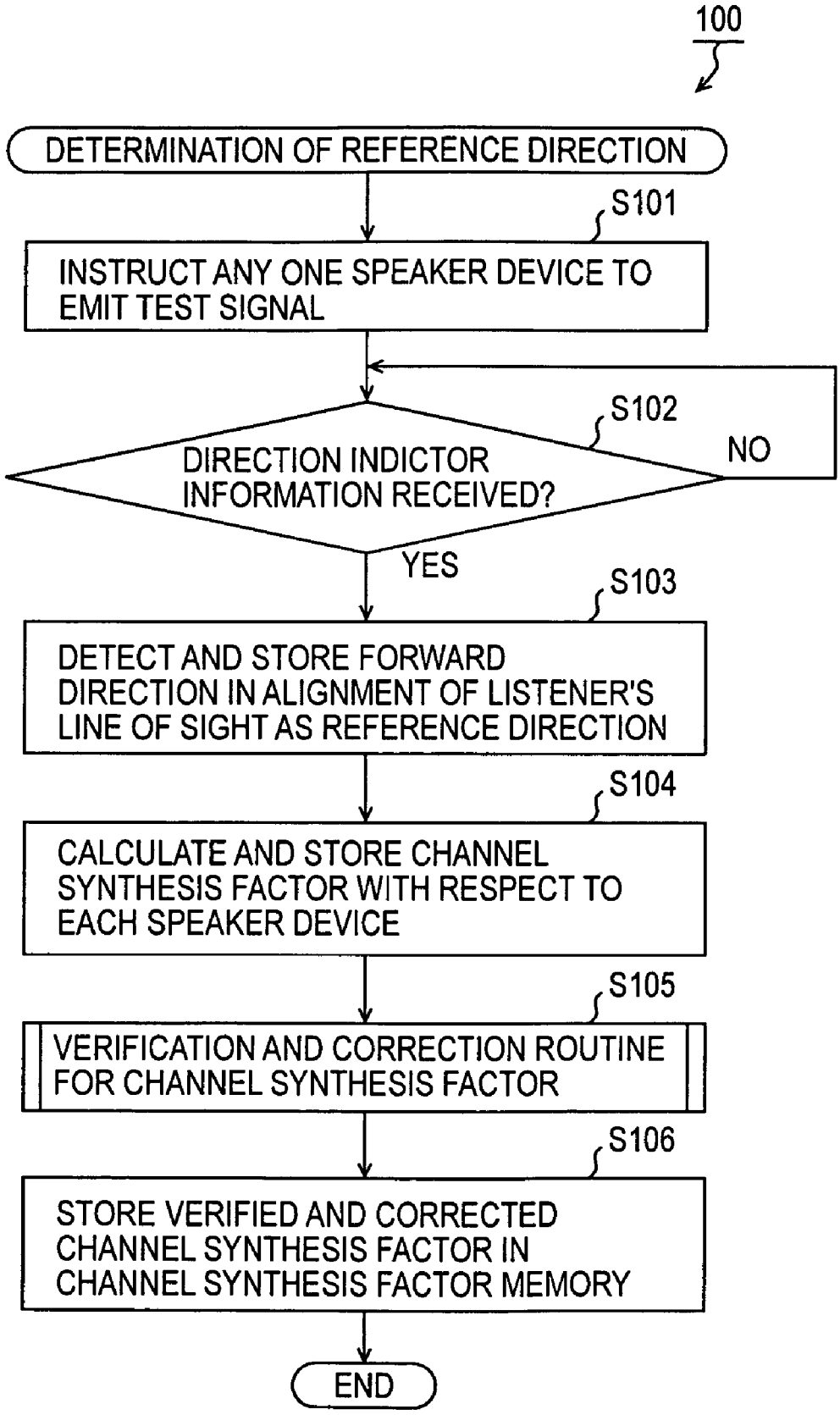
FIG. 21 is a flowchart illustrating the operation of the server apparatus that determines the forward direction of the listener as a reference direction in accordance with the first embodiment of the present invention.

FIG. 21 is a process routine of the reference direction determination process and subsequent processes of the server apparatus 100.

The CPU 110 in the server apparatus 100 unicasts the test signal and the sound emission command signal to any speaker device 200 arbitrarily selected from among the plurality of speaker devices 200 in step S101. A midrange noise or a burst signal is preferred as the test signal. A narrow-band signal is not preferable because an erroneous sound localization could result because of the effect of standing waves and reflected waves.

Upon receiving the test signal and the sound emission command signal, the speaker device 200 emits the sound of the test signal. The listener 500 rotates the direction indicator 1021 to a direction in which the speaker device 200 emits the test signal, with the home position of the remote-control transmitter 102 aligned with the forward direction of the listener 500, and then presses the direction indicator 1021 to notify the server apparatus 100 of the direction in which the test signal is heard. In other words, direction indicating information indicative of the direction of the incoming test signal with respect to the forward direction is transmitted to the server apparatus 100.

The CPU 110 in the server apparatus 100 monitors the arrival of the direction indicating information from the remote-control transmitter 102 in step S102. Upon recognizing the arrival of the direction indicating information from the remote-control transmitter 102, the CPU 110 in the server apparatus 100 detects the forward direction (reference direction) of the listener 500 in the layout configuration of the plurality of speaker devices 200 stored in the speaker layout information memory 118, and stores the direction information in the speaker layout information memory 118 in step S103.

When the reference direction is determined, the CPU 110 determines a channel synthesis factor for each of the speaker devices 200 so that the predetermined location with respect to the forward direction of the listener 500 coincides with the sound image localized by the plurality of speaker devices 200 arranged at any arbitrary locations in accordance with the 5.1-channel surround signals of the L channel, the R channel, the C channel, the LS channel, the RS channel, and the LFE channel. The calculated channel synthesis factor of each speaker device 200 is stored in the channel synthesis factor memory 119 with the ID number of the speaker device 200 associated therewith in step S104.

The CPU 110 initiates the channel synthesis factor verification and correction processor 122, thereby performing a channel synthesis factor verification and correction process in step S105. The channel synthesis factor of the speaker device 200 corrected in the channel synthesis factor verification and correction process is stored in the channel synthesis factor memory 119 for updating in step S106.

In this case, as well, the test signal can be supplied from the signal generator in the speaker device 200 rather than being supplied from the server apparatus 100.

The emission of the test signal, the response operation of the listener, and the storing of the direction information in steps S101-S103 may be performed by a plurality of times. The process routine may be applied to the other speaker devices 200. If a plurality of pieces of direction information are obtained, an averaging process may be performed to determine the reference direction.

In a second technique of the reference direction determination, the server apparatus 100 causes the speaker device 200 to emit the test sound, and receives the operational input of the listener 500 to the remote-control transmitter 102 in order to determine the forward direction of the listener 500 as the reference direction. In the second technique, one or two speaker devices 200 are caused to emit the test signal so that the sound image is localized in the forward direction of the listener 500.

The remote-control transmitter 102 used in the second technique includes a direction adjusting dial, although not shown, having a rotary control similar to the remote-control transmitter 102. In the second technique, the server apparatus 100 controls the remote-control transmitter 102 so that the image sound localization position responsive to the test signal from the speaker device 200 is located in the direction of rotation of the direction adjusting dial.

Figure 22A:
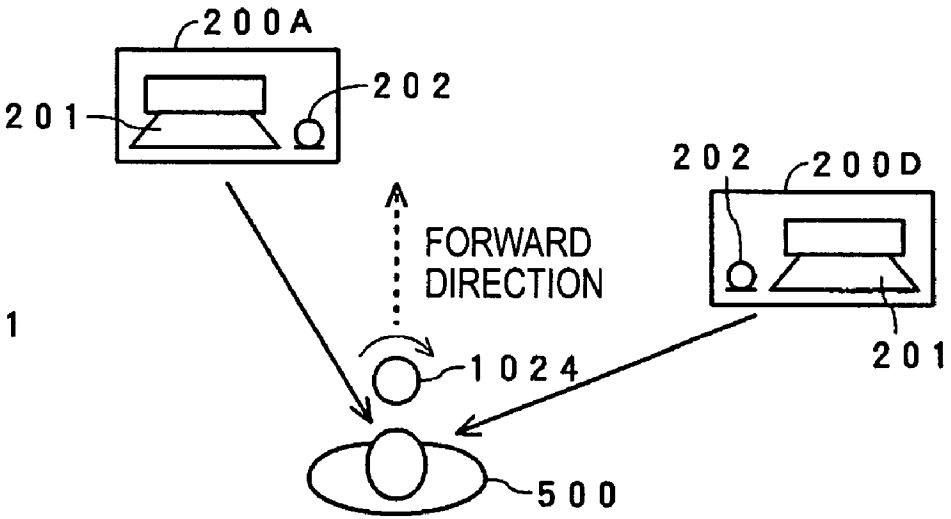
FIGS. 22A-22C illustrate a method for determining the forward direction of the listener as the reference direction in accordance with the first embodiment of the present invention.
Figure 22B:
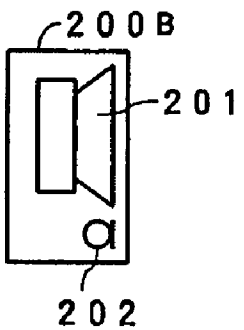
Figure 22C:
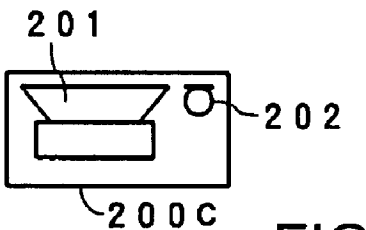

Referring to FIG. 22, the speaker device 200A now emits the test signal. Since the test signal is emitted and comes in from the left with reference to the forward direction of the listener 500, the listener 500 rotates clockwise the direction adjusting dial 1024 of the remote-control transmitter 102.

The server apparatus 100 receives an operation signal of the direction adjusting dial 1024 of the remote-control transmitter 102 through the remote-control receiver 123. The server apparatus 100 then causes the speaker device 200D, on the right side of the speaker device 200A, to emit the sound of the test signal. The server apparatus 100 controls the levels of the test signals emitted from the speaker devices 200A and 200D in accordance with the angle of rotation of the direction adjusting dial 1024, thereby adjusting the sound localization position in response to the test signals emitted from the two speakers 200A and 200D.

When the direction adjusting dial 1024 is rotated further even when the level of the test signal emitted from the speaker device 200D reaches a maximum (with the level of the test signal emitted from the speaker device 200A reaching zero), a speaker combination emitting the test signal is changed to two speaker devices 200D and 200C in the direction of rotation of the direction adjusting dial 1024.

If the direction of the sound localization responsive to the sound emission of the test signal is aligned with the forward direction of the listener 500, the listener 500 enters a decision input through the remote-control transmitter 102. In response to the decision input, the server apparatus 100 determines the forward direction of the listener 500 as the reference direction based on the combination of speaker devices 200 and the synthesis ratio of the audio signals emitted from the speaker devices 200.

Figure 23:
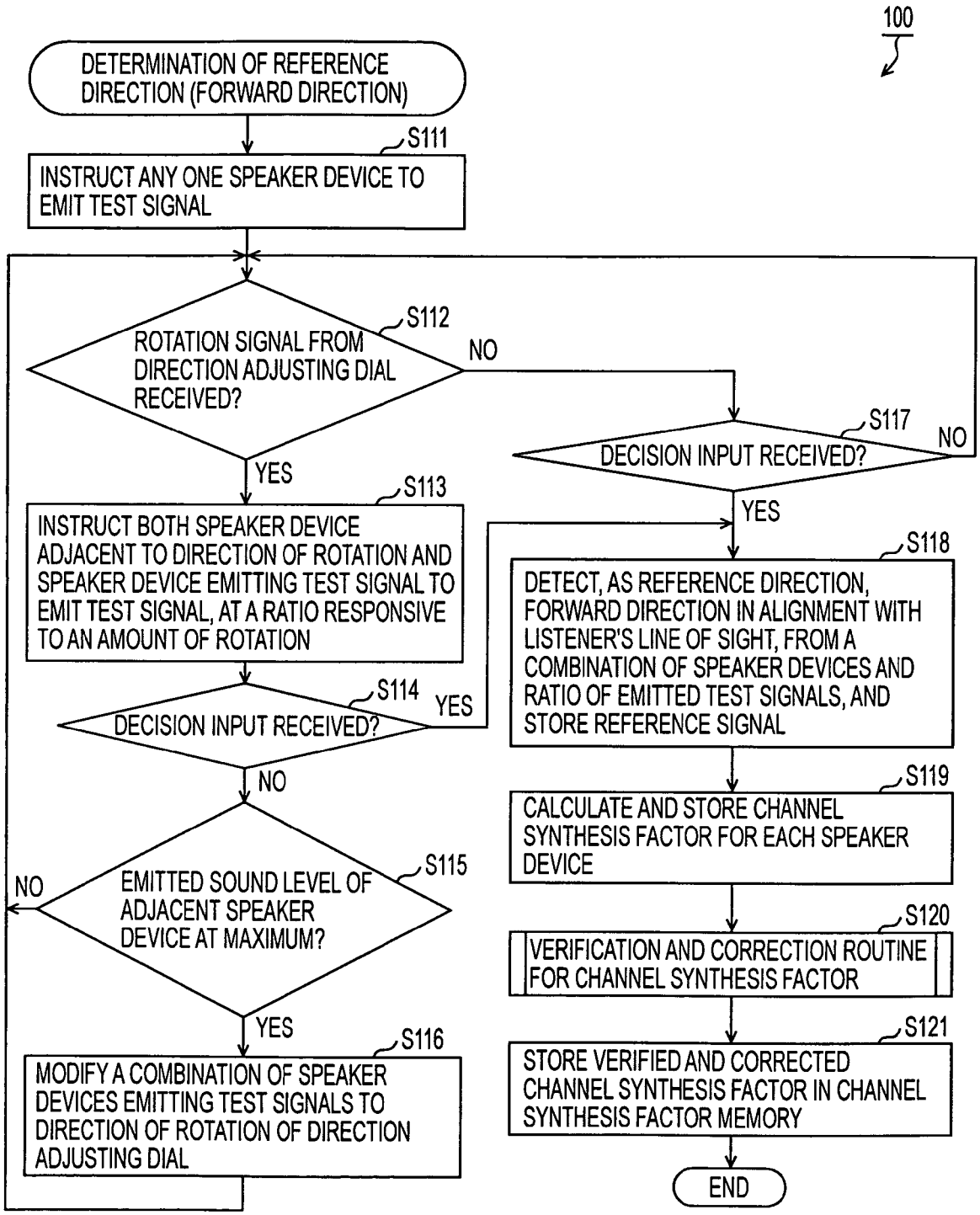
FIG. 23 is a flowchart illustrating the operation of the server apparatus that determines the forward direction of the listener as the reference direction in accordance with the first embodiment of the present invention.

FIG. 23 is a flowchart of the process routine performed by the server apparatus 100 in the reference direction determination process of the second technique.

In step S111, the CPU 110 in the server apparatus 100 unicasts the test signal and the sound emission command signal to any speaker device 200 selected from among the plurality of speaker devices 200. A midrange noise or a burst signal is preferred as the test signal. A narrow-band signal is not preferable because an erroneous sound localization could result because of the effect of standing waves and reflected waves.

Upon receiving the test signal and the sound emission command signal, the speaker device 200 emits the sound of the test signal. The listener 500 enters a decision input if the test signal is heard in the forward direction. If the test signal is not heard in the forward direction, the listener 500 rotates the direction adjusting dial 1024 of the remote-control transmitter 102 so that the sound image localization position of the heard test signal is shifted toward the forward direction of the listener 500.

The CPU 110 in the server apparatus 100 determines in step S112 whether information of the rotation input of the direction adjusting dial 1024 is received from the remote-control transmitter 102. If it is determined that no information of the rotation input of the direction adjusting dial 1024 is received, the CPU 110 determines in step S117 whether the decision input from the remote-control transmitter 102 is received. If it is determined that no decision input is received, the CPU 110 returns to step S112 to monitor the rotation input of the direction adjusting dial 1024.

If it is determined in step S112 that the information of the rotation input of the direction adjusting dial 1024 is received, the CPU 110 transmits the test signal to the speaker device 200 that is currently emitting the test signal and the speaker device 200 that is adjacent, in the direction of rotation, to the currently emitting speaker device 200. At the same time, the CPU 110 transmits a command to the two speaker devices 200 to emit the sounds of the test signals at a ratio responsive to the angle of rotation of the direction adjusting dial 1024 of the remote-control transmitter 102.

The two speaker devices 200 emit the sounds of the test signals at a ratio responsive to the angle of rotation of the direction adjusting dial 1024, and the sound image localization position responsive to the sound emission of the test signal changes in accordance with the angle of rotation of the direction adjusting dial 1024.

The CPU 110 in the server apparatus 100 determines in step S114 whether the decision input is received from the remote-control transmitter 102. If it is determined that no decision input is received, the CPU 110 determines in step S115 whether the sound emission level of the test signal from a speaker device 200 positioned adjacent in the direction of rotation is maximized.

If it is determined in step S115 that the sound emission level of the test signal from the speaker device 200 positioned adjacent in the direction of rotation is not maximized, the CPU 110 returns to step S112 to monitor the reception of the rotation input of the direction adjusting dial 1024.

If it is determined in step S115 that the sound emission level of the test signal from the speaker device 200 positioned adjacent in the direction of rotation is maximized, the CPU 110 changes the combination of the speaker devices 200 for the test signal emission to the next one in the direction of rotation of the direction adjusting dial 1024 in step S116, and returns to step S112 to monitor the reception of the rotation input of the direction adjusting dial 1024.

If it is determined in step S114 or step S117 that the decision input is received from the remote-control transmitter 102, the CPU 110 detects the forward direction (reference direction) of the listener 500 based on the combination of the speaker devices 200 that have emitted the test signal and the ratio of the sound emission of the test signals from the two speaker devices 200, and stores the resulting direction information in the speaker layout information memory 118 in step S118.

When the reference direction is determined, the CPU 110 determines a channel synthesis factor for each of the speaker devices 200 so that the predetermined location with respect to the forward direction of the listener 500 coincides with the sound image localized by the plurality of speaker devices 200 arranged at any arbitrary locations in accordance with the 5.1-channel surround signals of the L channel, the R channel, the C channel, the LS channel, the RS channel, and the LFE channel. The calculated channel synthesis factor of each speaker device 200 is stored in the channel synthesis factor memory 119 with the ID number of the speaker device 200 associated therewith in step S119.

The CPU 110 initiates the channel synthesis factor verification and correction processor 122, thereby performing a channel synthesis factor verification and correction process in step S120. The channel synthesis factor of the speaker device 200 corrected in the channel synthesis factor verification and correction process is stored in the channel synthesis factor memory 119 for updating in step S121.

A pair of operation keys for respectively indicating clockwise and counterclockwise rotations may be used instead of the direction adjusting dial 1024.

A third technique for reference direction determination dispenses with the operation of the remote-control transmitter 102 by the listener 500. In the third technique, a voice produced by the listener is captured by the microphone 202 of the speaker device 200 in the listener-to-speaker distance measurement discussed with reference to the flowchart of FIG. 12, and the record signal of the voice is used. The record signal of the speaker device 200 is stored in the RAM 112 of the server apparatus 100 in step S45 of FIG. 12. The forward direction of the listener 500 is detected using the record information stored in the RAM 112.

The third technique takes advantage of the property that the directivity pattern of the human voice is bilaterally symmetrical, and that the midrange component of the voice is maximized in the forward direction of the listener 500 while being minimized in the backward direction of the listener 500.

Figure 24:
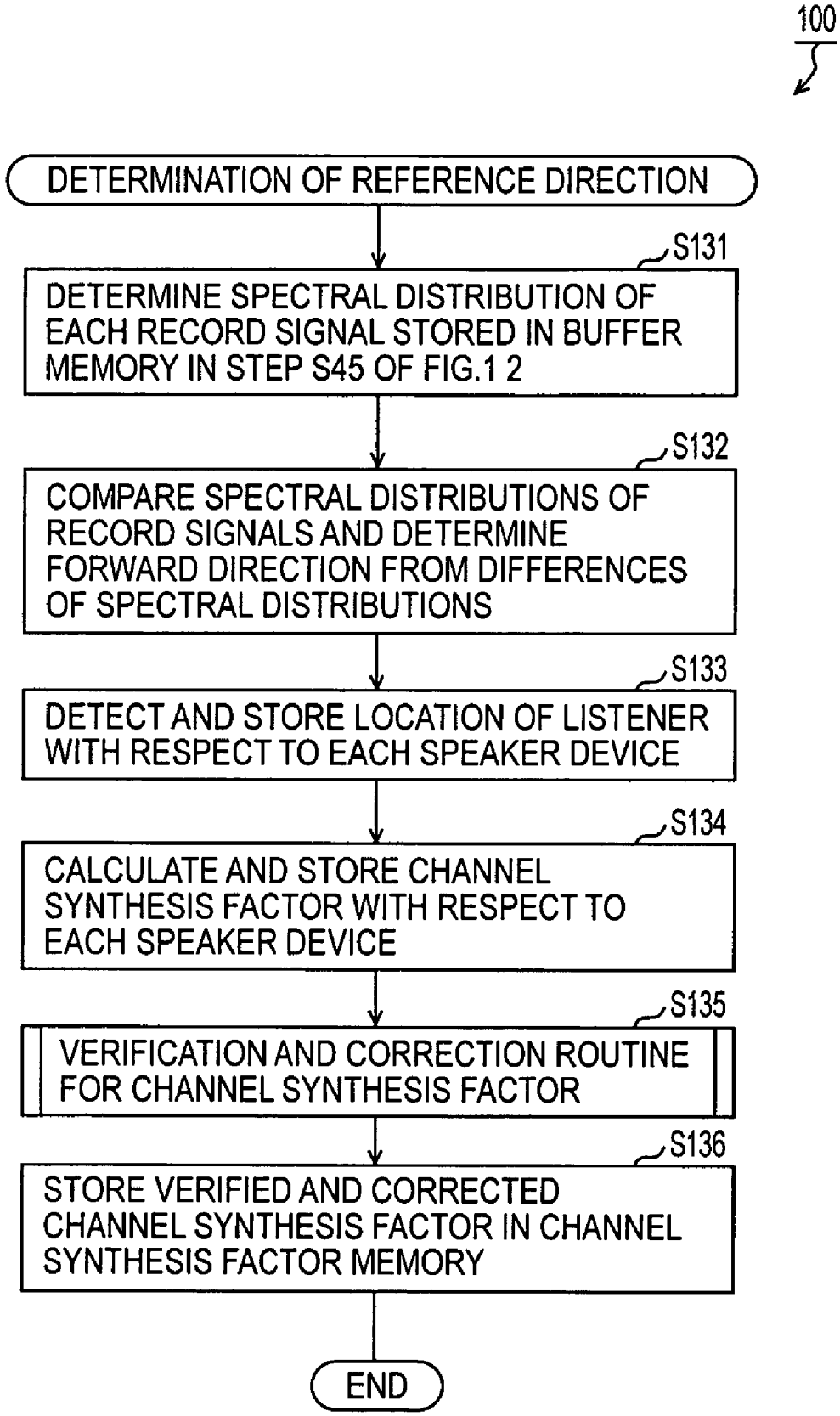
FIG. 24 is a flowchart illustrating the operation of the server apparatus that determines the forward direction of the listener as the reference direction in accordance with the first embodiment of the present invention.

FIG. 24 is a flowchart of a process routine of the server apparatus 100 that performs the reference direction determination in accordance with the third technique.

In accordance with the third technique, the CPU 110 in the CPU 110 determines in step S131 a spectral distribution of the record signal of the sound emitted by the listener 500. The sound of the listener 500 is the one that is captured by the microphone 202 in each speaker device 200 and stored as the record signal in the RAM 112 in step S45 of FIG. 12. The spectral intensity of the record signal is corrected in accordance with a distance DLi between the listener 500 and each speaker device 200, taking into consideration the attenuation of sound with distance of propagation.

The CPU 110 compares the spectral distributions of the record signal of the speaker devices 200 and estimates the forward direction of the listener 500 from a difference in characteristics in step S132. With the estimated forward direction as a reference direction, the CPU 110 detects the layout configuration of the plurality of speaker devices 200 with respect to the listener 500. The layout configuration information is stored together with the estimated forward direction in the speaker layout information memory 118 in step S133.

When the reference direction is determined, the CPU 110 determines a channel synthesis factor for each of the speaker devices 200 so that the predetermined location with respect to the forward direction of the listener 500 coincides with the sound image localized by the plurality of speaker devices 200 arranged at any arbitrary locations in accordance with the 5.1-channel surround signals of the L channel, the R channel, the C channel, the LS channel, the RS channel, and the LFE channel. The calculated channel synthesis factor of each speaker device 200 is stored in the channel synthesis factor memory 119 with the ID number of the speaker device 200 associated therewith in step S134.

The CPU 110 initiates the channel synthesis factor verification and correction processor 122, thereby performing a channel synthesis factor verification and correction process in step S135. The channel synthesis factor of the speaker device 200 corrected in the channel synthesis factor verification and correction process is stored in the channel synthesis factor memory 119 for updating in step S136.

The layout configuration of the plurality of speaker devices 200 forming the audio system is calculated and the channel synthesis factor for generating the speaker signal to be supplied to each speaker device 200 is calculated. Based on the calculated the channel synthesis factor, the server apparatus 100 generates and supplies the speaker signals to the speaker devices 200 via the bus 300. In response to a multi-channel audio signal from a music source, such as a disk, the server apparatus 100 localizes the sound image of the audio output of each channel at a predetermined location in audio playing.

The channel synthesis factor is not the one that is verified by causing the speaker device 200 to play the speaker signal, but the one produced described above. Depending on the acoustic space within which the speaker devices 200 are actually set up, the sound localization location of the sound image responsive to the audio output of each channel can be deviated.

In the first embodiment, the CPU 110 verifies that the channel synthesis factor of each speaker device 200 is actually appropriate, and corrects the channel synthesis factor if necessary. The verification and correction process of the server apparatus 100 is described below with reference to flowcharts of FIGS. 25 and 26.

In the first embodiment, the server apparatus 100 checks channel by channel whether the sound image responsive to the audio signal of each channel is localized at a predetermined location, and corrects the channel synthesis factor if necessary.

In step S141, the CPU 110 generates a speaker test signal to check the image sound localized state of the audio signal for an m-th channel using the channel synthesis factor stored in the channel synthesis factor memory 119.

If the m-th channel=channel L, the server apparatus 100 generates the speaker test signal for each speaker device 200 for each of the channel L audio signals. Each speaker test signal is obtained by reading a factor wLi for the channel L, from among the channel synthesis factors of the speaker device 200, and multiplying the test signal by the factor wLi.

In step S142, the CPU 110 generates the packet of FIG. 2, including the calculated speaker test signal, and transmits the packet to all speaker devices 200 via the bus 300. The CPU 110 in the server apparatus 100 broadcasts the trigger signal to all speaker devices 200 via the bus 300 in step S143.

All speaker devices 200 receive the speaker test signal transmitted via the bus 300, and emit the sound of the test signal. If any speaker device 200 has a factor wLi=0, that speaker emits no sound.

All speaker devices 200 start recording the sound captured by the microphone 202 thereof, as the audio signal, in captured signal buffer memory 219 as the ring buffer. Upon receiving the trigger signal, the speaker device 200 starts recording the audio signal for a rated duration of time in response to the trigger signal, and packetizes the record signal for the rated duration of time in order to transmit the packet to the server apparatus 100.

The CPU 110 in the server apparatus 100 waits for the arrival of the record signal for the rated duration of time from the speaker device 200 in step S144, and upon detection of the arrival of the record signal, stores the record signal in the RAM 112 in step S145.

The CPU 110 repeats steps S144 and S145 until the server apparatus 100 receives the record signals for the rated duration of time from all speaker devices 200. When the CPU 110 verifies that the record signal of the rated duration of time has been received from all speaker devices 200 in step S146, the CPU 110 calculates the transfer characteristic of the record signal for the rated duration of time from each speaker device 200, and analyzes frequency of the record signal. In step S147, the CPU 110 analyzes the transfer characteristic and frequency analysis result as to whether the sound image responsive to the sound emission of the test signal for the m-th channel is localized at a predetermined location.

Figure 25:
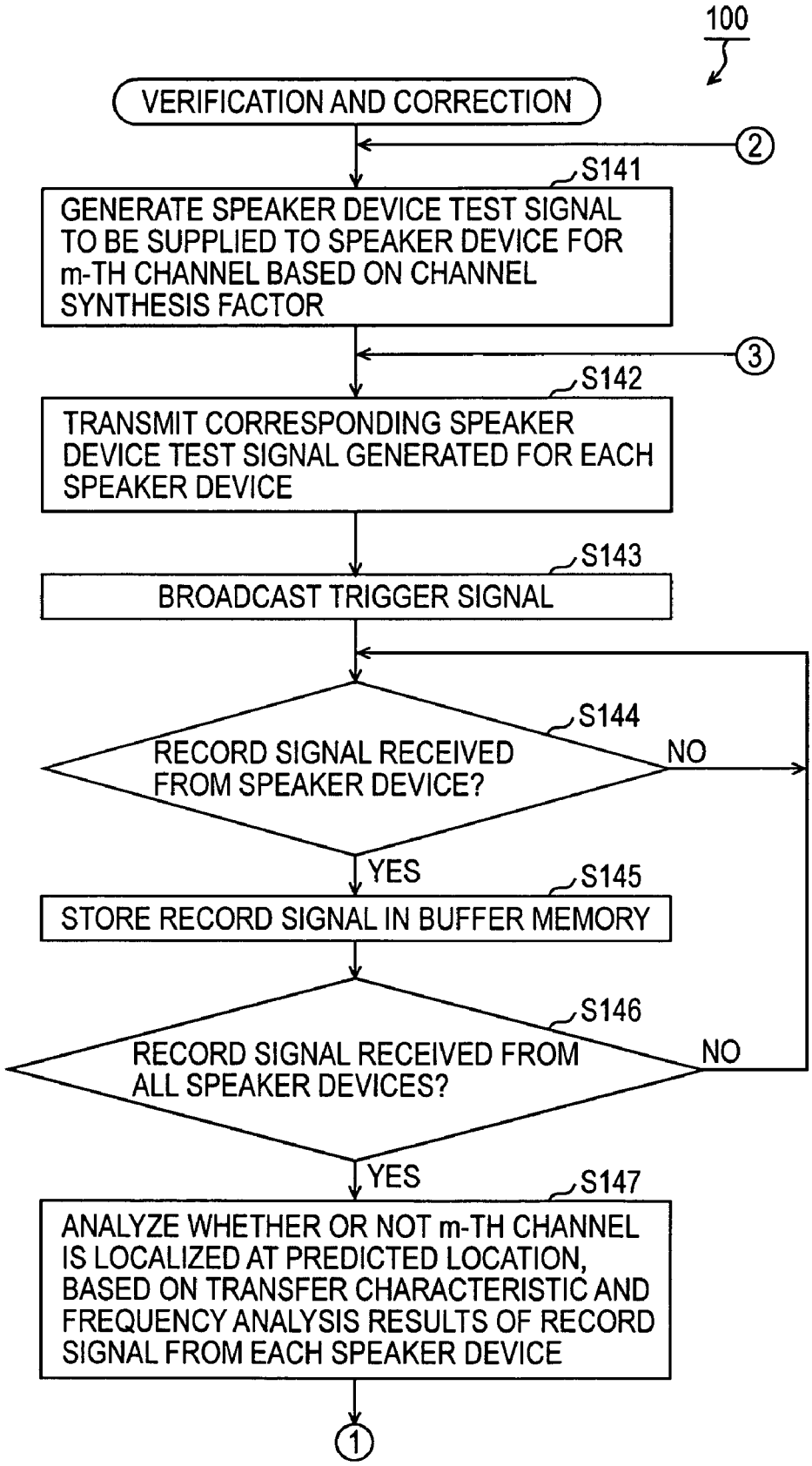
FIG. 25 is a flowchart illustrating the operation of the server apparatus that performs a verification and correction process on a channel synthesis factor in accordance with the first embodiment of the present invention.
Figure 26:
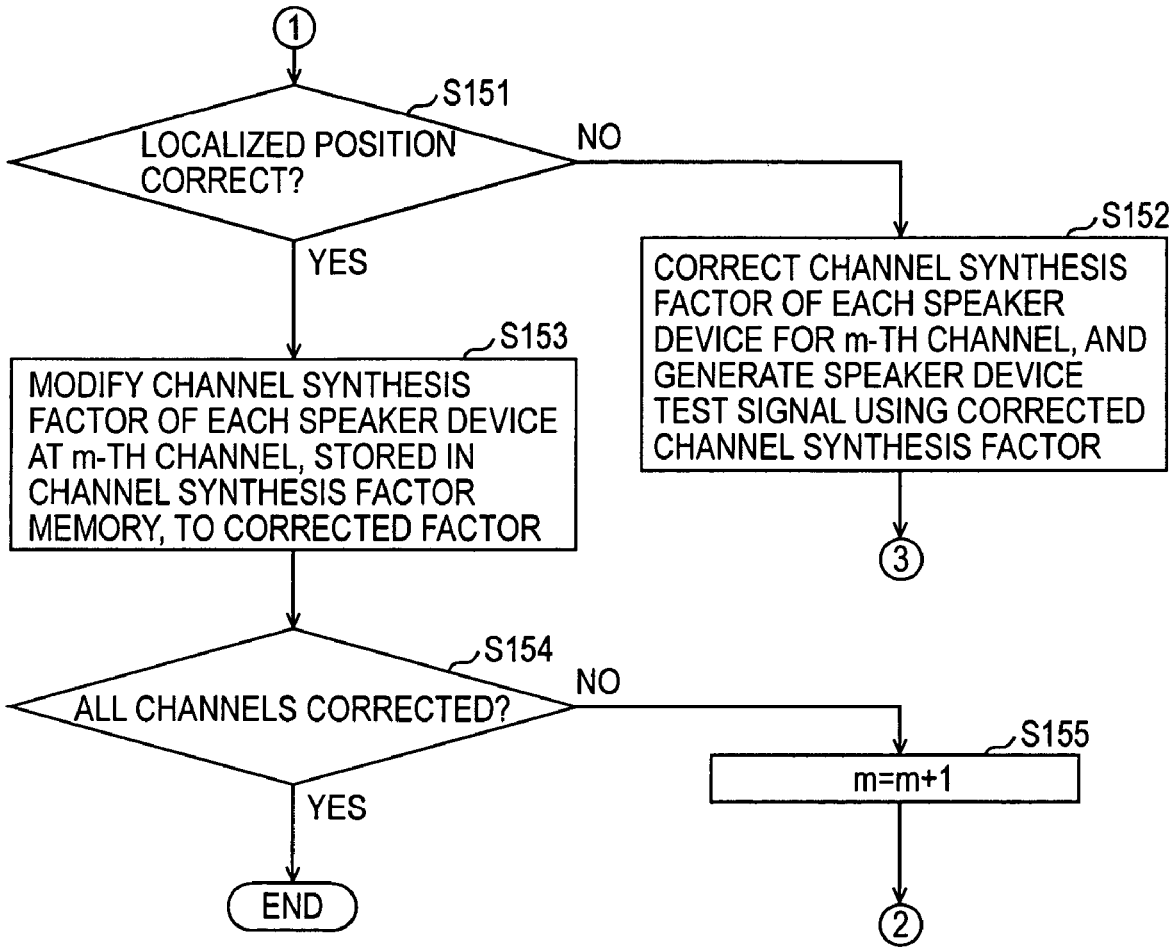
FIG. 26 is a flowchart illustrating the operation of the server apparatus that performs the verification and correction process on the channel synthesis factor in accordance with the first embodiment of the present invention.

Based on the analysis result, the CPU 110 determines in step S151 of FIG. 25 whether the sound image responsive to the sound emission of the test signal for the m-th channel is localized at a predetermined location. If it is determined that the sound image is not localized at the predetermined location, the server apparatus 100 corrects the channel synthesis factor of each speaker device 200 for the m-th channel, stores the corrected channel synthesis factor in the buffer memory, and generates the speaker test signal for each speaker for the m-th channel using the corrected channel synthesis factor (step S152).

Returning to step S142, the CPU 110 supplies each speaker test signal, generated using the corrected channel synthesis factor generated in step S152, to each speaker device 200 via the bus 300. The CPU 110 repeats the process in step S142 and subsequent steps.

If it is determined in step S151 that the sound image responsive to the sound emission of the test signal at the m-th channel is localized at the predetermined location, the CPU 110 updates the channel synthesis factor of each speaker at the m-th channel stored in the channel synthesis factor memory 119 with the corrected one in step S153.

The CPU 110 determines in step S154 whether the correction of the channel synthesis factors of all channels is complete. If it is determined that the correction of the channel synthesis factors is not complete, the CPU 110 specifies a next channel to be corrected (m=m+1) in step S155. The CPU 110 returns to step S141 to repeat the process in step S141 and subsequent steps.

If it is determined in step S154 that the correction of the channel synthesis factors of all channels is complete, the CPU 110 ends the process routine.

In accordance with the first embodiment, the layout configuration of the plurality of speaker devices 200 arranged at arbitrary locations is automatically detected, the appropriate speaker signal to be supplied to each speaker device 200 is automatically generated based on the information of the layout configuration. Whether the generated speaker signal actually forms an appropriate acoustic field is verified, and the speaker signal is corrected if necessary.

The verification and correction process of the channel synthesis factor in the first embodiment is not limited to the case where the layout configuration of the plurality of speaker devices arranged at arbitrary locations is automatically detected. Alternatively, a user enters settings in the server apparatus 100, and the server apparatus 100 calculates the channel synthesis factor based on the setting information. In this case, the verification and correction process may be performed to determine whether an optimum acoustic field is formed from the calculated channel synthesis factor.

In other words, a rigorously accurate determination of the layout configuration of the speaker devices 200 arranged at arbitrary locations is not required at first. The layout configuration is roughly set up first, and the channel synthesis factor based on the information of the layout configuration is corrected in the verification and correction process. A channel synthesis factor creating an optimum acoustic field thus results.

In the above discussion, the verification and correction process is performed on each channel synthesis factor on a channel-by-channel basis. If the speaker test signals for different channels are separately generated from the audio signal captured by the microphone 202, channel synthesis factors for a plurality of channels are subjected to the verification and correction process at the same time.

A speaker test signal of a different channel is generated from each of a plurality of test signals separated by frequency by a filter, and the speaker test signals are emitted from the respective speaker devices 200 at the same time.

Each speaker device 200 separates the audio signal of the speaker test signal captured by the microphone 202 into an audio signal component by a filter, and performs the verification and correction process on each separated audio signal as described previously. In this way, the channel synthesis factors are concurrently corrected in the verification and correction process on a plurality of channels.

In this case, as well, the test signal can be supplied from the signal generator in the speaker device 200 rather than being supplied from the server apparatus 100.

Second Embodiment

Figure 27:
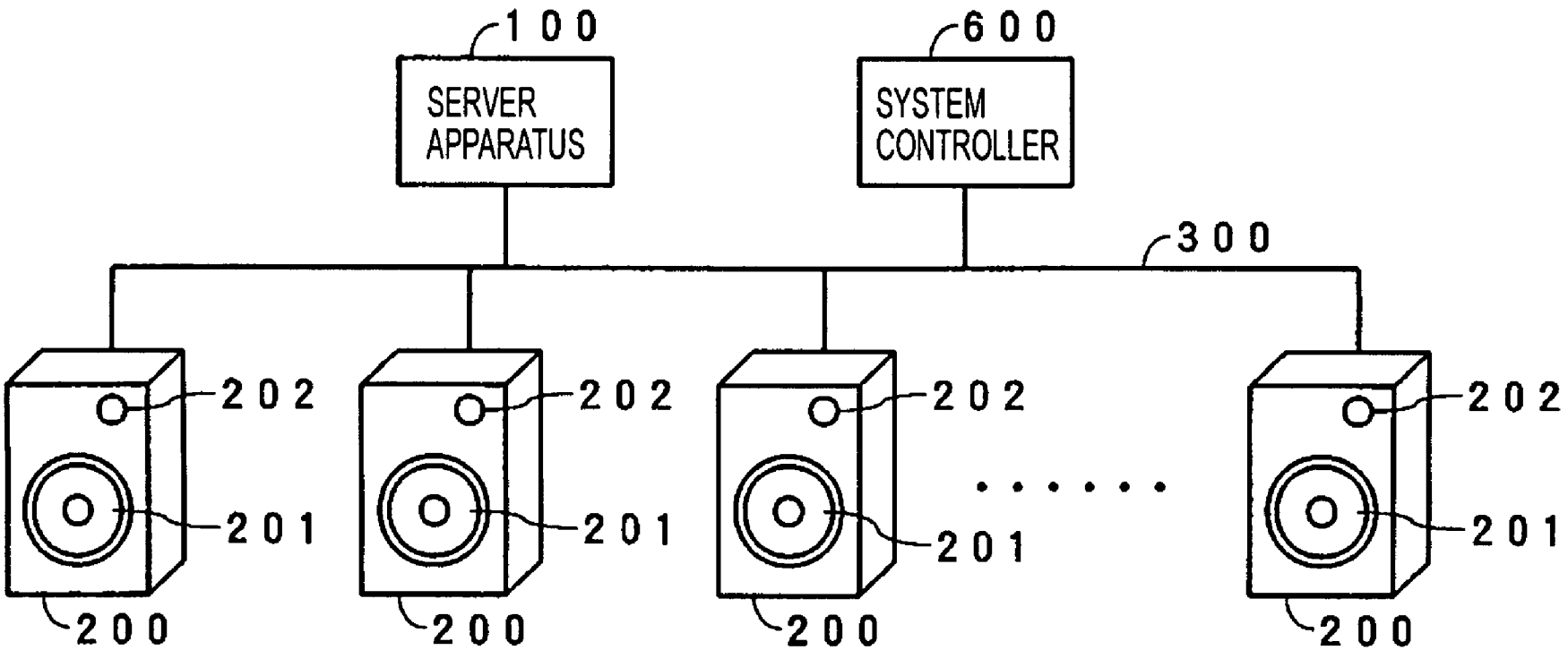
FIG. 27 illustrates a system configuration of an audio system in accordance with a second embodiment of the present invention.

FIG. 27 is a block diagram illustrating the entire structure of an audio system in accordance with a second embodiment of the present invention. In the second embodiment, a system controller 600, separate from the server apparatus 100, and the plurality of speaker devices 200, are connected to each other via the bus 300.

In the second embodiment, the server apparatus 100 has no function for generating each speaker signal from a multi-channel audio signal. Each speaker device 200 has a function for generating a speaker signal therefor.

Figure 28A:
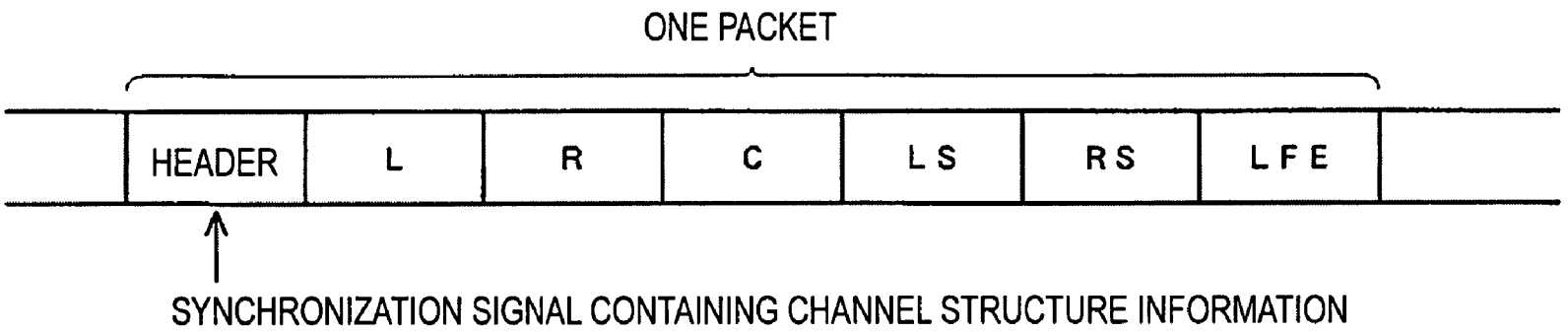
FIGS. 28A and 28B illustrate signals supplied to each of a plurality of speaker devices from a server apparatus in accordance with the second embodiment of the present invention.

The server apparatus 100 transmits, via the bus 300, audio data in the form of a packet in which a multi-channel audio signal is packetized every predetermined period of time. The audio data as the 5.1-channel surround signal transmitted from the server apparatus 100 contains, in one packet, an L-channel signal, an R-channel signal, a center-channel signal, an LS-channel signal, an RS-channel signal, and an LFE-channel signal as shown in FIG. 28A.

The multi-channel audio data L, R, C, LS, RS, and LFE contained in one packet is compressed. If the bus 300 works at a high-speed data rate, it is not necessary to compress the audio data L, R, C, LS, RS, and LFE. It is sufficient to transmit the audio data at a high-speed data rate.

Each speaker device 200 buffers one-packet information transmitted from the server apparatus 100 in the RAM, generates a speaker signal thereof using the stored channel synthesis factor, and emits the generated speaker signal from the speaker 201 in synchronization with the synchronization signal contained in the packet header.

Figure 28B:
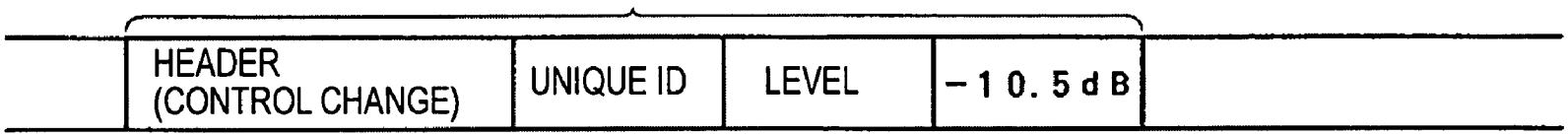

In accordance with the second embodiment, the packet header portion contains control change information as shown in FIG. 28B.

The system controller 600 has the detection function of the number of speaker devices 200, the ID number assignment function for each speaker device 200, the layout configuration detection function of the plurality of speaker devices 200, the detection function of the forward direction of the listener, and the sound image localization verification and correction function, although the server apparatus 100 has these functions in the first embodiment.

Figure 29:
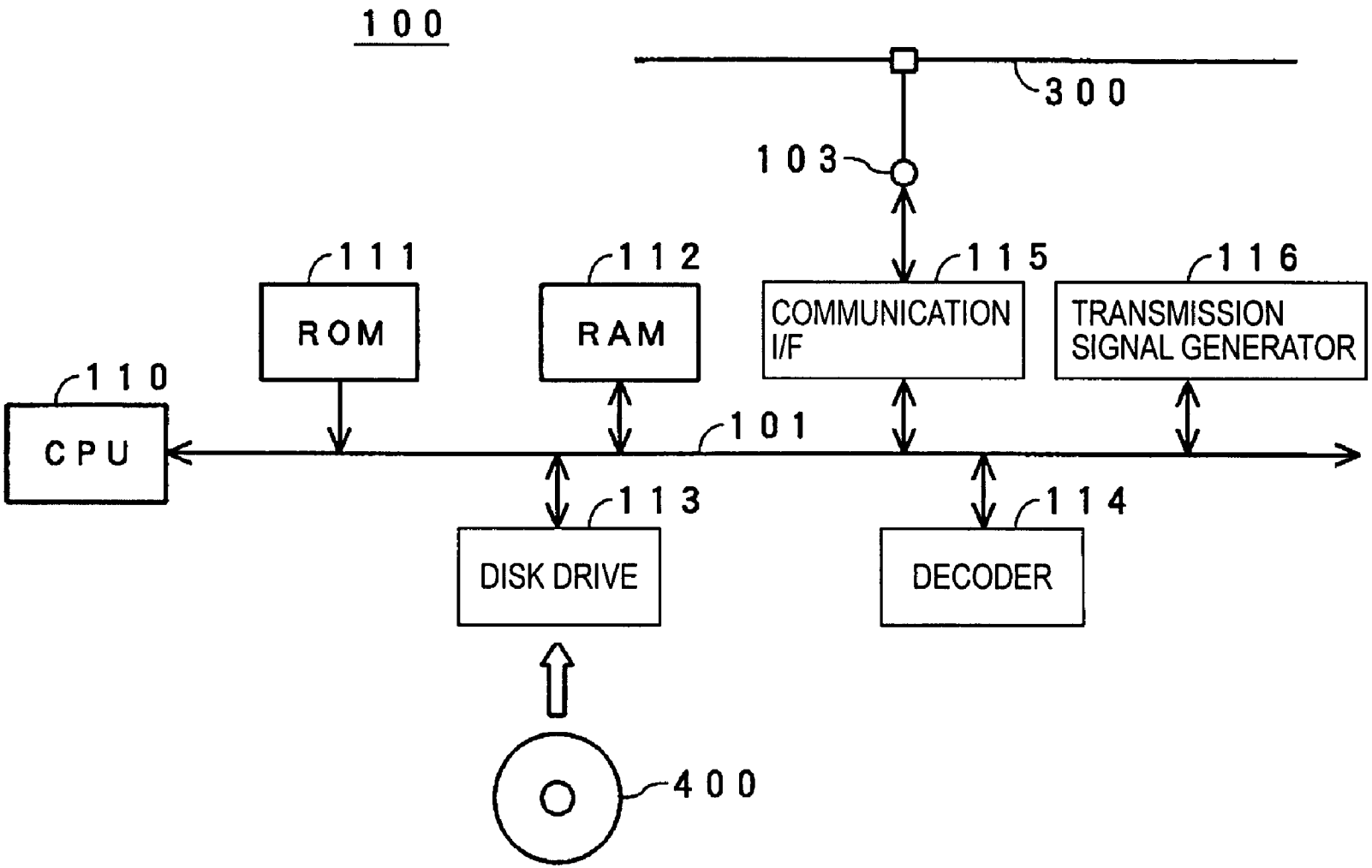
FIG. 29 illustrates the hardware structure of the server apparatus in accordance with the second embodiment of the present invention.

FIG. 29 illustrates the hardware structure of the server apparatus 100 in accordance with the second embodiment. The server apparatus 100 of the second embodiment includes the CPU 110, the ROM 111, the RAM 112, the disk drive 113, the decoder 114, the communication I/F 115, and the transmission signal generator 116, all mutually connected to each other via the system bus 101.

The server apparatus 100 of the second embodiment packetizes the multi-channel audio signal read from the disk 400 every predetermined period of time as shown in FIGS. 28A and 28B, and transmits the packet to each speaker device 200 via the bus 300. The server apparatus 100 of the second embodiment has no other functions of the server apparatus 100 of the first embodiment.

Figure 30:
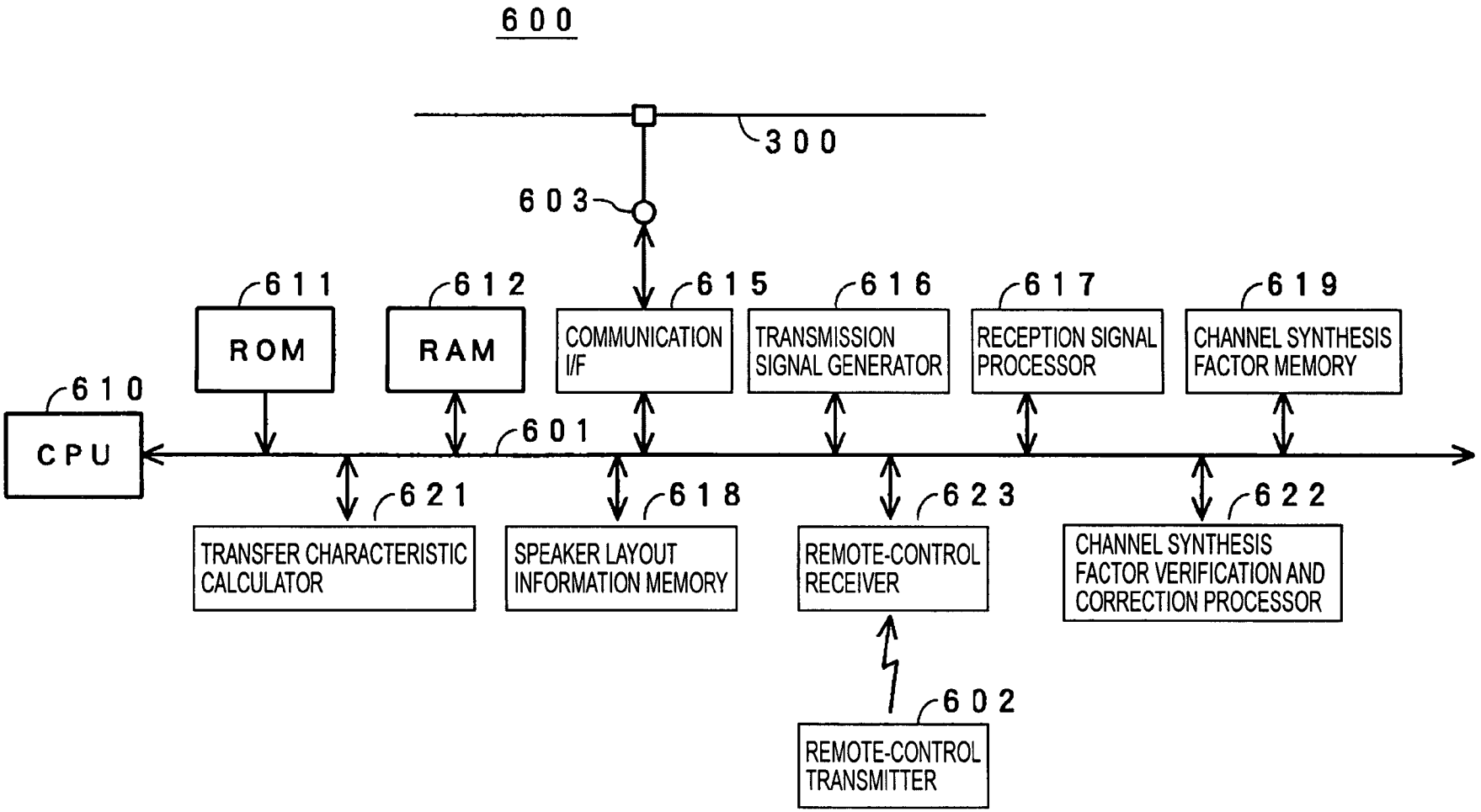
FIG. 30 illustrates the hardware structure of a system controller in accordance with the second embodiment of the present invention.

FIG. 30 illustrates the hardware structure of the system controller 600 of the second embodiment. The system controller 600 of FIG. 30 is identical in structure to the system control function unit in the server apparatus 100 of the first embodiment.

More specifically, the system controller 600 includes a CPU 610, an ROM 611, an RAM 612, a communication I/F 615, a transmission signal generator 616, a reception signal processor 617, a speaker layout information memory 618, a channel synthesis factor memory 619, a transfer characteristic calculator 621, a channel synthesis factor verification and correction processor 622, and a remote-control receiver 623, all mutually connected to each other via a system bus 601.

The system controller 600 shown in FIG. 30 is identical in structure to the server apparatus 100 of the first embodiment shown in FIG. 3 with the disk drive 113, the decoder 114, and the speaker signal generator 120 removed therefrom.

Figure 31:
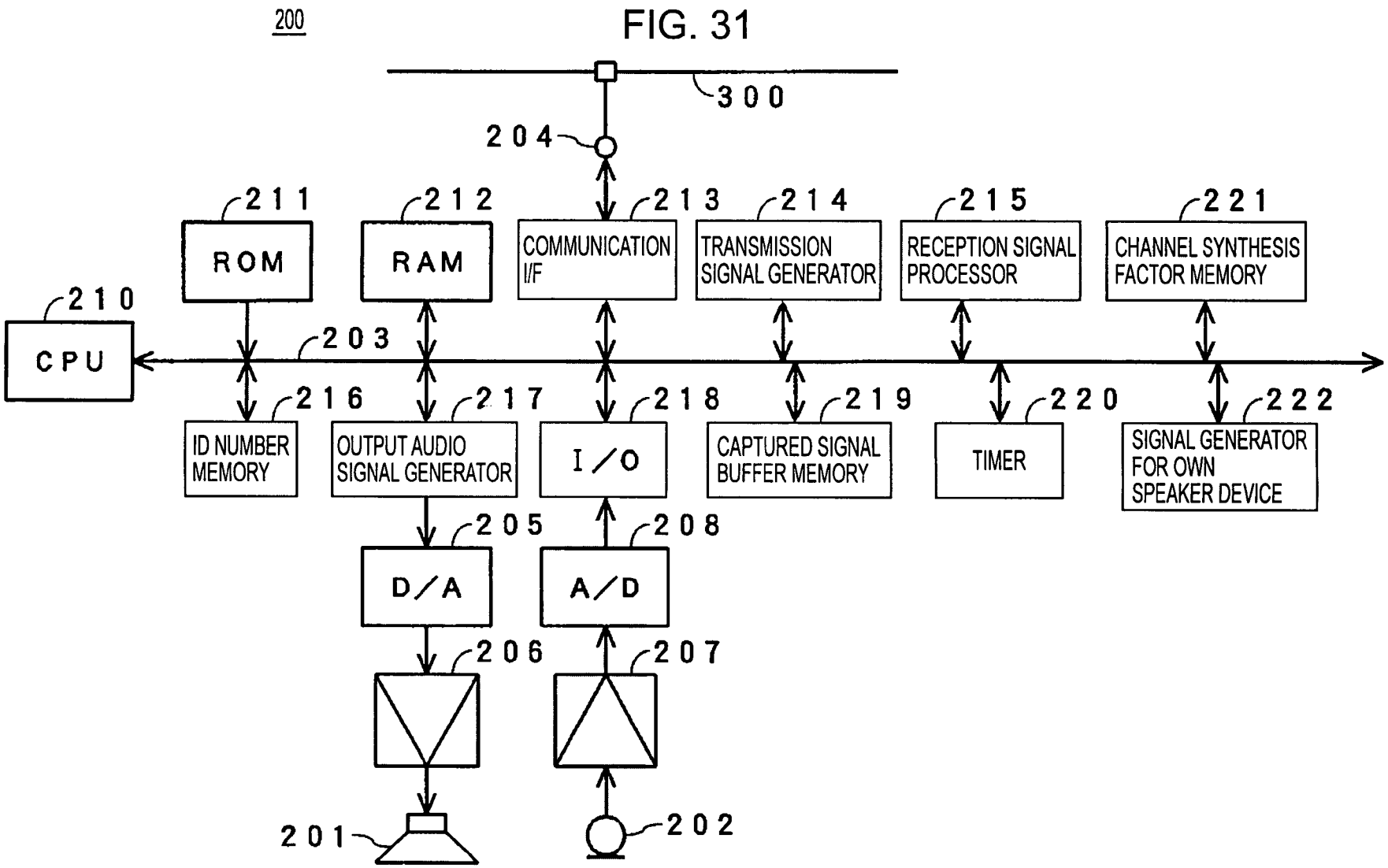
FIG. 31 is a block diagram illustrating the speaker device in accordance with the second embodiment of the present invention.

FIG. 31 illustrates the hardware structure of the speaker device 200 in accordance with the second embodiment. The speaker device 200 of the second embodiment shown in FIG. 30 is identical in structure to the speaker device 200 of the first embodiment discussed with reference to FIG. 4 with a channel synthesis factor memory 221 and a own speaker signal generator 222 attached thereto.

As the server apparatus 100 of the first embodiment, the system controller 600 of the second embodiment calculates the layout configuration of the plurality of speaker devices 200 based on the audio signal captured by the microphone 202 of each speaker device 200, and detects the forward direction of a listener as a reference signal in the layout configuration of the plurality of speaker devices 200. The detected layout configuration of the speaker devices 200 is stored in the speaker layout information memory 618. Based on information of the layout configuration, a channel synthesis factor of each speaker device 200 is calculated, and the calculated channel synthesis factor is stored in the channel synthesis factor memory 619.

The system controller 600 transmits the calculated channel synthesis factor of each speaker device 200 to the corresponding speaker device 200 via the bus 300.

The speaker device 200 receives the channel synthesis factor thereof from the system controller 600 and stores the channel synthesis factor in the channel synthesis factor memory 221. The speaker device 200 captures the multi-channel audio signal of FIGS. 28A and 28B from the server apparatus 100, and generates own speaker signal with the own-speaker signal generator 222 using the channel synthesis factor stored in the channel synthesis factor memory 221, and emits the sound of the speaker signal from the speaker 201.

Furthermore, the system controller 600 corrects the channel synthesis factor with the channel synthesis factor verification and correction processor 622 in the same way as in the first embodiment, and stores the corrected channel synthesis factor in the channel synthesis factor memory 619. The system controller 600 then transmits the corrected channel synthesis factors to the corresponding speaker devices 200 via the bus 300.

Upon receiving the channel synthesis factor, each speaker device 200 updates the content of the channel synthesis factor memory 221 with the corrected channel synthesis factor.

As in the first embodiment, a desired acoustic field is easily achieved by initiating the channel synthesis factor verification and correction process in the second embodiment when the layout configuration of the speaker devices 200 is slightly modified in the second embodiment.

In the second embodiment, the functions assigned to the system controller 600 may be integrated into the functions of the server apparatus 100, or the functions of one of the speaker devices 200.

Third Embodiment

As the audio system of the first embodiment of FIG. 1, an audio system of a third embodiment of the present invention includes the server apparatus 100 and the plurality of speaker devices 200 connected to the server apparatus 100 via the bus 300. Each of the speaker devices 200 has the functions of the system controller 600.

As in the second embodiment, the server apparatus 100 in the third embodiment has no function for generating each speaker signal from a multi-channel audio signal. Each speaker device 200 has a function for generating a speaker signal therefor. The server apparatus 100 transmits, via the bus 300, audio data in the form of a packet in which a multi-channel audio signal is packetized every predetermined period of time as shown in FIG. 28A. In the third embodiment, the packet for control change of FIG. 28B is effective.

Each speaker device 200 buffers one-packet information transmitted from the server apparatus 100 in the RAM thereof, generates a speaker signal thereof using the stored channel synthesis factor, and emits the generated speaker signal from the speaker 201 in synchronization with the synchronization signal contained in the packet header.

Figure 32:
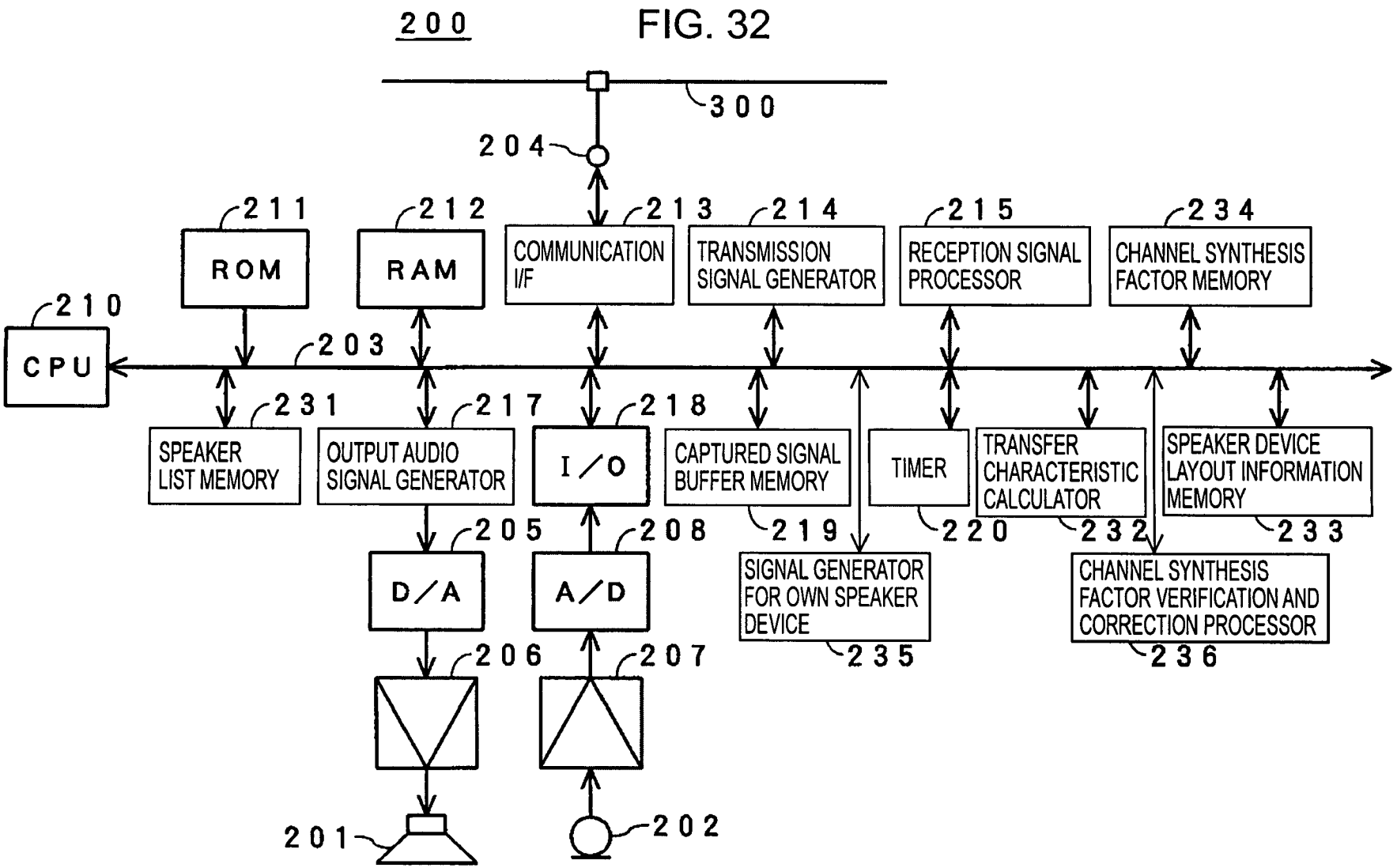
FIG. 32 is a block diagram illustrating the hardware structure of the speaker device in accordance with a third embodiment of the present invention.

The server apparatus 100 of the third embodiment has the same structure as the one shown in FIG. 29. The speaker device 200 of the third embodiment has the same hardware structure as the one shown in FIG. 32. In addition to the elements of the speaker device 200 of the first embodiment show in FIG. 4, the speaker device 200 of the third embodiment includes a speaker list memory 231 in place of the ID number memory 216, a speaker device layout information memory 233, a channel synthesis factor memory 234, an own-speaker device signal generator 235, and a channel synthesis factor verification and correction processor 236.

The speaker list memory 231 stores a speaker list including the ID number of own speaker device 200 and the ID numbers of the other speaker devices 200.

The transfer characteristic calculator 232 and the channel synthesis factor verification and correction processor 236 can be implemented in software as in the preceding embodiments.

In the third embodiment, each speaker device 200 stores, in the speaker list memory 231, the ID numbers of the plurality of speaker devices 200 forming the audio system for management. Each speaker device 200 calculates the layout configuration of the plurality of speaker devices 200 forming the audio system as will be discussed later, and stores information of the calculated layout configuration of the speaker devices 200 in the speaker device layout information memory 233.

Each speaker device 200 calculates the channel synthesis factor thereof based on the speaker layout information in the speaker device layout information memory 233, and stores the calculated channel synthesis factor in the channel synthesis factor memory 234.

Each speaker device 200 reads the channel synthesis factor thereof from the channel synthesis factor memory 234, generates the speaker signal for own speaker device 200 with the own speaker device signal generator 235, and emits the sound of the speaker signal from the speaker 201.

The channel synthesis factor verification and correction processor 236 in each speaker device 200 performs a verification and correction process on the channel synthesis factor of each speaker device 200 as will be discussed later, and updates the storage content of the channel synthesis factor memory 234 with the correction result. During the verification and correction process of the channel synthesis factor, the channel synthesis factors corrected by the speaker devices 200 are averaged and resulting channel synthesis factors are stored in the channel synthesis factor memory 234 of the respective speaker devices 200.

As previously described, the user can set and register, in own speaker device 200, the number of speaker devices 200 connected to the bus 300 and the ID numbers of the speaker devices 200 connected to the bus 300. In the third embodiment, the detection function of detecting the number of speaker devices 200 connected to the bus 300 and the ID number assignment function of assigning the ID numbers to the respective speaker devices 200 are automatically performed in each speaker device 200 in cooperation with the other speaker devices 200 as described below.

Figure 33:
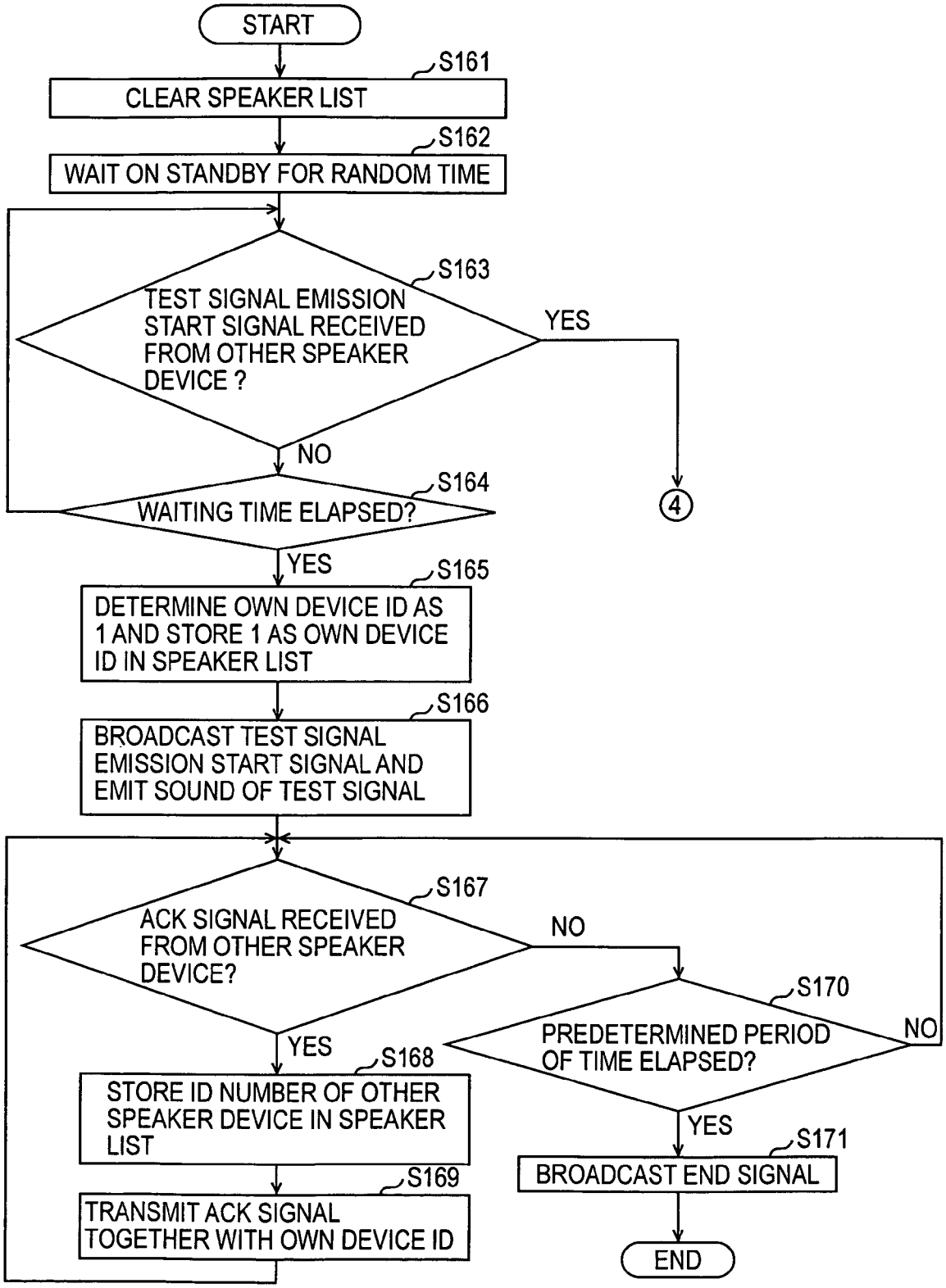
FIG. 33 is a flowchart illustrating the operation of the speaker device that performs a first process for assigning an ID number to each of the plurality of speaker devices connected to a bus in accordance with the third embodiment of the present invention.

A flowchart shown in FIGS. 33 and 34 illustrates a first process of the detection function of detecting the number of speaker devices 200 connected to the bus 300 and the ID number assignment function of assigning the ID numbers to the respective speaker devices 200 in accordance with the third embodiment. The first process is mainly performed by the CPU 210 in each speaker device 200.

The bus 300 is reset when one of the server apparatus 100 and the speaker devices 200 transmits a bus reset signal to the bus 300. In response to the resetting of the bus 300, each speaker device 200 initiates the process routine of FIGS. 33 and 34.

The CPU 210 in the speaker device 200 clears the speaker list stored in the speaker list memory 231 in step S161. The speaker device 200 waits on standby for a random time in step S162.

The CPU 210 determines in step S163 whether own speaker device 200 has received a test signal sound emission start signal for starting the sound emission of the test signal from the other speaker devices 200. If it is determined that the speaker device 200 has received no emission start signal, the CPU 210 determines whether the waiting time set in step S162 has elapsed. If it is determined that the waiting time has not elapsed, the CPU 210 returns to step S163 to monitor the arrival of the test signal sound emission start signal from the other speaker devices 200.

If it is determined in step S164 that the waiting time has elapsed, the CPU 210 determines that own speaker device 200 becomes a master device for assigning an ID number to own speaker device 200, sets the ID number of own speaker device 200 as ID=1, and stores the ID number in the speaker list memory 231. In the third embodiment, a first speaker device 200 becoming first ready to emit the test signal from bus resetting functions as a master device, and the other speaker devices 200 function as slave devices.

The CPU 210 broadcasts the test signal sound emission start signal to the other speaker devices 200 via the bus 300, while emitting the test signal at the same time in step S166. The test signal is preferably a narrow-band signal (beep sound), such as a raised sine wave, or a signal constructed of narrow-band signals of a plurality of frequency bands, or a repeated version of one of these signals. The test signal is not limited to those signals.

The CPU 210 monitors an arrival of an ACK signal from the other speaker device 200 in step S167. If it is determined in step S167 that an ACK signal is received from the other speaker device 200, the CPU 210 extracts the ID number of the other speaker device 200 attached to the ACK signal, and stores that ID number in the speaker list in the speaker list memory 231 in step S168.

The speaker 201 broadcasts the ACK signal together with the ID number (=1) of own speaker device 200 via the bus 300 in step S169. This action is interpreted as a statement saying: "one ID number of a slave speaker device has been registered. Any other else remains?". The CPU 210 returns to step S167 to wait for an arrival of an ACK signal from another speaker device 200.

If the CPU 210 determines in step S167 that no ACK signal has been received from the other speaker device 200, the CPU 210 determines in step S170 whether a predetermined period of time has elapsed without receiving an ACK signal. If it is determined that the predetermined period of time has not elapsed, the CPU 210 returns to step S167. If it is determined that the predetermined period of time has elapsed, the CPU 210 determines that all slave speaker devices 200 have transmitted the ACK signal, and broadcasts an end signal via the bus 300 in step S171.

If it is determined in step S163 that the test signal sound emission start signal is received from another speaker device 200, the CPU 210 determines that own speaker device 200 becomes a slave device. The CPU 210 determines in step S181 of FIG. 34 whether the sound of the test signal emitted by the other speaker device 200 as a master device and captured by the microphone 202 is equal to or higher than a rated level. If the speaker device 200 uses the previously mentioned narrow-band signal as the test signal, the audio signal from the microphone 202 is filtered using a band-pass filter. The CPU 210 determines whether the level of an output signal from the band-pass filter is equal to or higher than a threshold. If it is determined that the level of the output signal of the filter is equal to or higher than the threshold, the CPU 210 determines the sound of the test signal is captured.

If it is determined in step S181 that the sound of the test signal is captured, the CPU 210 stores, in the speaker list of the speaker list memory 231, the ID number attached to the test signal sound emission start signal received in step S163 (step S182).

In step S183, the CPU 210 determines whether the bus 300 is released for use, namely, whether the bus 300 is ready for transmission from own speaker device 200. If it is determined in step S183 that the bus 300 is not released, the CPU 210 monitors a reception of the ACK signal from another speaker device 200 connected to the bus 300 in step S184. Upon recognizing a reception of the ACK signal, the CPU 210 extracts the ID number of the other speaker device 200 attached to the received ACK signal, and stores the ID number in the speaker list in the speaker list memory 231 in step S185. The CPU 210 returns to step S183 to wait for the release of the bus 300.

If it is determined in step S183 that the bus 300 is released, the CPU 210 determines an ID number of own speaker device 200, and broadcasts the ACK signal together with the determined ID number via the bus 300 in step S186. This action is interpreted as a statement saying: "the emission of the sound of the test signal is acknowledged". The ID number of own speaker device 200 is determined as a minimum number available in the speaker list.

The CPU 210 stores the ID number, determined in step S186, in the speaker list in the speaker list memory 231 in step S187.

In step S188, the CPU 210 determines whether an end signal is received via the bus 300. If it is determined that the end signal is not received, the CPU 210 determines in step S189 whether an ACK signal has been received from another speaker device 200.

If it is determined in step S189 that no ACK signal is received from the other speaker device 200, the CPU 210 returns to step S188 to monitor the reception of an end signal. If it is determined in step S189 that the ACK signal has been received from the other speaker device 200, the CPU 210 stores the ID number attached to the ACK signal in the speaker list in the speaker list memory 231 in step S190.

If it is determined in step S188 that the end signal has been received via the bus 300, the CPU 210 ends the process routine.

The number of speaker devices 200 connected to the bus 300 is detected as the maximum ID number. All speaker devices 200 store the same speaker list. Each speaker device 200 has its own ID number.

Figure 35:
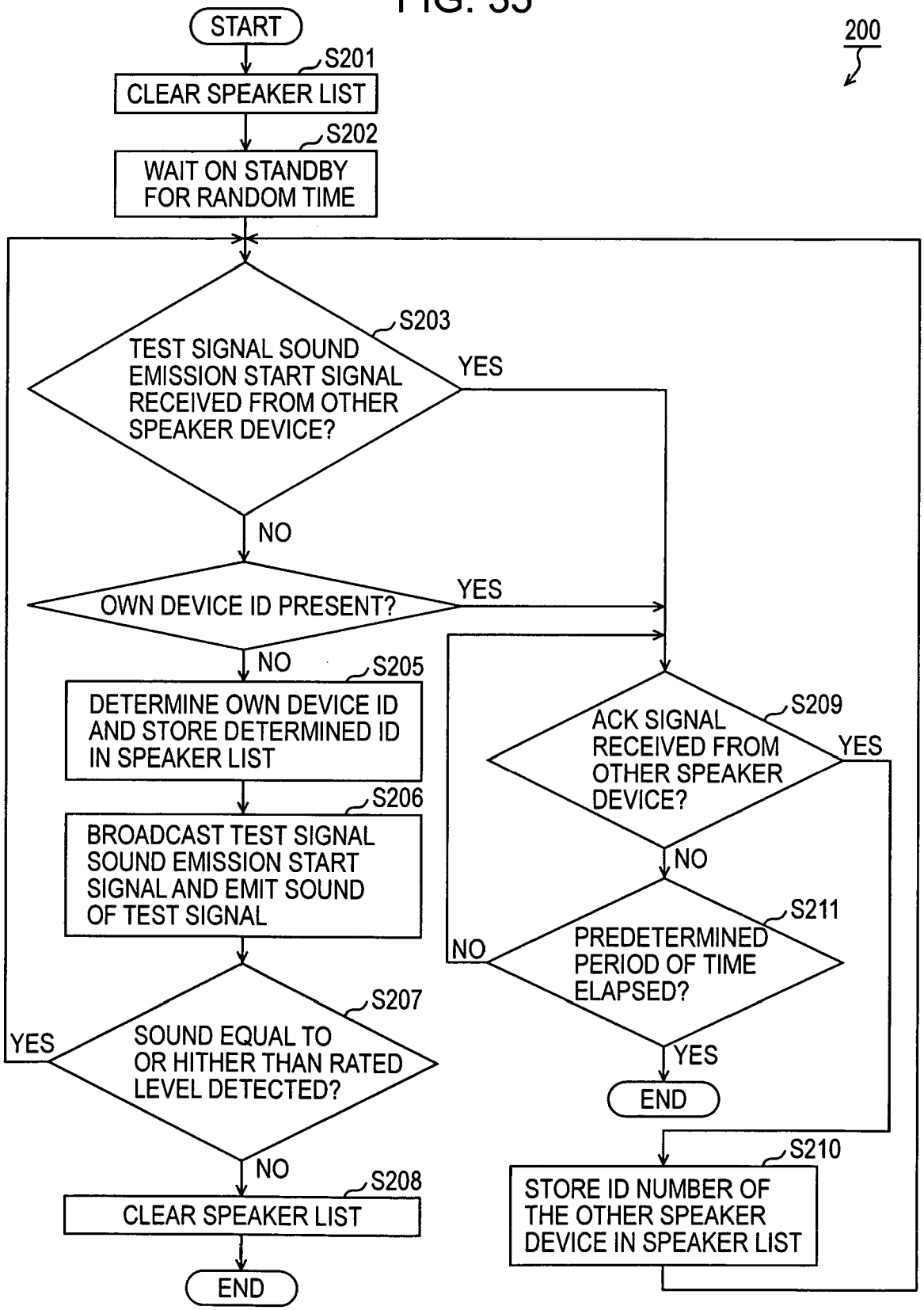
FIG. 35 is a flowchart illustrating the operation of the speaker device that performs a second process for assigning an ID number to each of the plurality of speaker devices connected to the bus in accordance with the third embodiment of the present invention.

FIG. 35 is a flowchart of a second process of the detection function of detecting the number of speaker devices 200 connected to the bus 300 and the ID number assignment function of assigning the ID numbers to the respective speaker devices 200 in accordance with the third embodiment. The process routine of the flowchart in FIG. 35 is performed by the CPU 210 in each speaker device 200. Unlike the first process, the second process does not divides the speaker devices 200 into the master device and the slave devices for ID number assignment. In the second process, own speaker device 200 that emits the test signal also captures the sound with the microphone 202, and uses the audio signal of the sound.

The bus 300 is reset when one of the server apparatus 100 and the speaker devices 200 transmits a bus reset signal to the bus 300. In response to the resetting of the bus 300, each speaker device 200 initiates the process routine of the process of FIG. 35.

The CPU 210 in the speaker device 200 clears the speaker list stored in the speaker list memory 231 in step S201. The speaker device 200 waits on standby for a random time in step S202.

The CPU 210 determines in step S203 whether the speaker device 200 has received a test signal sound emission start signal for starting the sound emission of the test signal from the other speaker devices 200. If it is determined that the speaker device 200 has received no emission start signal, the CPU 210 determines in step S204 whether an ID number is assigned to own speaker device 200.

The CPU 210 now determines whether own CPU 210 has the right to emit the test sound or is in a position to hear the sound from the other speaker devices 200. The process in step S204 clarifies whether the ID number is assigned to own speaker device 200 for later processing, in other words, whether the ID number of own speaker device 200 is stored in the speaker list memory 231.

If it is determined in step S203 that the speaker device 200 has received no test signal sound emission start signal from the other speaker devices 200 and if it is determined in step S204 that no ID number is assigned to own speaker device 200, in other words, if it is determined that own speaker device 200 has still the right to emit the sound of the test signal, the CPU 210 determines a minimum number available from the speaker list as an ID number of own speaker device 200, and stores the ID number in the speaker list memory 231 in step S205.

The CPU 210 broadcasts the test signal sound emission start signal to the other speaker devices 200 via the bus 300, while emitting the sound of the test signal at the same time in step S206. The test signal is the one similar to the test signal used in the first process.

The CPU 210 captures the sound of the test signal emitted from own speaker device 200 and determines in step S207 whether the level of the received sound is equal to or higher than a threshold. If it is determined that the level of the received sound is equal to or higher than the threshold, the CPU 210 determines that the speaker 201 and the microphone 202 in own speaker device 200 normally function, and returns to step S203.

If it is determined in step S207 that the level of the received sound is lower than the threshold, the CPU 210 determines the speaker 201 and the microphone 202 in own speaker device 200 do not normally function, clears the storage content of the speaker list memory 231, and ends the process routine in step S208. In this case, that speaker device 200 behaves as if not being connected to the bus 300.

If it is determined in step S203 that the test signal sound emission start signal is received from the other speaker device 200, or if it is determined in step S204 that the ID number is assigned to own speaker device 200, the CPU 210 monitors the arrival of an ACK signal from the other speaker device 200 in step S209.

If it is determined in step S209 that the ACK signal is received from the other speaker device 200, the CPU 210 extracts the ID number of the other speaker device 200 attached to the ACK signal, and adds the ID number to the speaker list in the speaker list memory 231 in step S210.

If it is determined in step S209 that no ACK signal is received from the other speaker device 200, the speaker 201 determines in step S211 whether a predetermined period of time has elapsed. If it is determined that the predetermined period of time has not elapsed, the CPU 210 returns to step S209. If it is determined that the predetermined period of time has elapsed, the CPU 210 ends the process routine. If no ACK signal is received in step S209, the CPU 210 waits for the predetermined period of time in step S211. If no further ACK signal is returned from the other speaker device 200, the CPU 210 determines that all speaker devices 200 have returned the ACK signal, and ends the process routine.

The number of speaker devices 200 connected to the bus 300 is detected as the maximum number ID number. All speaker devices 200 store the same speaker list. Each speaker device 200 has its own ID number.

In the first and second processes, an ID number is assigned to a speaker device 200 after bus resetting when the speaker device 200 is newly connected to the bus 300. In a third process, bus resetting is not performed. When newly connected to the bus 300, speaker devices 200 emit a connection statement sound at the bus connection thereof, and are successively added to the speaker list.

Figure 36:
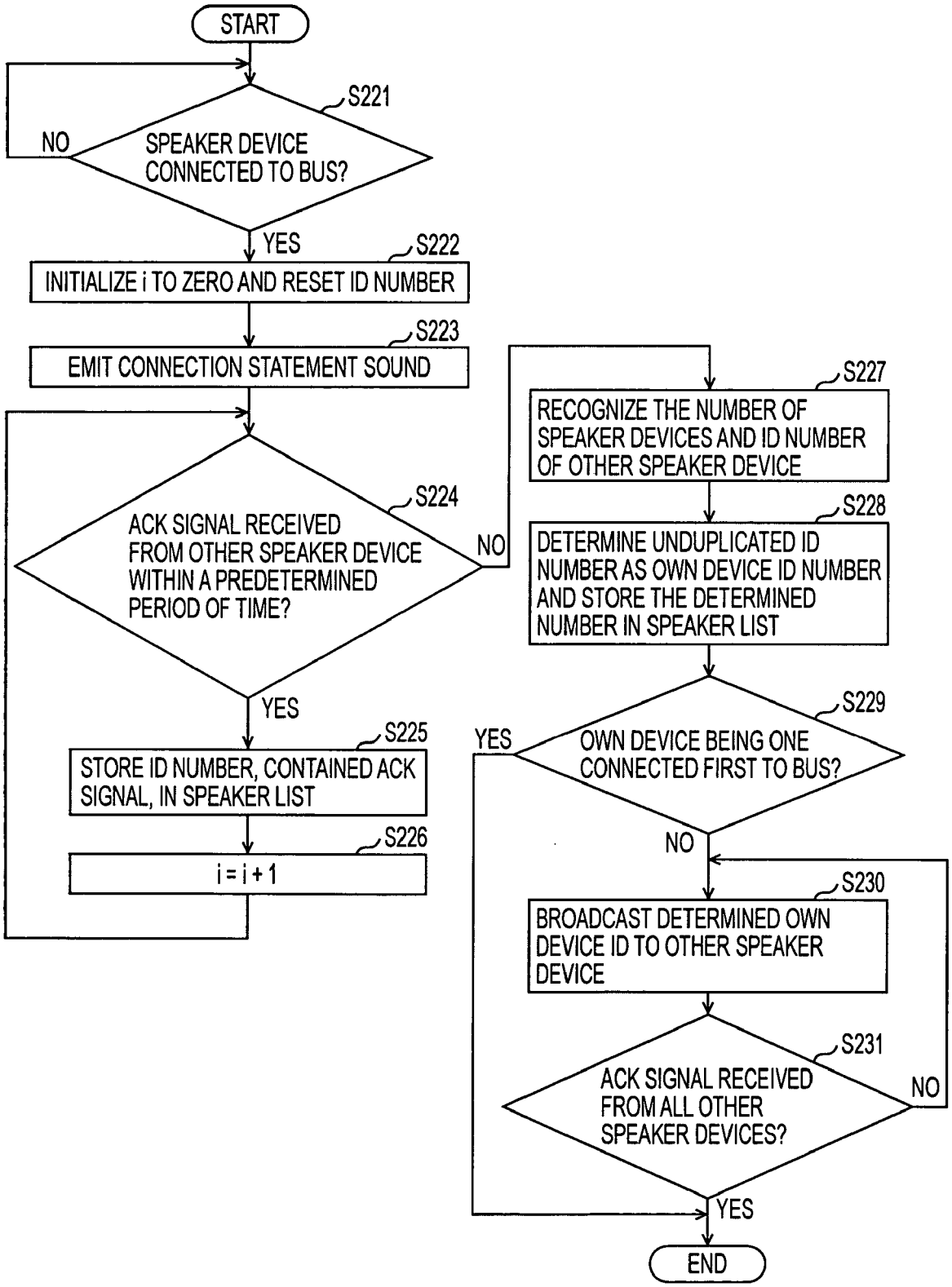
FIG. 36 is a flowchart illustrating the operation of the speaker device that performs a third process for assigning an ID number to each of the plurality of speaker devices connected to the bus in accordance with the third embodiment of the present invention.
Figure 37:
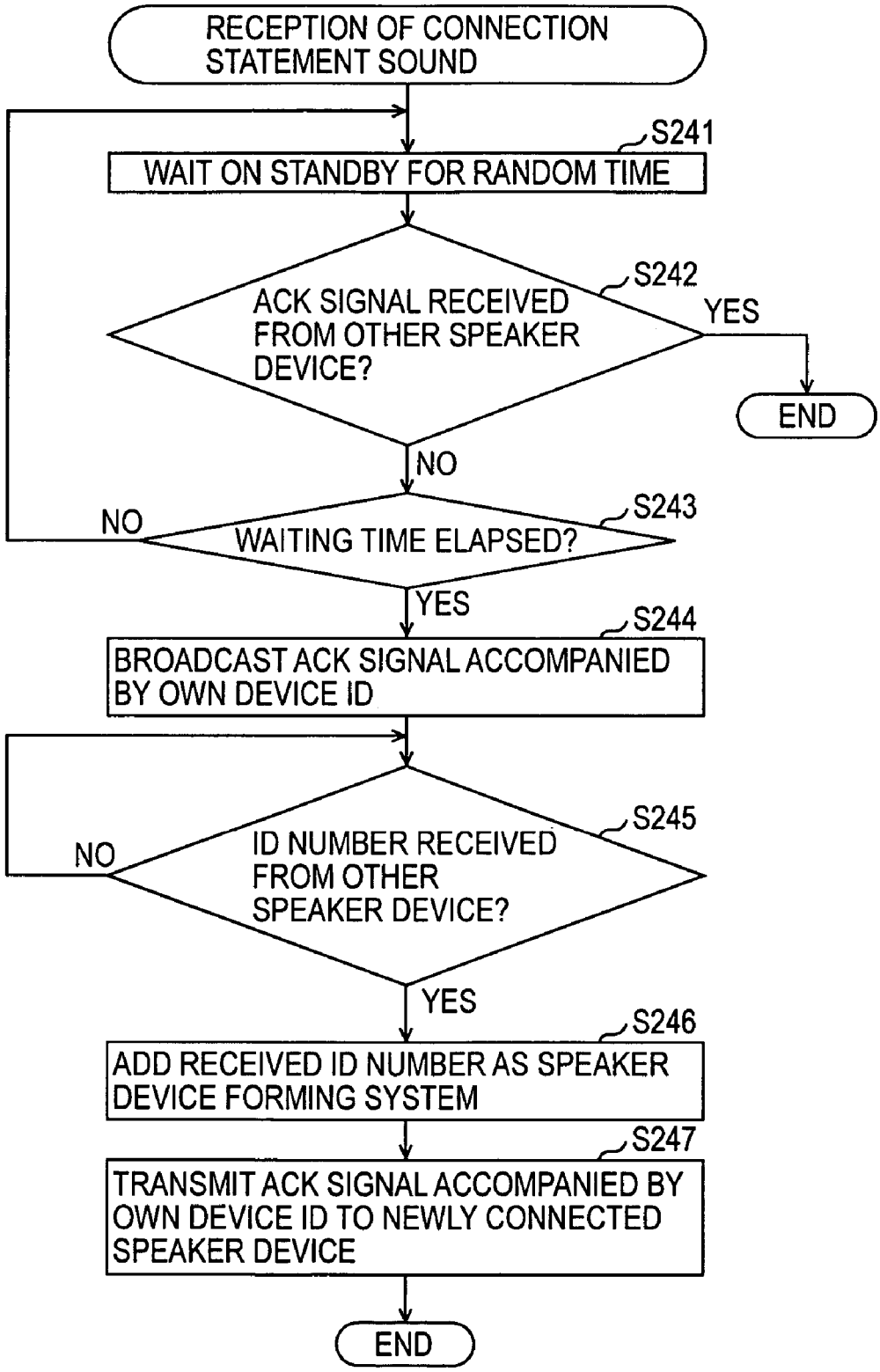
FIG. 37 is a flowchart illustrating the operation of the speaker device that performs the third process for assigning the ID number to each of the plurality of speaker devices connected to the bus in accordance with the third embodiment of the present invention.

FIG. 36 is a flowchart of a process routine of the third process performed by a speaker device 200 that is newly connected to the bus 300. FIG. 37 is a flowchart of a process routine performed by a speaker device 200 already connected to the bus 300.

As shown in FIG. 36, the CPU 210 detects a bus connection in step S221 when a speaker device 200 is newly connected to the bus 300 in the third process. The CPU 210 initializes the number "i" of speakers 200, while resetting the ID number of own speaker device 200 in step S222.

The CPU 210 emits a connection statement sound from the speaker 201 thereof in step S223. The connection statement sound can be emitted using a signal similar to the previously discussed test signal.

The CPU 210 determines in step S224 whether an ACK signal is received from another speaker device 200 that has been connected to the bus 300 within a predetermined period of time since the emission of the connection statement sound.

If it is determined in step S224 that an ACK signal is received from the other speaker device 200, the CPU 210 extracts the ID number attached to the received ACK signal, and adds the ID number to the speaker list in the speaker list memory 231 in step S225. The CPU 210 increments the speaker count "i" by one in step S226. The CPU 210 returns to step S223, emits a connection statement sound, and repeats steps S223-S226.

If it is determined in step S224 that no ACK signal has been received from the other speaker devices 200 within the predetermined period of time, the CPU 210 determines that the ACK signals have been received from all speaker devices 200 connected to the bus 300. The CPU 210 then recognizes the count of speaker device 200 counted up until now and the ID numbers of the other speaker devices 200 in step S227. The CPU 210 determines an ID number, unduplicated in the recognized ID numbers, as the ID number of own speaker device 200 and stores own ID number in the speaker list memory 231 in step S228. The determined ID number is here a minimum number available. In this case, the ID number of the speaker device 200 connected first to the bus 300 is "1".

In step S229, the CPU 210 determines, based on the determined ID number of own speaker device 200, whether own speaker device 200 is the one first connected to the bus 300. If it is determined that own speaker device 200 is the first connected speaker device 200, the number of speaker devices 200 connected to the bus 300 is one, and the CPU 210 ends the process routine.

If it is determined in step S229 that own speaker device 200 is not the first connected to the bus 300, the CPU 210 broadcasts the ID number of own speaker device 200, determined in step S228, to the other speaker devices 200 via the bus 300 in step S230. The CPU 210 determines in step S231 whether the ACK signals have been received from all other speaker devices 200. The CPU 210 repeats step S230 until the ACK signals are received from all other speaker devices 200. After recognizing that the ACK signals have been received from all other speaker devices 200, the CPU 210 ends the process routine.

If a first speaker device 200 is connected to the bus 300 having no existing speaker device 200 connected thereto, no ACK signal is received in step S224. The speaker device 200 recognizes itself as a first connection to the bus 300, and determines "1" as an ID number of own speaker device 200, and ends the process routine.

When second and subsequent speaker devices 200 are connected to the bus 300, the bus 300 has already the existing speaker device 200 connected thereto. The CPU 210 acquires the number of speaker devices 200 and the ID numbers thereof. The CPU 210 determines, as the ID number of own speaker device 200, a number unduplicated from and consecutively following the ID number already assigned to the speaker device 200 connected to the bus 300, and notifies the speaker device 200 of the ID number of own speaker device 200.

Referring to FIG. 37, the process routine of the speaker device 200 already connected to the bus 300 is described below. Each speaker device 200 already connected to the bus 300 initiates the process routine of FIG. 37 when the microphone 202 captures the connection statement sound equal to or higher than a rated level.

Upon detecting the connection statement sound equal to or higher than a rated level, the CPU 210 in each speaker device 200 already connected to the bus 300 enters a random-time waiting state in step S241. The CPU 210 monitors the arrival of the ACK signal from another speaker device 200 in step S242. Upon recognizing the arrival of the ACK signal, the CPU 210 ends the process routine. When the speaker device 200 detects the connection statement sound equal to or higher than the rated level again, the speaker 201 initiates the process routine of FIG. 37 again.

If it is determined in step S242 that no ACK signal is received from the other speaker device 200, the CPU 210 determines in step S243 whether a waiting time has elapsed. If it is determined that the waiting time has not elapsed, the CPU 210 returns to step S242.

If it is determined in step S243 that the waiting time has elapsed, the CPU 210 broadcasts the ACK signal with the ID number of own speaker device 200 attached thereto via the bus 300 in step S244.

In step S245, the CPU 210 waits for the ID number from the other speaker device 200, namely, the newly connected speaker device 200 to which the determined ID number is broadcast in step S230. Upon receiving the ID number, the CPU 210 stores the ID number of the newly connected speaker device 200 on the speaker list memory 231 in step S246. The CPU 210 unicasts an ACK signal to the newly connected speaker device 200.

In this process, reassignment of the ID numbers is not required when a speaker device 200 is newly connected to the bus 300 in the audio system.

As in the first and second embodiments, the distance difference ΔDi of the distances of the speaker devices 200 with respect to the listener is determined in the third embodiment as well. In the third embodiment, however, each speaker device 200 calculates the distance difference ΔDi.

Figure 38:
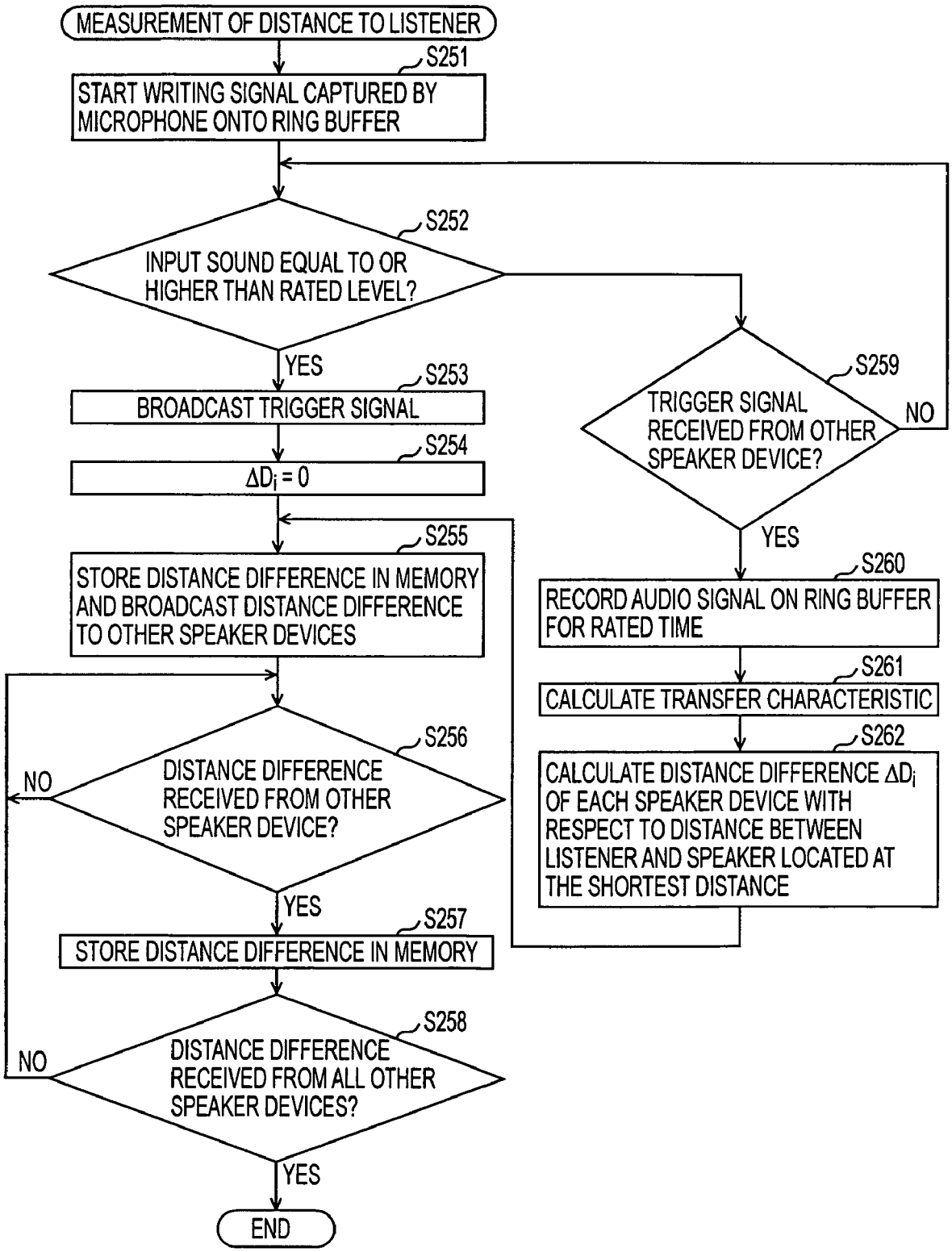
FIG. 38 is a flowchart illustrating the operation of the speaker device that collects information concerning the distance between the listener and the speaker device in accordance with the third embodiment of the present invention.

FIG. 38 is a flowchart of the listener-to-speaker distance measurement process performed by each speaker device 200. In this case, the server apparatus 100 does not supplies the listener-to-speaker distance measurement process start signal to each speaker device 200. Alternatively, each speaker device 200 initiate the process routine of FIG. 38 when the speaker device 200 detects two hand clap sounds of the listener as a listener-to-speaker distance measurement process start signal.

Upon detecting the start signal, the CPU 210 in each speaker device 200 initiates the process routine of FIG. 38, and enters a wait mode for capturing the sound emitted by the listener. The CPU 210 stops emitting sound from the speaker 201 (mutes sound output), while starting writing the audio signal captured by the microphone 202 onto the captured signal buffer memory (ring buffer memory) 219 in step S251.

The CPU 210 monitors the level of the audio signal from the microphone 202. A determination of step S252 of whether or not the listener has produced the sound is performed base on whether the audio signal rises above the rated level. The determination of whether the audio signal rises above the rated level is performed to prevent background noise from being detected as the sound produced by the listener 500.

If it is determined in step S252 that the audio signal above the rated level is detected, the CPU 210 broadcasts a trigger signal to the other speaker devices 200 via the bus 300 in step S253.

Since the CPU 210 transmits the trigger signal, the CPU 210 determines own speaker device 200 as the one closet to the listener 500 (shortest distance speaker) and determines the distance difference ΔDi=0 in step S254. The CPU 210 stores the distance difference ΔDi in the buffer memory or the speaker device layout information memory 233 while broadcasting the distance difference ΔDi to the other speaker devices 200 in step S255.

The CPU 210 waits for the arrival of the distance difference ΔDi from another speaker devices 200 in step S256. Upon recognizing the reception of the distance difference ΔDi from the other speaker devices 200, the CPU 210 stores the received distance difference ΔDi in the speaker device layout information memory 233 in step S257.

The CPU 210 determines in step S258 whether the distance differences ΔDi have been received from all other speaker devices 200. If it is determined that the reception of the distance differences ΔDi from all other speaker devices 200 is not complete, the CPU 210 returns to step S256. If it is determined that the reception of the distance differences ΔDi from all other speaker devices 200 is complete, the CPU 210 ends the process routine.

If it is determined in step S252 that the audio signal above the rated level is not detected, the CPU 210 determines in step S259 whether a trigger signal has been received from another speaker device 200 via the bus 300. If it is determined that no trigger signal has been received, the CPU 210 returns to step S252.

If it is determined in step 259 that the trigger signal has been received from the other speaker device 200, the CPU 210 records, in the captured signal buffer memory 219, the audio signal captured by the microphone 202 for a rated duration of time starting from the received trigger in step 260.

The CPU 210 calculates the transfer characteristic of the audio signal recorded for the rated duration of time using the transfer characteristic calculator 232 in step S261, calculates the distance difference ΔDi of the closet distance speaker relative to the listener 500 from the propagation delay time in step S262, stores the calculated distance difference ΔDi in the buffer memory or the speaker device layout information memory 233, and broadcasts the distance difference ΔDi with the ID number of own speaker device attached thereto to the other speaker devices 200 in step S255.

The CPU 210 waits for the arrival of the distance difference ΔDi from the other speaker device 200 in step S256. Upon recognizing the arrival of the distance difference ΔDi from the other speaker device 200, the CPU 210 stores, in the buffer memory thereof or the speaker device layout information memory 233, the received distance difference ΔDi with the ID number associated therewith in step S257.

The CPU 210 determines in step S258 whether the speaker device 200 has received the distance differences ΔDi from all other speaker devices 200 connected to the bus 300. If it is determined that the speaker device 200 has not yet received the distance differences ΔDi from all other speaker devices 200, the CPU 210 returns to step S256. If it is determined that the speaker device 200 has received the distance differences ΔDi from all other speaker devices 200, the CPU 210 ends the process routine.

In the third embodiment, only the distance difference ΔDi is determined as information relating to distance between the listener 500 and the speaker device 200.

The distance difference ΔDi alone as the information relating to the distance between the listener 500 and the speaker device 200 is not sufficient to determine the layout configuration of the plurality of speaker devices 200. In accordance with the third embodiment, as well, the distance between the speaker devices 200 is measured, and the layout configuration is determined from the speaker-to-speaker distance and the distance difference ΔDi.

A sound emission start command of the test signal for speaker-to-speaker distance measurement is transmitted to the speaker devices 200 connected to the bus 300. As in the first embodiment discussed with reference to FIG. 16, the server apparatus 100 may broadcast the sound emission command signal of the test signal to all speaker devices 200. In the third embodiment, however, the speaker device 200 performs the process that is performed by the server apparatus 100 in accordance with the first embodiment. For example, three hand-clap sounds produced by the listener 500 are detected by each speaker device 200 as a command for starting the speaker-to-speaker distance measurement process.

The test signal in the third embodiment is not the one transmitted from the server apparatus 100 but the one stored in the ROM 211 in each speaker device 200.

Upon receiving the command for starting the speaker-to-speaker distance measurement process, the speaker device 200 enters a random-time wait state. A speaker device 200 with the waiting time thereof elapsing first broadcasts the trigger signal via the bus 300 while emitting the sound of the test signal at the same time. The packet of the trigger signal transmitted to the bus 300 is accompanied by the ID number of the speaker device 200. Each of the other speaker devices 200 having received the trigger signal stops the time wait state thereof while capturing and recording the sound of the test signal from the speaker device 200 with the microphone 202.

The speaker device 200 that has recorded the audio signal of the test signal calculates the transfer characteristic of the record signal recorded during a rated duration of time from the timing of the trigger signal, calculates the distance of the speaker device 200 having emitted the trigger signal based on the propagation delay time from the timing of the trigger signal, and stores the distance information in the speaker device layout information memory 233. The speaker device 200 transmits the calculated distance information to the other speaker devices 200 while receiving distance information transmitted from the other speaker devices 200.

Each speaker device 200 repeats the above-referenced process starting in response to the test signal sound emission command until all speaker devices 200 connected to the bus 300 emit the test signals. The speaker-to-speaker distances of all speaker device 200 are calculated and stored in each speaker device 200. The distance between the same speaker devices 200 is repeatedly measured, and the average of the measured distances is adopted.

The speaker-to-speaker distance measurement process performed by the speaker device 200 is described with reference to a flowchart of FIG. 39.

Figure 39:
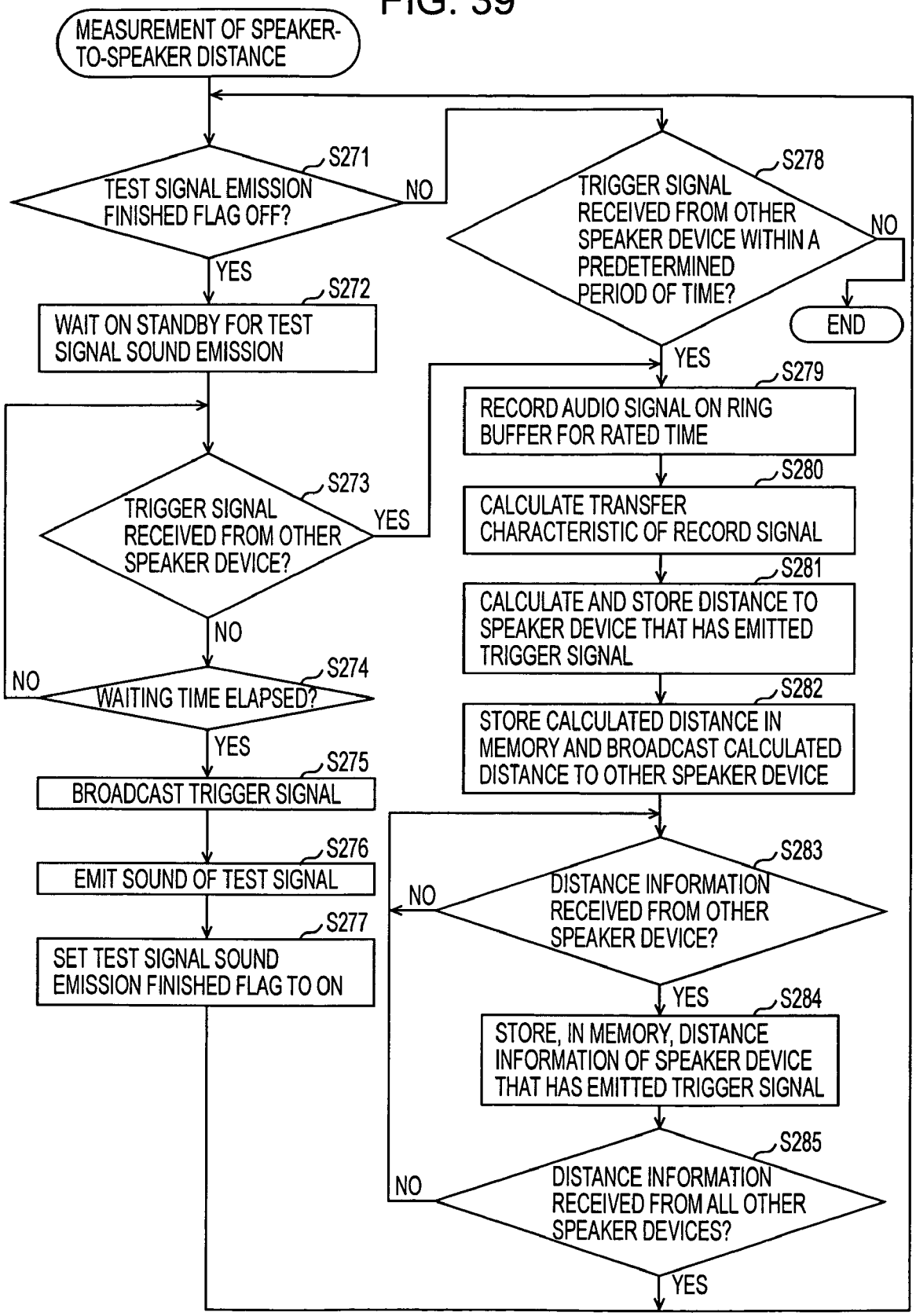

Upon detecting the emission command of the test signal in the audio signal captured by the microphone 202, the CPU 210 in each speaker device 200 initiates the process routine of the flowchart of FIG. 39. The CPU 210 determines in step S271 whether the test signal emitted flag is off. If it is determined that the test signal emitted flag is off, the CPU 210 determines that the emission of the test signal is not complete, and enters a random-time wait state for the test signal emission in step S272.

The CPU 210 determines in step S273 whether a trigger signal has been received from another speaker device 200. If it is determined that no trigger signal has been received from the other speaker device 200, the CPU 210 determines in step S274 whether the waiting time set in step S272 has elapsed. If it is determined that the waiting time has not elapsed, the CPU 210 returns to step S273 to continuously monitor a trigger signal from another speaker device 200.

If it is determined in step S274 that the waiting time has elapsed without receiving a trigger signal from another speaker device 200, the CPU 210 packetizes the trigger signal with the ID number thereof attached thereto and broadcasts the trigger signal via the bus 300 in step S275. The CPU 210 also emits the sound of the test signal from the speaker 201 in synchronization with the transmitted trigger signal in step S276. The speaker 201 then sets the test signal emitted flag to on in step S277, and returns to step S271.

If it is determined in step S271 that the test signal has been emitted with the test signal emitted flag on, the CPU 210 determines in step S278 whether a trigger signal has been received from another speaker device 200 within a predetermined period of time. If it is determined that no trigger signal has been received from the other speaker device 200 within the predetermined period of time, the CPU 210 ends the process routine.

If it is determined in step S278 that a trigger signal has been received, the CPU 210 records the sound of the test signal, captured by the microphone 202, for a rated duration of time from the timing of the received trigger signal in step S279. If it is determined in step S273 that the trigger signal has been received from the other speaker device 200, the CPU 210 proceeds to step S279 where the CPU 210 records the sound of the test signal, captured by the microphone 202, for the rated duration of time from the timing of the received trigger signal.

The CPU 210 calculates the transfer characteristic of the record signal for the rated duration of time from the timing of the received trigger signal in step S280, and calculates the distance to the speaker device 200 that has emitted the trigger signal, based on the propagation delay time with respect to the timing of the trigger signal in step S281. In step S282, the CPU 210 stores, in the speaker device layout information memory 233, information of the distance between own speaker device 200 and the speaker device 200 that has transmitted the trigger signal while broadcasting the distance information with the ID number thereof attached thereto to the other speaker devices 200.

The CPU 210 waits for the arrival of distance information from another speaker device 200 in step S283. Upon receiving the distance information, the CPU 210 stores, in the speaker device layout information memory 233, the received distance information in association with the ID number of the other speaker device 200 attached to the received distance information in step S284.

The CPU 210 determines in step S285 whether information of distances of all other speaker devices 200 relative to the speaker device 200 having transmitted the trigger signal has been received. If it is determined that the distance information has not been received from all other speaker devices 200, the CPU 210 returns to step S283 to wait for the distance information. If it is determined that the distance information has been received from all other speaker devices 200, the CPU 210 returns to step S271.

In the third embodiment, the information of the calculated layout configuration of the listener 500 and the plurality of speaker devices 200 does not account for the forward direction of the listener 500. Several techniques are available for the speaker device 200 to automatically recognize the forward direction of the listener 500 as a reference direction.

In a first method of determining the reference direction, a particular speaker device 200 connected to the bus 300, for example, a speaker device 200 having an ID number=1, from among the plurality of speaker devices 200, outputs test signals in an intermittent fashion. The test signal may be a midrange burst sound to which the human has a relatively good sense of orientation. For example, noise having an energy band of one octave centered on 2 kHz may be used for the test signal.

In this method for outputting the test sound in an intermittent fashion, a test signal sound emission period of 200 milliseconds followed by a mute period of 200 milliseconds is repeated three times, and then a mute period of 2 seconds resumes.

If the listener 500 having heard the test signal senses that the center is located more right, the listener 500 claps hands once to indicate the sense within the mute period of 2 seconds. If the listener 500 having heard the test signal senses that the center is located more left, the listener 500 claps hands twice to indicate the sense within the mute period of 2 seconds.

Each speaker device 200 connected to the bus 300 detects the count of hand claps of the listener 500 during the mute period of 2 seconds from the audio signal captured by the microphone 202. If any speaker device 200 detects the count of hand claps of the listener 500, that speaker device 200 broadcasts information of the count of hand claps to the other speaker device 200.

If the listener 500 claps hands once, the test signal is emitted by not only the speaker device 200 having the ID number=1 but also the speaker device 200 located immediately right of the speaker device 200 having the ID number=1. The sound is adjusted and emitted so that the sound image localization direction using the test signal sound is rotated clockwise by a predetermined angle, for example, 30° with respect to a preceding sound image localization direction.

The adjustment of the signal sound includes an amplitude adjustment and a phase adjustment of the test signal. An imaginary circle having a radius equal to the distance between the listener 500 and the speaker device 200 having the ID number=1 is assumed, and each speaker device 200 calculates the test signal so that the sound image localization position moves clockwise or counterclockwise along the circle.

More specifically, if the speaker devices 200 are placed in a circle centered on the listener 500, the sound image is localized in an intermediate position between two adjacent speaker devices 200 if the two adjacent speaker devices 200 emit the sounds at an appropriate signal distribution ratio. If the speaker devices 200 are not equidistant from the listener 500, the distance between a speaker device 200 placed farthest to the listener 500 and the listener 500 is used as a reference distance. Each of speaker devices 200 placed closer in distance to the listener 500 is provided with a test signal with a delay corresponding to a distance difference to the reference distance introduced therewithin.

If the count of hand claps made by the listener 500 during the mute period of 2 seconds is zero or not detected at all, the test signal is emitted again at the same localization direction.

If it is determined that two hand claps are made during the mute period of 2 seconds, two speaker devices 200 for emitting the test signal adjust and emit the signal sounds in a manner such that the sound image localization direction caused by the test signal sound is rotated counterclockwise by an angle, smaller than the angle rotated clockwise previously, 15°, for example.

As long as the same count of hand claps is kept, the angular resolution step remains unchanged, and the sound image localization location is consecutively rotated in the same direction. If the count of hand claps is changed, the sound image localization location is rotated in an opposite direction at an angular resolution step smaller than the preceding adjustment. The sound image localization direction is thus gradually converged to the forward direction of the listener 500.

When the listener 500 approves the sound image localization direction as the forward direction, the listener 500 claps hands three times consecutively quickly. Any speaker device 200 that detects first the hand clap sounds notifies all other speaker devices 200 of the end of the process routine of the reference direction. The process routine is thus complete.

Figure 40:
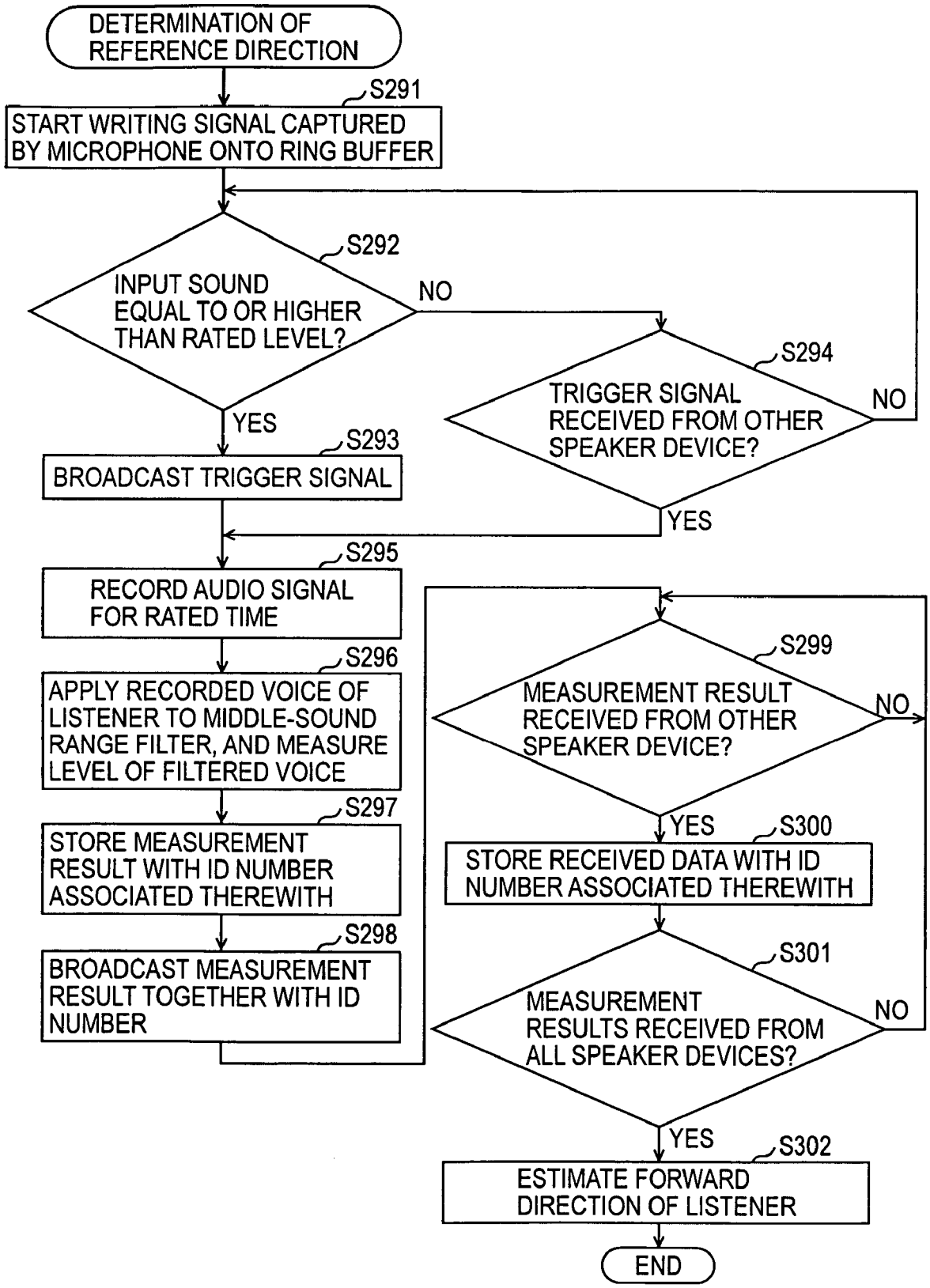
FIG. 40 is a flowchart illustrating the operation of the speaker device that determines the forward direction of the listener as the reference direction in accordance with the third embodiment of the present invention.

FIG. 40 is a flowchart of a second reference direction determination method.

In the second reference direction determination method, the process routine of FIG. 40 is initiated when a command for starting the reference direction determination process, such as four hand claps by the listener 500, is input.

In response to the start of the process routine of FIG. 40, the CPU 210 in each speaker device 200 starts writing the audio signal, captured by the microphone 202, on the captured signal buffer memory (ring buffer memory) 219 in step S291.

The listener 500 voices any words in the forward direction. The CPU 210 in each speaker device 200 monitors the level of the audio signal. When the level of the audio signal rises equal to or higher than a rated level, the CPU 210 determines in step S292 that the listener 500 voices words. The determination of whether the audio signal is equal to or higher than the predetermined threshold level is performed to prevent the speaker device 200 from erroneously detect noise as a voice produced by the listener 500.

If it is determined in step S292 that the audio signal equal to or higher than the rated level is detected, the CPU 210 broadcasts the trigger signal to the other speaker devices 200 via the bus 300 in step S293.

If it is determined in step S292 that the audio signal equal to or higher than the rated level is not detected, the CPU 210 determines in step S294 whether a trigger signal has been received from another speaker device 200 via the bus 300. If it is determined that no trigger signal has been received from the other speaker device 200, the CPU 210 returns to step S292.

If it is determined in step S294 that the trigger signal has been received from the other speaker device 200, or if the CPU 210 broadcasts the trigger signal via the bus 300 in step S293, the CPU 210 records, in the captured signal buffer memory 219, the audio signal for a rated duration of time from the timing of the received trigger signal or the timing of the transmitted trigger signal in step S295.

The CPU 210 in each speaker device 200 subjects the voice of the listener 500 captured by the microphone 202 to a midrange filter and measures the level of the output of the filter in step S296. Taking into consideration the attenuation of the acoustic wave along a propagation distance, the CPU 210 corrects the signal level in accordance with the distance DLi between the listener 500 and the speaker device 200. The measured signal level is stored with the ID number of own speaker device 200 associated therewith in step S297.

In step S298, the CPU 210 broadcasts information of the measured signal level together with the ID number of own speaker device 200 to the other speaker devices 200 via the bus 300.

The CPU 210 waits for the arrival of the information of the measured signal level from the other speaker device 200 in step S299. Upon recognizing the arrival of the information of measured signal level, the CPU 210 stores the received measured signal level information with the ID number of the other speaker device 200 associated therewith in step S300.

The CPU 210 determines in step S301 whether the reception of the measured signal level information from all other speaker devices 200 is complete. If it is determined that the reception of the measured signal level information from all other speaker devices 200 is not complete, the CPU 210 returns to step S299 to receive the information of a signal level from a remaining speaker device 200.

If it is determined in step S301 that the reception of the measured signal level information from all other speaker devices 200 is complete, the CPU 210 analyzes the signal level information, estimates the forward direction of the listener 500, and stores information of the estimated forward direction as the reference direction in the speaker device layout information memory 233 in step S302. The estimation method is based on the property that the directivity pattern of the human voice is bilaterally symmetrical, and that the midrange component of the voice is maximized in the forward direction of the listener 500 while minimized in the backward direction of the listener 500.

Since all speaker devices 200 perform the above-referenced process, all speaker devices 200 provide the same process result.

To enhance accuracy in the process, two or more bands for extraction are prepared in the filter used in step S296, and the resulting estimated forward directions are checked against each other in each band.

The layout configuration of the plurality of speaker devices 200 forming the audio system is calculated and the reference direction is determined as described above. The channel synthesis factor for generating the speaker signal to be supplied to the speaker device 200 is thus calculated.

In accordance with the third embodiment, each speaker device 200 verifies that the channel synthesis factor thereof is actually appropriate, and corrects the channel synthesis factor if necessary. The verification and correction process performed by the speaker device 200 is described with reference to a flowchart of FIGS. 41 and 42.

Figure 41:
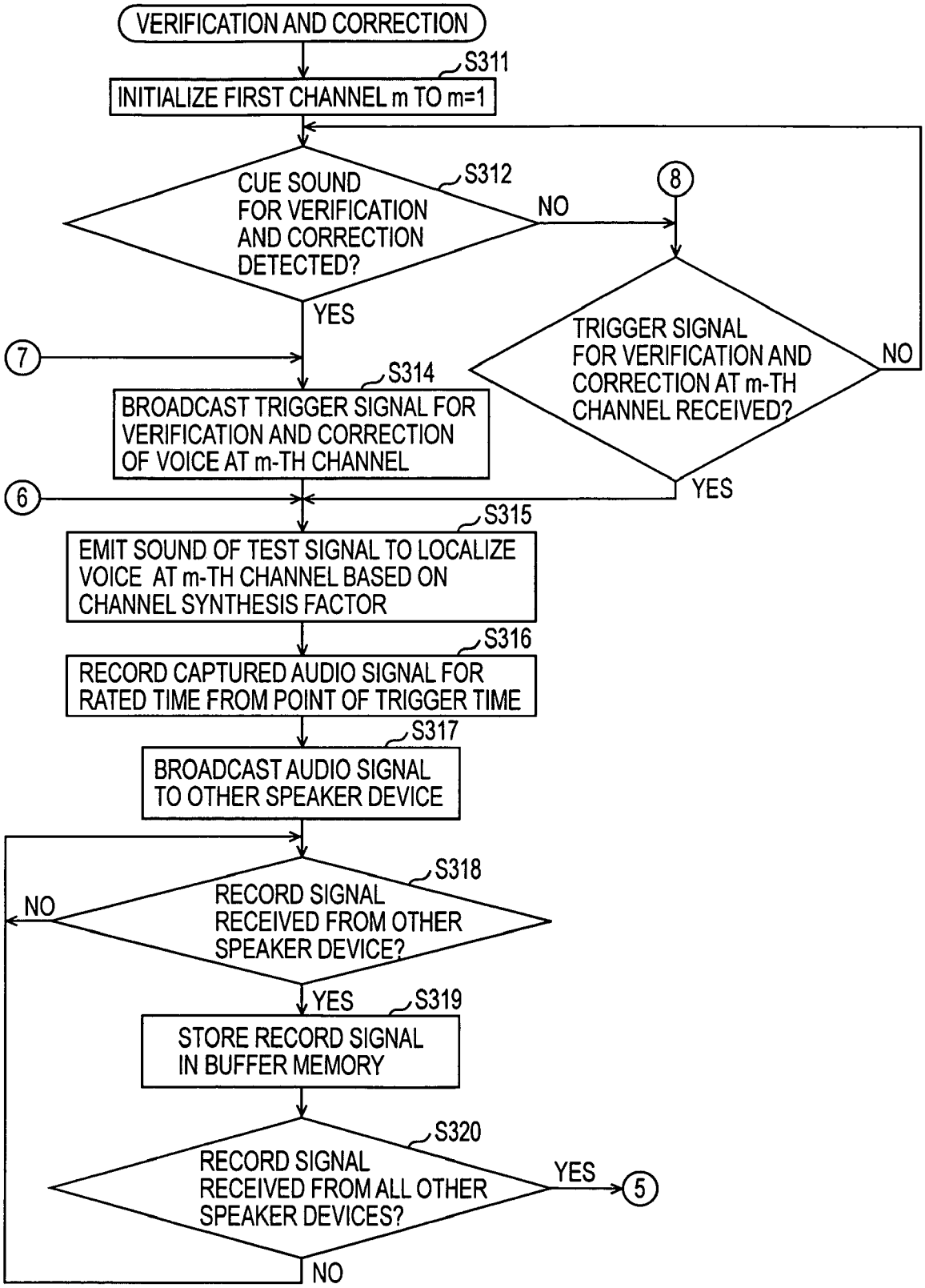
FIG. 41 is a flowchart illustrating the operation of the speaker device that performs a verification and correction process on a channel synthesis coefficient in accordance with the third embodiment of the present invention.
Figure 42:
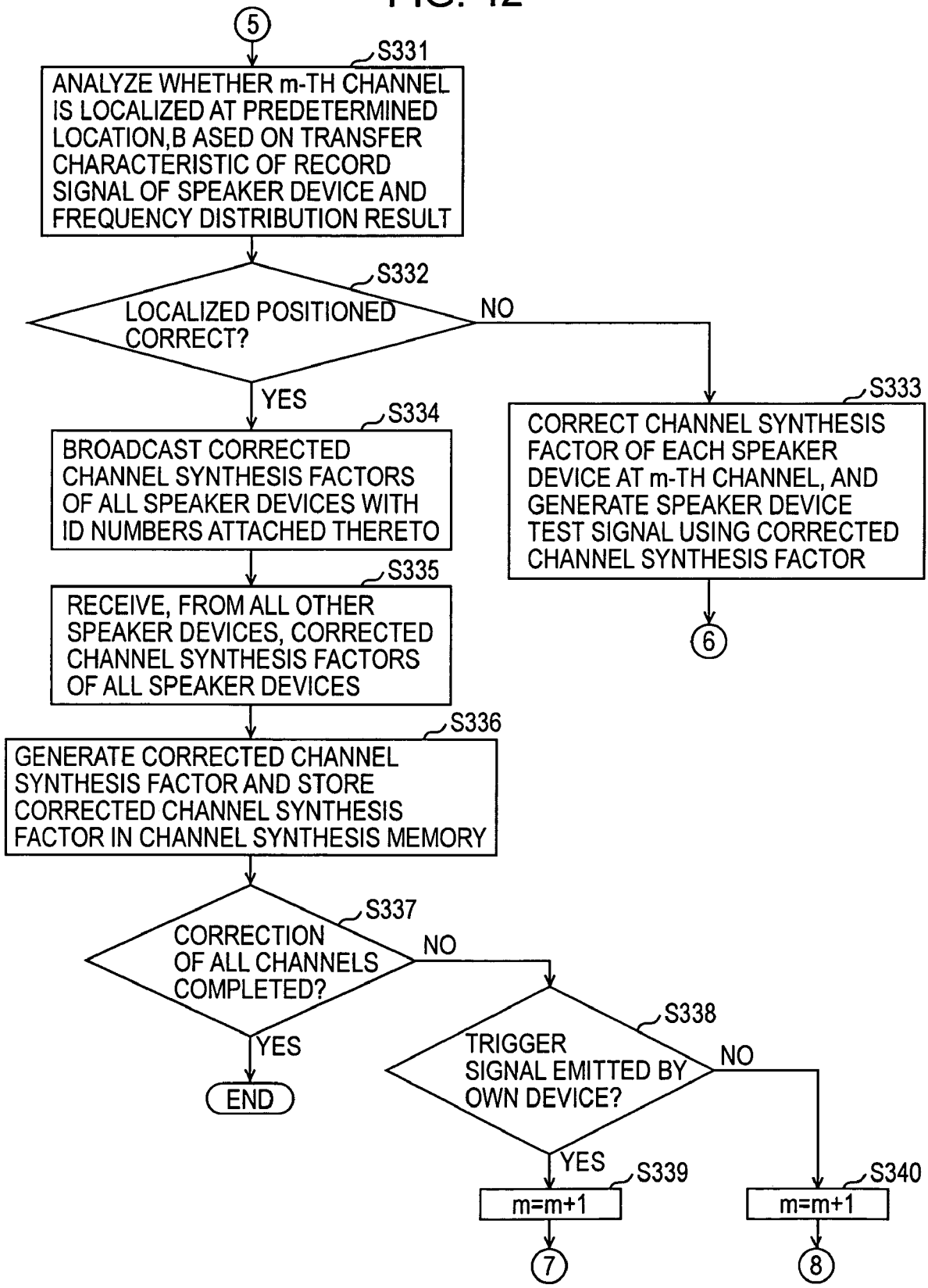
FIG. 42 is a continuation of the flowchart of FIG. 41.

The speaker device 200 initiates the process routine of FIGS. 41 and 42 upon detecting a cue sound for starting the channel synthesis factor verification and correction process. The cue sound may be several hand claps produced by the listener 500 or a voice or whistle produced by the listener 500.

In the third embodiment, each speaker device 200 verifies on a channel-by-channel basis that the sound image caused by the audio signal is localized at a predetermined location, and corrects the channel synthesis factor as required.

In step S311, the CPU 210 performs an initialization process in order to set a first channel m to m=1 for channel synthesis factor verification. Channel 1 is for an L-channel audio signal.

The CPU 210 determines in step S312 whether the speaker device 200 detects the cue sound produced by the listener 500. If it is determined that the cue sound is detected, the speaker device 200 broadcasts, to the other speaker devices 200 via the bus 300, a trigger signal for the verification and correction process of the channel synthesis factor for the audio signal at the m-th channel in step S314.

If it is determined in step S312 that no cue sound is detected, the speaker device 200 determines in step S313 whether the speaker device 200 has received the trigger signal for the verification and correction process of the channel synthesis factor for the audio signal at the m-th channel from another speaker devices 200. If it is determined that no trigger signal has been received, the CPU 210 returns to step S312.

If it is determined in step S313 that the trigger signal for the verification and correction process of the channel synthesis factor for the audio signal at the m-th channel has been received, or after broadcasting, to the other speaker devices 200 via the bus 300, the trigger signal for the verification and correction process of the channel synthesis factor for the audio signal at the m-th channel in step S314, the CPU 210 proceeds to step S315. In step S315, the CPU 210 generates and then emits the speaker signal for verifying the sound image localization state of the audio signal at the m-th channel using the channel synthesis factor of own speaker device 200 from among the channel synthesis factors stored in the channel synthesis factor memory 234.

In order to generate the speaker test signal for an audio signal for an L-channel as an m-th channel, each speaker device 200 reads the factor wLi for the L-channel from among the channel synthesis factors of the speaker devices 200, and multiplies the test signal by the factor wLi. The test signal used here is a signal stored in the ROM 211 of each speaker device 200. No sound emission is performed from a speaker device 200 if the speaker device 200 has a factor wLi=0.

The CPU 210 captures the sound with the microphone 202, and starts recording the audio signal for a rated duration of time starting at the timing of the trigger signal in step S316. The CPU 210 packetizes the record signal for the rated duration of time and the ID number of each speaker device 200 attached thereto, and broadcasts the resulting signal to the other speaker devices 200 in step S317.

The CPU 210 waits for the arrival of the record signal for the rated duration of time from the other speaker devices 200 in step S318. Upon recognizing the arrival of the record signal, the CPU 210 stores the record signal in the RAM 212 in step S319.

The CPU 210 repeats steps S318 and S319 until the record signals are received from all speaker devices 200. Upon recognizing the reception of the record signals for the rated duration of time from all speaker devices 200 in step S320, the CPU 210 calculates the transfer characteristics of the record signals for the rated duration of time of own speaker device 200 and the other speaker devices 200, and performs frequency analysis on the transfer characteristics. Based on the frequency analysis result, the CPU 210 analyzes in step S331 of FIG. 42 whether the sound image caused by the emission of the test signal at the m-th channel is localized at the predetermined location.

Based on the analysis result, the CPU 210 determines in step S332 whether the sound image caused by the emission of the test signal at the m-th channel is localized at the predetermined location. If it is determined that the sound image is not localized at the predetermined location, the CPU 210 corrects the channel synthesis factors of the speaker devices 200 at the m-channel in accordance with the analysis result, stores the corrected channel synthesis factors in the buffer memory, and generates the speaker test signal for own speaker device 200 at the m-th channel using the corrected channel synthesis factors in step S333. The CPU 210 returns to step S315 to emit the speaker test signal generated using the corrected channel synthesis factors generated in step S333.

If it is determined in step S332 that the sound image of the test signal at the m-th channel is localized at the predetermined location, the CPU 210 broadcasts, via the bus 300, the corrected channel synthesis factors of all speaker devices 200 with the ID number of own speaker device 200 attached thereto in step S334.

The CPU 210 receives the corrected channel synthesis factors of all speaker devices 200 from all speaker devices 200 in step S335. The CPU 210 determines a convergence value of the corrected channel synthesis factors from the channel synthesis factors received from all speaker devices 200. The CPU 210 stores the convergence value of the channel synthesis factors in the channel synthesis factor memory 234 for updating in step S336.

The CPU 210 determines in step S337 whether the correction process of all channels is complete. If it is determined that the correction process of all channels is complete, the CPU 210 ends the process routine.

If it is determined in step S337 that the correction process of all channels is not complete, the CPU 210 determines in step S338 whether the trigger signal is emitted by own speaker device 200. If it is determined that the speaker device 200 that has emitted the trigger signal is own speaker device 200, the CPU 210 specifies a next channel in step S339, and then returns to step S314. If it is determined in step S338 that the speaker device 200 that has emitted the trigger signal is not own speaker device 200, the CPU 210 returns to step S313 after specifying a next channel in step S340.

In accordance with the third embodiment, each speaker device 200 automatically detects the layout configuration of the plurality of speaker devices 200 placed at arbitrary positions, automatically generates an appropriate speaker signal to be supplied to each speaker device 200 based on the information of the layout configuration, and performs the verification and correction process to verify that the generated speaker signal forms an appropriate acoustic field.

The channel synthesis factor verification and correction process of the third embodiment is not limited to the automatic detection of the layout configuration of the plurality of speaker devices 200 placed at arbitrary locations. The user may enter settings to each speaker device 200, and each speaker device 200 calculates the channel synthesis factor thereof based on the information of the setting. In this case, as well, the verification and correction process of the third embodiment is also applicable to verifying that the calculated channel synthesis factor actually forms an optimum acoustic field in sound playing.

In other words, a rigorously accurate determination of the layout configuration of the speaker devices 200 arranged at arbitrary locations is not required. The layout configuration is roughly set up first, and the channel synthesis factor based on the information of the layout configuration is corrected in the verification and correction process. A channel synthesis factor creating an optimum acoustic field thus results.

In the third embodiment, a desired acoustic field is easily achieved by initiating the channel synthesis factor verification and correction process instead of recalculating the layout configuration of the speaker devices when the layout configuration of the speaker devices 200 is slightly modified in the second embodiment.

In the third embodiment, the verification and correction process can be performed on a plurality of channels at the same time rather than on each channel synthesis factor on a channel-by-channel basis. If the speaker test signals for different channels are separately generated from the audio signal captured by the microphone 202, channel synthesis factors for a plurality of channels are subjected to the verification and correction process at the same time.

Fourth Embodiment

Figure 43:
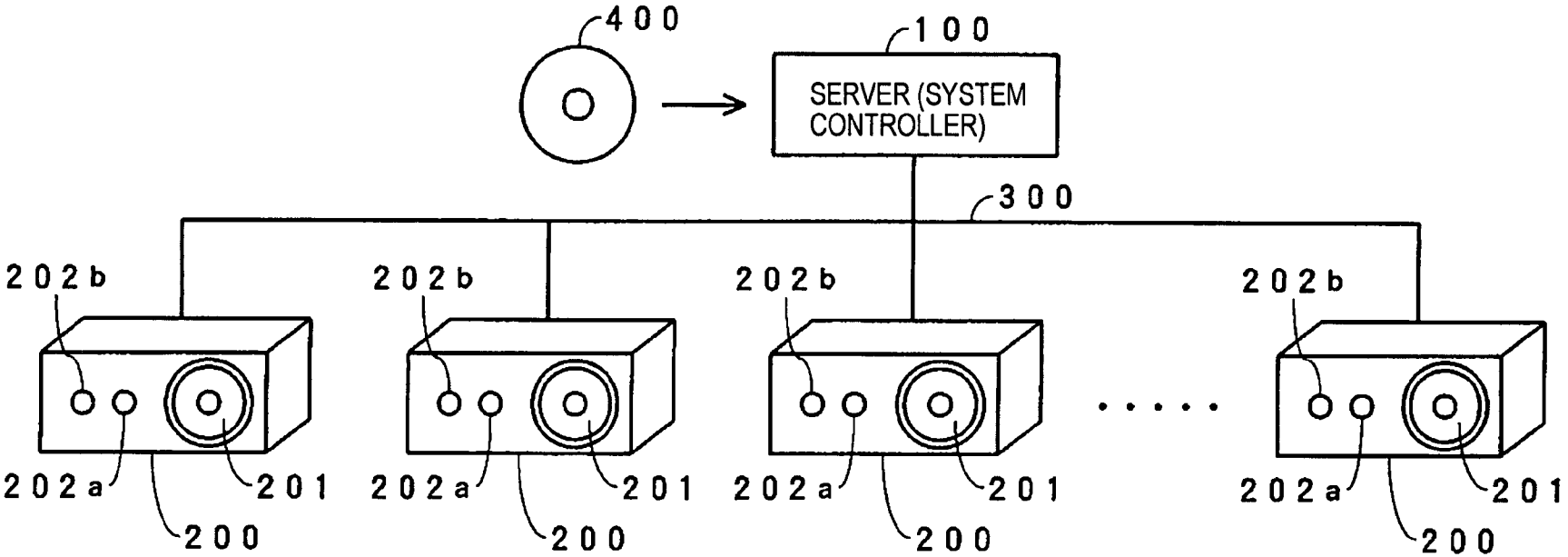
FIG. 43 illustrates a system configuration of an audio system of a fourth embodiment of the present invention.

FIG. 43 is a block diagram of an audio system in accordance with a fourth embodiment of the present invention. The fourth embodiment is a modification of the first embodiment. In the fourth embodiment, the microphone 202 as a pickup unit includes two microphones: a microphone 202*a* and a microphone 202*b*.

In accordance with the fourth embodiment, the two microphones 202*a* and 202*b* in each speaker device 200 are used to capture sounds. The microphones 202*a* and 202*b* detects the incident direction of sound with respect to the speaker device 200, and the detected incident direction of sound is used to calculate the layout configuration of the plurality of speaker devices 200.

Figure 44:
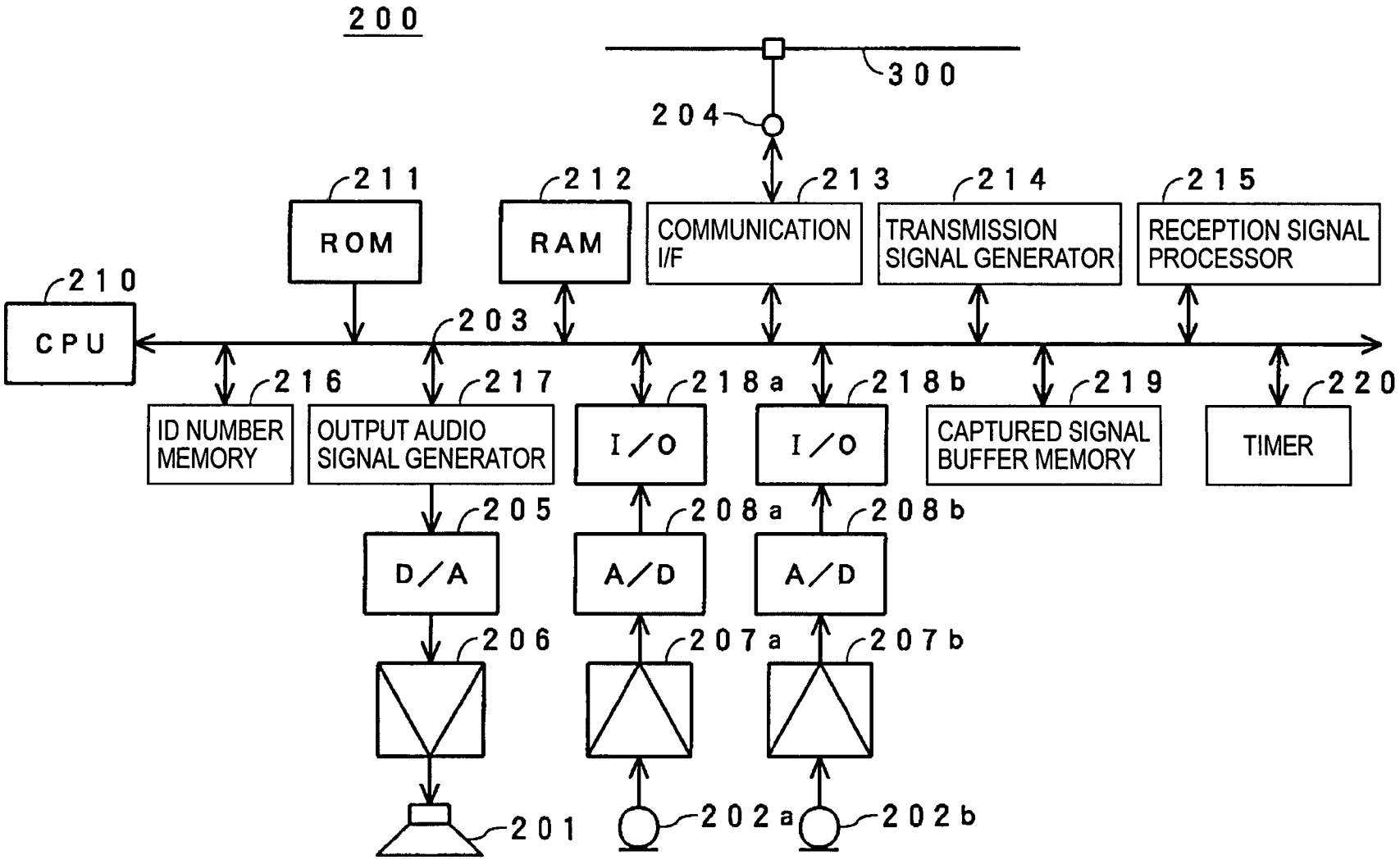
FIG. 44 is a block diagram illustrating the hardware structure of a speaker device in accordance with the fourth embodiment of the present invention.

FIG. 44 illustrates the hardware structure of the speaker device 200 in accordance with the fourth embodiment of the present invention.

In the speaker device 200 of the fourth embodiment, the audio signal captured by the microphone 202*a* is fed to an analog-to-digital (A/D) converter 208*a* via an amplifier 207*a*. The audio signal is analog-to-digital converted by the A/D converter 208*a* and is then transferred to the captured signal buffer memory 219 via an I/O port 218*a* and the system bus 203.

The audio signal captured by the microphone 202*b* is fed to an analog-to-digital (A/D) converter 208*b* via an amplifier 207*b*. The audio signal is analog-to-digital converted by the A/D converter 208*b* and is then transferred to the captured signal buffer memory 219 via an I/O port 218*b* and the system bus 203.

Figure 45:
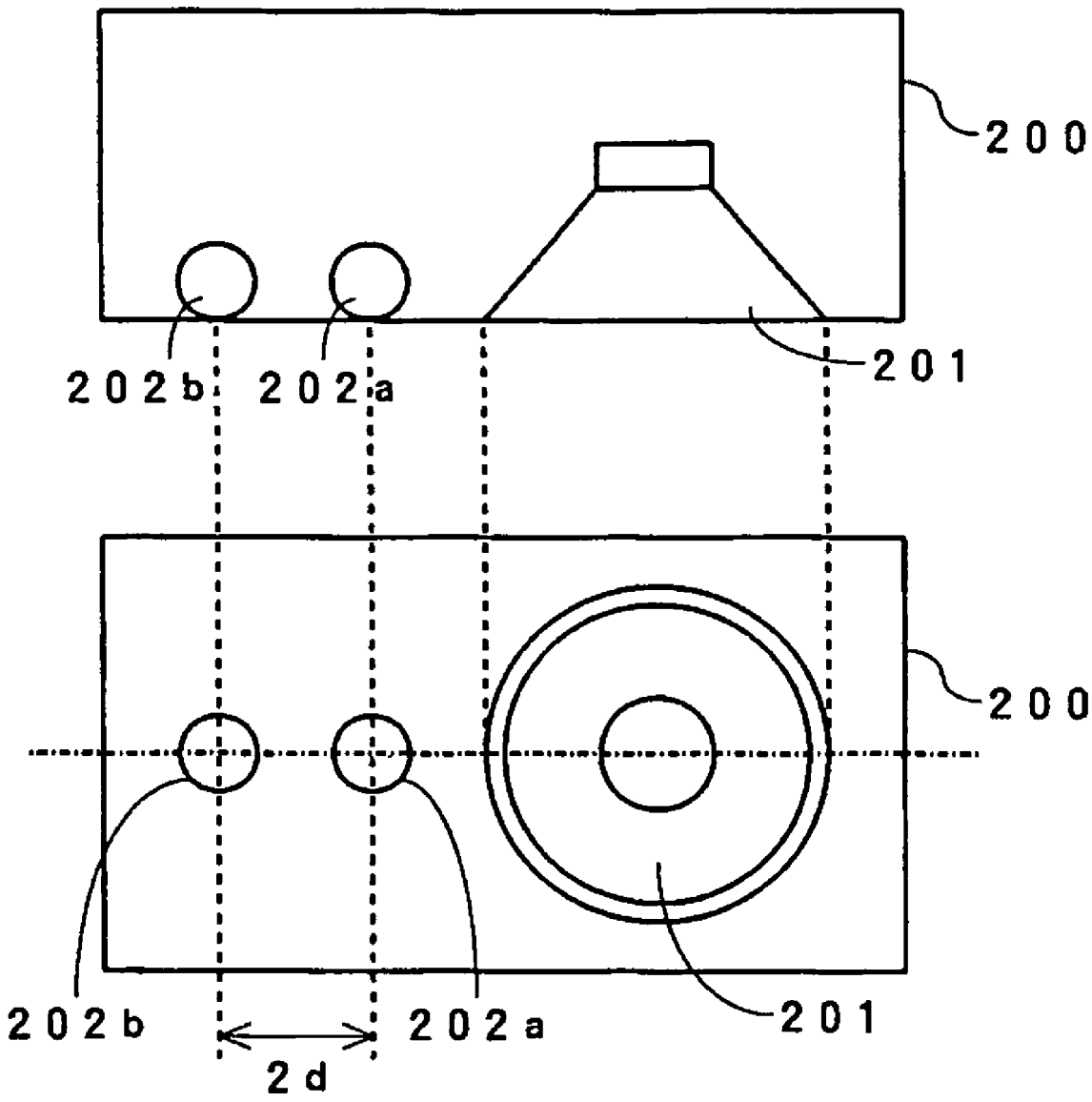
FIG. 45 illustrates the layout of microphones in the speaker device in accordance with the fourth embodiment of the present invention.

In accordance with the fourth embodiment, the two microphones 202*a* and 202*b* are arranged in the speaker device 200 as shown in FIG. 45. The upper portion of FIG. 45 is a top view of the speaker device 200 and the lower portion of FIG. 45 is a front view of the speaker device 200. The speaker device 200 lies on the long-side surface thereof in the mounting position thereof. As shown in the lower portion of FIG. 45, the two microphones 202*a* and 202*b* are arranged on the right-hand side or the left-hand side along the center line with a distance 2*d* maintained therebetween.

The two microphones 202*a* and 202*b* are omnidirectional. In the fourth embodiment, the CPU 210 uses the RAM 212 as a work area thereof under the control of the program of the ROM 211. Using a software process, a sum signal and a difference signal are determined from digital audio signals AUDa and AUDb captured into the captured signal buffer memory 219 through the I/O ports 218*a* and 218*b*.

In accordance with the fourth embodiment, the sum signal and the difference signal of the digital audio signals S0 and S1 are used to calculate the incident direction of sound from a sound source to the speaker device 200.

FIG. 46A is a block diagram illustrating a processor circuit for performing a process on the digital audio signals S0 and S1 from the two microphones 202*a* and 202*b*, the process being equivalent to the process performed by the CPU 210.

As shown in FIG. 46A, the digital audio signals S0 and S1 from the two microphones 202*a* and 202*b* are supplied to a summing amplifier 242 and a differential amplifier 243 via a level adjuster 241. The level adjuster 241 adjusts the digital audio signals S0 and S1 to eliminate a difference in gain between the two microphones 202*a* and 202*b*.

The summing amplifier 242 outputs a sum output Sadd of the digital audio signal S0 and the digital audio signal S1. The differential amplifier 243 outputs a difference output Sdiff of the digital audio signal S0 and the digital audio signal S1.

As shown in FIGS. 46B and 46C, the sum output Sadd is omnidirectional while the difference output Sdiff is bidirectional. The reason why the sum output Sadd and the difference output Sdiff provide directivity patterns as shown is discussed below with reference to FIGS. 47 and 48.

As shown in FIG. 47, two microphones M0 and M1 are arranged in a horizontally extending line with a distance 2*d* maintained therebetween. The sound incident direction from the sound source to the two microphones M0 and M1 is θ with reference to the horizontal direction.

Let S0 represent the output of the microphone M0, and the output S1 of the microphone M1 as expressed by Eq. 1 in FIG. 48. The difference output Sdiff between the output S0 and the output S1 is expressed in Eq. 2 as shown in FIG. 48 if k2d<<1. The sum output Sadd of the output S0 and the output S1 is expressed in Eq. 3 as shown in FIG. 48 if k2d<<1.

The sum output Sadd of the two microphones M0 and M1 is omnidirectional while the difference output Sdiff is bidirectional. The sound incident direction from the sound source is determined from the sum output Sadd and the difference output Sdiff because the two directivity patterns reverse in output polarity depending on the sound incident direction.

The measurement method of the sound incident direction is a method of determining an acoustic intensity. The acoustic intensity is understood as "a flow of energy passing through a unit area per unit time", and the unit of the acoustic intensity is $w/cm^2$. The flow of energy of sound from the two microphones is measured, and the acoustic intensity together with the direction of flow are treated as a vector.

This method is referred to as the two-microphone method. The wavefront of the wave reaching first the microphone M0 then reaches the microphone M1 with a time difference. The propagation direction of the sound and a component of magnitude of the sound with respect to the axis of the microphones are calculated based on the time difference. Let S0(*t*) represent an acoustic pressure at the microphone M0 and S1(*t*) represent an acoustic pressure at the microphone M1, and a mean value S(t) of the acoustic pressure and a particle velocity V(t) are expressed in Eq. 4 and Eq. 5 as shown in FIG. 48.

The acoustic intensity is determined by multiplying S(t) and V(t), and time-averaging the product. The sum output Sadd corresponds to the means value S(t) of the acoustic pressure, and the difference output Sdiff corresponds to the particle velocity V(t).

In the above discussion, the two microphones 202*a* and 202*b* are arranged along a horizontal line on the assumption that the plurality of speaker devices 200 are arranged on a horizontal plane. It is not a requirement that the two microphones 202*a* and 202*b* be arranged along the center line passing through the center of the speaker 201 of the speaker device 200. It is sufficient to arrange the two microphones 202*a* and 202*b* in a substantially horizontal line.

As shown in FIG. 45, the two microphones 202*a* and 202*b* can be arranged on both sides of the speaker 201 as shown in FIG. 49 rather than on one side of the speaker 201 as shown in FIG. 45. The upper portion of FIG. 49 is a top view of the speaker device 200 while the lower portion of FIG. 49 is a front view of the speaker device 200. The two microphones 202*a* and 202*b* are arranged along a horizontal line passing through the center of the speaker 201.

Even when the two microphones 202*a* and 202*b* are mounted on both sides of the speaker 201, it is not a requirement that the two microphones 202*a* and 202*b* be arranged along the horizontally extending line passing through the center of the speaker 201 as shown in FIG. 49.

In accordance with the fourth embodiment for the listener-to-speaker distance measurement and speaker-to-speaker distance measurement, which are previously discussed in connection with the first embodiment, the speaker device 200 supplies the server apparatus 100 with the audio signal captured by the two microphones 202*a* and 202*b*. To calculate the listener-to-speaker distance and the speaker-to-speaker distance, the server apparatus 100 calculates the sum output Sadd and the difference output Sdiff to determine the sound incident direction to the speaker device 200, and stores the sound incident direction information together with the resulting distance information.

Figure 50:
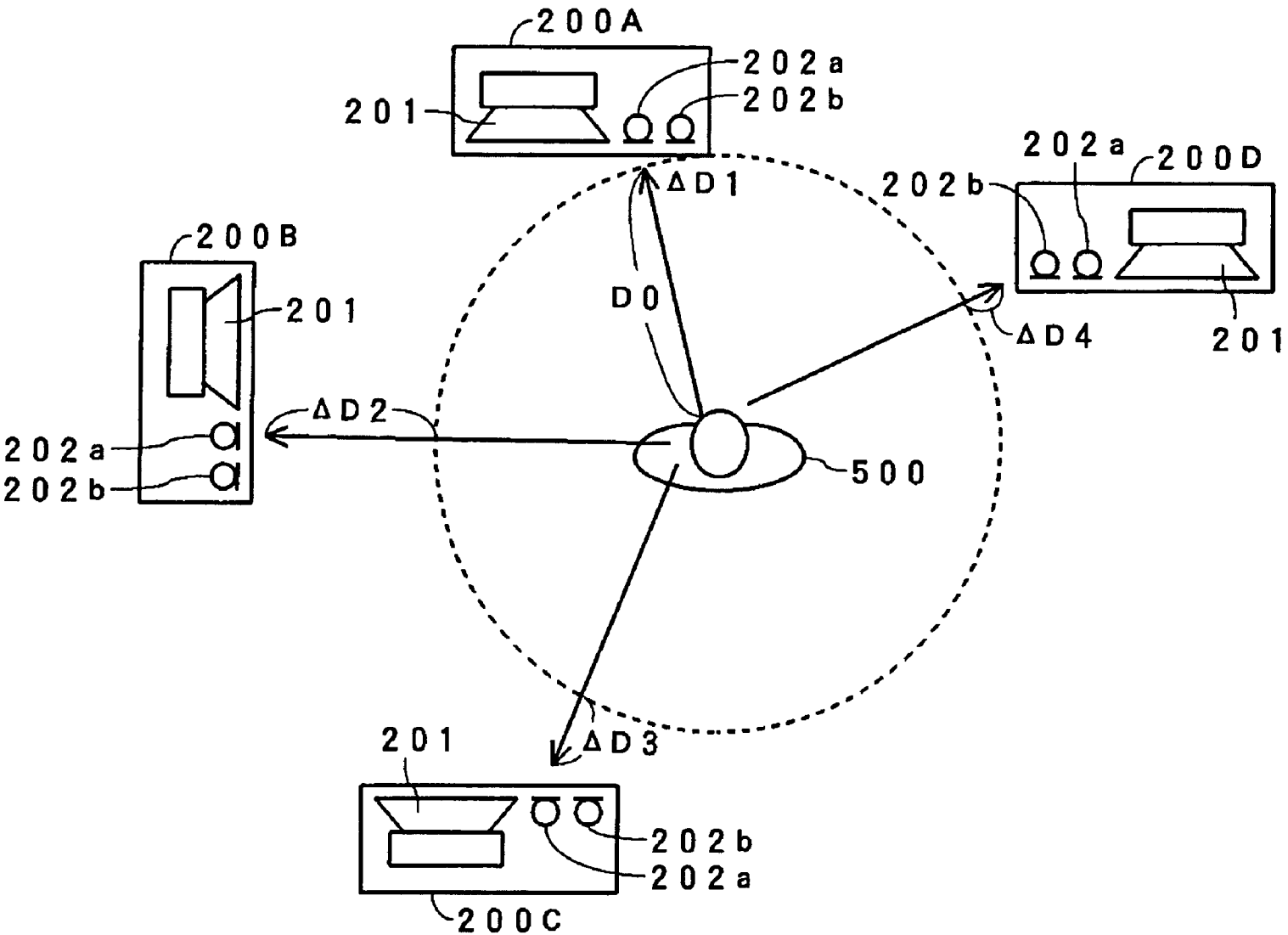
FIG. 50 illustrates a method for determining a distance between the listener and the speaker device in accordance with the fourth embodiment of the present invention.

FIG. 50 illustrates an audio system configuration for measuring the listener-to-speaker distance in accordance with the fourth embodiment. The measurement method of the fourth embodiment for measuring the listener-to-speaker distance is identical to that of the first embodiment. Each speaker device 200 captures the sound produced by the listener 500. The difference between the fourth embodiment and the first embodiment is that the two microphones 202*a* and 202*b* are used to capture the sound in the fourth embodiment as shown in FIG. 50.

Figure 51:
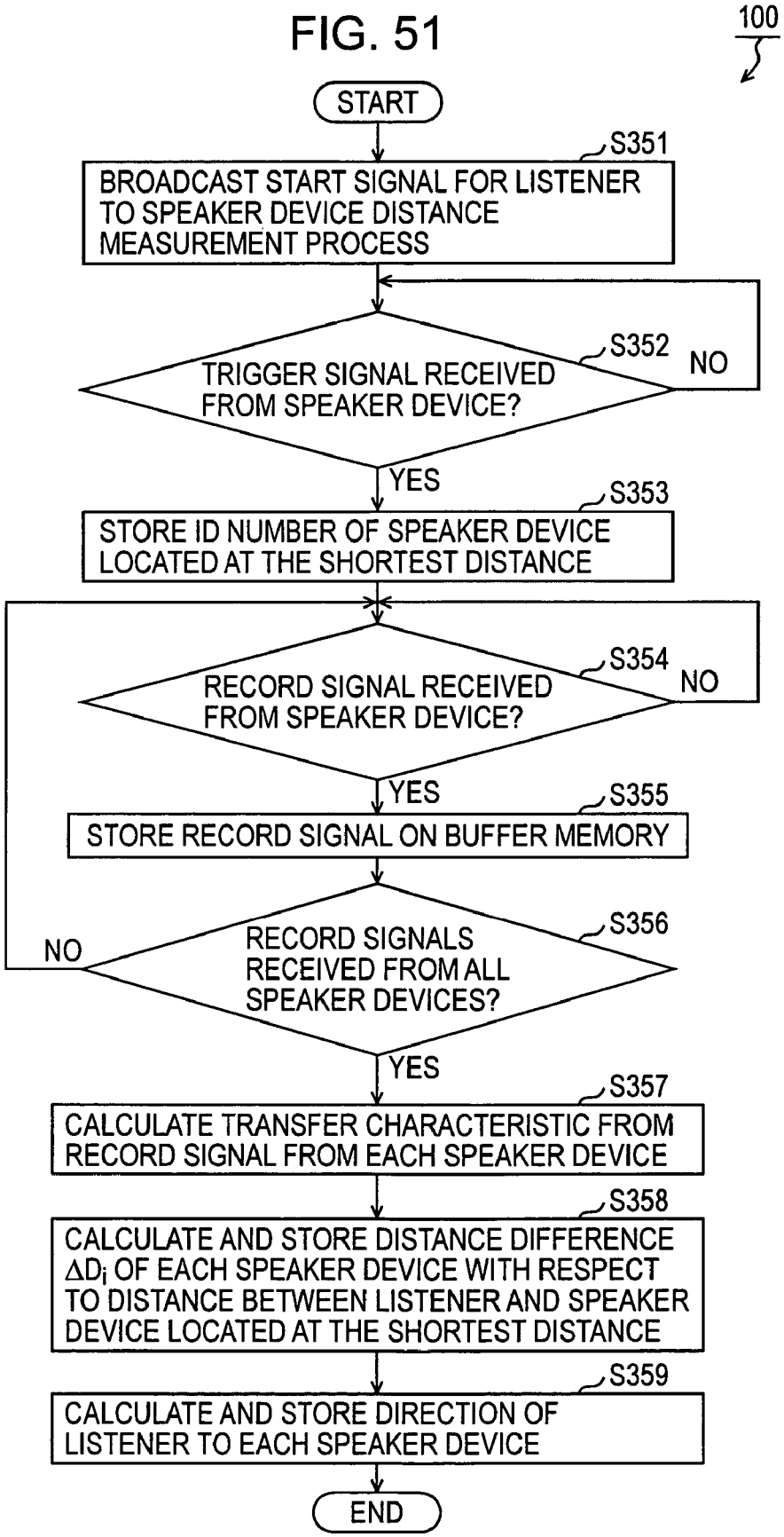
FIG. 51 is a flowchart illustrating the operation of the server apparatus that collects information concerning the distance between the listener and the speaker device in accordance with the fourth embodiment of the present invention.

The process routine of the server apparatus 100 for measuring the listener-to-speaker distance is described below with reference to a flowchart of FIG. 51.

The server apparatus 100 broadcasts a listener-to-speaker distance measurement process start signal to all speaker devices 200 via the bus 300 in step S351. The CPU 110 waits for the arrival of a trigger signal from any of the speaker devices 200 via the bus 300 in step S352.

Upon recognizing the arrival of a trigger signal from any speaker device 200, the CPU 110 determines the speaker device 200 having transmitted the trigger signal as a speaker device 200 closest placed to the listener 500 and stores the ID number of that speaker device 200 in the RAM 112 or the speaker layout information memory 118 in step S353.

The CPU 110 waits for the arrival of the record signal of the audio signal captured by the two microphones 202*a* and 202*b* in step S354. Upon recognizing the arrival of the ID number of the speaker device 200 and the record signal, the CPU 110 stores the record signal in the RAM 112 in step S355. The CPU 110 determines in step S356 whether the record signal of the audio signal captured by the two microphones 202*a* and 202*b* has been received from all speaker devices 200 connected to the bus 300. If it is determined that the record signals have not been received from all speaker devices 200, the CPU 110 returns to step S354 where the CPU 110 repeats the reception process of the record signal until the record signals of the audio signals captured by the two microphones 202*a* and 202*b* are received from all speaker devices 200.

If it is determined in step S356 that the record signals of the audio signals captured by the two microphones 202*a* and 202*b* have been received from all speaker devices 200, the CPU 110 controls the transfer characteristic calculator 121 to calculate the transfer characteristic of the record signal of the audio signal captured by the two microphones 202*a* and 202*b* in each speaker device 200 in step S357.

In this case, the server apparatus 100 can calculate the transfer characteristic from the audio signal from one or both of the two microphones 202*a* and 202*b*.

The CPU 110 calculates the propagation delay time of each speaker device 200 from the calculated transfer characteristic, calculates the distance difference ΔDi of each speaker device 200 with respect to the distance Do between the closet speaker 200 and the listener 500, and stores information of the distance difference ΔDi in the RAM 112 or the speaker layout information memory 118 with the ID number of the speaker device 200 associated therewith in step S358.

The server apparatus 100 can calculate the transfer characteristic based on the audio signal from one or both of the two microphones 202*a* and 202*b*. For example, the server apparatus 100 can calculate the transfer characteristic from the sum output Sadd of the audio signals of the two microphones 202*a* and 202*b*.

When the propagation delay time of each speaker device 200 is calculated from the transfer characteristic of the audio signal captured by one of the two microphones 202*a* and 202*b*, the listener-to-speaker distance is calculated with respect to the single microphone.

When the transfer characteristic is calculated from the sum output Sadd of the audio signals of the two microphones 202*a* and 202*b* and the propagation delay time of each speaker device 200 is calculated from the transfer characteristic, the center point between the two microphones 202*a* and 202*b* is considered as a location of each speaker device 200. When the two microphones 202*a* and 202*b* are arranged as shown in FIG. 49, the center of the speaker 201 serves as a reference location of the speaker device 200.

The speaker device 200 calculates the sum output Sadd and the difference output Sdiff of the two microphones 202*a* and 202*b*, received as the record signal from the speaker device 200, calculates the sound incident direction of the sound produced by the listener 500 to the speaker device 200, i.e., the direction of the speaker device 200 toward the listener 500, and stores the listener direction information onto one of the RAM 112 and the speaker layout information memory 118 with the ID number of the speaker device 200 associated therewith in step S359.

The process routine of the speaker device 200 for measuring the listener-to-speaker distance in accordance with the fourth embodiment is described below with reference to a flowchart of FIG. 52.

Figure 52:
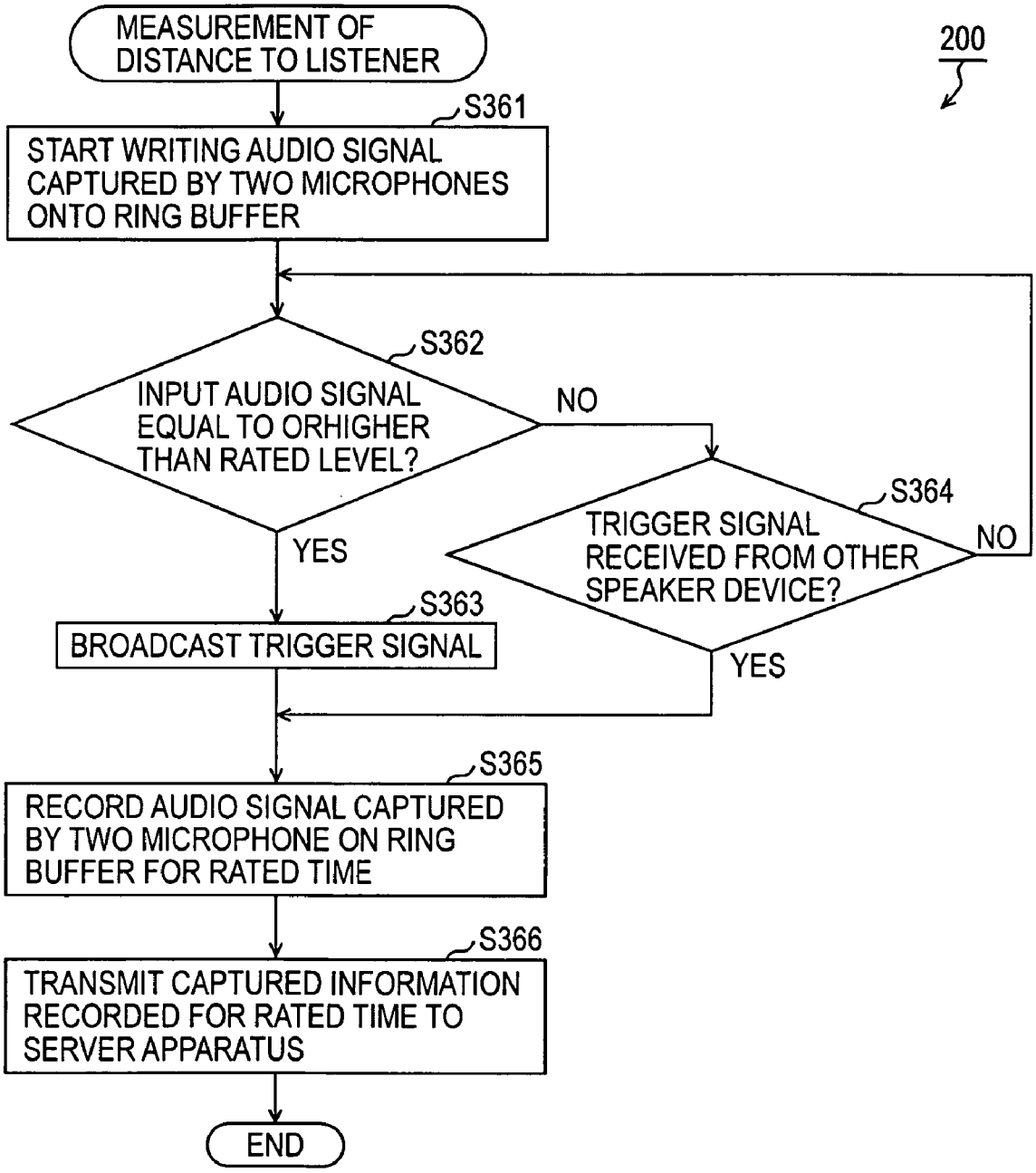
FIG. 52 is a flowchart illustrating the operation of the speaker device that collects the information concerning the distance between the listener and the speaker device in accordance with the fourth embodiment of the present invention.

Upon receiving the listener-to-speaker distance measurement process start signal from the server apparatus 100 via the bus 300, the CPU 210 in each speaker device 200 initiates the process routine of the flowchart of FIG. 52. The CPU 210 starts writing the audio signal, captured by the microphones 202*a* and 202*b*, onto the captured signal buffer memory 219 in step S361.

The CPU 210 monitors the level of the audio signal from one or both of the two microphones 202*a* and 202*b*. In order to determine whether the listener 500 has produced a voice in step S362, the CPU 210 determines whether the level of the audio signal of one microphone if the one microphone is used, or the level of the audio signal of one of the two microphones 202*a* and 202*b* if the two microphones 202*a* and 202*b* are used, rises above a predetermined rated level. The determination of whether the audio signal is equal to or higher than the predetermined threshold level is performed to prevent the speaker device 200 from erroneously detecting noise as a voice produced by the listener 500.

If it is determined in step S362 that the audio signal equal to or higher than the rated level is detected, the CPU 210 broadcasts the trigger signal to the server apparatus 100 and the other speaker devices 200 via the bus 300 in step S363.

If it is determined in step S362 that the audio signal equal to or higher than the rated level is not detected, the CPU 210 determines in step S364 whether the trigger signal has been received from another speaker device 200. If it is determined that no trigger signal has been received, the CPU 210 returns to step S362.

If it is determined in step S364 that the trigger signal has been received from another speaker device 200, or when the CPU 210 broadcasts the trigger signal via the bus 300 in step S363, the CPU 210 starts recording, in the captured signal buffer memory 219, the audio signal, captures by the microphones 202*a* and 202*b*, from the timing of the received trigger signal or from the timing of the transmission of the trigger signal in step S365.

The CPU 210 transmits the audio signal from the two microphones 202*a* and 202*b* recorded for the rated time to the server apparatus 100 via the bus 300 together with the ID number of own speaker device 200 in step S366.

In accordance with the fourth embodiment, the CPU 110 calculates the transfer characteristic in step S357, thereby determining the propagation delay time of the speaker device 200. Alternatively, a cross correlation calculation may be performed on the record signal from the closest speaker and the record signals from each of the other speaker devices 200, and the propagation delay time is determined from the result of cross correlation calculation.

Figures 53A, 53B:
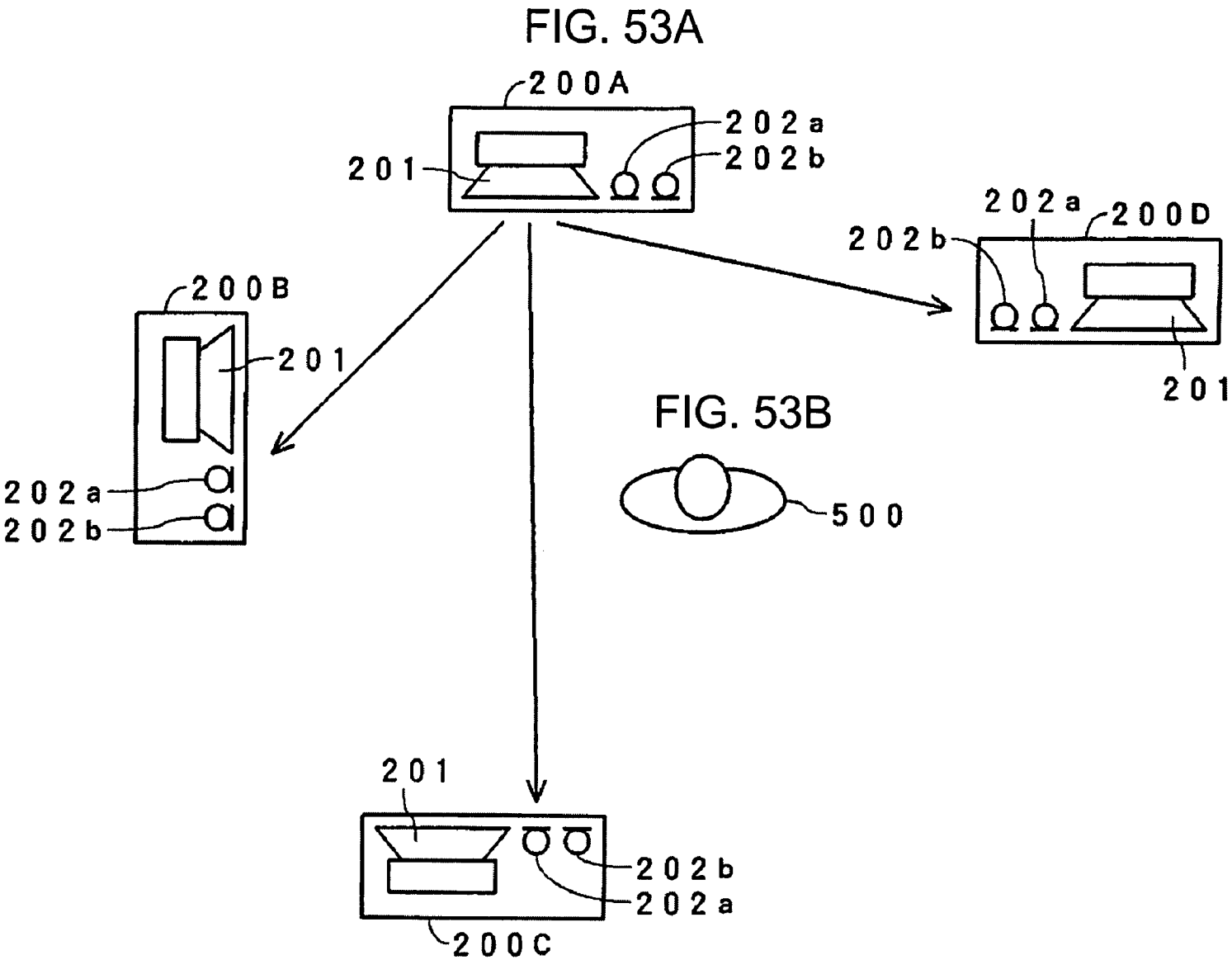
FIGS. 53A and 53B illustrate a method for determining the distance between the speaker devices in accordance with the fourth embodiment of the present invention.

The speaker-to-speaker distance measurement process of the speaker devices 200 in accordance with the fourth embodiment remains unchanged from that of the first embodiment. FIG. 53 illustrates the speaker-to-speaker distance measurement process of the speaker device 200. The server apparatus 100 transmits a test signal emission command signal to the speaker device 200. The other speaker devices 200 capture the sound from the speaker device 200 that has performed sound emission, and supply the server apparatus 100 with the audio signals of the sound. The server apparatus 100 calculates the speaker-to-speaker distance of each speaker device 200.

In accordance with the fourth embodiment, the audio signals captured by the two microphones 202*a* and 202*b* are used to calculate the sound incident direction to each speaker device 200, and the layout configuration of the speaker devices 200 is thus more accurately calculated.

The speaker-to-speaker distance measurement process routine of the speaker device 200 in accordance with the fourth embodiment is described below with reference to a flowchart of FIG. 54.

Figure 54:
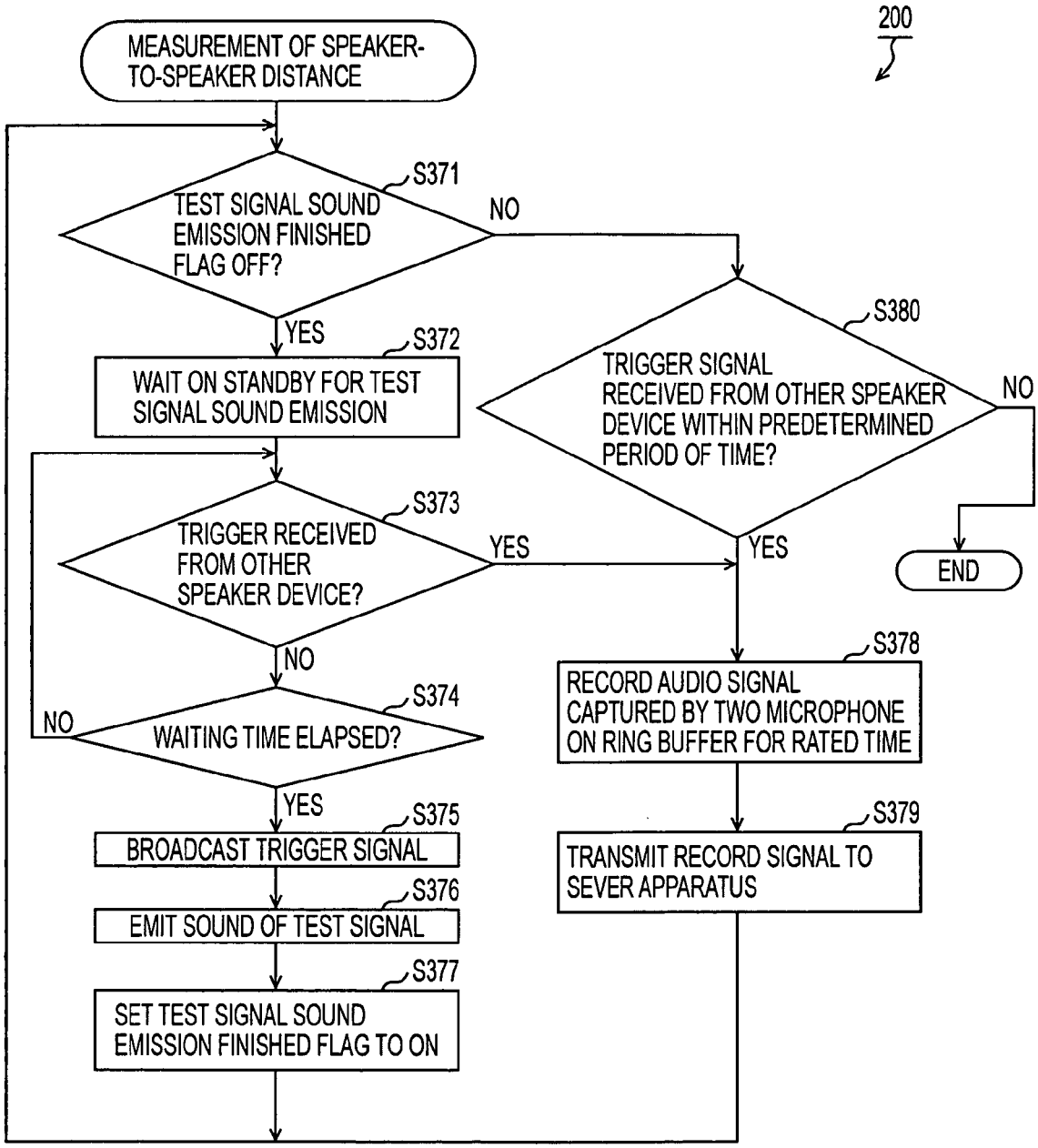
FIG. 54 illustrates a method for determining the distance between the speaker devices in accordance with the fourth embodiment of the present invention.

Upon receiving the test signal sound emission command signal from the server apparatus 100 via the bus 300, the CPU 210 in each speaker device 200 initiates the process routine of the flowchart of FIG. 54. The CPU 210 determines in step S371 whether a test signal emitted flag is off. If it is determined that the test signal emitted flag is off, the CPU 210 determines that no test signal has not been emitted, and waits for a test signal emission for a random time in step S372.

The CPU 210 determines in step S373 whether a trigger signal has been received from another speaker device 200. If it is determined that no trigger signal has been received, the CPU 210 determines in step S374 whether the waiting time set in step S372 has elapsed. If it is determined that the waiting time has not elapsed, the CPU 210 returns to step S373 to continuously monitor the arrival of a trigger signal from another speaker device 200.

If it is determined in step S374 that the waiting time has elapsed without receiving a trigger signal from another speaker device 200, the CPU 210 packetizes the trigger signal with own ID number attached thereto and broadcasts the packet via the bus 300 in step S375. In synchronization with the broadcast trigger signal, the CPU 210 emits the sound of the test signal from the speaker 201 thereof in step S376. The CPU 210 sets the test signal emitted flag to on in step S377, and then returns to step S371.

If it is determined in step S373 that a trigger signal has been received from another speaker device 200 during the waiting time for the test signal emission, the CPU 210 records the audio signal of the test signal captured by the two microphones 202*a* and 202*b* of each speaker device 200 for rated time from the timing of the trigger signal in step S378. The CPU 210 packetizes the audio signals captured by the two microphones 202*a* and 202*b* for the rated time, attaches the ID number to the packet, and transmits the packet to the server apparatus 100 via the bus 300 in step S379. The CPU 210 returns to step S371.

If it is determined in step S371 that the test signal has been emitted with the test signal emitted flag on, the CPU 210 determines in step S380 whether a trigger signal has been received from another speaker device 200 within a predetermined period of time. If it is determined that a trigger signal has been received, the CPU 210 records the audio signal of the test signal, captured by the two microphones 202*a* and 202*b*, for rated time from the timing of the received trigger signal in step S378. The CPU 210 packetizes the audio signal recorded for the rated time, attaches the ID number to the packet, and transmits the resulting packet to the server apparatus 100 via the bus 300 in step S379.

If it is determined in step S380 that no trigger signal has been received from another speaker device 200 within the predetermined period of time, the CPU 210 determines that the sound emission of the test signal from all speaker devices 200 is complete, and ends the process routine.

The process routine of the server apparatus 100 for measuring the speaker-to-speaker distance in accordance with the fourth embodiment is described below with reference to a flowchart of FIG. 55.

The CPU 110 in the server apparatus 100 broadcasts a test signal emission command signal to all speaker devices 200 via the bus 300 in step S391. The CPU 110 determines in step S392 whether a predetermined period of time, set taking into consideration waiting time for waiting the sound emission of the test signal in the speaker device 200, has elapsed.

If it is determined in step S392 that the predetermined period of time has not elapsed, the CPU 110 determines in step S393 whether the trigger signal is received from any speaker device 200. If it is determined that no trigger signal has been received, the CPU 110 returns to step S392 to monitor whether the predetermined period of time has elapsed.

If it is determined in step S393 that a trigger signal has been received, the CPU 110 identifies in step S394 the ID number NA of the speaker device 200 that has transmitted the trigger signal from the ID number attached to the packet of the trigger signal.

In step S395, the CPU 110 waits for the arrival of the record signal of the audio signal captured by the two microphones 202*a* and 202*b* in the speaker device 200. Upon recognizing the arrival of the record signal, the CPU 110 identifies the ID number NB that has transmitted the record signal from the ID number attached to the packet of the record signal. The CPU 110 stores the record signal into the buffer memory with the ID number NB associated therewith in step S396.

In step S397, the CPU 110 calculates the transfer characteristic of the record signal stored in the buffer memory, thereby determining the propagation delay time from the generation timing of the trigger signal. The CPU 110 calculates a distance Djk between the speaker device 200 having the ID number NA that has emitted the test signal and the speaker device 200 having the ID number NB that has transmitted the record signal (namely, a distance between the speaker device 200 having an ID number j and the speaker device 200 having an ID number k), and stores information of the distance Djk in the speaker layout information memory 118 in step S398.

The server apparatus 100 can calculate the transfer characteristic based on the audio signal from one or both of the two microphones 202*a* and 202*b*. For example, the server apparatus 100 can calculate the transfer characteristic from the sum output Sadd of the audio signals of the two microphones 202*a* and 202*b*.

When the propagation delay time of each speaker device 200 is calculated from the transfer characteristic of the audio signal captured by one of the two microphones 202*a* and 202*b*, the listener-to-speaker distance is calculated with respect to the single microphone.

When the transfer characteristic is calculated from the sum output Sadd of the audio signals of the two microphones 202*a* and 202*b* and the propagation delay time of each speaker device 200 is calculated from the transfer characteristic, the center point between the two microphones 202*a* and 202*b* is considered as a location of each speaker device 200. When the two microphones 202*a* and 202*b* are arranged as shown in FIG. 49, the center of the speaker 201 serves as a reference location of the speaker device 200, and the speaker-to-speaker distance is the distance between the center of one speaker 201 and the center of another speaker 201.

The speaker device 200 calculates the sum output Sadd and the difference output Sdiff of the two microphones 202*a* and 202*b*, received as the record signal from the speaker device 200 having the ID number NB. Based on the sum output Sadd and the difference output Sdiff, the CPU 210 calculates the sound incident direction θjk of the test signal to the speaker device 200 having the ID number NB from the speaker device 200 having the ID number NA that has emitted the test signal (i.e., the sound incident angle of the test signal from the speaker device 200 having an ID number k to the speaker device 200 having an ID number j), and stores the sound incident direction information in the speaker layout information memory 118 in step S399.

The propagation delay time is determined by calculating the transfer characteristic in step S397. Alternatively, a cross correlation calculation may be performed on the test signal and the record signal from each of the other speaker devices 200, and the propagation delay time is determined from the result of cross correlation calculation.

The CPU 110 determines in step S400 whether the record signals have been received from all speaker devices 200 connected to the bus 300, except the speaker device 200 having the ID number NA having emitted the test signal. If it is determined that the reception of the record signals from all speaker devices 200 is not complete, the CPU 110 returns to step S395.

If it is determined in step S400 that the record signals have been received from all speaker devices 200 connected to the bus 300, except the speaker device 200 having the ID number NA having emitted the test signal, the CPU 110 returns to step S391 to broadcast the test signal emission command signal to the speaker devices 200 via the bus 300 again.

If it is determined in step S392 that the predetermined period of time has elapsed without receiving a trigger signal from any speaker device 200, the CPU 110 determines that all speaker devices 200 have emitted the test signals, and that the measurement of the speaker-to-speaker distance and the measurement of the sound incident direction of the test signal to each speaker device 200 are complete. The CPU 110 calculates the layout configuration of the plurality of speaker devices 200 connected to the bus 300 and stores the information of the calculated layout configuration into the speaker layout information memory 118 in step S401.

The server apparatus 100 determines the layout configuration of the speaker devices 200 based on the speaker-to-speaker distance Djk determined in this process routine and the sound incident direction θjk of the test signal to each speaker device 200 but also the distance difference ΔDi relating to the distance of the listener 500 with respect to each of the speaker devices 200 and the incident direction of the sound to each speaker device 200 from the listener 500.

Since the speaker-to-speaker distance Djk and the sound incident direction θjk are determined in accordance with the fourth embodiment, the layout configuration of the speaker devices 200 is determined more accurately than in the first embodiment. A listener's location, satisfying the distance difference ΔDi of each speaker device 200 relative to the listener 500 and the sound incident direction of the sound from the listener 500 to each speaker device 200, is determined more accurately than in the first embodiment.

FIG. 56 illustrates a table listing the listener-to-speaker distances and the speaker-to-speaker distances. The speaker layout information memory 118 stores at least the table information of FIG. 56.

In accordance with the fourth embodiment, the speaker device 200 transmits the audio signals captured by the microphones 202*a* and 202*b* to the server apparatus 100. Alternatively, the speaker device 200 may calculate the sum output Sadd and the difference output Sdiff and send the calculated sum output Sadd and difference output Sdiff to the server apparatus 100. The audio signal captured by the microphones 202*a* and 202*b* may be transmitted to the server apparatus 100 for transfer characteristic calculation. If the transfer characteristic is calculated from the sum output Sadd, there is no need for transmitting the audio signal captured by the microphones 202*a* and 202*b* to the server apparatus 100.

As in the first embodiment, the forward direction of the listener 500 must be determined as the reference direction in the fourth embodiment, and one of the previously discussed techniques may be employed. Since the sound incident direction from the sound source is calculated from the audio signal captured by the microphones 202*a* and 202*b* in each speaker device 200 in accordance with the fourth embodiment, the accuracy level in the reference direction determination is heightened by applying the third technique for reference determination to the sound incident direction.

As previously discussed, the third technique for determining the reference direction eliminates the need for the operation of the remote-control transmitter 102 by the listener 500. The third technique for determining the reference direction in accordance with the fourth embodiment uses a signal that is recorded in response to the sound produced by the listener 500 and captured by the microphones 202*a* and 202*b*, in the listener-to-speaker distance measurement process discussed with reference to the flowchart of FIG. 51. The record signal of the audio signal from the two microphones 202*a* and 202*b* in the speaker device 200 is stored in the RAM 112 in the server apparatus 100 in step S355 of FIG. 51. The audio information stored in the RAM 112 is thus used to detect the forward direction of the listener 500.

As previously discussed, the third technique takes advantage of the property that the directivity pattern of the human voice is bilaterally symmetrical, and that the midrange component of the voice is maximized in the forward direction of the listener 500 while being minimized in the backward direction of the listener 500.

Figure 57:
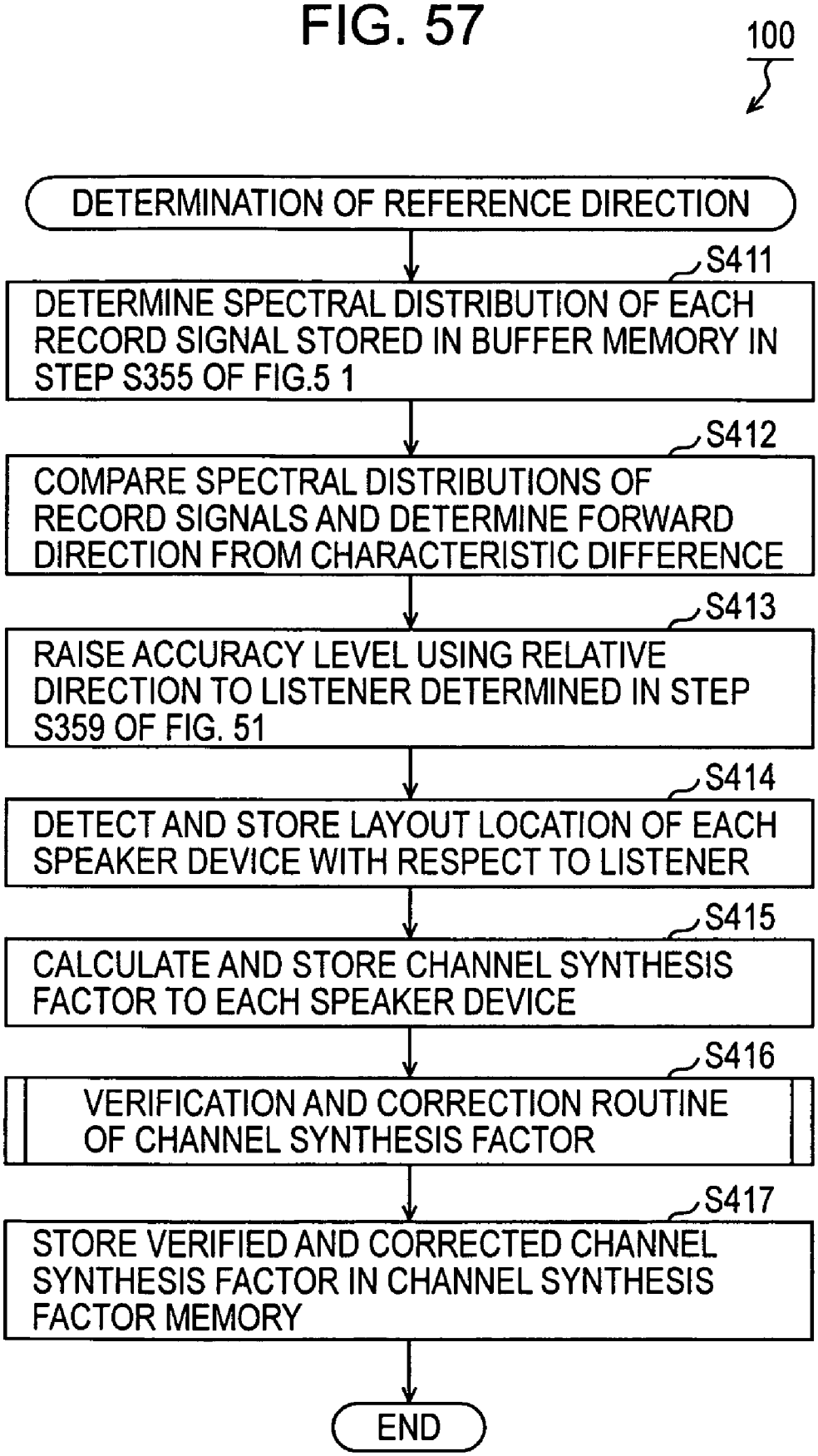
FIG. 57 is a flowchart illustrating the operation of the server apparatus that determines the forward direction of the listener as the reference direction.

FIG. 57 is a flowchart of the process routine of the third technique performed by the server apparatus 100 for determining the reference direction in accordance with the fourth embodiment and a subsequent process routine.

In accordance with the third technique, the CPU 110 in the server apparatus 100 determines in step S411 a spectral distribution of the record signal of the sound of the listener 500 captured by the two microphones 202*a* and 202*b* in each speaker device 200, and stored in the RAM 112. Taking into consideration attenuation of the acoustic wave through propagation, spectral intensity is corrected in accordance with the distance between the listener 500 and each of the microphones 202*a* and 202*b* in the speaker device 200.

The CPU 110 compares the spectral distributions of the speaker devices 200 and estimates the forward direction of the listener 500 from a difference in the characteristics in step S412. In step S413, the CPU 110 heightens the accuracy level of the estimated forward direction using the incident direction of the sound produced by the listener 500 to each speaker device 200 determined in step S359 of FIG. 15 (a relative direction of each speaker device 200 with reference to the listener 500).

The layout configuration of the plurality of speaker devices 200 with respect to the listener 500 is detected with the estimated forward direction set at the reference direction. The layout configuration information is stored together with the information of the estimated forward direction in step S414.

When the reference direction is determined, the CPU 110 determines a channel synthesis factor for each of the speaker devices 200 so that the predetermined location with respect to the forward direction of the listener 500 coincides with the sound image localized by the plurality of speaker devices 200 arranged at any arbitrary locations in accordance with the 5.1-channel surround signals of the L channel, the R channel, the C channel, the LS channel, the RS channel, and the LFE channel. The calculated channel synthesis factor of each speaker device 200 is stored in the channel synthesis factor memory 119 with the ID number of the speaker device 200 associated therewith in step S415.

The CPU 110 initiates the channel synthesis factor verification and correction processor 122, thereby performing a channel synthesis factor verification and correction process in step S416. The channel synthesis factor of the speaker device 200 corrected in the channel synthesis factor verification and correction process is stored in the channel synthesis factor memory 119 for updating in step S417.

The fourth embodiment provides the layout configuration of the plurality of speaker devices 200 in an accuracy level higher than the first embodiment, thereby resulting in an appropriate channel synthesis factor.

The remaining structure and functions of the first embodiment are equally applicable to the fourth embodiment.

Fifth Embodiment

In accordance with a fifth embodiment, the two microphones 202*a* and 202*b* are used in each speaker device 200 in the structure of the second embodiment as in the fourth embodiment. The incident direction of sound to each speaker device 200 is obtained based on the sum output Sadd and the difference output Sdiff of the two microphones 202*a* and 202*b*.

In accordance with the fifth embodiment, the audio signals of the two microphones 202*a* and 202*b* are supplied to the system controller 600 rather than to the server apparatus 100. The system controller 600 calculates the layout configuration of the plurality of speaker devices 200 using the sound incident direction. The rest of the fifth embodiment remains unchanged from the second embodiment.

In the fifth embodiment, instead of transmitting the audio signals captured by the microphones 202*a* and 202*b* to the system controller 600, the speaker device 200 may calculate the sum output Sadd and the difference output Sdiff and send the calculated sum output Sadd and difference output Sdiff to the system controller 600. The audio signal captured by the microphones 202*a* and 202*b* may be transmitted to the system controller 600 for transfer characteristic calculation. If the transfer characteristic is calculated from the sum output Sadd, there is no need for transmitting the audio signal captured by the microphones 202*a* and 202*b* to the system controller 600.

Sixth Embodiment

In accordance with a sixth embodiment of the present invention, the two microphones 202*a* and 202*b* are used in each speaker device 200 in the structure of the third embodiment as in the fourth embodiment. Each speaker device 200 detects the incident direction of the sound. Using the sound incident direction information, the sixth embodiment provides the layout configuration of the plurality of speaker devices 200 at an accuracy level higher than in the third embodiment.

In accordance with the sixth embodiment, the sound produced by the listener 500 is captured by the two microphones 202*a* and 202*b*, and the distance difference with respect to the distance between the closest speaker device 200 and the listener 500 is calculated. The incident direction of the sound produced by the listener 500 to each speaker device 200 is calculated, and the information of the calculated distance difference and the information of the sound incident direction are then transmitted to the other speaker devices 200.

The sound emitted from another speaker device 200 is captured by the microphones 202*a* and 202*b* in own speaker device 200 to determine the speaker-to-speaker distance. The incident direction of the sound emitted from the other speaker device 200 to own speaker device 200 is calculated. The information of the speaker-to-speaker distance and the information of the incident direction of the sound are transmitted to the other speaker devices 200.

The process of calculating the layout configuration of the speaker devices 200 in the sixth embodiment is substantially identical to that in the fourth embodiment except that the process of calculating the layout configuration is performed by each speaker device 200 in the sixth embodiment. The rest of the detailed structure of the sixth embodiment is identical to the second embodiment.

In accordance with the sixth embodiment, each speaker device 200 generates the sum output Sadd and the difference output Sdiff, calculates the sound incident direction, and transmits the information of the sound incident direction to the other speaker devices 200. Alternatively, each speaker device 200 may transmit the audio signals captured by the microphones 202*a* and 202*b* to the other speaker devices 200, and each of the other speaker devices 200 that receives the audio signals may generate the sum output Sadd and the difference output Sdiff to calculate the sound incident direction.

Seventh Embodiment

In each of the above-referenced embodiments, the layout configuration is calculated on the assumption that the plurality of speaker devices 200 are arranged on a horizontal plane. In practice, however, the rear left and rear right speakers may be sometimes placed at an elevated position. In such a case, the layout configuration of the speaker devices 200 calculated in the way described above suffers from accuracy degradation.

A seventh embodiment of the present invention is intended to improve accuracy of the calculated layout configuration. In accordance with the seventh embodiment, a separate microphone is arranged at a height level different from the level of the microphone 202 or the microphones 202*a* and 202*b* arranged in the speaker device 200.

FIG. 58 illustrates the layout of the speaker devices in an audio system in accordance with the seventh embodiment. As shown, the audio system includes five speakers with respect to the listener 500: a front left speaker device 200LF, a front right speaker device 200RF, a front center 200C, a rear left speaker device 200LB, and a rear right speaker device 200RB.

As in the first through third embodiments, each of the five speaker devices 200LF-200RB includes a speaker unit 201 and a single microphone 202.

In accordance with the seventh embodiment, a server apparatus 700, like the server apparatus 100, is mounted on the center front speaker device 200C. The server apparatus 700 is provided with a microphone 701 at a predetermined location. The server apparatus 700 having the microphone 701 is thus mounted on the speaker device 200C placed in front of the listener 500. The microphone 701 is placed at a height level vertically shifted from the height level of the microphones 202 of the speaker devices 200LF-200RB.

Figure 59:
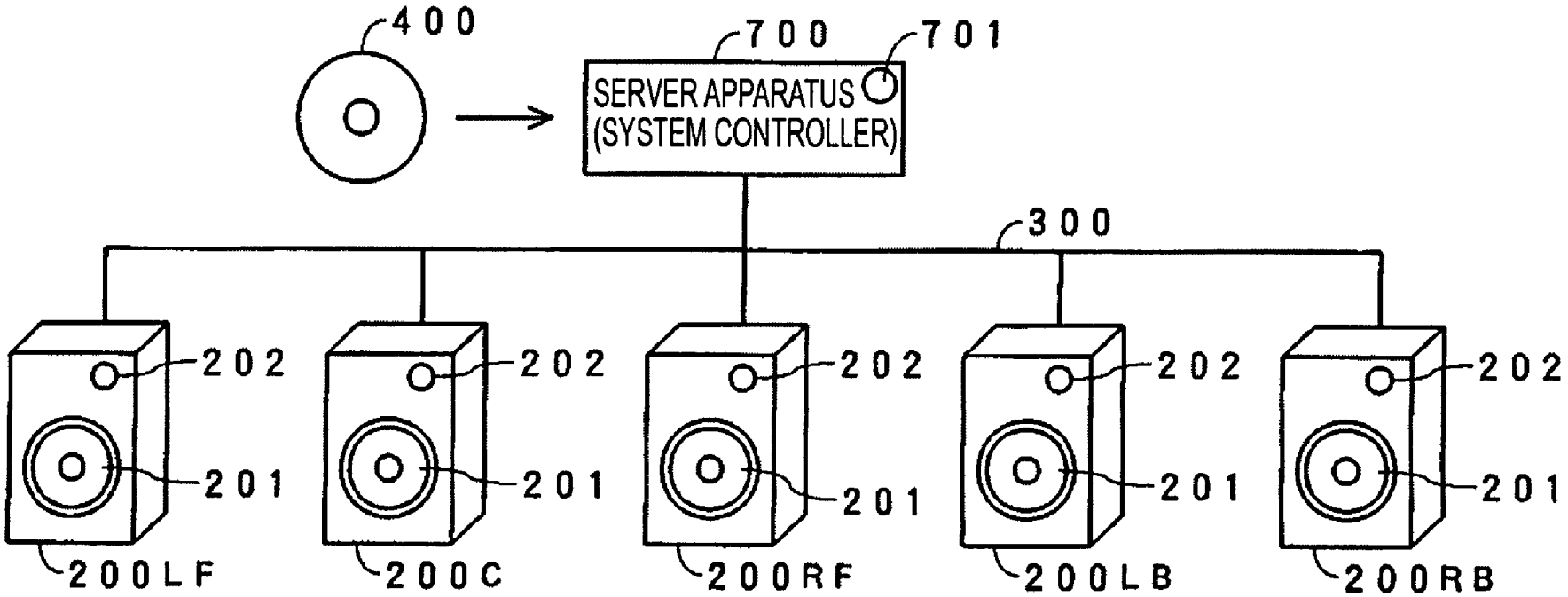
FIG. 59 illustrates the audio system in accordance with the seventh embodiment of the present invention.
Figure 60A:
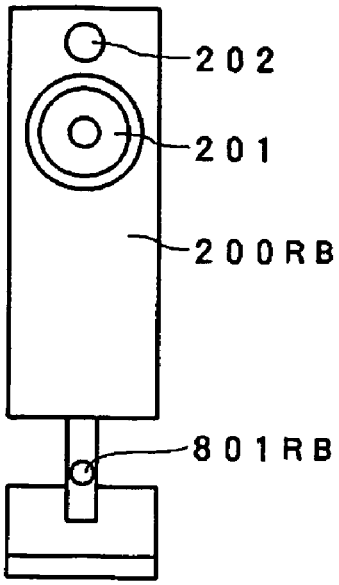
Figure 60B:
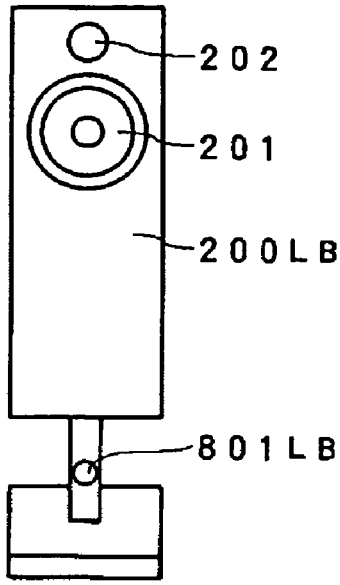
Figure 60C:
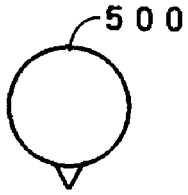
Figure 60D:
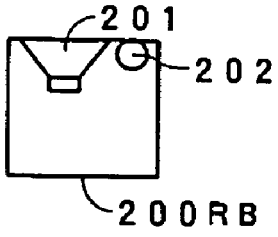
Figure 60E:
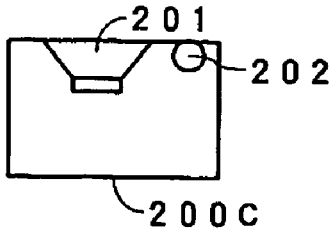
Figure 60F:
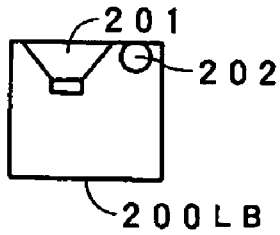
Figure 61:
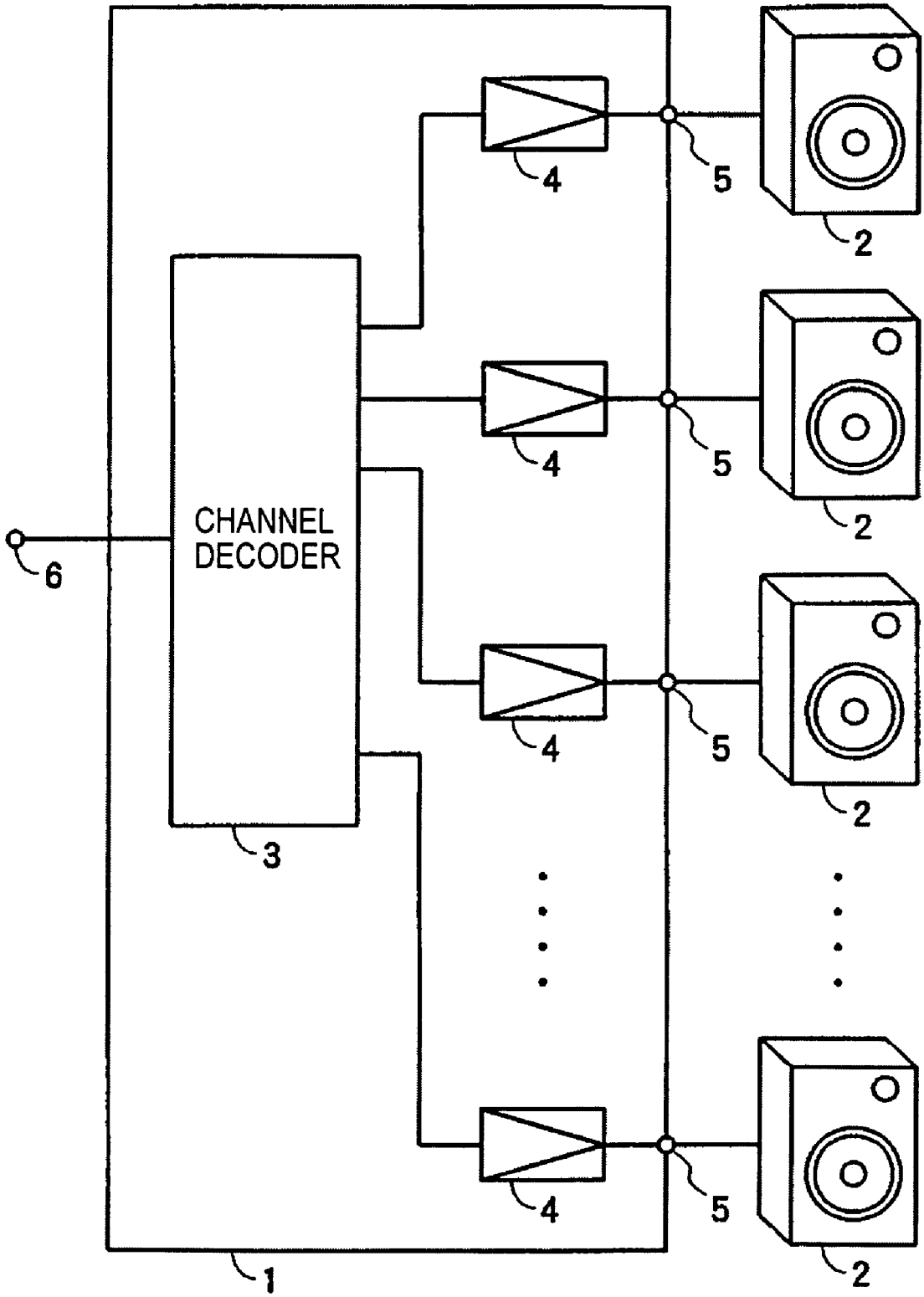
FIG. 61 illustrates a system configuration of a known audio system.
Figure 62:
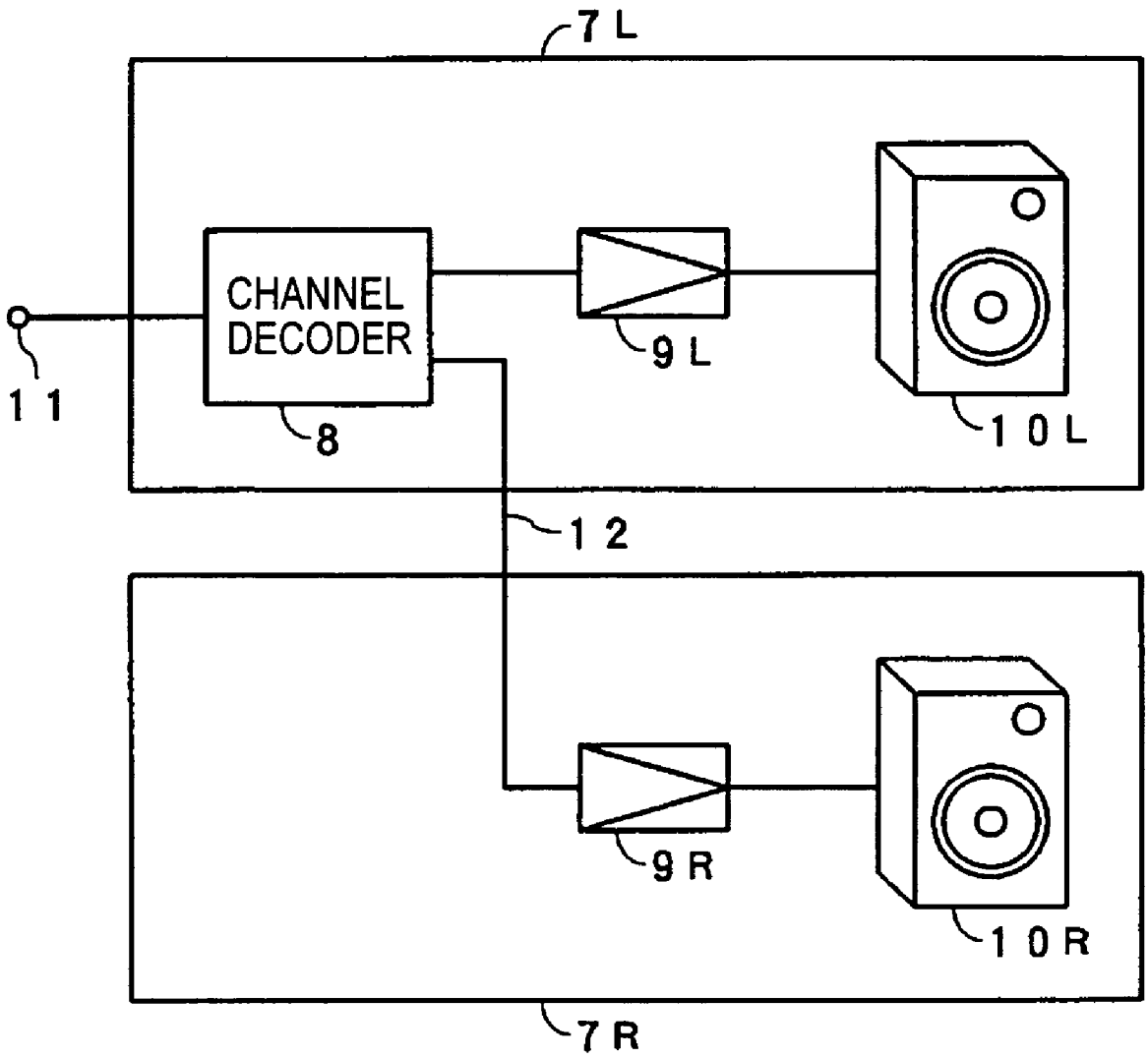
FIG. 62 illustrates a system configuration of another known audio system.

FIG. 59 illustrates the connection of the audio system of the seventh embodiment, identical to the connection of the audio system of the first embodiment. In other words, the server apparatus 700 and the five speaker devices 200LF-200RB are mutually connected via the system bus 300.

In accordance with the seventh embodiment, the microphone 701 captures the sound from the listener 500 and the sounds emitted from the speaker devices 200LF-200RB. The audio signals of the sounds are used to calculate the listener-to-speaker distance difference of each speaker with respect to the distance of each speaker devices 200 between the closest speaker and the listener 500 and the speaker-to-speaker distance with respect to each speaker as described in connection with the first embodiment. The listener-to-speaker distance and the speaker-to-speaker distance are thus three-dimensionally calculated with enhanced accuracy.

More specifically, each of the microphones 200LF-200RB starts recording the sound produced by the listener 500 and captured by the microphone 202 at the trigger signal as a start point, and supplies the record signal to the server apparatus 700. The server apparatus 700 also starts recording the sound, produced by the listener 500 and captured by the microphone 701, in response to the trigger signal as a start point.

When each of the microphones 200LF-200RB calculates the distance difference of each speaker with respect to the distance between the closest speaker device and the listener 500, not only the record signal from each microphone 202 but also the record signal from the microphone 701 is used.

In accordance with the seventh embodiment, the calculated distance difference of each of the microphones 200LF-200RB is assessed based on the distance difference between the distance of the closest speaker to the listener 500 and the distance of the microphone 701 to the listener 500. A three-dimensional element is thus accounted for in the calculation result.

When the speaker-to-speaker distance is calculated, the distance between the speaker having emitted the sound and the microphone 701 is accounted for. In this way, the layout configuration of the microphones 200LF-200RB is calculated even if the microphones 200LF-200RB are arranged three-dimensionally rather than two-dimensionally.

In accordance with the first embodiment, the same information is obtained from two speakers concerning speaker-to-speaker distance. In accordance with the seventh embodiment, the speaker-to-speaker distance is obtained and further the distance between the speaker emitting the sound during the measurement of the speaker-to-speaker distance and the microphone 701 is also calculated. Since the position of the microphone 701 is known, the layout configuration of the two speakers is estimated with respect to the known position. A three-dimensional layout configuration is thus estimated using the speaker-to-speaker distance of the other speakers and the distance between the speaker currently emitting the sound and the microphone 701.

For example, when the distance between the speaker currently emitting the sound and the microphone 701 is used with three speakers arranged on the same plane, the calculated speaker-to-speaker distance can be inconsistent with the distance between the speaker device and the microphone 701. The inconsistency is overcome by placing the speaker devices in a three-dimensional layout. In other words, the three-dimensional layout configuration of the plurality of speaker devices is calculated using the speaker-to-speaker distance and the distance between the speaker device and the microphone 701.

The use of a single microphone at the predetermined location, separate from the microphone 202 in each speaker device 200, provides a relative geometry relative to that microphone. To detect a more accurate three-dimensional layout, two microphones may be arranged at predetermined separate locations, separate from the microphones 202 of the speaker devices, and the audio signal of the sounds captured by the two microphones may be used.

FIG. 60 illustrates such an example. The rear left speaker device 200LB and the rear right speaker device 200RB are of a tall type with feet. The rear left speaker device 200LB and the rear right speaker device 200RB include the respective microphones 202 near vertically top portions thereof and respective separate microphones 801LB and 801RB at predetermined locations on bottom portions thereof. As shown in FIG. 60, the microphones 801LB and 801RB are mounted on the feet of the speaker devices 200LB and 200RB, respectively.

Alternatively, the microphones 801LB and 801RB and the microphones 202 may be interchanged with each other in mounting locations thereof.

The audio signal of the sound produced by the listener 500, and the audio signal of the sound emitted from the speaker devices to measure the speaker-to-speaker distance are captured by the microphones 801LB and 801RB. The audio signal captured by the microphones 801LB and 801RB is transmitted to the server apparatus 100 of FIG. 4 together with information identifying that the audio signal is the one captured by the microphones 801LB and 801RB.

The server apparatus 100 calculates a three-dimensional layout configuration of the plurality of speaker devices, based on the information of the distance between each of the two microphones 801LB and 801RB and the sound source.

The seventh embodiment has been discussed with reference to the first embodiment. The seventh embodiment is also applicable to the structure of the second and third embodiments.

As shown in FIG. 59, the microphone 701 is mounted on the server apparatus 700 as a single separate microphone. Alternatively, the microphone 701 may be mounted on a single particular speaker device in a predetermined location rather than on the server apparatus. If an amplifier is placed at a predetermined location, the microphone 701 may be mounted on that amplifier.

In the system of FIGS. 60A-60F, microphones may be mounted in predetermined locations instead of the locations of the microphones 801LB and 801RB.

Alternate Embodiments

In the above-referenced embodiments, the ID number is used as an identifier of each speaker device. The identifier is not limited to the ID number. Any type of identifier may be used as long as the speaker device 200 can identify. The identifier may be composed of alphabets, or a combination of alphabets and numbers.

In the above-referenced embodiments, the speaker devices are connected to each other via the bus 300 in the audio system. Alternatively, the server apparatus may be connected to each of the speaker devices via speaker cables. The present invention is applicable to an audio system in which control signals and audio data are exchanged in a wireless fashion between a server apparatus and speaker devices, each equipped with a radio communication unit thereof.

In the above-referenced embodiments, the channel synthesis factor is corrected to generate the speaker signal to be supplied to each speaker device. The audio signal captured by a microphone is subjected to frequency analysis. Each channel is thus tone controlled using the frequency analysis result.

In the above-referenced embodiments, the pickup unit of the sound is a microphone. Alternatively, the speaker 201 of the speaker device 200 may be used as a microphone unit.

What is claimed is:

1. A method for detecting a speaker layout configuration in an audio system including a plurality of speaker devices and a server apparatus that generates, from an input audio signal, a speaker signal to be supplied to each of the plurality of speaker devices in accordance with locations of the plurality of speaker devices, the method comprising:

a first step for capturing a sound emitted at a location of a listener with a pickup unit mounted in each of the plurality of speaker devices and for transmitting an audio signal of the captured sound from each of the speaker devices to the server apparatus;

a second step for analyzing the audio signal transmitted from each of the plurality of speaker devices in the first step and for calculating a distance difference between a distance of the location of the listener to a speaker device closest to the listener and the distance of the location of the listener to each of the plurality of speaker devices;

a third step for emitting a predetermined sound from one of the speaker devices in response to a command signal from the server apparatus and calculating angles between the speakers;

a fourth step for capturing the predetermined sound, emitted in the third step, with the pickup units of the speaker devices other than the speaker device that has emitted the predetermined sound and transmitting an audio signal of the captured sound to the server apparatus;

a fifth step for analyzing the audio signal transmitted in the fourth step from the speaker devices other than the speaker device that has emitted the predetermined sound and for calculating a speaker-to-speaker distance between each of the speaker devices that have transmitted the audio signal in the fourth step and the speaker device that has emitted the predetermined sound;

a sixth step for repeating the third step through the fifth step until all speaker-to-speaker distances and angles between the speakers of the plurality of speaker devices are obtained; and a seventh step for calculating a layout configuration of the plurality of speaker devices based on a distance difference of each of the plurality of speaker devices obtained in the second step, the angles between the speakers and speaker-to-speaker distances of the plurality of speaker devices obtained in the fifth step.

2. The method according to claim 1, wherein the first step comprises supplying a trigger signal, from a speaker device that has first detected the sound produced at the location of the listener, to the server apparatus and the other speaker devices, and wherein the second step comprises calculating the distance difference of each of the speaker devices relative to the location of the listener using the trigger signal as a reference.

3. The method according to claim 1, wherein the third step comprises supplying a trigger signal, from the speaker device that has emitted the predetermined sound in response to the command signal from the server apparatus, to the server apparatus and the other speaker devices;

wherein the fourth step comprises transmitting, to the server apparatus, the audio signal captured in response to the trigger signal by the speaker device that has received the trigger signal; and wherein the fifth step comprises calculating the speaker-to-speaker distances with the speaker device having transmitted the trigger signal being regarded as the speaker device having emitted the predetermined sound.

4. The method according to claim 1, further comprising a step for detecting a forward direction of the listener by causing one of the speaker devices to emit a predetermined sound and by receiving information of a deviation between a direction in which the sound is heard at the location of the listener and the forward direction of the listener.

5. The method according to claim 1, further comprising a step for detecting a forward direction of the listener based on a combination of two mutually adjacent speaker devices and a synthesis ratio of a direction adjusting signal input by the listener, wherein the server apparatus causes each of the two mutually adjacent speaker devices to emit the predetermined sound in response to the synthesis ratio.

6. The method according to claim 1, further comprising a step for detecting a forward direction of the listener by analyzing audio signals transmitted from the plurality of speaker devices in the first step wherein the sound produced at the location of the listener is a voice of the listener in the first step.

7. The method according to claim 1, wherein the server apparatus and the plurality of speaker devices are connected via a common transmission line;

wherein the server apparatus supplies the plurality of speaker devices with the command signal via the common transmission line; and wherein each of the speaker devices transmits audio signals to the server apparatus via the common transmission line.

8. The method according to claim 7, wherein the server apparatus supplies an enquiry signal to the plurality of speaker devices, and notifies any speaker device of an identifier of the speaker device that has transmitted a reply signal in response to the enquiry signal, thereby assigning the identifier to each of the plurality of speaker devices and recognizing a number of the speaker devices.

9. The method according to claim 8, wherein one of the speaker devices that have received the enquiry signal from the server apparatus transmits the reply signal to the server apparatus and the other speaker devices via the common transmission line; and wherein the other speaker devices that have received the reply signal are inhibited from transmitting the reply signal to the server apparatus.

10. The method according to claim 8, wherein one of the speaker devices that have received the enquiry signal from the server apparatus emits a predetermined sound, and transmits the reply signal to the sewer apparatus via the common transmission line; and wherein the other speaker devices that have received the predetermined sound from the speaker device are inhibited from transmitting the reply signal to the server apparatus.

11. The method according to claim 1, wherein the audio signal corresponding to the predetermined sound to be emitted by the speaker device is generated using a signal that can also be generated by each of the plurality of speaker devices.

12. The method according to claim 1, wherein each of the plurality of speaker devices comprises two pickup units, and transmits, to the server apparatus, an audio signal of sound captured by the two pickup units in the first step and the fourth step;

wherein the second step comprises calculating the distance difference of each of the speaker devices relative to the location of the listener and calculating an incident direction of the sound produced at the location of the listener to each of the speaker devices based on the sound captured by the two pickup units;

wherein the fifth step comprises calculating the speaker-to-speaker distances and calculating an incident direction of sound input to each of the speaker device from the speaker device that has emitted the predetermined sound; and wherein the seventh step comprises calculating the layout configuration of the plurality of speaker devices based on the incident direction of the sound, produced at the location of the listener, calculated in the second step and the incident direction of the predetermined sound emitted from the speaker device calculated in the fifth step.

13. The method according to claim 12, wherein each of the two pickup units of each of the speaker devices is omnidirectional; and wherein each of the speaker devices transmits, to the server apparatus, a sum signal and a difference signal of the audio signals captured by the two pickup units for use in the calculation of the incident direction of the predetermined sound to each of the speaker devices.

14. The method according to claim 12, wherein each of the two pickup units of each of the speaker device is omnidirectional; and wherein the server apparatus generates a sum signal and a difference signal of the audio signals from the two pickup units and calculates the incident direction of the sound to each of the speaker devices from the sum signal and the difference signal.

15. The method according to claim 1, further comprising:

a step for transmitting, to the server apparatus, an audio signal of a sound produced at the location of the listener captured by at least one separate pickup unit arranged at a predetermined location, separate from the plurality of pickup units provided in each of the plurality of speaker devices; and a step for transmitting, to the server apparatus, the audio signal of the predetermined sound emitted from the speaker device and captured by the separate pickup unit each time the third step is repeated, and wherein the seventh step comprises calculating the layout configuration of the plurality of speaker devices based on the audio signal of the sound produced at the location of the listener and captured by the separate pickup unit and the audio signal of the sound emitted from each of the plurality of speaker devices.

16. The method according to claim 15, wherein the at least one separate pickup unit is arranged with at least one of the speaker devices.

17. The method according to claim 15, wherein the at least one separate pickup unit is arranged separate from the speaker devices.

18. A method for detecting a speaker layout configuration in an audio system including a plurality of speaker devices and a system controller connected to the plurality of speaker devices, an input audio signal being supplied to each of the plurality of speaker devices via a common transmission line, and each of the plurality of speaker devices generating a speaker signal to emit a sound therefrom in response to the input audio signal, the method comprising:

a first step for capturing a sound produced at a location of a listener with a pickup unit mounted in each of the plurality of speaker devices and for transmitting an audio signal of the captured sound from each of the speaker devices to the system controller;

a second step for analyzing the audio signal transmitted in the first step from each of the plurality of speaker devices to the system controller and for calculating a distance difference between a distance of the location of the listener to the speaker device closest to the listener and a distance of the location of the listener to each of the plurality of speaker devices;

a third step for emitting a predetermined sound from one of the speaker devices in response to a command signal from the system controller;

a fourth step for capturing the predetermined sound, emitted in the third step, with the pickup units of the speaker devices other than the speaker device that has emitted the predetermined sound and for transmitting an audio signal of the sounds to the system controller;

a fifth step for analyzing the audio signal transmitted in the fourth step from the speaker devices other than the speaker device that has emitted the predetermined sound and for calculating a speaker-to-speaker distance between each of the speaker devices that have transmitted the audio signal and the speaker device that has emitted the predetermined sound;

a sixth step for repeating the third step through the fifth step until all speaker-to-speaker distances and angles between the speakers of the plurality of speaker devices are obtained; and a seventh step for calculating a layout configuration of the plurality of speaker devices based on a distance difference of each of the plurality of speaker devices obtained in the second step, and speaker-to-speaker distances and angles between the speakers of the plurality of speaker devices obtained in the fifth step.

19. The method according to claim 18, wherein each of the plurality of speaker devices comprises two pickup units, and transmits, to the system controller, the audio signals of the sounds captured by the two pickup units in the first step and the fourth step;

wherein the second step comprises calculating the distance difference of each of the speaker devices to the location of the listener and an incident direction of the sound produced at the location of the listener to the speaker device based on the audio signal of the sound captured by the two pickup units;

wherein the fifth step comprises calculating the speaker-to-speaker distances and calculating an incident direction of the sound input to each of the speaker device from the speaker device that has emitted the predetermined sound; and wherein the seventh step comprises calculating the layout configuration of the plurality of speaker devices based on the incident direction of the sound, produced at the location of the listener, calculated in the second step and the incident direction of the predetermined sound emitted from the speaker device calculated in the fifth step.

20. The method according to claim 19, wherein each of the two pickup units of each of the speaker devices is omnidirectional; and wherein each of the speaker devices transmits, to the system controller, a sum signal and a difference signal of the audio signals captured by the two pickup units for use in the calculation of the incident direction of the predetermined sound to each of the speaker devices.

21. The method according to claim 19, wherein each of the two pickup units of each of the speaker device is omnidirectional; and wherein the system controller generates a sum signal and a difference signal of the audio signals captured by the two pickup units and calculates the incident direction of the sound to each of the speaker devices from the sum signal and the difference signal.

22. The method according to claim 18, further comprising:

a step for transmitting, to the system controller, an audio signal of a sound produced at the location of the listener captured by at least one separate pickup unit arranged at a predetermined location, separate from the plurality of pickup units provided in each of the plurality of speaker devices;

a step for transmitting, to the system controller, the audio signal of the predetermined sound emitted from the speaker device and captured by the separate pickup unit each time the third step is repeated, and wherein the seventh step comprises calculating the layout configuration of the plurality of speaker devices based on the audio signal of the sound produced at the location of the listener and captured by the separate pickup unit and the audio signal of the predetermined sound emitted from each of the plurality of speaker devices.

23. The method according to claim 22, wherein the at least one separate pickup unit is arranged with at least one of the speaker devices.

24. The method according to claim 22, wherein the at least one separate pickup unit is arranged in the system controller.

25. A method for detecting a speaker layout configuration in an audio system including a plurality of speaker devices, an input audio signal being supplied to each of the plurality of speaker devices via a common transmission line, and each of the plurality of speaker devices generating a speaker signal to emit a sound therefrom in response to the input audio signal, the method comprising:

a first step for supplying a first trigger signal from one of the speaker devices that has first detected a sound produced at a location of a listener to the other speaker devices via the common transmission line;

a second step for recording, in response to the first trigger signal as a start point, the sound produced at the location of the listener and captured by a pickup unit of each of the plurality of speaker devices that have received the first trigger signal;

a third step for analyzing an audio signal of the sound recorded in the second step, and calculating a distance difference between a distance of the location of the listener to the speaker device that has supplied the first trigger signal and is closest to the listener location and a distance between each of the speaker devices and the location of the listener;

a fourth step for transmitting information of the distance difference calculated in the third step from each of the speaker devices to the other speaker devices via the common transmission line;

a fifth step for transmitting a second trigger signal from one of the plurality of speaker devices to the other speaker devices via the common transmission line and for emitting a predetermined sound from the one of the plurality of speaker devices;

a sixth step for recording, in response to a time of reception of the second trigger signal as a start point the predetermined sound, emitted in the fifth step and captured by the pickup unit, with each of speaker devices other than the speaker device that has emitted the predetermined sound;

a seventh step for analyzing an audio signal captured in the sixth step with each of the speaker devices other than the speaker device that has emitted the predetermined sound, and calculating a speaker-to-speaker distance between the speaker device that has emitted the predetermined sound and each of the speaker devices that have transmitted an audio signal of the predetermined sound;

an eighth step for repeating the fifth step through the seventh step until all speaker-to-speaker distances and angles between the sneakers of the plurality of speaker devices are obtained; and a ninth step for calculating a layout configuration of the plurality of speaker devices based on distance differences of the plurality of speaker devices obtained in the third step and speaker-to-speaker distances of the plurality of speaker devices obtained in the repeatedly performed seventh steps.

26. The method according to claim 25, further comprising a step for emitting a predetermined sound from two adjacent speaker devices of the plurality of speaker devices so that a sound image is localized in an area between the two adjacent speaker devices, detecting a voice produced by the listener with one of the plurality of speaker devices and notifying all other speaker devices of an audio signal of the voice, adjusting the sound produced by the adjacent two speaker devices in response to the voice emitted by the listener, and detecting a forward direction of the listener from an adjustment state.

27. The method according to claim 25, further comprising:

a step for capturing a voice produced by the listener with the pickup unit of each of the plurality of speaker devices, analyzing an audio signal of the voice, and transmitting an analysis result to the other speaker devices via the common transmission line; and a step for detecting a forward direction of the listener with each of the plurality of speaker devices based on the analysis result received from the other speaker devices.

28. The method according to claim 25, further comprising a step for assigning an identifier to each of the plurality of speaker devices based on sounds emitted from the plurality of speaker devices, audio signals of the sounds captured by the pickup units of the speaker devices, and signals exchanged between the plurality of speaker devices via the common transmission line.

29. The method according to claim 28, wherein the identifier assigning step comprises:

assigning a first identifier to one speaker device, and storing the first identifier in a speaker list if the one speaker device is determined to emit first a predetermined sound for identifier assignment;

transmitting a sound emission start signal accompanied by the first identifier from the speaker device having the first identifier assigned thereto to all other speaker devices via the common transmission line and emitting the predetermined sound from the speaker device having the first identifier assigned thereto;

receiving the sound emission start signal via the common transmission line, and storing, in the speaker list, the first identifier that is detected by the pickup unit of the speaker device that has captured the predetermined sound; and determining availability of the common transmission line with each of the speaker devices that have detected and stored the first identifier in the speaker list, setting an identifier, found to be unduplicated in the speaker list, as one for the speaker device with reference to the speaker list if the speaker device determines that the common transmission line is available for use, and transmitting the identifier to the other speaker devices via the common transmission line, and receiving the identifiers transmitted from the other speaker devices to store the identifiers in the speaker list if the speaker device determines that the common transmission line is not available for use.

30. The method according to claim 28, wherein the identifier assigning step comprises:

a first determination step, of each of the plurality of speaker devices, for determining whether each of plurality of speaker devices has received a sound emission start signal of the predetermined sound from any of the other speaker devices;

a second determination step, of a first speaker device that has determined in the first determination step that no sound emission start signal of the predetermined sound has been received from the other speaker devices, for determining whether an identifier of the first speaker device is stored in a speaker list;

a step for setting an identifier, found to be unduplicated in the speaker list, as an identifier for the first speaker device and for storing the identifier in the speaker list if the first speaker device determines in the second determination step that the identifier of the first speaker device is not stored in the speaker list;

a step, of the first speaker device that has stored the identifier of the first speaker device on the speaker list, for transmitting the sound emission start signal of the predetermined sound to all other speaker devices via the common transmission line and for emitting the predetermined sound; and a step, of a second speaker device that has determined in the first determination step that the sound emission start signal of the predetermined sound has been received from the other speaker devices or the second speaker device that has determined in the second determination step that the identifier of the second speaker device is stored in the speaker list, for receiving a signal from the other speaker devices and storing an identifier contained in the received signal onto the speaker list.

31. The method according to claim 25, wherein each of the plurality of speaker devices comprises two pickup units;

wherein the third step comprises calculating an incident direction of the sound produced at the location of the listener to own speaker device based on the distance difference of the speaker device relative to the location of the listener determined in the third step, and an audio signal of sound captured by the two pickup units;

wherein the fourth step comprises transmitting information of the distance difference and the sound incident direction calculated in the third step to the other speaker devices via the common transmission line;

wherein the seventh step comprises calculating speaker-to-speaker device distances and an incident direction of the sound input to the speaker device that has transmitted the audio signal; and wherein the ninth step comprises calculating the layout configuration of the plurality of speaker devices based on the distance differences, the speaker-to-speaker distances, and the sound incident direction to each of the speaker devices.

32. The method according to claim 25, further comprising:

a step for transmitting, to the plurality of speaker devices, an audio signal of the sound produced at the location of the listener and captured by at least one separate pickup unit in response to the first trigger signal as a start point, arranged at a predetermined location, separate from the plurality of pickup units provided in each of the plurality of speaker devices;

a step for transmitting, to the speaker devices other than the speaker device that has emitted the predetermined sound, an audio signal of the sound emitted from the speaker device and captured by the separate pickup unit in response to the second trigger signal as a start point each time the fifth step is repeated; and wherein the ninth step comprises calculating the layout configuration of the plurality of speaker devices based on the audio signal of the sound captured by the separate pickup unit.

33. An audio system comprising a plurality of speaker devices and a server apparatus that generates, from an input audio signal, a speaker signal to be supplied to each of the plurality of speaker devices in accordance with locations of the plurality of speaker devices, wherein each of the plurality of speaker devices comprises:

a pickup unit for capturing a sound, means for transmitting a first trigger signal from one of the plurality of speaker devices to each of the other speaker devices and the server apparatus when a pickup unit of the one of the plurality of speaker devices detects a sound equal to or higher than a predetermined level without receiving the first trigger signal from the other speaker devices means for transmitting a second trigger signal to each of the other speaker devices and the server apparatus and for emitting a predetermined sound when a predetermined period of time has elapsed without receiving the second trigger signal from any of the other speaker devices subsequent to the reception of a command signal from the server apparatus, and means for recording an audio signal of the sound, captured by the pickup unit, in response to a time of reception of one of the first trigger signal and the second trigger signal as a start point and transmitting the audio signal to the server apparatus when the one of the first trigger signal and the second trigger signal from the other speaker devices is received; and wherein the server apparatus comprises:

distance difference calculating means for analyzing the audio signal when the audio signal is received from each of the speaker devices without transmitting the command signal, and for calculating a distance difference between a distance of a source of the sound captured by the pickup unit to the speaker device that has generated the first trigger signal and the distance of each of the speaker devices to a sound source, means for supplying the command signal to the plurality of speaker devices;

speaker-to-speaker calculating means for analyzing the audio signal when the audio signal is received from each of the speaker devices subsequent to the transmission of the command signal, and for calculating a speaker-to-speaker distance and a speaker-to-speaker angle between the speaker device that has transmitted the audio signal and the speaker device that has generated the second trigger signal, speaker layout configuration calculating means for calculating a speaker layout configuration of the plurality of speaker devices based on a calculation result of the distance difference calculating means and the speaker-to-speaker distance and speaker-to-speaker angle, and storage means for storing speaker layout information calculated by the speaker layout configuration calculating means.

34. The audio system according to claim 33, wherein the server apparatus further comprises:

listener forward direction detecting means for detecting a forward direction of a listener; and means for generating a speaker signal to be supplied to each of the speaker devices based on the speaker layout configuration information of the plurality of speaker devices and information of the forward direction of the listener.

35. The audio system according to claim 34, wherein the listener forward direction detecting means comprises a detector that causes one of the speaker devices to emit a predetermined sound and receives information of a deviation between a direction in which the sound is heard at the location of the listener and a forward direction of the listener.

36. The audio system according to claim 34, wherein the listener forward direction detecting means comprises a detector for detecting a forward direction of the listener based on a combination of two mutually adjacent speaker devices and a synthesis ratio of a direction adjusting signal input by the listener, wherein the server apparatus causes each of the two mutually adjacent speaker devices to emit a predetermined sound in response to the synthesis ratio.

37. The audio system according to claim 34, wherein the listener forward direction detecting means comprises a detector that detects a forward direction of the listener by analyzing audio signals recorded in response to the time of reception of the first trigger signal as a start point and transmitted from the plurality of speaker devices.

38. The audio system according to claim 33, wherein the server apparatus and the plurality of speaker devices are connected to each other via a common transmission line;

wherein the sever apparatus supplies the plurality of speaker devices with the command signal via the common transmission line; and wherein each of the speaker devices transmits the audio signal to the server apparatus via the common transmission line.

39. The audio system according to claim 38, wherein the server apparatus supplies an enquiry signal to the plurality of speaker devices via the common transmission line, and notifies any speaker device of an identifier of the speaker device that has transmitted a reply signal in response to the enquiry signal, thereby assigning the identifier to each of the plurality of speaker devices and recognizing a number of the speaker devices.

40. The audio system according to claim 39, wherein one of the speaker devices that have received the enquiry signal from the server apparatus transmits the reply signal to the server apparatus and the other speaker devices via the common transmission line; and wherein the other speaker devices that have received the reply signal are inhibited from transmitting the reply signal to the server apparatus.

41. The audio system according to claim 39, wherein one of the speaker devices that have received the enquiry signal from the server apparatus emits a predetermined sound, and transmits the reply signal to the server apparatus via the common transmission line; and wherein the other speaker devices that have received the predetermined sound from the speaker device are inhibited from transmitting the reply signal to the server apparatus.

42. The audio system according to claim 38, wherein the server apparatus supplies the plurality of speaker devices respectively with a plurality of speaker signals for the plurality of speaker devices via the common transmission line; and wherein each of the plurality of speaker devices extracts one speaker signal for itself from among the plurality of speaker signals transmitted via the common transmission line and emits a sound of the extracted speaker signal.

43. The audio system according to claim 42, wherein each of the plurality of speaker signals transmitted from the server apparatus via the common transmission line contains a synchronization signal thereof; and wherein each of the plurality of speaker devices emits a sound in response to the speaker signal thereof at a timing determined by the synchronization signal.

44. The audio system according to claim 33, wherein an audio signal corresponding to a sound to be emitted by the speaker device is generated using a signal that can also be generated by each of the plurality of speaker devices.

45. The audio system according to claim 33, wherein each of the plurality of speaker devices comprises two pickup units, and transmits, to the server apparatus, an audio signal of sound captured by the two pickup units;

wherein the server apparatus comprises means for calculating an incident direction of the sound produced at a location of the listener to the speaker device based on the sound captured by the two pickup units; and wherein the speaker layout configuration calculating means calculates the speaker layout configuration of the plurality of speaker devices based on the sound incident direction.

46. The audio system according to claim 45, wherein each of the two pickup units of each of the speaker device is omnidirectional; and wherein each of the speaker devices transmits, to the server apparatus, a sum signal and a difference signal of the audio signal captured by the two pickup units for use in calculation of the incident direction of the sound to each of the speaker devices.

47. The audio system according to claim 46, wherein each of the two pickup units of each of the speaker device is omnidirectional; and wherein the server apparatus generates a sum signal and a difference signal of the audio signals from the two pickup units and calculates the incident direction of the sound to each of the speaker devices from the sum signal and the difference signal.

48. The audio system according to claim 33, further comprising:

at least one separate pickup unit arranged at a predetermined location, separate from the plurality of pickup units provided in each of the plurality of speaker devices; and means for transmitting, to the server apparatus, an audio signal of sound captured by the separate pickup unit in response to a time of reception of one of the first trigger signal and the second trigger signal as a start point;

wherein the server apparatus calculates the layout configuration of the plurality of speaker devices based on the audio signal of the sound captured by the separate pickup unit.

49. An audio system comprising a plurality of speaker devices and a system controller connected to the plurality of speaker devices, an input audio signal being supplied to each of the plurality of speaker devices via a common transmission line, and each of the plurality of speaker devices generating a speaker signal to emit a sound therefrom in response to the input audio signal, wherein each of the plurality of speaker devices comprises:

a pickup unit for capturing a sound, means for transmitting a first trigger signal from one of the speaker devices to each of the other speaker devices and the system controller when a pickup unit of the one of the speaker devices detects a sound equal to or higher than a predetermined level without receiving the first trigger signal from the other speaker devices, means for transmitting a second trigger signal to each of the other speaker devices and the system controller and for emitting a predetermined sound when a predetermined period of time has elapsed without receiving the second trigger signal from the other speaker devices subsequent to the reception of a command signal from the system controller, and means for recording an audio signal of the sound captured by the pickup unit in response to a time of reception of one of the first trigger signal and the second trigger signal as a start point and for transmitting the audio signal to the system controller when the one of the first trigger signal and the second trigger signal from the other speaker devices is received; and wherein the system controller comprises:

distance difference calculating means for analyzing the audio signal when the audio signal is received from each of the speaker devices without transmitting the command signal, and for calculating a distance difference between a distance of a source of the sound captured by the pickup unit to the speaker device that has generated the first trigger signal and the distance of each of the speaker devices to a sound source, means for supplying the command signal to the plurality of speaker devices;

speaker-to-speaker distance and angle calculating means for analyzing the audio signal when the audio signal is received from each of the speaker devices subsequent to the transmission of the command signal and for calculating a speaker-to-speaker distance and speaker-to-speaker angle between the speaker device that has transmitted the audio signal and the speaker device that has generated the second trigger signal, speaker layout configuration calculating means for calculating a speaker layout configuration of the plurality of speaker devices based on a calculation result of the distance difference calculating means and the speaker-to-speaker distance and speaker to speaker angle, and a storage means for storing information of the speaker layout configuration calculated by the speaker layout configuration calculating means.

50. The audio system according to claim 49, wherein each of the plurality of speaker devices comprises two pickup units, and transmits, to the system controller, an audio signal of the sound captured by the two pickup units;

wherein the system controller comprises:

means for calculating an incident direction of sound produced at a location of the listener to the speaker device based on the sound captured by the two pickup units, and means for calculating an incident direction of sound emitted from the speaker device to each of the speaker devices based on the sound captured by the two pickup units; and wherein the speaker layout configuration calculating means calculates the speaker layout configuration of the plurality of speaker devices based on the incident direction of the sound produced at the location of the listener to the speaker device and the incident direction of the sound emitted from the speaker device to each of the speaker devices.

51. The audio system according to claim 50, wherein each of the two pickup units of each of the speaker device is omnidirectional; and wherein each of the speaker devices transmits, to the system controller, a sum signal and a difference signal of the audio signal captured by the two pickup units for use in calculation of the incident direction of the sound to the speaker devices.

52. The audio system according to claim 50, wherein each of the two pickup units of each of the speaker device is omnidirectional; and wherein the system controller generates a sum signal and a difference signal of the audio signal from the two pickup units and calculates the incident direction of the sound to each speaker device from the sum signal and the difference signal.

53. The audio system according to claim 49, further comprising:

at least one separate pickup unit arranged at a predetermined location, separate from the plurality of pickup units provided in each of the plurality of speaker devices; and means for transmitting, to the system controller, an audio signal of sound captured by the separate pickup unit in response to a time of reception of one of the first trigger signal and the second trigger signal as a start point, wherein the system controller calculates the speaker layout configuration of the plurality of speaker devices based on the audio signal of the sound captured by the separate pickup unit.

54. An audio system comprising a plurality of speaker devices, an input audio signal being supplied to each of the plurality of speaker devices via a common transmission line, and each of the plurality of speaker devices generating a speaker signal to emit a sound therefrom in response to the input audio signal, wherein each of the plurality of speaker devices comprises:

a pickup unit for capturing a sound;

first transmitting means for transmitting a first trigger signal from one of the speaker devices to each of the other speaker devices when a pickup unit of the one of the speaker devices detects a sound equal to or higher than a predetermined level without receiving the first trigger signal from the other speaker devices via the common transmission line;

sound emission means for transmitting a second trigger signal to each of the other speaker devices and for emitting a predetermined sound when a predetermined period of time has elapsed without receiving the second trigger signal from the other speaker devices via the common transmission line;

distance difference calculating means for recording an audio signal of the sound, captured by the pickup unit, in response to a time of reception of the first trigger signal as a start point, for analyzing the audio signal, and for calculating a distance difference between a distance of a source of the sound captured by the pickup unit to the speaker device that emitted the first trigger signal and a distance of the speaker device to the sound source when the first trigger signal from the other speaker devices is received;

second transmitting means for transmitting information of the distance difference calculated by the distance difference calculating means to other speaker devices via the common transmission line;

speaker-to-speaker distance and angle calculating means for recording the audio signal of the sound, captured by the pickup unit, in response to a time of reception of the second trigger signal as a start point, analyzing the audio signal, and calculating a distance and an angle between the speaker device and the speaker device that has generated the second trigger signal when the second trigger signal is received from the other speaker devices;

third transmitting means for transmitting information of the speaker-to-speaker distance calculated by the speaker-to-speaker distance calculating means to other speaker devices via the common transmission line;

receiving means for receiving the information of the distance difference and the information of the speaker-to-speaker distance from the other speaker devices via the common transmission line; and speaker layout configuration calculating means for calculating a layout configuration of the plurality of speaker devices from the information of the distance difference and speaker-to-speaker distance and angle received by the receiving means.

55. The audio system according to claim 54, wherein each of the plurality of speaker devices further comprises:

means for adjusting a predetermined audio signal and then emitting a sound;

means for controlling adjusting the predetermined audio signal in response to a sound produced by a listener and captured by the pickup unit or the predetermined audio signal that is received, via the common transmission line, from another speaker device that has captured the sound produced by the listener with the pickup units thereof; and means for detecting a forward direction of the listener based on an adjustment state of the predetermined audio signal.

56. The audio system according to claim 55, wherein each of the plurality of speaker devices further comprises means for generating a speaker signal to be supplied to each of the plurality of speaker devices based on layout configuration information of the plurality of speaker devices and information of the forward direction of the listener.

57. The audio system according to claim 54, wherein each of the plurality of speaker devices further comprises:

means for capturing a voice produced by a listener with the pickup unit, for analyzing an audio signal of the voice, and for transmitting an analysis result to the other speaker devices; and means for detecting a forward direction of the listener from the analysis result by the speaker device and the analysis result received from the other speaker devices.

58. The audio system according to claim 54, wherein each of the plurality of speaker devices further comprises:

decision means for deciding whether to emit first a predetermined sound for speaker identifier assignment based on a determination of whether a predetermined period of time has elapsed without receiving a sound emission start signal from the other speaker devices subsequent to clearance of a speaker list;

first storage means for storing an identifier in the speaker list after assigning the identifier to the speaker device if the decision means decides to emit first the predetermined sound for speaker identifier assignment;

means for transmitting the sound emission start signal accompanied by the first identifier to other speaker devices via the common transmission line and for emitting the predetermined sound after a first identifier is stored in the speaker list by the first storage means;

second storage means for receiving an identifier of each speaker device via the common transmission line from the other speaker devices and storing the identifiers in the speaker list after emission of the predetermined sound;

sound emission detecting means for capturing and detecting, with the pickup unit, sound emitted by the other speaker devices if the decision means decides not to emit first the predetermined sound for speaker identifier assignment;

third storage means for storing, in the speaker list, the first identifier contained in the sound emission start signal transmitted from another speaker device via the common transmission line when the sound emission detecting means detects the emission of the sound;

availability determination means for determining whether the common transmission line is available for use after the first storage means stores the first identifier in the speaker list;

means for setting an identifier, found to be unduplicated in the speaker list, as a set identifier of the speaker device and transmitting the set identifier to the other speaker devices if the availability determination means determines that the common transmission line is available for use; and means for receiving and storing, in the speaker list, an identifier of the other speaker device transmitted from the other speaker device if the availability determination means determines that the common transmission line is not available for use.

59. The audio system according to claim 54, wherein each of the plurality of speaker devices further comprises:

first determining means for determining whether a sound emission start signal of the predetermined sound has been received from another speaker device;

second determining means for determining whether an identifier of the speaker device is stored in a speaker list if the first determining means determines that the sound emission start signal of the predetermined sound has not been received from the other speaker device;

first storage means for setting an identifier, found to be unduplicated in the speaker list, as an identifier of the speaker device and storing the identifier in the speaker list if the second determining means determines that the identifier of the speaker device is not stored in the speaker list;

means for transmitting the sound emission start signal of the predetermined sound to other speaker devices via the common transmission line and for emitting the predetermined sound after the first storage means stores the identifier of the speaker device in the speaker list; and second storage means for receiving a signal from the other speaker device and storing a received identifier contained in the received signal in the speaker list if the first determining means determines that the sound emission start signal of the predetermined sound has been received from the other speaker device or if the second determining means determines that the identifier of the speaker device is stored in the speaker list.

60. The audio system according to claim 54, wherein each of the plurality of speaker devices comprises two pickup units;

wherein the distance difference calculating means calculates an incident direction of the sound to the speaker device from the sound source based on a distance difference of each of the plurality of speaker devices to the sound source, and an audio signal captured by the two pickup units;

wherein the second transmitting means transmits, to other speaker devices, information of the distance difference and the incident direction of the sound to the speaker device;

wherein the speaker-to-speaker distance calculating means calculates an incident direction of the sound from the speaker device that has emitted the second trigger signal, based on the speaker-to-speaker distance and the audio signal of the sound captured by the two pickup units;

wherein the third transmitting means transmits, to other speaker devices, information of the speaker-to-speaker distance calculated by the speaker-to-speaker distance calculating means and the incident direction of the sound from the speaker device that has emitted the second trigger signal; and wherein the speaker layout configuration calculating means calculates the layout configuration of the plurality of speaker devices based on the information of the distance difference and the information of the speaker-to-speaker distance, received by the receiving means, and the incident direction of the sound.

61. The audio system according to claim 60, wherein each of the two pickup units of each of the speaker device is omnidirectional; and wherein each of the plurality of speaker devices generates a sum signal and a difference signal of the audio signal from the two pickup units and calculates the incident direction of the sound to the speaker device from the sum signal and the difference signal.

62. The audio system according to claim 54, further comprising:

at least one separate pickup unit arranged at a predetermined location, separate from the plurality of pickup units provided in each of the plurality of speaker devices; and means for transmitting, to the plurality of speaker devices, an audio signal of sound captured by the separate pickup unit in response to a time of reception of the first trigger signal as a start point;

means for transmitting, to the speaker devices other than the speaker device that has emitted the sound, the audio signal of the sound emitted by the speaker device and captured by the separate pickup unit in response to a time of reception of the second trigger signal as a start point; and wherein each of the plurality of speaker devices calculates the layout configuration of the plurality of speaker devices based on the audio signal of the sound captured by the separate pickup unit.

63. A server apparatus generating a speaker signal from an input audio signal and supplying the speaker signal to each of a plurality of speaker devices in accordance with locations of the plurality of speaker devices, the server apparatus comprising:

first receiving means for receiving a first trigger signal from a speaker device closest to a location of a listener;

distance difference calculating means for analyzing a received audio signal when the audio signal is received from the plurality of speaker devices without transmitting a command signal, and for calculating a distance difference between a distance of a source of the sound at the location of the listener to a speaker device that has generated the first trigger signal and a distance of each of the speaker devices to the sound source;

means for supplying the plurality of speaker devices with the command signal;

second receiving means for receiving a second trigger signal transmitted from one of the plurality of speaker devices having received the command signal;

speaker-to-speaker distance and angle calculating means for analyzing an audio signal that is received from each of the speaker devices subsequent to transmission of the command signal, and calculating a distance and an angle between the speaker device that has transmitted the audio signal and the speaker device that has generated the second trigger signal;

speaker layout configuration calculating means for calculating a layout configuration of the plurality of speaker devices based on a calculation result of the distance difference calculating means and a calculation result of the speaker-to-speaker distance and angle calculating means; and a storage means for storing information of the layout configuration of the plurality of speaker devices calculated by the speaker layout configuration information calculating means.

64. The server apparatus according to claim 63, further comprising:

listener forward direction calculating means for detecting a forward direction of the listener; and means for generating a speaker signal to be supplied to the speaker devices based on information of the speaker layout configuration of the plurality of speaker devices and information of the forward direction of the listener.

65. The server apparatus according to claim 64, wherein the listener forward direction detecting means comprises a detector that causes one of the speaker devices to emit a predetermined sound and receives information of a deviation between a direction in which the sound is heard at the location of the listener and the forward direction of the listener.

66. The server apparatus according to claim 64, wherein the forward direction detecting means comprises a detector for detecting the forward direction of the listener based on a combination of two mutually adjacent speaker devices and a synthesis ratio of a direction adjusting signal input by the listener, wherein the server apparatus causes each of the two mutually adjacent speaker devices to emit a predetermined sound in response to the synthesis ratio.

67. The server apparatus according to claim 64, wherein the listener forward direction detecting means comprises a detector that detects the forward direction of the listener by analyzing audio signals recorded in response to a time of reception of the first trigger signal as a start point and transmitted from the plurality of speaker devices.

68. The server apparatus according to claim 63, wherein the server apparatus is connected to the plurality of speaker devices via a common transmission line;

wherein the sever apparatus supplies the plurality of speaker devices with the command signal via the common transmission line; and wherein each of the speaker devices transmits the audio signal to the server apparatus via the common transmission line.

69. The server apparatus according to claim 68, wherein the server apparatus supplies an enquiry signal to the plurality of speaker devices via the common transmission line, and notifies any speaker device of an identifier of the speaker device that has transmitted a reply signal in response to the enquiry signal, thereby assigning the identifier to each of the plurality of speaker devices and recognizing a number of the speaker devices.

70. The server apparatus according to claim 63, receiving an audio signal of sound captured by two pickup units of a speaker device, and further comprising:

means for calculating an incident direction of sound produced at the location of the listener to the speaker device based on the sound captured by the two pickup units; and means for calculating an incident direction of sound emitted from the speaker device to each of the speaker devices based on the sound captured by the two pickup units; and wherein the speaker layout configuration calculating means calculates the speaker layout configuration of the plurality of speaker devices based on the incident direction of the sound produced at the location of the listener to the speaker device and the incident direction of the sound emitted from the speaker device to each of the speaker devices.

71. The server apparatus according to claim 70, wherein each of the two pickup units of each of the speaker device is omnidirectional; and wherein a sum signal and a difference signal of audio signals captured by the two pickup units are generated for use in calculation of an incident direction of the sound to each of the speaker devices.

72. A speaker device in an audio system including a plurality of speaker devices and a server apparatus, the server apparatus generating, from an audio input signal, a speaker signal to be supplied to each of the speaker devices, and each speaker device emitting a sound in response to the speaker signal, the speaker device comprising:

a pickup unit for capturing a sound;

means for transmitting a first trigger signal from one of the speaker devices to each of the other speaker devices and the server apparatus when a pickup unit of the one of the speaker devices detects a sound equal to or higher than a predetermined level without receiving the first trigger signal from the other speaker devices;

means for transmitting a second trigger signal to each of the other speaker devices and the server apparatus and for emitting a predetermined sound when a predetermined period of time has elapsed without receiving the second trigger signal from the other speaker devices subsequent to the reception of a command signal from the server apparatus; and means for recording an audio signal of sound captured by the pickup unit in response to a time of reception of one of the first trigger signal and the second trigger signal as a start point and transmitting the audio signal to the server apparatus when the one of the first trigger signal and the second trigger signal is received from the other speaker devices.

73. The speaker device according to claim 72, wherein the speaker device and the other speaker devices are connected to the server apparatus via a common transmission line; and wherein each of the plurality of speaker devices extracts one speaker signal for the speaker device from among a plurality of speaker signals transmitted from the server apparatus via the common transmission line and emits a sound of the extracted speaker signal.

74. The speaker device according to claim 72, wherein an audio signal corresponding to a sound to be emitted by the speaker device is generated using a signal that can also be generated by each of the plurality of speaker devices.

75. The speaker device according to claim 72, wherein each of the plurality of speaker devices extracts one speaker signal for the speaker device from among a plurality of speaker signals transmitted from the server apparatus via the common transmission line and emits a sound of the extracted speaker signal.

76. The speaker device according to claim 75, wherein each of the plurality of speaker signals transmitted from the server apparatus via the common transmission line contains a synchronization signal thereof; and wherein each of the plurality of speaker devices emits a sound of the speaker signal thereof at a timing determined by the synchronization signal.

77. The speaker device according to claim 72, further comprising two pickup units, and transmitting, to the server apparatus, audio signals of sounds captured by the two pickup units.

78. The speaker device according to claim 77, wherein each of the two pickup units of each of the speaker device is omnidirectional; and wherein each of the speaker devices transmits, to the server apparatus, a sum signal and a difference signal of the audio signals captured by the two pickup units for use in calculation of an incident direction of the sound.

79. A speaker device in an audio system including a plurality of speaker devices and a system controller, the speaker device being supplied with an input audio signal via a common transmission line common to the other speaker devices, and generating a speaker signal from the input audio signal to emit a sound therefrom, the speaker device comprising:

a pickup unit for capturing a sound;

means for transmitting a first trigger signal from one of the speaker devices to the other speaker devices and the system controller when a pickup unit of the one of the speaker devices detects a sound equal to or higher than a predetermined level without receiving the first trigger signal from the other speaker devices;

means for transmitting a second trigger signal to the other speaker devices and the system controller and for emitting a predetermined sound when a predetermined period of time has elapsed without receiving the second trigger signal from the other speaker devices subsequent to reception of a command signal from the system controller; and means for recording an audio signal of a sound, captured by the pickup unit, in response to a time of reception of one of the first trigger signal and the second trigger signal as a start point and for transmitting the audio signal to the system controller when the one of the first trigger signal and the second trigger signal is received from the other speaker device.

80. The speaker device according to claim 79, further comprising two pickup units, and means for transmitting, to the system controller, an audio signal of sound captured by the two pickup units.

81. The speaker device according to claim 80, wherein each of the two pickup units of each of the speaker device is omnidirectional; and wherein the speaker device transmits, to the system controller, a sum signal and a difference signal of audio signals, captured by the two pickup units, for use in calculation of a sound incident direction of the speaker device.

82. A speaker device in an audio system including a plurality of speaker devices, the speaker device being supplied with an input audio signal via a common transmission line common to the other speaker devices, and generating a speaker signal from the input audio signal to emit a sound therefrom, the speaker device comprising:

a pickup unit for capturing a sound;

first transmitting means for transmitting a first trigger signal from one of the speaker devices to the other speaker devices when a pickup unit of the one of the speaker devices detects a sound equal to or higher than a predetermined level without receiving the first trigger signal from the other speaker devices via the common transmission line;

sound emission means for transmitting a second trigger signal to each of the other speaker devices and for emitting a predetermined sound when a predetermined period of time has elapsed without receiving the second trigger signal from the other speaker devices via the common transmission line;

distance difference calculating means for recording an audio signal of a sound, captured by the pickup unit, in response to a time of reception of the first trigger signal as a start point, analyzing the audio signal, and calculating a distance difference between a distance of a source of the sound captured by the pickup unit to the speaker device that has emitted the first trigger signal and a distance of the speaker device to the sound source when the first trigger signal is received from the other speaker device;

second transmitting means for transmitting information of the distance difference calculated by the distance difference calculating means to other speaker devices via the common transmission line;

speaker-to-speaker distance and angle calculating means for recording the audio signal of the sound, captured by the pickup unit, in response to a time of reception of the second trigger signal as a start point, analyzing the audio signal, and calculating a distance and angle between the speaker device and another speaker device that has generated the second trigger signal when the second trigger signal is received from the other speaker device;

third transmitting means for transmitting information of the distance calculated by the speaker-to-speaker distance calculating means to other speaker devices via the common transmission line;

receiving means for receiving the information of the distance difference and the information of the speaker-to-speaker distance from the other speaker device via the common transmission line; and speaker layout configuration calculating means for calculating a layout configuration of the plurality of speaker devices from the information of the distance difference and speaker-to-speaker distance and angle received by the receiving means.

83. The speaker device according to claim 82, further comprising:

means for adjusting a predetermined audio signal and then emitting a sound;

means for controlling adjusting the predetermined audio signal in response to a sound produced by a listener and captured by the pickup unit or the predetermined audio signal that is received, via the common transmission line, from another speaker device that has captured the sound produced by the listener with the pickup units thereof; and means for detecting a forward direction of the listener based on an adjustment state of the predetermined audio signal.

84. The speaker device according to claim 83, further comprising means for generating a speaker signal to be supplied to each of the plurality of speaker devices based on the layout configuration information of the plurality of speaker devices and the information of the forward direction of the listener.

85. The speaker device according to claim 82, further comprising:

means for capturing a voice produced by a listener with the pickup unit, analyzing an audio signal of the voice, and transmitting an analysis result to the other speaker devices; and means for detecting a forward direction of the listener from the analysis result by the speaker device and at least one analysis result received from an other speaker devices.

86. The speaker device according to claim 82, further comprising:

decision means for deciding whether to emit a predetermined sound for speaker identifier assignment based on a determination of whether a predetermined period of time has elapsed without receiving a sound emission start signal from the other speaker devices subsequent to clearance of a speaker list;

first storage means for storing an identifier in the speaker list after assigning the identifier to the speaker device if the decision means decides to emit first the predetermined sound for speaker identifier assignment;

means for transmitting the sound emission start signal accompanied by the identifier to all other speaker devices via the common transmission line and for emitting the predetermined sound after the identifier is stored in the speaker list by the first storage means;

second storage means for receiving identifiers of each speaker device via the common transmission line from other speaker devices and storing the identifiers in the speaker list after the emission of the predetermined sound;

sound emission detecting means for capturing and detecting, with the pickup unit, sound emitted by the other speaker device if the decision means decides not to emit first the predetermined sound for speaker identifier assignment;

third storage means for storing, in the speaker list, the identifier contained in the sound emission start signal transmitted from the other speaker device via the common transmission line when the sound emission detecting means detects emission of the sound;

availability determination means for determining whether the common transmission line is available for use after the first storage means stores the identifier in the speaker list;

means for setting an identifier, found to be unduplicated in the speaker list as a set identifier of the speaker device and for transmitting the set identifier to the other speaker devices if the availability determination means determines that the common transmission line is available for use; and means for receiving and storing, in the speaker list, an identifier of the other speaker device transmitted from the other speaker device if the availability determination means determines that the common transmission line is not available for use.

87. The speaker device according to claim 82, further comprising:

first determining means for determining whether a sound emission start signal of the predetermined sound has been received from another speaker device;

second determining means for determining whether an identifier of the speaker device is stored in a speaker list if the first determining means determines that the sound emission start signal of the predetermined sound has not been received from the other speaker device;

first storage means for setting an identifier, found to be unduplicated in the speaker list, as an identifier of the speaker device and storing the identifier in the speaker list if the second determining means determines that the identifier of the speaker device is not stored in the speaker list;

means for transmitting the sound emission start signal of the predetermined sound to the other speaker devices via the common transmission line and for emitting the predetermined sound after the first storage means stores the identifier of the speaker device in the speaker list; and second storage means for receiving a signal from the other speaker device and storing an identifier contained in the received signal in the speaker list if the first determining means determines that the sound emission start signal of the predetermined sound has been received from the other speaker device or if the second determining means determines that the identifier of the speaker device is stored in the speaker list.

88. The speaker device according to claim 82, further comprising two pickup units;

wherein the distance difference calculating means calculates an incident direction of the sound to the speaker device from the sound source based on a distance difference of the speaker devices to the sound source, and audio signals captured by the two pickup units;

wherein the second transmitting means transmits, to the other speaker devices, information of the distance difference and the incident direction of the sound to own speaker device;

wherein the speaker-to-speaker distance calculating means calculates an incident direction of sound from the speaker device that has emitted the second trigger signal, based on the speaker-to-speaker distance and the audio signal of the sound captured by the two pickup units;

wherein the third transmitting means transmits, to the other speaker devices, information of the speaker-to-speaker distance calculated by the speaker-to-speaker distance calculating means and an incident direction of the sound from the speaker device that has emitted the second trigger signal; and wherein the speaker layout configuration calculating means calculates the layout configuration of the plurality of speaker devices based on the information of the distance difference and the information of the speaker-to-speaker distance received by the receiving means, and the incident direction of the sound.

89. The speaker device according to claim 88, wherein each of the two pickup units is omnidirectional; and wherein a sum signal and a difference signal are generated from audio signals captured by the two pickup units and the incident direction of the sound to each speaker device is calculated from the sum signal and the difference signal.

* * * * *

UNITED STATES PATENT AND TRADEMARK OFFICE

CERTIFICATE OF CORRECTION

PATENT NO. : 7,676,044 B2
APPLICATION NO. : 11/009955
DATED : March 9, 2010
INVENTOR(S) : Toru Sasaki et al.

It is certified that error appears in the above-identified patent and that said Letters Patent is hereby corrected as shown below:

On the Title of the patent, Column 1, under (*) Notice, please remove the sentence "This patent is subject to a terminal disclaimer."

Signed and Sealed this

Twentieth Day of July, 2010

David J. Kappos

David J. Kappos
*Director of the United States Patent and Trademark Office*